US011932979B2

(12) United States Patent
Andrejczuk et al.

(10) Patent No.: US 11,932,979 B2
(45) Date of Patent: Mar. 19, 2024

(54) LAUNDRY TREATING APPLIANCE HAVING A REMOVABLE CLOTHES MOVER

(71) Applicant: WHIRLPOOL CORPORATION, Benton Harbor, MI (US)

(72) Inventors: Jonathan A. Andrejczuk, Stevensville, MI (US); Adam Gary, Marco Island, FL (US); Philip J. Czarnecki, Saugatuck, MI (US); Benjamin D. Lowell, Benton Harbor, MI (US); Sayer J. Murphy, St. Joseph, MI (US); James Jeffery, St. Joseph, MI (US); Eric W. Merrow, Benton Harbor, MI (US); Emmanuel F. Gonzaga, Rio Claro (BR); Thomas R. Scott, Hartford, MI (US); Donald E. Erickson, Stevensville, MI (US); Bradley D. Morrow, Stevensville, MI (US); Jason S. Burnette, St. Joseph, MI (US); Kevin Peralta, Chicago, IL (US); Corinne M. Gorenchan, Lawton, MI (US); Kenneth L. McConnell, Stevensville, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 649 days.

(21) Appl. No.: 17/010,422

(22) Filed: Sep. 2, 2020

(65) Prior Publication Data

US 2021/0062382 A1 Mar. 4, 2021

Related U.S. Application Data

(60) Provisional application No. 62/895,331, filed on Sep. 3, 2019.

(51) Int. Cl.

| | |
|---|---|
| ***D06F 13/02*** | (2006.01) |
| ***D06F 17/10*** | (2006.01) |
| ***D06F 37/20*** | (2006.01) |

(52) U.S. Cl.

CPC ..... *D06F 17/10* (2013.01); *D06F 37/20* (2013.01)

(58) Field of Classification Search

CPC ..... D06F 13/00; D06F 13/02; D06F 13/04; D06F 13/06; D06F 13/08; D06F 21/06;

(Continued)

(56) References Cited

U.S. PATENT DOCUMENTS

| | | | |
|---|---|---|---|
| 2,976,711 | A | 3/1961 | Smith |
| 4,118,957 | A | 10/1978 | Marcussen |

(Continued)

FOREIGN PATENT DOCUMENTS

| | | | |
|---|---|---|---|
| BR | 102020018076 | A2 | 3/2021 |
| CN | 101191288 | A | 6/2008 |

(Continued)

*Primary Examiner* — David G Cormier

(74) *Attorney, Agent, or Firm* — Brooks Kushman P.C.

(57) ABSTRACT

A laundry treating appliance for treating laundry items according to an automatic cycle of operation can include a cabinet defining an interior and having an access opening providing access to the interior. A tub can be located within the interior and can at least partially define a liquid chamber. A drum is rotatably mounted within the liquid chamber and at least partially defines a treating chamber. A clothes mover is located within the treating chamber and rotatable about a vertical axis. The clothes mover can include a base and a barrel.

13 Claims, 100 Drawing Sheets

(58) Field of Classification Search
CPC ..... D06F 21/08; D06F 23/04; D06F 37/12; D06F 37/14; D06F 37/145; D06F 37/40; D06F 39/024
See application file for complete search history.

(56) References Cited

U.S. PATENT DOCUMENTS

| | | | |
|---|---|---|---|
| D267,672 | S | 1/1983 | Ohmann et al. |
| D268,707 | S | 4/1983 | Ohmann et al. |
| D300,969 | S | 5/1989 | Bergeson |
| D314,263 | S | 1/1991 | Mueller |
| D326,937 | S | 6/1992 | Miyahara |
| 5,235,994 | A | 8/1993 | Comin et al. |
| D357,561 | S | 4/1995 | Kropf et al. |
| 5,500,967 | A | 3/1996 | Wilson et al. |
| D375,390 | S | 11/1996 | Pinkowski |
| D381,140 | S | 7/1997 | Pinkowski et al. |
| D423,740 | S | 4/2000 | Euler et al. |
| D424,874 | S | 5/2000 | Anton et al. |
| D426,108 | S | 6/2000 | Anton et al. |
| D474,567 | S | 5/2003 | Clark et al. |
| D474,568 | S | 5/2003 | Clark et al. |
| D477,697 | S | 7/2003 | Bullock et al. |
| D485,654 | S | 1/2004 | Clark et al. |
| 7,069,752 | B2 | 7/2006 | Clark et al. |
| D687,202 | S | 7/2013 | Motsenbocker |
| D749,137 | S | 2/2016 | Vlosich, III et al. |
| D762,028 | S | 7/2016 | Rodrigues et al. |
| D764,730 | S | 8/2016 | Chaklos |
| 10,731,284 | B2 | 8/2020 | Alexander et al. |
| 10,787,761 | B2 | 9/2020 | Czarnecki et al. |
| D933,916 | S | 10/2021 | Bae et al. |
| D933,917 | S | 10/2021 | Bae et al. |
| D933,918 | S | 10/2021 | Kim et al. |
| D933,919 | S | 10/2021 | Kim et al. |
| D942,701 | S | 2/2022 | Geissler et al. |
| D957,077 | S | 7/2022 | Bae et al. |
| D957,078 | S | 7/2022 | Bae et al. |
| D967,576 | S | 10/2022 | Kim et al. |
| D968,734 | S | 11/2022 | Kim et al. |
| 2012/0085133 | A1 | 4/2012 | Slutsky et al. |
| 2018/0155864 | A1 | 6/2018 | Alexander et al. |
| 2019/0017208 | A1 | 1/2019 | Marangoni et al. |
| 2019/0062978 | A1* | 2/2019 | Czarnecki ..... D06F 17/10 |
| 2022/0243379 | A1 | 8/2022 | Adkins et al. |

FOREIGN PATENT DOCUMENTS

| | | | |
|---|---|---|---|
| CN | 101600832 | A | 12/2009 |
| CN | 203530690 | U | 4/2014 |
| CN | 203729101 | U | 7/2014 |
| CN | 112442822 | A | 3/2021 |
| KR | 19980031291 | U | 8/1998 |
| KR | 100556483 | B | 3/2006 |
| WO | 2015048870 | A1 | 4/2015 |

* cited by examiner

LAUNDRY TREATING APPLIANCE HAVING A REMOVABLE CLOTHES MOVER

CROSS-REFERENCE TO RELATED APPLICATIONS

This application claims the benefit of U.S. provisional application Ser. No. 62/895,331 filed Sep. 3, 2019, the disclosure of which is hereby incorporated in its entirety by reference herein.

BACKGROUND

Laundry treating appliances, such as clothes washers, clothes dryers, washing machines, refreshers, and non-aqueous systems, can have a configuration based on a container, such as a laundry basket or drum that defines a drum opening, which may or may not rotate, and that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, or detergents, can be supplied to the treating chamber in accordance with the cycle of operation.

Laundry treating appliances typically operate to treat laundry items by placing the laundry items in contact with treating fluid such as a detergent/water mixture, sometimes referred to as wash liquor, and providing relative motion between the laundry items and the fluid. The controller can further control a motor to rotate the laundry basket or drum according to one of the pre-programmed cycles of operation. The controller can also control a clothes mover provided within the laundry basket or drum and configured to impart mechanical energy to laundry items within the treating chamber according to a selected cycle of operation. The clothes mover can include multiple components, such as a base, which can be provided as an impeller plate, and a barrel, which can be provided as an agitator post, and which can couple to the base.

BRIEF SUMMARY

In one aspect, the present disclosure relates to a laundry treating appliance for treating laundry items according to an automatic cycle of operation, the laundry treating appliance comprising a cabinet defining an interior and having an access opening providing access to the interior, a tub located within the interior and at least partially defining a liquid chamber, a drum rotatably mounted within the liquid chamber and at least partially defining a treating chamber, and a clothes mover located within the treating chamber and rotatable about a vertical axis, the clothes mover comprising an agitator having a base and a barrel configured to selectively couple with the base.

DETAILED DESCRIPTION

Figure 1:
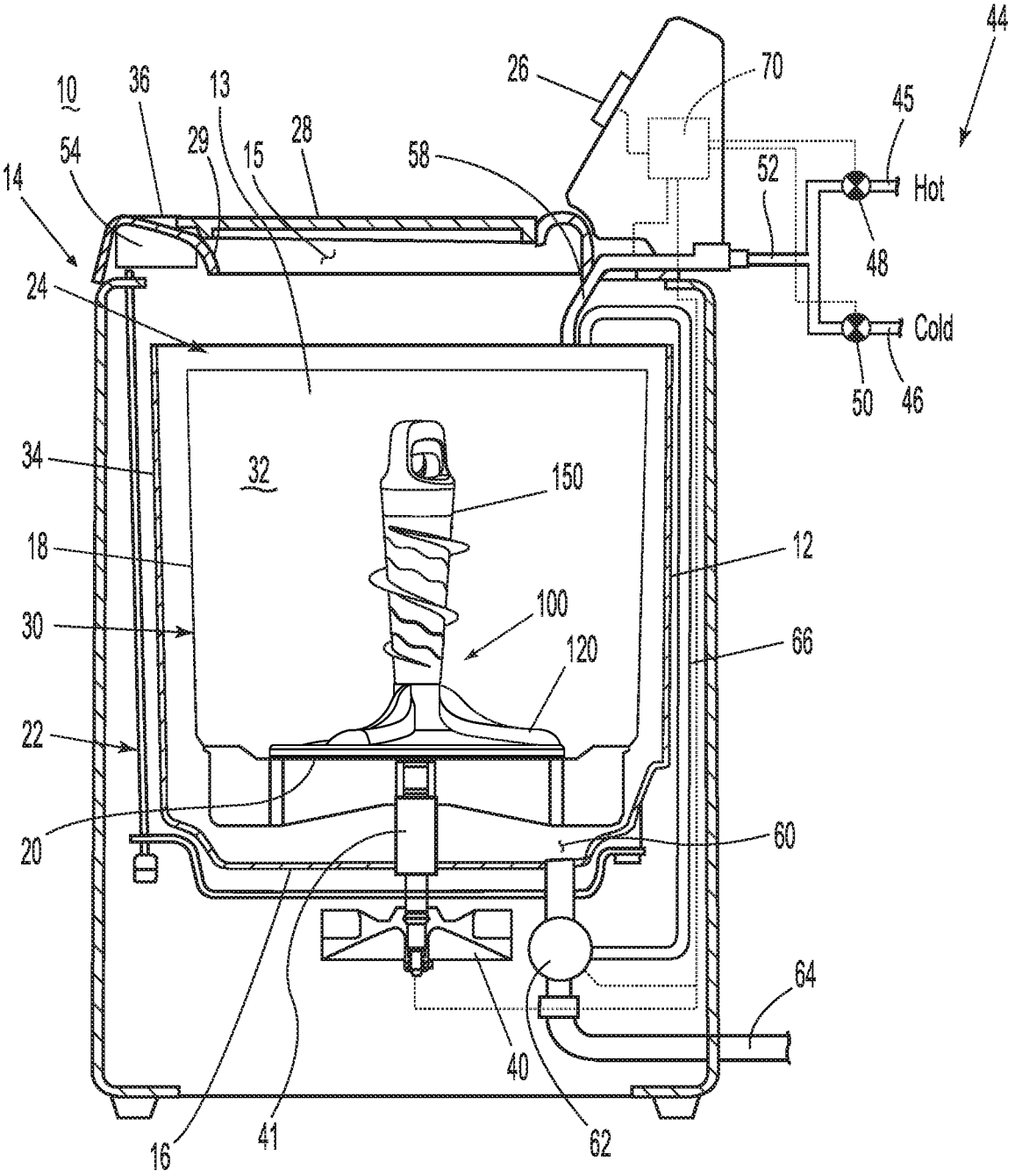
FIG. 1 is a schematic cross-sectional view of a laundry treating appliance including a clothes mover including an agitator coupled to an impeller.

FIG. 1 illustrates a schematic view of a laundry treating appliance 10 according to aspects of the present disclosure. The laundry treating appliance 10 can be any laundry treating appliance 10 that performs a cycle of operation to clean or otherwise treat laundry items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance 10 is illustrated herein as a vertical axis, top-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 can include a structural support assembly comprising a cabinet 14, which defines a housing and an interior, within which a laundry holding assembly resides. The cabinet 14 can be a housing having a chassis and/or a frame, to which decorative panels can or cannot be mounted, defining an interior, enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure.

The laundry holding assembly of the illustrated exemplary laundry treating appliance 10 can include a rotatable basket 30 having an open top 13 that can be disposed within the interior of the cabinet 14 and can at least partially define a rotatable treating chamber 32 for receiving laundry items for treatment and an access opening 15. The access opening 15 can provide access to the treating chamber 32. The treating chamber 32 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, and a jacket.

The open top 13 can be aligned with the access opening 15. A tub 34 can also be positioned within the cabinet 14 and can define an interior 24 within which the basket 30 can be positioned. The tub 34 can also at least partially define at least a portion of the treating chamber 32. The tub 34 can have a generally cylindrical side or tub peripheral wall 12 closed at its bottom end by a base 16 that can at least partially define a sump 60. The tub 34 can be at least partially aligned with the access opening 15 and the open top 13. In one example, the tub 34, the basket 30, along with the open top 13, and the access opening 15, can have central axes that are co-axial with one another, or with at least one of the other axes, such that a common central axis is formed.

The basket 30 can have a generally peripheral side wall 18, which is illustrated as a cylindrical side wall, closed at the basket end by a basket base 20 to further at least partially define the treating chamber 32. The basket 30 can be rotatably mounted within the tub 34 for rotation about a vertical basket axis of rotation and can include a plurality of perforations (not shown), such that liquid can flow between the tub 34 and the rotatable basket 30 through the perforations (not shown). While the illustrated laundry treating appliance 10 includes both the tub 34 and the basket 30, with the basket 30 at least partially defining the treating chamber 32, it is also within the scope of the present disclosure for the laundry holding assembly to include only one receptacle, such as the tub 34, without the basket 30, with the receptacle defining the laundry treating chamber 32 for receiving the load to be treated.

The cabinet 14 can further define a top wall or top panel 36, which can comprise a shroud 29 or to which the shroud 29 can be coupled. The shroud 29 can define at least a portion of the access opening 15, such that the shroud 29 can at least partially encircle the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34.

A selectively openable closure or cover, illustrated herein as comprising a lid 28, can be movably mounted to or coupled to the cabinet 14 for selective movement between an opened position and a closed position, as shown, to selectively open and close the access opening 15, respectively, and to selectively provide access into the laundry treating chamber 32 through the access opening 15 of the basket 30. In one example, the lid 28 can be rotatable between the closed position and the opened position relative to the cabinet 14. By way of non-limiting example, the lid 28 can be hingedly coupled to the cabinet 14 for movement between the opened position and the closed position. In the closed position, the lid 28 can seal against at least one of the access opening 15, the top panel 36, or the shroud 29 and can at least partially confront the treating chamber 32 when the lid 28 closes the access opening 15. In the opened position, the lid 28 can be spaced apart from the access opening 15, the top panel 36, or the shroud 29 and can allow access to the top panel 36 and the access opening 15.

A clothes mover 100 can be rotatably mounted within the basket 30 to impart mechanical agitation and energy to a load of laundry items placed in the basket 30 or the treating chamber 32 according to a cycle of operation. The clothes mover 100 can be oscillated or rotated about its vertical axis of rotation during a cycle of operation in order to produce load motion effective to wash the load contained within the treating chamber 32. The clothes mover 100 can comprise a base or a first clothes mover, illustrated herein as an impeller 120, and a barrel, illustrated herein as an agitator 150. The agitator 150 as illustrated herein can comprise a vertically oriented agitator post 150 that can be removably coupled with the impeller 120, the agitator 150 projecting vertically from the impeller 120 within the treating chamber 32 and toward the open top 13 of the basket 30. In this aspect of the disclosure, the clothes mover 100 can be formed by coupling an additional component, the agitator 150, to the impeller 120 and can be thought of as forming a second clothes mover.

Figure 11:
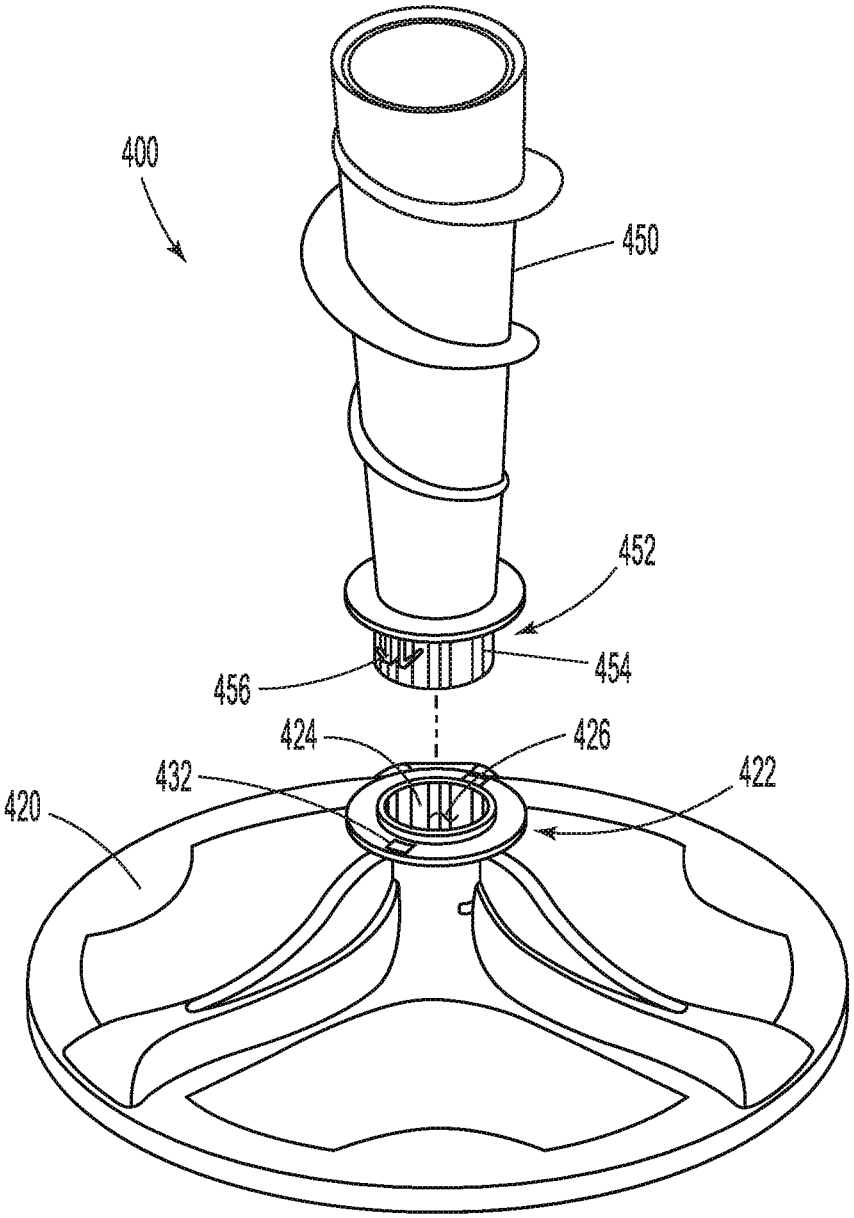
FIG. 11 is a perspective view of another example of an agitator coupling to an impeller for use with the clothes mover and laundry treating appliance of FIG. 1.

The agitator 150 can include any configuration of vanes, blades, or other structural features for imparting mechanical energy to laundry items during a cycle of operation. In one example, the agitator 150 can be in the form of an auger (FIG. 11). Generally, the vertical extent of the agitator 150, combined with vane, blade, or other structural features, can impart the mechanical action to laundry items, which provides improved cleaning performance and can be suitable for particularly soiled loads. Other exemplary types of clothes movers include, but are not limited to, an agitator alone, a wobble plate, and a hybrid impeller/agitator.

The basket 30 and the clothes mover 100 can be driven, such as to rotate within the tub 34, by a drive assembly 40 that includes a motor 41, which can include a gear case, operably coupled with the basket 30 and clothes mover 100. The motor 41 can be a brushless permanent magnet (BPM) motor having a stator (not shown) and a rotor (not shown). Alternately, the motor 41 can be coupled to the basket 30 through a belt and a drive shaft to rotate the basket 30, as is known in the art. Other motors, such as an induction motor or a permanent split capacitor (PSC) motor, can also be used. The motor 41 can rotate the basket 30 at various speeds in either rotational direction about the vertical axis of rotation during a cycle of operation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive assembly 40 and can selectively operably couple the motor 41 with either the basket 30 and/or the clothes mover 100.

A suspension assembly 22 can dynamically hold the tub 34 within the cabinet 14. The suspension assembly 22 can dissipate a determined degree of vibratory energy generated by the rotation of the basket 30 and/or the clothes mover 100 during a treating cycle of operation. Together, the tub 34, the basket 30, and any contents of the basket 30, such as liquid and laundry items, define a suspended mass for the suspension assembly 22.

The laundry treating appliance 10 can further include a liquid supply assembly to provide liquid, such as water or a combination of water and one or more wash aids, such as detergent, into the treating chamber 32 for use in treating laundry items during a cycle of operation. The liquid supply assembly can include a water supply 44 configured to supply hot or cold water. The water supply 44 can include a hot water inlet 45 and a cold water inlet 46. A valve assembly can include a hot water valve 48, a cold water valve 50, and various conduits 52, 58 for selectively distributing the water supply 44 from the hot water and cold water inlets 45, 46. The valves 48, 50 are selectively openable to provide water from a source of water, such as from a household water supply (not shown) to the conduit 52. A second water conduit, illustrated as the water inlet 58, can also be fluidly coupled with the conduit 52 such that water can be supplied directly to the treating chamber 32 through the open top of the basket 30. The water inlet 58 can be configured to dispense water, and optionally treating chemistry, into the tub 34 in a desired pattern and under a desired amount of pressure. For example, the water inlet 58 can be configured to dispense a flow or stream of treating chemistry or water into the tub 34 by gravity, i.e., a non-pressurized stream. The valves 48, 50 can be opened individually or together to provide a mix of hot and cold water at a selected temperature. While the valves 48, 50 and conduit 52 are illustrated exteriorly of the cabinet 14, it will be understood that these components can be internal to the cabinet 14.

A treating chemistry dispenser 54 can be provided for dispensing treating chemistry to the basket 30 for use in treating the laundry items according to a cycle of operation, either directly or mixed with water from the water supply 44. The treating chemistry dispenser 54 can be a single use dispenser, a bulk dispenser, or a combination of or an integrated single use and bulk dispenser, in non-limiting examples, and is fluidly coupled to the treating chamber 32. While the treating chemistry dispenser 54 is illustrated herein as being provided at the top panel 36 or the shroud 29, it will be understood that other locations for the treating chemistry dispenser 54 can be contemplated, such as at a different location within the cabinet 14. Further, the treating chemistry dispenser 54 can be provided in a drawer configuration or as at least one reservoir fluidly coupled to the treating chamber 32.

The treating chemistry dispenser 54 can include means for supplying or mixing detergent to or with water from the water supply 44. Alternatively, water from the water supply 44 can also be supplied to the tub 34 through the treating chemistry dispenser 54 without the addition of a detergent. The treating chemistry dispenser 54 can be configured to dispense the treating chemistry or water into the tub 34 in a desired pattern and under a desired amount of pressure. For example, the treating chemistry dispenser 54 can be configured to dispense a flow or stream of treating chemistry or water into the tub 34 by gravity, i.e., a non-pressurized stream.

The treating chemistry dispenser 54 can include multiple chambers or reservoirs fluidly coupled to the treating chamber 32 for receiving doses of different treating chemistries. The treating chemistry dispenser 54 can be implemented as a dispensing drawer that is slidably received within the cabinet 14, or within a separate dispenser housing which can be provided in the cabinet 14. The treating chemistry dispenser 54 can be moveable between a fill position, where the treating chemistry dispenser 54 is exterior to the cabinet 14 and can be filled with treating chemistry, and a dispense position, where the treating chemistry dispenser 54 is interior of the cabinet 14.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply assembly and treating chemistry dispenser 54 can differ from the configuration shown, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid.

A liquid recirculation and drain assembly can be provided with the laundry treating appliance 10 for recirculating liquid from within the laundry holding assembly and draining liquid from the laundry treating appliance 10. Liquid supplied to the tub 34 or into the treating chamber 32 through the water inlet 58 and/or the treating chemistry dispenser 54 typically enters a space between the tub 34 and the basket 30 and can flow by gravity to the sump 60. More specifically, the sump 60 can be located in and formed in part by the bottom of the tub 34 and the liquid recirculation assembly can be configured to recirculate treating liquid from the sump 60 onto the top of a laundry load located in the treating chamber 32.

A pump 62 can be housed below the tub 34 and can have an inlet fluidly coupled with the sump 60 and an outlet configured to fluidly couple and to direct liquid to either or both a household drain 64, which can drain the liquid from the laundry treating appliance 10, or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid from the recirculation conduit 66 into the open top of the basket 30. The recirculation conduit 66 can introduce the liquid into the basket 30 in any suitable manner, such as by spraying, dripping, or providing a steady flow of liquid. In this manner, liquid provided to the tub 34, with or without treating chemistry can be recirculated into the treating chamber 32 for treating the laundry within. The liquid recirculation and drain assembly can include other types of recirculation assemblies.

It is noted that the illustrated drive assembly, suspension assembly, liquid supply assembly, recirculation and drain assembly, and dispensing assembly are shown for exemplary purposes only and are not limited to the assemblies shown in the drawings and described above. For example, the liquid supply and recirculation and pump assemblies can differ from the configuration shown in FIG. 1, such as by inclusion of other valves, conduits, sensors (such as liquid level sensors and temperature sensors), and the like, to control the flow of liquid through the laundry treating appliance 10 and for the introduction of more than one type of treating chemistry. For example, the liquid supply assembly can be configured to supply liquid into the interior of the basket 30 or into the interior of the tub 34 not occupied by the basket 30, such that liquid can be supplied directly to the tub 34 without having to travel through the basket 30. In another example, the liquid supply assembly can include a single valve for controlling the flow of water from the household water source. In another example, the recirculation and pump assembly can include two separate pumps for recirculation and draining, instead of the single pump 62 as previously described.

The laundry treating appliance 10, and specifically the liquid supply and/or recirculation and drain assemblies, can be provided with a heating assembly (not shown), which can include one or more devices for heating laundry and/or to heat liquid provided to the treating chamber 32 as part of a cycle of operation, such as, for example, a steam generator, which can be any suitable type of steam generator, such as a flow through steam generator or a tank-type steam generator, and/or a sump heater. Alternatively, the sump heater can be used to generate steam in place of or in addition to the steam generator. In one example, the heating assembly can include a heating element provided in the sump 60 to heat liquid that collects in the sump 60. Alternatively, the heating assembly can include an in-line heater that heats the liquid as it flows through the liquid supply, dispensing and/or recirculation assemblies.

The laundry treating appliance 10 can further include a control assembly, illustrated herein as a controller 70, for controlling the operation of the laundry treating appliance 10 and coupled with various working components of the laundry treating appliance 10 to control the operation of the working components and to implement one or more treating cycles of operation. The control assembly can include the controller 70 located within the cabinet 14 and a user interface 26 that can be operably coupled with the controller 70. The user interface 26 can provide an input and output function for the controller 70.

The user interface 26 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 70 to communicate with the user in a variety of ways. For example, the controller 70 can be configured to send a text message to the user, send an electronic mail to the user, or provide audio information to the user either through the laundry treating appliance 10 or utilizing another device such as a mobile phone.

The controller 70 can include the machine controller and any additional controllers provided for controlling any of the components of the laundry treating appliance 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the laundry treating appliance 10.

Figure 2:
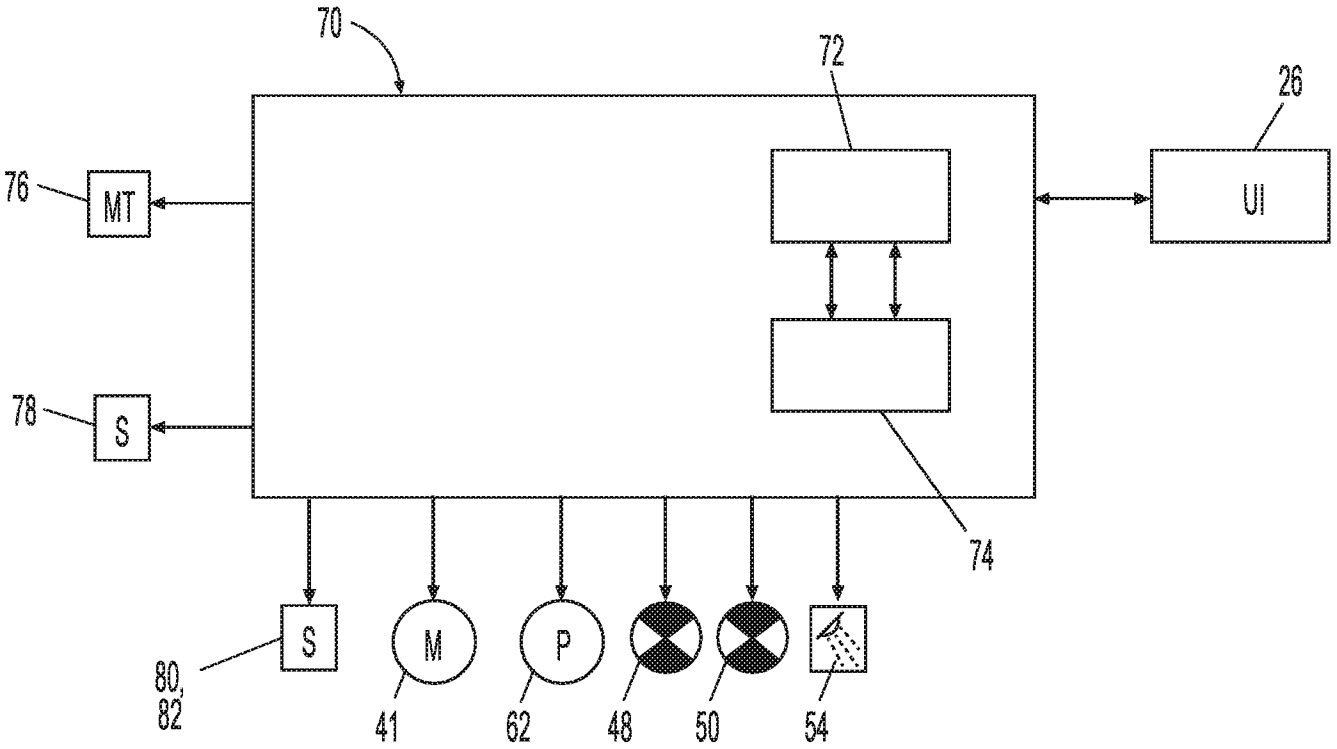
FIG. 2 is a schematic representation of a control assembly for controlling the operation of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the laundry treating appliance 10 and any additional software. For example, the memory 72 can store a set of executable instructions including at least one user-selectable cycle of operation. Examples, without limitation, of treating cycles of operation include: wash, heavy duty wash, delicate wash, quick wash, pre-wash, refresh, rinse only, and timed wash, which can be selected at the user interface 26. The memory 72 can also be used to store information, such as a database or table, and to store data received from the one or more components of the laundry treating appliance 10 that can be communicably coupled with the controller 70. The database or table can be used to store the various operating parameters for the one or more cycles of operation, including factory default values for the operating parameters and any adjustments to them by the control assembly or by user input.

The controller 70 can be operably coupled with one or more components of the laundry treating appliance 10 for communicating with and/or controlling the operation of the components to complete a cycle of operation. For example, the controller 70 can be coupled with the hot water valve 48, the cold water valve 50, and the dispenser 54 for controlling the temperature and flow rate of treating liquid into the treating chamber 32; the pump 62 for controlling the amount of treating liquid in the treating chamber 32 or sump 60; the drive assembly 40 at the motor 41 for controlling the direction and speed of rotation of the basket 30 and/or the clothes mover 100; the user interface 26 for receiving user selected inputs and communicating information to the user; and the heater assembly to control the operation of these and other components to implement one or more of the cycles of operation.

A clothes mover sensor 80 can optionally be provided to determine the presence/absence of the agitator 150 or the impeller 120. The sensor 80 can be any suitable type of sensor 80 configured to determine the presence or absence of the associated component, herein the agitator 150 or the impeller 120, and provide an output to the controller 70 indicative of the presence or absence of the component. Non-limiting examples of suitable types of sensors 80 include optical sensors, light sensors, electrical sensors, and electromechanical sensors. In one example, the sensor 80 can be of the type in which a circuit is completed when the associated component—the agitator 150 or impeller 120—is present and the completion of the circuit is provided as an output to the controller 70 to indicate the presence of the associated component. In another example, the sensor 80 can include an optical sensor or a light sensor in which a light source provides illumination that is detected by a suitable detector (not shown) when the associated component, the agitator 150 or impeller 120, is not present and when the associated component is present, the illumination is blocked. The detector (not shown) can be configured to output a signal indicative of the presence or absence of the component to the controller 70 based on whether or not the illumination reaches the detector (not shown).

The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also be coupled with one or more additional sensors 78 provided in one or more of the assemblies of the laundry treating appliance 10 to receive input from the various additional sensors 78, which are known in the art and not shown for simplicity. Non-limiting examples of additional sensors 78 that can be communicably coupled with the controller 70 include a weight sensor, a moisture sensor, a chemical sensor, a position sensor, an imbalance sensor, a load size sensor, and a motor torque sensor, which can be used to determine a variety of assembly and laundry characteristics, such as laundry load inertia or mass.

Figure 3:
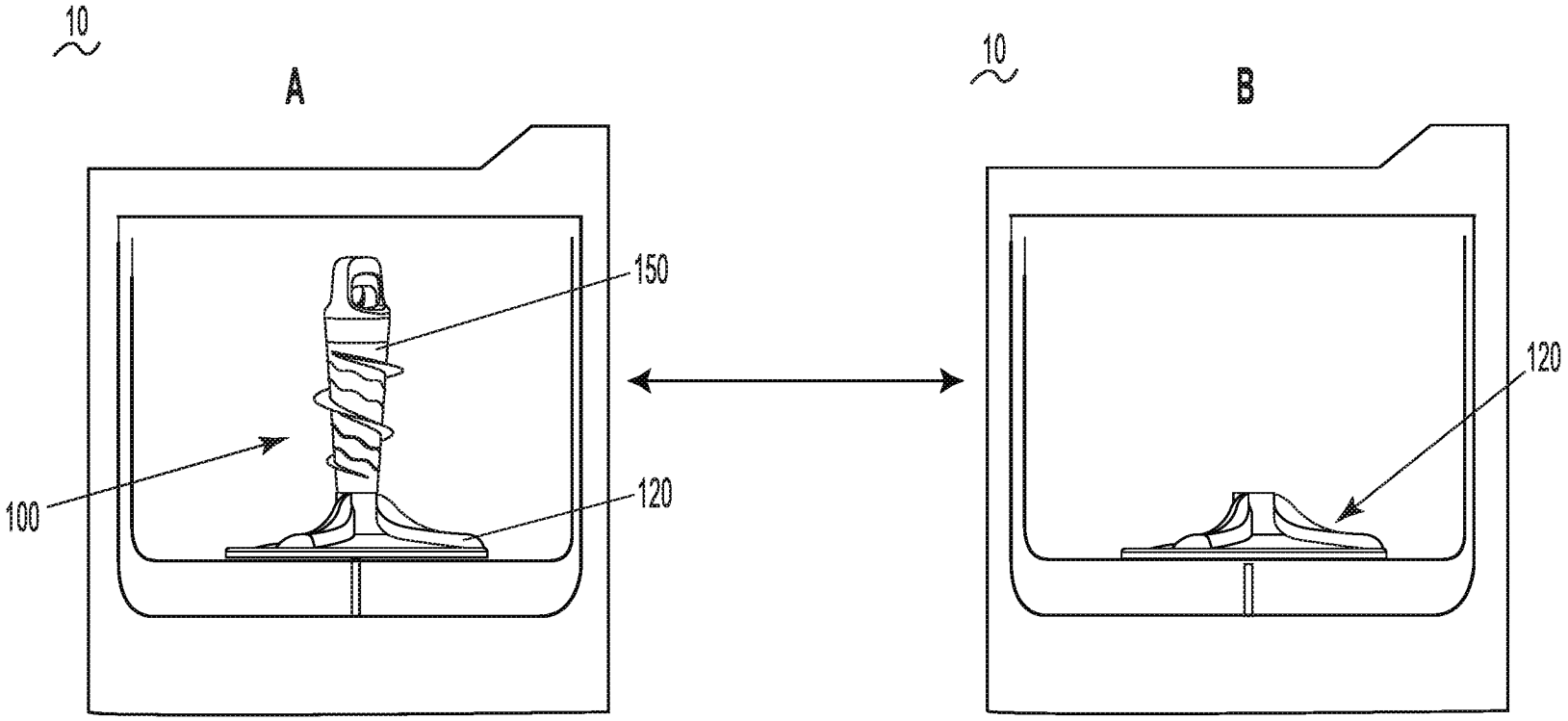
FIG. 3 is a schematic view of the laundry treating appliance and the clothes mover of FIG. 1 with the clothes mover shown in first and second configurations.

Referring now to FIG. 3, the laundry treating appliance 10 as described herein allows the user to customize the laundry treating appliance 10 for treating the laundry load or loads to be treated. For example, the laundry treating appliance 10 can be utilized and operated with one of at least two different configurations, each utilizing a different type of clothes mover 100, the configurations selectable based on the user's treatment needs. Aspects of the laundry treating appliance 10 described herein allow the user to selectively assemble and disassemble the agitator 150, which can be thought of as forming a second clothes mover, and the impeller 120, which can be thought of as a first clothes mover, to configure the laundry treating appliance 10 into one of the two configurations. The user can customize the clothes mover 100 based on the user's personal preferences, based on the amount and/or type of mechanical action implemented by the different configurations of the clothes mover 100, and/or based on characteristics of the laundry items to be treated, non-limiting examples of which include an amount of laundry items to be treated, a size of the laundry item(s) to be treated, soil level of the laundry items, an amount and/or type of mechanical energy to be applied to the laundry items, the type of fabric of the laundry items (e.g., whether the laundry is delicate or rugged), and a fill level of liquid during treatment.

The laundry treating appliance 10 can be configured in a first configuration, illustrated by way of example as a configuration A as shown, and also as illustrated in FIG. 1, by assembling the agitator 150 with the impeller 120 within the laundry treating appliance 10. In the configuration A, the user can elect to use the clothes mover 100 that includes the agitator 150 for treating a laundry load. Such a configuration as configuration A can be useful if the user wishes to implement a treatment mode using agitator-based washing, such as for imparting significant or high quantities of mechanical action onto particularly soiled laundry items, or if the user wishes to perform deep water washing, or based on any other user preference for the clothes mover 100 and the agitator 150, such as a personal preference.

In another example, the laundry treating appliance 10 can also be configured in a second configuration, illustrated by way of example as a configuration B as shown, by assembling only the impeller 120 within the laundry treating appliance 10 and decoupling or removing the agitator 150. In the configuration B, the user elects to use the clothes mover 100 with the lower profile impeller 120 and that does not include the agitator 150 or any similar agitator post. Such a configuration as configuration B can be useful if the user wishes to implement a treatment mode using impeller-based washing, such as for low water washing, for gentler washing, wherein a lower mechanical action is imparted to the laundry items, or for washing bulky items such as blankets or comforters that could tangle around the agitator 150. Larger, bulky laundry items generally do not fit well in the basket 30 when a vertical-oriented agitator-type clothes mover 100, such as configuration A including the agitator 150, is present. Thus, the user can selectively configure the laundry treating appliance 10 to utilize the only the impeller 120 as illustrated in the configuration B, without the agitator 150 extending upward into the treating chamber 32, for use in treating large and/or bulky loads or to implement a low water treatment mode, for example, or based on another preference of the user, such as a personal preference.

The components of the laundry treating appliance 10 are configured to allow the user to configure and re-configure the laundry treating appliance 10 into either of the agitator 150 configuration A and the impeller 120 configuration B as desired. The user can select either of the configurations A or B based on personal preference of utilizing the particular type of clothes mover 100 of configuration A or B over the other, the desired cycle of operation to be implemented, and/or characteristics of the laundry items or the laundry load.

Turning now to the process or method of configuring or re-configuring the clothes mover 100, to operate the laundry treating appliance 10 and to utilize configuration A in which the agitator 150 is present in the laundry treating appliance 10, the user can assemble the agitator 150 in the laundry treating appliance 10, such as by coupling or assembling the agitator 150 to the impeller 120 to form the clothes mover 100. The user can then utilize the laundry treating appliance 10 to implement a cycle of operation on a load of laundry in a conventional manner. When the agitator 150 is configured to be supported at least in part by the impeller 120, configuration A will include the impeller 120. Optionally, if the agitator 150 does not require the impeller 120 for support, such as when the agitator 150 can be supported by the basket 30, configuration A does not have to include the impeller 120. In this alternative configuration A, the impeller 120 does not have to be present and the clothes mover 100 can be utilized with just the agitator 150.

To operate the laundry treating appliance 10 and to utilize configuration B in which only the impeller 120 is present in the laundry treating appliance 10, the removable agitator 150 is disassembled or uncoupled from the impeller 120 by the user and removed from the laundry treating appliance 10, and the impeller 120 is assembled within the basket 30. To assemble the impeller 120 within the basket 30, the agitator 150 can be configured to separate from the impeller 120 while the impeller 120 remains coupled with the drive assembly 40 and the motor 41. The user can then utilize the laundry treating appliance 10 to implement a cycle of operation on a load of laundry in a conventional manner. The impeller 120 is configured to operate as the clothes mover 100 of configuration B, that is different than the clothes mover 100 of configuration A and independent of the agitator 150, during a cycle of operation. In this manner, the laundry treating appliance 10 can be selectively re-configured by the user between the first and second configurations as illustrated to utilize two different clothes movers 100.

Further, to configure or re-configure the laundry treating appliance 10 from the first configuration, configuration A, to the second configuration, configuration B, the user removes or decouples the agitator 150 and sets it aside. Optionally, the laundry treating appliance 10 can be configured to facilitate storage of the removable agitator 150 when not in use. For example, the laundry treating appliance 10 can include a storage element that suspends the removable agitator 150 from the laundry treating appliance 10, such as a hook, clamp, hanger, or suspending rod. In another example, the storage element can be in the form of a shelf, drawer, or cavity configured to support the removable agitator 150. In another aspect of the disclosure, a companion laundry dryer or laundry module can include the storage element configured to store the removable agitator 150.

In one aspect of the present disclosure, the laundry treating appliance 10 can be provided to the user in configuration B in which the laundry treating appliance 10 includes only the impeller 120. The agitator 150 can be offered to the user as a kit that can optionally be used with the laundry treating appliance 10. The laundry treating appliance 10 can be configured for use as is in configuration B and optionally for use with the kit components, including at least the agitator 150. In this manner, the user has the option to customize the laundry treating appliance 10. A kit according to an aspect of the disclosure includes any combination of clothes mover 100 components and related components that allow the laundry treating appliance 10 to be selectively configured by the user into different clothes mover 100 configurations.

Further, multiple different kits including different agitators 150 and/or different options of removable agitators 150 can be made available to the user for customizing the laundry treating appliance 10. For example, agitators 150 having different features, such as different shapes or blade or vane configurations can be provided. In one example, one option can include an agitator 150 having an auger-style blade, as illustrated in FIG. 11, whereas another option can include an agitator 150 having vertically extending blades.

By way of further non-limiting example, kits including agitators 150 having different options can be provided. For example, a kit can include a different style of removable agitator 150 based on the configuration of the impeller 120, the manner in which the removable agitator 150 is mounted within the laundry treating appliance 10 and/or within the impeller 120, optional features of the removable agitator 150, and/or features of the laundry treating appliance 10 (e.g., based on whether the laundry treating appliance 10 has a separate liquid supply system for use with a removable agitator 150). In another example, a kit can include a removable agitator 150 in which the agitator 150 includes at least one dispenser for supplying a treating chemistry to the treating chamber 32 that are separate from the main treating chemistry dispenser 54 that supplies treating chemistry to the treating chamber 32. An alternative kit can include a removable agitator 150 that does not include separate dispensers. The different options of clothes movers 100, agitators 150, and impellers 120 can be combined as desired to form any number of different kits for use with the laundry treating appliance 10 of the present disclosure.

Figure 4:
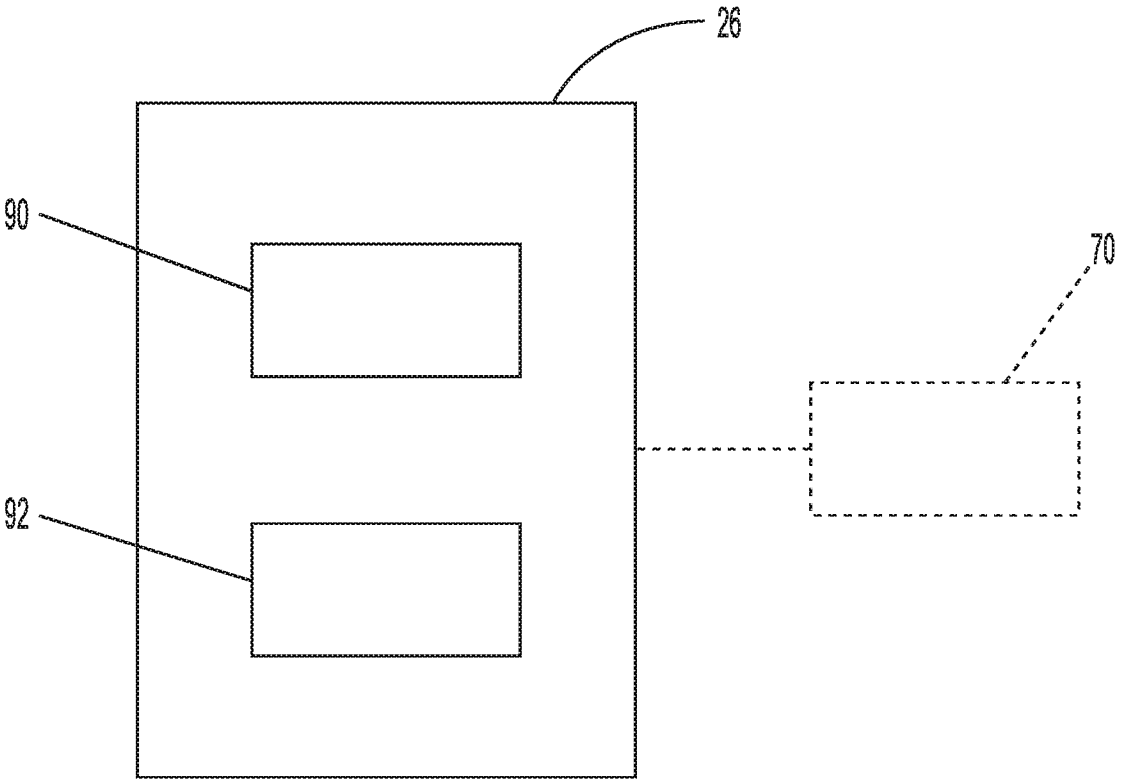
FIG. 4 is a schematic view of a user interface for use with the laundry treating appliance of FIG. 1.

Referring now to FIG. 4, in yet another aspect of the present disclosure, the user interface 26, or a portion of the user interface 26, can be provided with a dedicated input that can be selected by the user and is configured to allow the user to provide input regarding which of the configurations A or B is present, and thus also whether or not the removable agitator 150 is present, within the basket 30 to be utilized to treat laundry items within the laundry treating appliance 10. The user interface 26 can include an indicator 90 for indicating configuration A and an indicator 92 for indicating configuration B. Each of the indicators 90, 92 can be actuatable by the user and utilized to communicate to the controller 70 which of the configurations A and B will be present during the impending cycle of operation. Alternatively, the indicators 90, 92 themselves are not selectable and a separate selector actuator is provided for cycling through each of the options indicated by the indicators 90, 92. The user can utilize the indicators 90, 92 before or after assembling the desired configuration A or B.

Turning now to the operation of the laundry treating appliance 10, and specifically based upon the presence or absence of the agitator 150, and thus the use of configuration A or B, the user can select a cycle of operation through the user interface 26 for implementation by the controller 70 in treating the laundry items in the basket 30. The controller 70 can be configured to implement a cycle of operation with the basket 30 and the clothes mover 100 in the same manner or in a different manner based on the presence or absence of the removable agitator 150. In one example, the controller 70 can be configured to implement the same cycles of operation independent of the presence of the agitator 150. In another aspect, the controller 70 can be configured to implement at least one different cycle of operation based on the presence of the agitator 150 and of either configuration A or B. For example, the basket 30 and/or the clothes mover 100 can be rotated in a different manner when the removable agitator 150 is present compared to when the removable agitator 150 is absent, even if the user selects the same cycle of operation to be implemented using the basket 30.

Optionally, the controller 70 can control the information and selectable options available through the user interface 26 based on which of the indicators 90, 92 is selected by the user, such that the user interface 26 can be configured to allow the user to select from a predetermined set of cycles of operation, including cycle options, based on the input regarding the presence or absence of the agitator 150. In one example, the user interface 26 can be configured to display a first set of predetermined selectable cycles of operation when the agitator 150 is present and a second set of predetermined selectable cycles of operation when the agitator 150 is absent and only the impeller 120 is present. The first and second sets of predetermined selectable cycles of operation can differ by one or more cycles of operation or based on one or more selectable cycle options for a given set of selectable cycles of operation.

Alternatively, or additionally, the controller 70 can use the indicators 90, 92 to indicate to the user which configuration A or B to utilize based on the user's selection of the impending cycle of operation and/or one or more selected cycle options. For example, if the user indicates through the user interface 26 that the laundry items to be washed include a bulky item (e.g., a blanket or comforter), the user interface 26 can be configured to communicate to the user through indicator 92 that configuration B is recommended for use in implementing the cycle of operation. The user can then remove the agitator 150, if the agitator 150 has not already been removed, and implement the selected cycle of operation using the recommended configuration B. In another example, if the user indicates through the user interface 26 that the laundry load includes heavily soiled items, the controller 70 can be programmed to control the user interface 26 to indicate to the user through indicator 90 that configuration A with the agitator 150 is recommended.

Similarly, instead of indicating to the user that a particular configuration A, B is recommended for use based upon the user's selection of the impending cycle of operation and/or one or more selected cycle options, the controller 70 can instead be configured to make a determination of the presence or absence of the removable agitator 150 based on the cycle of operation selected by the user. For example, if the user indicates through the user interface 26 that the laundry items to be washed include a bulky item (e.g., a blanket or comforter), the user interface 26 can be configured to communicate to the user through indicator 92 that the controller 70 has determined that the removable agitator 150 is present based upon the cycle of operation selected by the user.

The user interface 26 can include graphics and/or text to indicate to the user which configuration A, B is recommended or has been determined based upon the cycle of operation selected by the user and/or to allow the user to communicate the configuration A, B to the controller 70. In one example, the user interface 26 can include graphics representative of either of the possible configurations A or B, and the user interface 26 can be configured to illuminate the graphic corresponding to the recommended or determined configuration A, B. For example, each of the indicators 90, 92 can include a graphic representative of each configuration A, B, which is illuminated based on the user's selection and/or based on the configuration A, B recommended or determined by the controller 70.

Optionally, the controller 70 can be provided with information regarding which of the configurations A or B is present based on input information from the sensor 80 to determine the presence or absence of the removable agitator 150. In this way, the presence or absence of the removable agitator 150 can be determined automatically based upon input information from using the sensor 80, can be determined based upon user input through the user interface 26, or a combination of both. The controller 70 can optionally use the input information from the sensor 80 to illuminate one of the indicators 90, 92 to communicate to a user that a particular configuration A, B is present.

As described previously, the sensor 80 can be provided to determine the presence or absence of the agitator 150 or the impeller 120 and provide an output to the controller 70 accordingly. More specifically, and with respect to the configurations A and B, the presence or absence of the agitator 150, and thus of either of the configurations A and B, can be determined based on input from the sensor 80. The clothes mover 100 can include the sensor 80 configured to determine the presence or the absence of the agitator 150. When the agitator 150 is present, i.e., is coupled to the impeller 120, the sensor 80 can provide an output to the controller 70 indicating that the agitator 150 is present. When the agitator 150 is absent, i.e., is un-coupled from the impeller 120, the sensor 80 can provide an output to the controller 70 that the agitator 150 is absent, indicating that only the impeller 120 is present.

According to another aspect of the disclosure, the determination of the presence or absence of the agitator 150, and thus of whether the first configuration A or the second configuration B is present or absent, can alternatively, or additionally, be determined based on input or output from the motor 41. For example, the power utilized by the motor 41 in rotating the clothes mover 100 when including the agitator 150 at a first speed or acceleration can be different than the power utilized by the motor 41 in rotating the clothes mover 100 with only the impeller 120, such that the agitator 150 is absent, at the same speed or acceleration. The difference in power can be utilized by the controller 70 to determine whether the agitator 150, and thus the configuration A or configuration B, is present. Optionally, the controller 70 can be configured to alter one or more aspects of the selected cycle of operation based on the determination of the presence or absence of the agitator 150.

Figure 5:
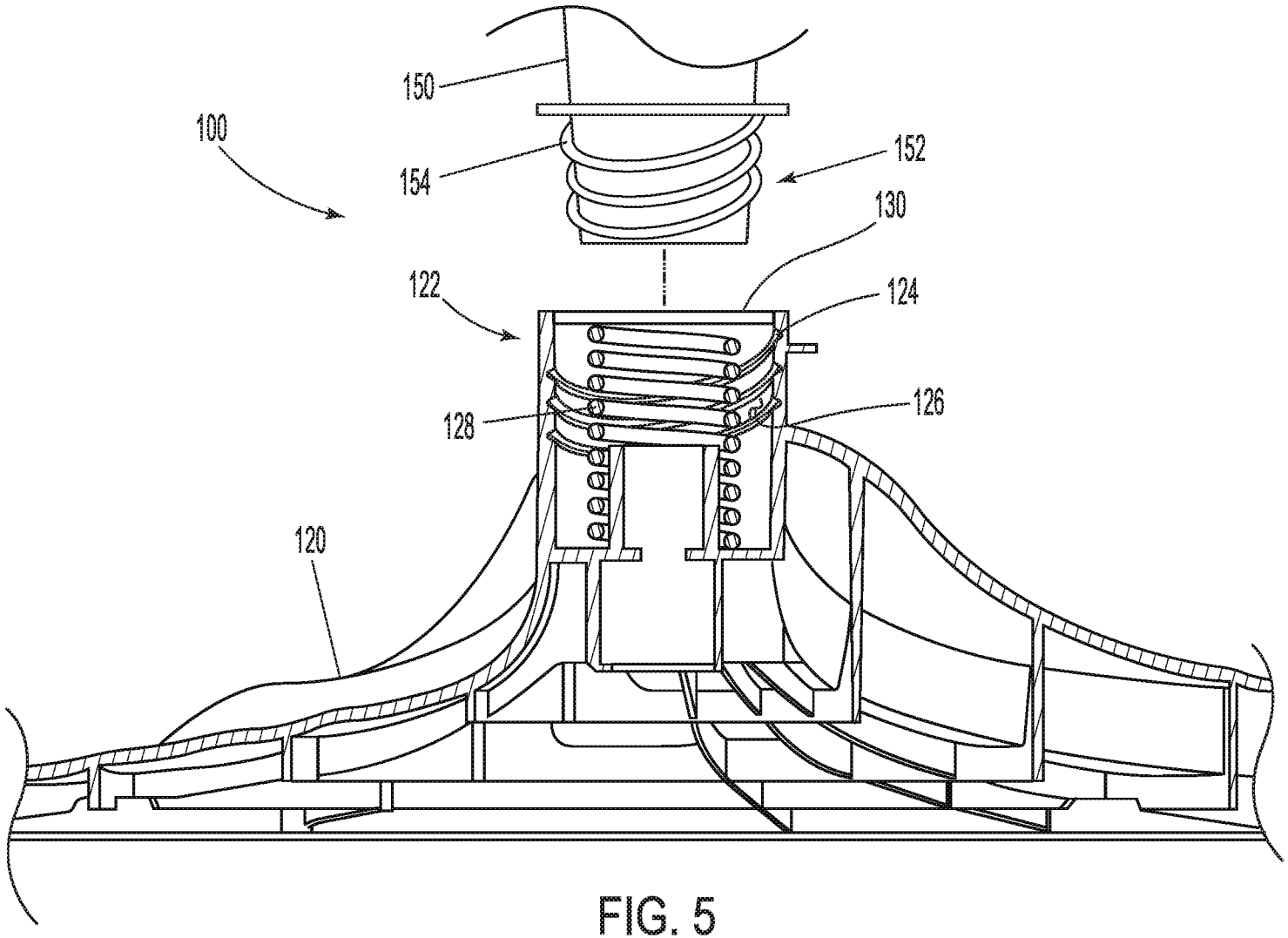
FIG. 5 is a partial cross-sectional view of the clothes mover of FIG. 1 including an example of the coupling of the agitator to the impeller.

Referring now to FIG. 5, the clothes mover 100 in the configuration A can be formed by coupling an additional component, in this case the removable agitator 150, to the impeller 120 to form a new clothes mover 100. In one aspect, the impeller 120 operates as a both a base for coupling with the agitator 150 to form the clothes mover 100 and an independent low profile clothes mover 120 for use by itself. The agitator 150 can include a first connector 152 that is configured to releasably couple with a second connector 122 provided on the impeller 120. The first connector 152 can include male threads 154 that are configured to be matingly received by corresponding female threads 124 on the second connector 122 such that the agitator 150 can be threaded onto the impeller 120 to form the clothes mover 100 and unthreaded from the impeller 120 such that the impeller 120 is provided as the first clothes mover. When the threads 154 are matingly received by the corresponding threads 124 to thread the agitator 150 onto the impeller 120 to form the clothes mover 100, the engagement between the threads 154, 124 can inhibit, such as, by way of non-limiting example, by friction, both unintended rotation of the agitator 150 relative to the impeller 120 during a cycle of operation, which could result in unintended uncoupling of the agitator 150 from the impeller 120, as well as inhibiting unintended lateral displacement, such as upward or vertical movement, of the agitator 150 relative to the impeller 120 during a cycle of operation, improving stability of the clothes mover 100.

While the agitator 150 is illustrated as forming the male portion of the coupling and the impeller 120 is illustrated as forming the female portion, it is understood that for any of the clothes movers described in the present disclosure that the roles can be reversed and that the agitator can form the female portion of the coupling and the impeller can form the male portion.

Still referring to FIG. 5, the second connector 122 includes a socket 126 configured to receive the first connector 152 therein. The socket 126 optionally includes a cover 130 configured to provide access to the socket 126. As shown in FIG. 5, the cover 130 is biased into a closed position, as illustrated, by a biasing element, such as a spring 128. The cover 130 can prevent access to the socket 126 when the agitator 150 is not coupled to the impeller 120. Closing the socket 126 can inhibit laundry items from falling into the socket 126 and prevent laundry items from being snagged or caught on the edges forming the socket 126, which could damage the laundry items.

To assemble the agitator 150 onto the impeller 120 to form the clothes mover 100, the agitator 150 is pressed against the cover 130 as the first connector 152 is inserted into the second connector 122. As the first connector 152 is threaded onto the second connector 122, the first connector 152 travels into the socket 126, pressing the cover 130 into the socket 126, against the bias of the spring 128. To disassemble the agitator 150 from the impeller 120 such that the impeller 120 can form the first clothes mover, the first connector 152 is unthreaded and withdrawn from the socket 126. As the agitator 150 is withdrawn, the cover 130 moves back into the closed position by expansion of the compressed spring 128. In this manner, the cover 130 is automatically moved into the closed position when the agitator 150 is removed. The spring 128 can also apply a biasing force to the agitator 150 through the cover 130 to bias the agitator 150 away from the impeller 120, which can facilitate disassembling the clothes mover 100. While the spring 128 is described herein as a spring 128 that can be compressed, it will be understood that any suitable type of expansion device or element could alternatively be used.

In another aspect of the present disclosure, cover 130 can be a removable cover 130 which may or may not be biased into the closed position. For example, the cover 130 can be coupled to the second connector 122 by a threaded connection, a snap-fit connection, or an interference fit. To assemble the agitator 150, the user removes the cover 130 and sets the cover 130 aside prior to coupling the agitator 150 to the impeller 120. In one example, the agitator 150 can include a compartment configured to store the cover 130 when not in use. In still another example, the cover 130 can be formed of a flexible, resilient material, such as natural or synthetic rubber, that closes the socket 126 in its initial position, but bends out of the way as the first connector 152 is inserted into the second connector 122. When the agitator 150 is uncoupled, the flexible, resilient material returns to its initial position, closing the socket 126.

Figure 6:
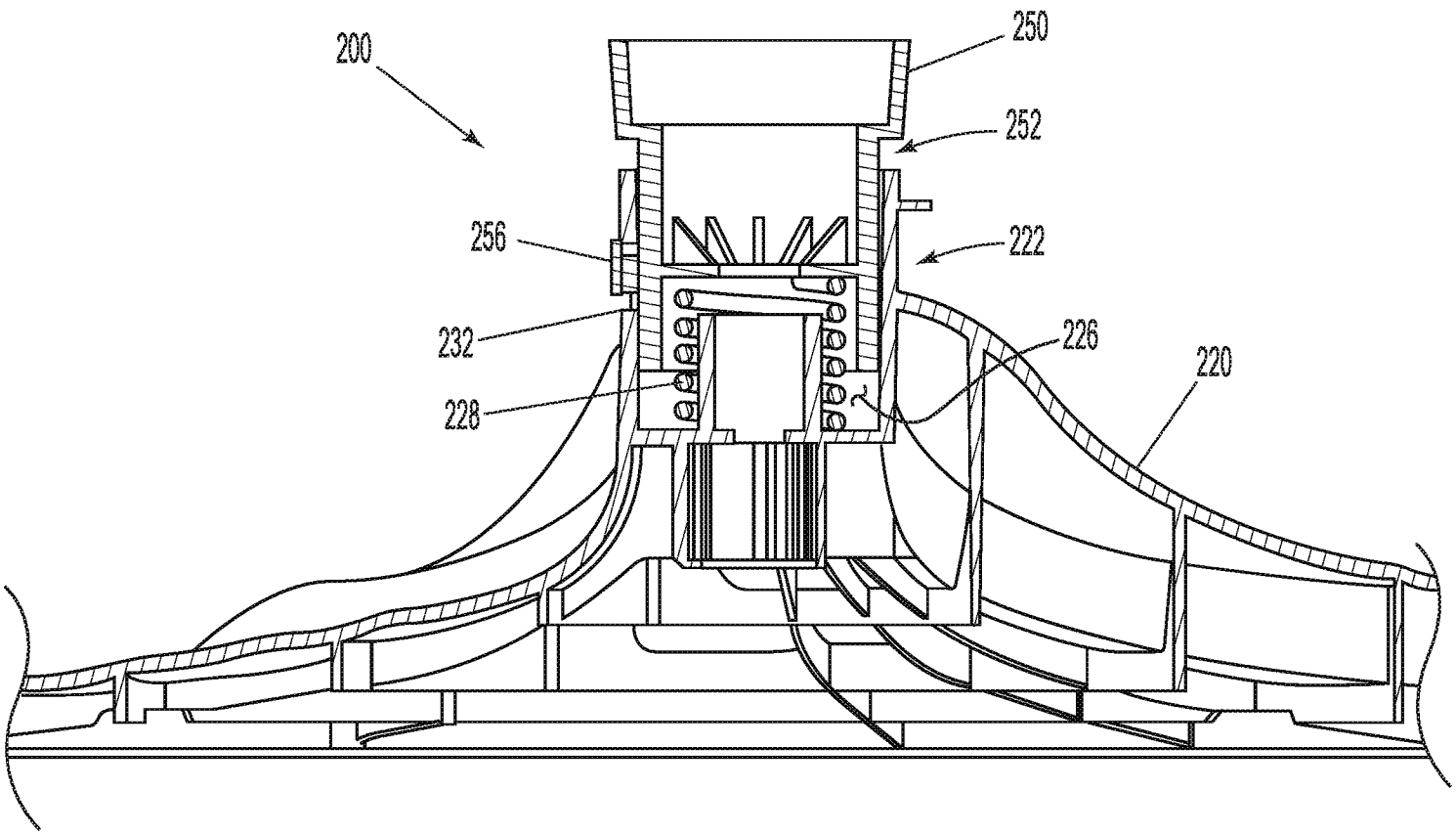
FIG. 6 is partial cross-sectional view of the clothes mover of FIG. 1 including another example of a coupling of the agitator to the impeller.
Figure 8:
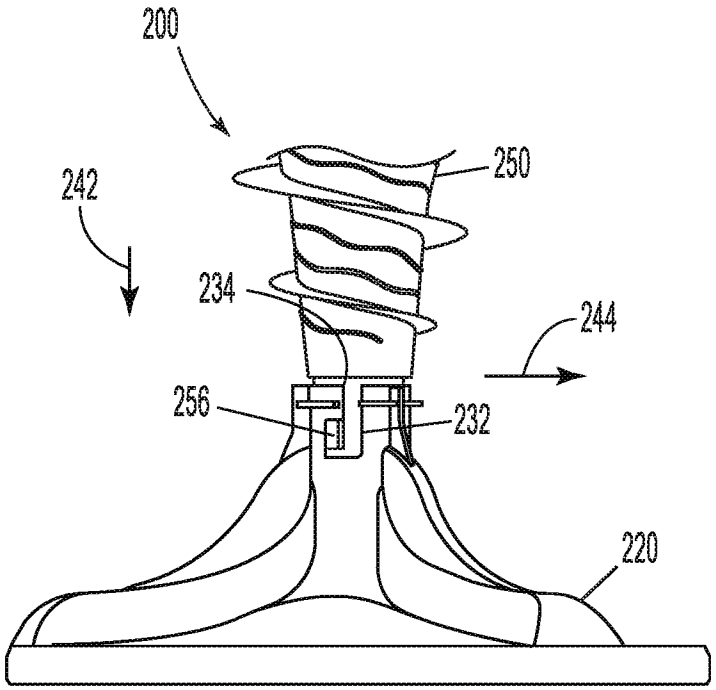
FIG. 8 is a partial side view of the agitator coupled to the impeller of FIG. 6 in a second position.
Figure 7:
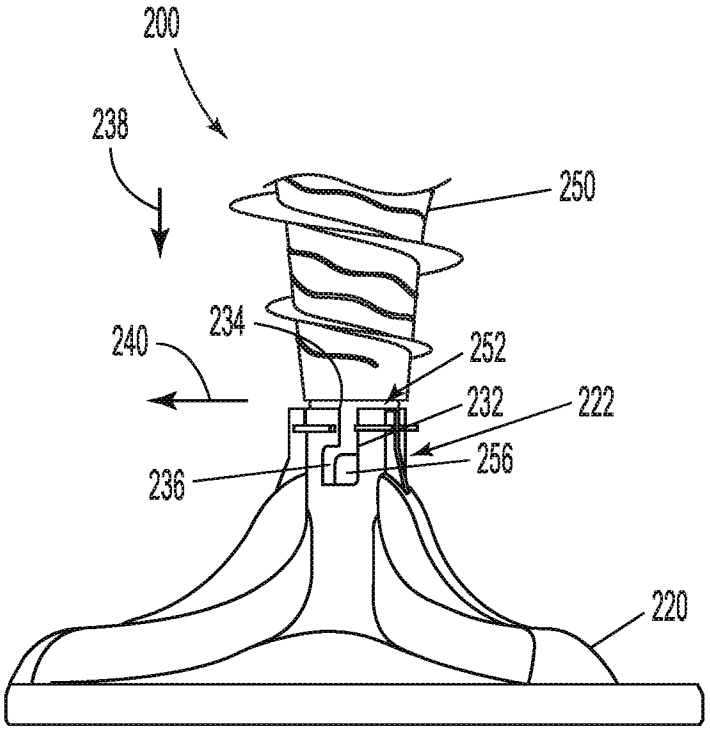
FIG. 7 is a partial side view of the agitator coupled to the impeller of FIG. 6 in a first position.

FIGS. 6-8 illustrate another example of a clothes mover 200 including an agitator 250 and an impeller 220 for use in the laundry treating appliance 10 described herein that is similar to the agitator 150 and impeller 120 of FIG. 5, but differs in some aspects, such as the manner in which the agitator 250 is coupled with the impeller 220. Therefore, elements of the agitator 250 and impeller 220 that are similar to those of the agitator 150 and impeller 120 are labeled with the prefix 200.

Referring now to FIG. 6, the agitator 250 is coupled to the impeller 220 to form the clothes mover 200 using a bayonet mount-type connection. The second connector 222 includes at least one channel 232 configured to receive a pin 256 carried by the first connector 252. The second connector 222 optionally includes a biasing element, illustrated herein as a spring 228, within the socket 226 which is compressed within the socket 226 when the agitator 250 is coupled with the impeller 220, as illustrated in FIG. 6.

Referring now to FIGS. 7-8, to assemble the clothes mover 200, the agitator 250 is aligned with the impeller 220 such that the pin 256 is aligned with an opening 234 of the channel 232. The agitator 250 is moved toward the impeller 220, as illustrated by arrow 238, to insert the first connector 252 into the second connector 222. As the first connector 252 is inserted into the second connector 222, the pin 256 travels to an end of the channel 232. The agitator 250 is then rotated, as illustrated by arrow 240, to move the pin 256 into a lock portion 236 of the channel 232, as illustrated in FIG. 8.

When the agitator 250 is coupled with the impeller 220, the spring 228 (FIG. 6) biases the agitator 250 away from the impeller 220, facilitating maintaining the pin 256 in the lock portion 236. The spring 228 bias applies a force that presses the agitator 250, and thus the pin 256, upward, which presses the pin 256 against the wall forming the lock portion 236. Biasing the pin 256 against the wall of the lock portion 236 can inhibit unintended rotation of the agitator 250 relative to the impeller 220 during a cycle of operation into a position in which the pin 256 is aligned with the channel opening 234, which could result in unintended uncoupling of the agitator 250 from the impeller 220.

To uncouple the agitator 250 from the impeller 220 in FIG. 8, a downward pressure is applied to the agitator 250, as illustrated by arrow 242 to disengage the pin 256 from the channel wall forming the lock portion 236. The agitator 250 is then rotated, as illustrated by arrow 244, to align the pin 256 with the channel opening 234, as illustrated in FIG. 8. When the pin 256 is aligned with the channel opening 234, the agitator 250 can be withdrawn in the opposite direction of arrow 238 of FIG. 7. Because the spring 228 (FIG. 6) is compressed when the agitator 250 is coupled with the impeller 220, the spring 228 provides a biasing force that presses the agitator 250 away from the impeller 220, which can facilitate withdrawing and uncoupling of the agitator 250. In another aspect of the disclosure, the spring 228 is not present. Alternatively, the spring 228 is carried by the agitator 250.

Figure 9:
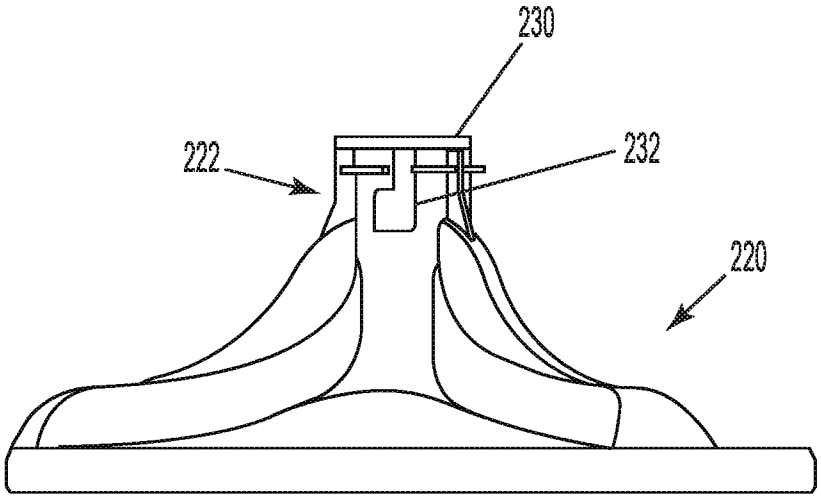
FIG. 9 is a side view of the clothes mover of FIG. 6 with the agitator removed.

Once the agitator 250 is uncoupled from the impeller 220, the agitator 250 can be set aside, leaving only the impeller 220, as illustrated in FIG. 9, for use in the basket 30. Optionally, the impeller 220 can be provided with a cover 230 for closing the opening to the socket 226 of the second connector 222 (FIG. 6). In one example, the cover 230 can be in the form of a plug that is inserted into the socket 226 and optionally covers the channel 232. In another example, the cover 230 can be in the form of a cap that fits over an exterior of the second connector 222, optionally covering the channel 232. The cover 230 can be secured to the second connector 222 using any suitable type of connection, non-limiting examples of which include a snap-fit, a threaded connection, or an interference fit. In still another example, the cover 230 can be formed of a flexible, resilient material, such as natural or synthetic rubber, that closes the socket 226 in its initial position, but bends out of the way as the first connector 252 is inserted into the second connector 222. When the agitator 250 is uncoupled, the material returns to its initial position closing the socket 226.

Figure 10:
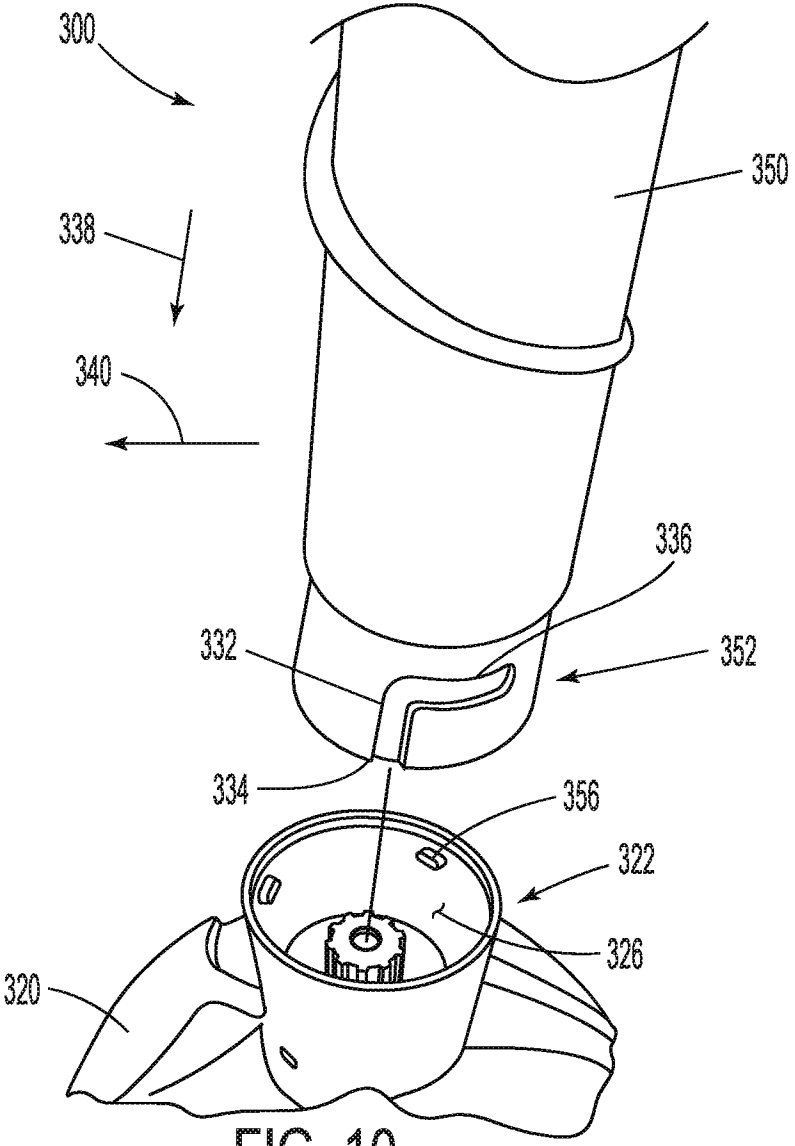
FIG. 10 is a perspective view of another example of an agitator coupling to an impeller for use with the clothes mover and laundry treating appliance of FIG. 1.

FIG. 10 illustrates another exemplary clothes mover 300 including an agitator 350 and an impeller 320 for use in the laundry treating appliance 10 described herein that are similar to the clothes mover 100, agitator 150, and impeller 120 of FIG. 5 and to the clothes mover 200, agitator 250, and impeller 220 of FIG. 6, but differs in some aspects, such as the manner in which the agitator 350 is coupled with the impeller 320. Therefore, elements of the clothes mover 300, agitator 350, and impeller 320 that are similar to those of the clothes mover 100, agitator 150, impeller 120 and the clothes mover 200, agitator 250, and impeller 220 are labeled with the prefix 300.

In the aspect of FIG. 10, the agitator 350 is coupled to the impeller 320 to form the clothes mover 300 using a bayonet mount-type connection. The first connector 352 includes at least one channel 332 configured to receive a pin 356 carried by the second connector 322 that projects into the socket 326. To assemble the clothes mover 300, the agitator 350 is aligned with the impeller 320 such that the pin 356 is aligned with the opening 334 of the channel 332. The agitator 350 is moved toward the impeller 320, as illustrated by arrow 338, to insert the first connector 352 into the second connector 322. As the first connector 352 is inserted into the second connector 322, the pin 356 travels to the end of the channel 332. The agitator 350 is then rotated, as illustrated by arrow 340, to move the pin 356 into the lock portion 336 of the channel 332. The process can be performed in reverse to uncouple and remove the agitator 350 to form the first clothes mover comprising the impeller 320.

Optionally, one of the first or second connectors 352, 322 can include a biasing element to facilitate securing the coupled agitator 350 in place and to facilitate disassembly of the agitator 350 in a manner similar to that described above with respect to the first and second connectors 252, 222 of FIG. 6. In one aspect of the present disclosure, the impeller 320 can be provided with a cover similar to any of those described with respect to the impellers 120, 220 of FIGS. 5 and 9.

FIG. 11 illustrates another exemplary clothes mover 400, agitator 450, and impeller 420 for use in the laundry treating appliance 10 described herein that is similar to the clothes mover 100, agitator 150, and impeller 120 of FIG. 5 and to the clothes mover 200, agitator 250, and impeller 220 of FIG. 6, but differs in some aspects, such as the manner in which the agitator 450 is coupled with the impeller 420. Therefore, elements of the clothes mover 400, agitator 450, and impeller 420 that are similar to those of the clothes mover 100, agitator 150, impeller 120 and the clothes mover 200, agitator 250, and impeller 220 are labeled with the prefix 400.

The first connector 452 can include a set of alternating grooves and ribs 454 configured to mate with a corresponding set of alternating grooves and ribs 424 provided on the second connector 422. The sets of grooves and ribs 454, 424 can be provided to facilitate aligning the agitator 450 for coupling with the impeller 420 and/or to provide structural support to the agitator 450 in use during a cycle of operation. The first connector 452 further includes a lock element 456 that mates with a corresponding aperture 432 to secure the agitator 450 to the impeller 420.

In one aspect, the lock element 456 includes a pair of resilient prongs having outwardly extending legs that flex toward one another as the lock element 456 is inserted into the aperture 432 and then resiliently flex back toward their original position once the legs pass through the aperture 432. The legs engage the surface around the aperture 432, inhibiting withdrawal of the first connector 452 from the second connector 422. To uncouple the agitator 450, the prongs are pressed together to allow the legs to pass back through the aperture 432 as the first connector 452 is withdrawn from the second connector 422. Optionally, the position of the lock element 456 and the aperture 432 on the first and second connectors 452, 422 is reversed. The impeller 420 can optionally include a cover (not shown) in a manner similar to that described for other impellers of the present disclosure.

Optionally, the impeller 420 or the agitator 450 can be configured to provide the user with feedback when the agitator 450 is coupled to the impeller 420. The feedback can be in the form of audible, visual, and/or tactile feedback. In one example, one of the first and/or second connectors 452, 422 can be configured to provide an audible "click" or tactile vibration when coupled together. In another example, one of the first and/or second connectors 452, 422 can be provided with a sensor communicably coupled with the controller 70, such as the sensor 80 described above with respect to FIG. 2. The sensor 80 can provide an output to the controller 70 when the first and second connectors 452, 422 are coupled, indicating that the agitator 450 is coupled with the impeller 420. The controller 70 can be configured to provide visual feedback to the user through the user interface 26 or an audible feedback, such as a chime, to indicate to the user that the agitator 450 is coupled with the impeller 420.

Figure 12:
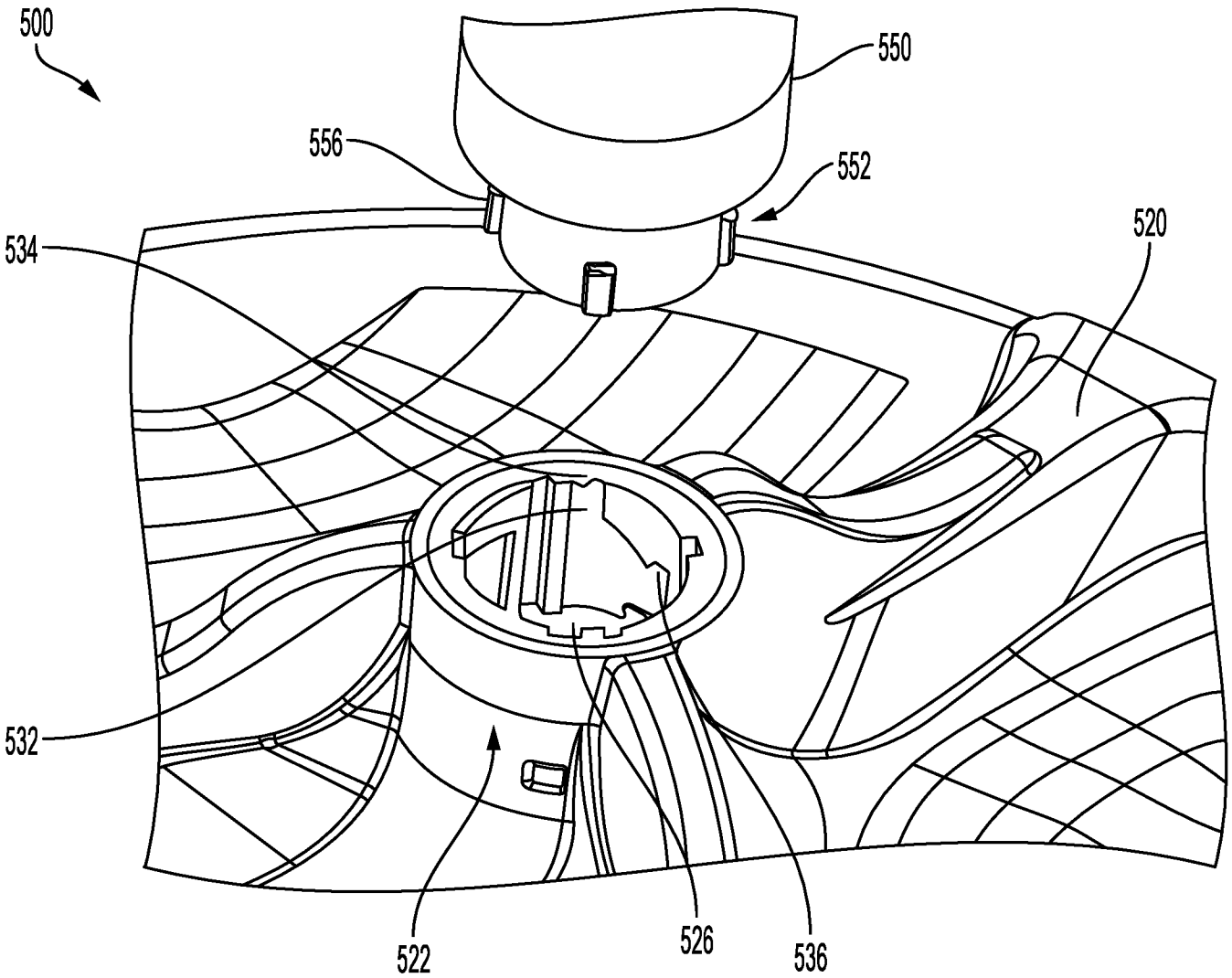
FIG. 12 is a perspective view of another example of an agitator coupling to an impeller for use with the clothes mover and laundry treating appliance of FIG. 1.
Figure 13:
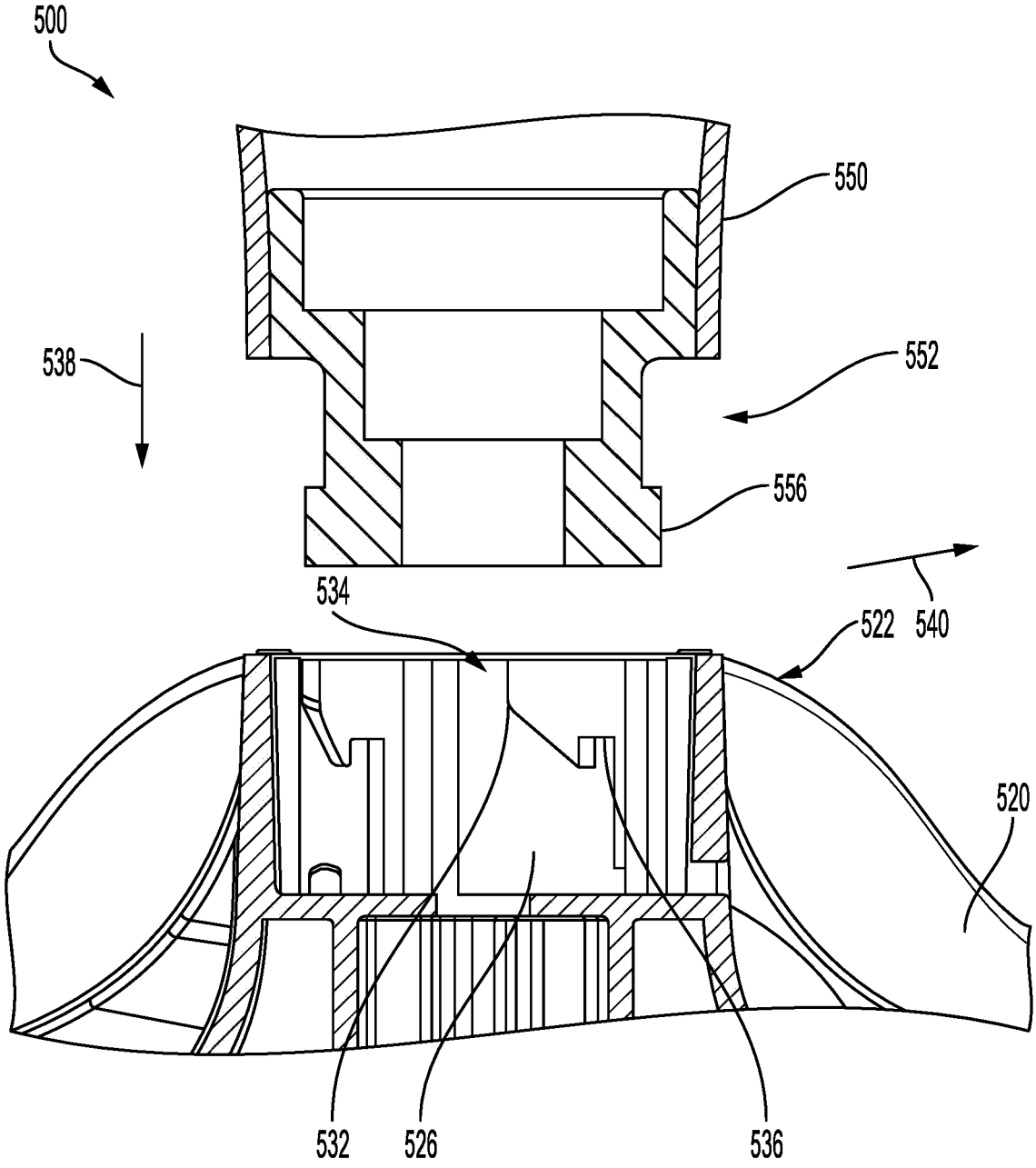
FIG. 13 is a side cross-sectional view of the agitator coupling to the impeller of FIG. 12.
Figure 14:
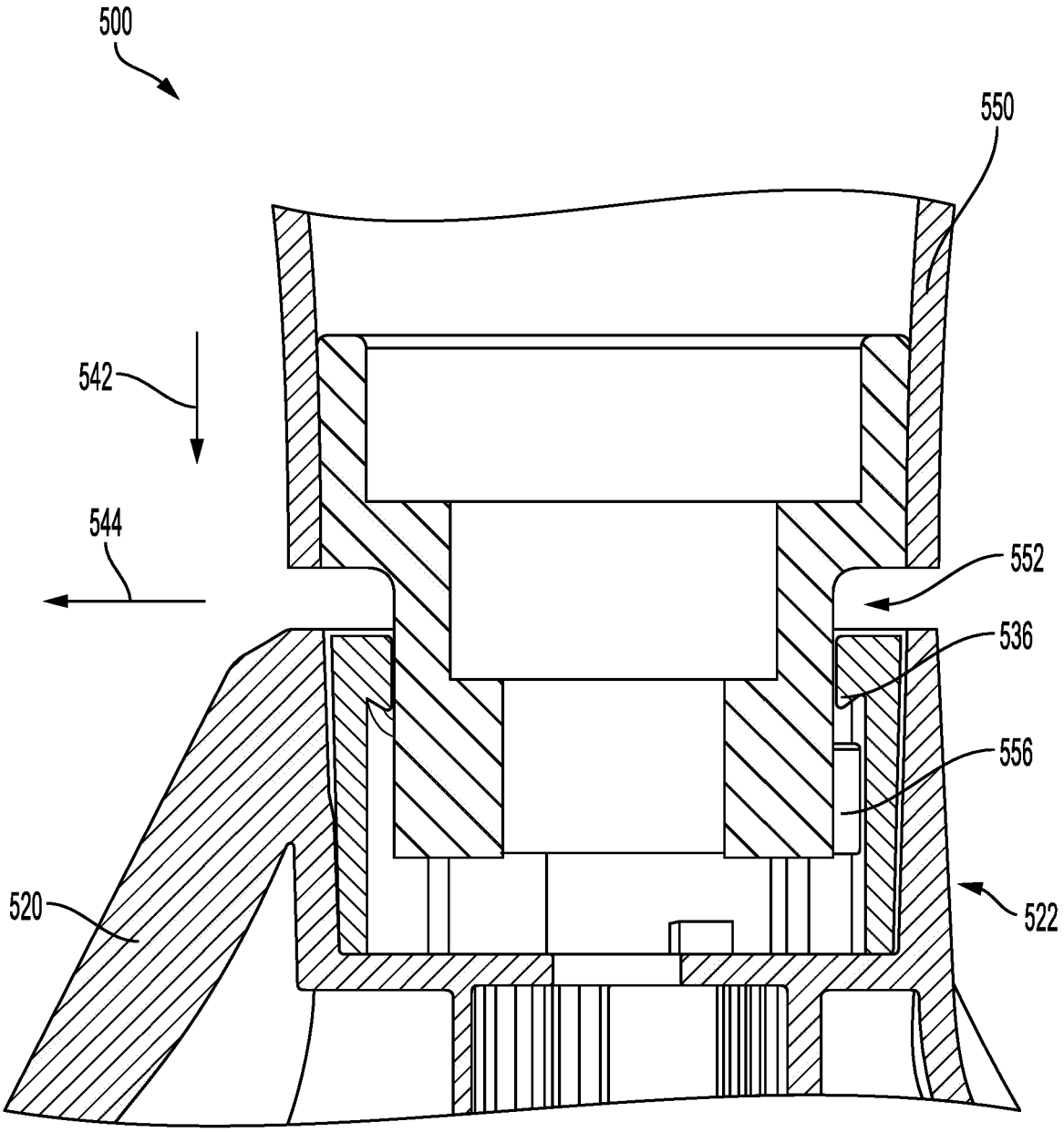
FIG. 14 is a side cross-sectional view of the agitator coupling to the impeller of FIG. 12.

FIGS. 12-14 illustrate another example of a clothes mover 500 including an agitator 550 and an impeller 520 for use in the laundry treating appliance 10 described herein that are similar to the clothes mover 100, agitator 150, and impeller 120 of FIG. 5 and to the clothes mover 200, agitator 250, and impeller 220 of FIG. 6, but differs in some aspects, such as the manner in which the agitator 550 is coupled with the impeller 520. Therefore, elements of the clothes mover 500, agitator 550, and impeller 520 that are similar to those of the clothes mover 100, agitator 150, impeller 120 and the clothes mover 200, agitator 250, and impeller 220 are labeled with the prefix 500.

Referring now to FIG. 12, the agitator 550 is coupled to the impeller 520 to form the clothes mover 500 using a bayonet mount-type connection. The second connector 522 includes at least one channel 532 configured to receive at least one pin 556 carried by the first connector 552. The second connector 522 optionally includes a biasing element, such as at least one spring (not shown), which can be the same as the spring 228 of FIG. 6 and operating in a manner similar to that described above with respect to the first and second connectors 252, 222 of FIG. 6, within the socket 526 which is compressed within the socket 526 when the agitator 550 is coupled with the impeller 520, as illustrated in FIG. 12.

Referring now to FIGS. 13-14, to assemble the clothes mover 500, the agitator 550 is aligned with the impeller 520 such that the pin 556 is aligned with an opening 534 of the channel 532. The agitator 550 is moved toward the impeller 520, as illustrated by arrow 538, to insert the first connector 552 into the second connector 522. As the first connector 552 is inserted into the second connector 522, the pin 556 travels to an end of the channel 532. The agitator 550 is then rotated, as illustrated by arrow 540, to move the pin 556 into a lock portion 536 of the channel 532, as illustrated in FIG. 14.

When the agitator 550 is coupled with the impeller 520, the spring (not shown), or other biasing element, biases the agitator 550 away from the impeller 520, facilitating maintaining the pin 556 in the lock portion 536. The spring bias (not shown) applies a force that presses the agitator 550, and thus the pin 556, upward, which presses the pin 556 upwardly to be received within the lock portion 536 and against the cavity wall forming the lock portion 536. Biasing the pin 556 against the cavity wall of the lock portion 536, such that the pin 556 is received within the cavity forming the lock portion 536, can inhibit unintended rotation of the agitator 550 relative to the impeller 520 during a cycle of operation into a position in which the pin 556 is aligned with the channel opening 534, which could result in unintended uncoupling of the agitator 550 from the impeller 520.

To uncouple the agitator 550 from the impeller 520 in FIG. 14, a downward pressure is applied to the agitator 550, as illustrated by arrow 542 to disengage the pin 556 from the cavity wall forming the lock portion 536. The agitator 550 is then rotated, as illustrated by arrow 544, to align the pin 556 with the channel opening 534, as illustrated in FIG. 13. When the pin 556 is aligned with the channel opening 534, the agitator 550 can be withdrawn in the opposite direction of arrow 538 of FIG. 13. Because the spring (not shown) is compressed when the agitator 550 is coupled with the impeller 520, the spring (not shown) provides a biasing force that presses the agitator 550 away from the impeller 520, which can facilitate withdrawing and uncoupling of the agitator 550. In another aspect of the disclosure, the spring is not present. Alternatively, the spring (not shown) can be carried by the agitator 550. The impeller 520 can be provided with a cover similar to any of those described with respect to the impellers 120, 220 of FIGS. 5 and 9. Either of the impeller 520 or the agitator 550, or both, can be provided with a locking mechanism.

Figure 15:
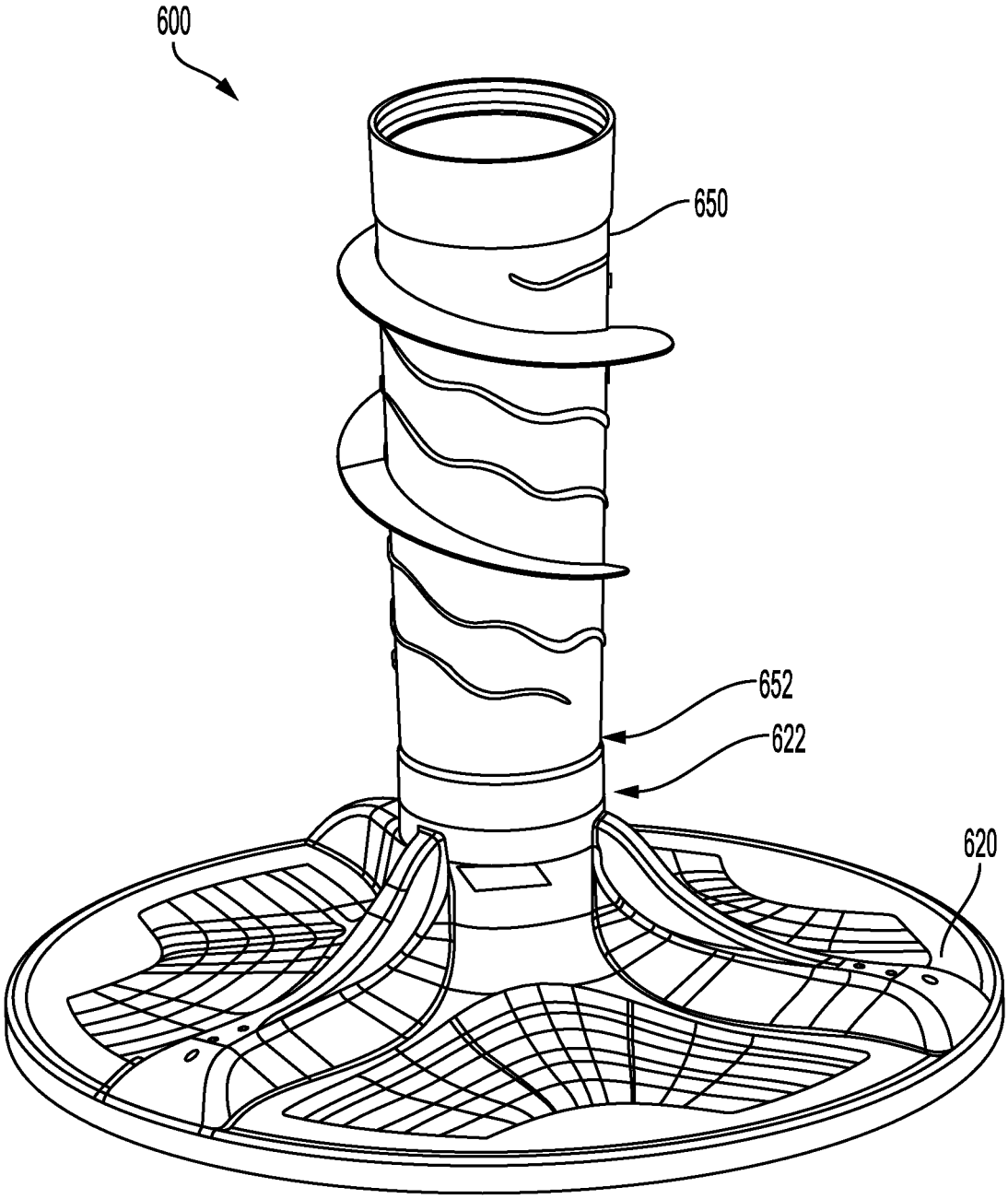
FIG. 15 is a perspective view of another example of an agitator coupling to an impeller for use with the clothes mover and laundry treating appliance of FIG. 1.
Figure 16:
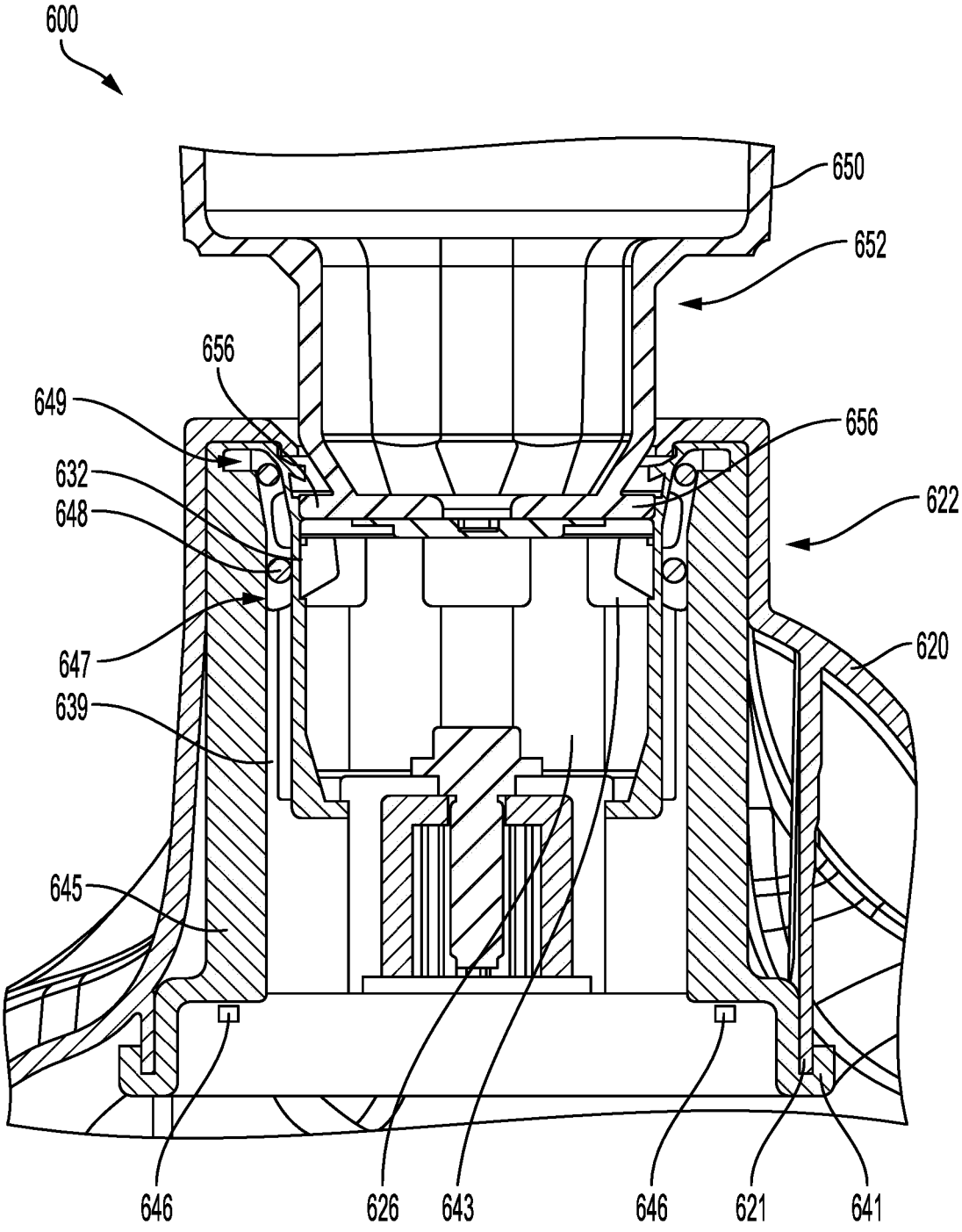
FIG. 16 is a side cross-sectional view of the agitator coupling to the impeller of FIG. 15 in a first position.
Figure 17:
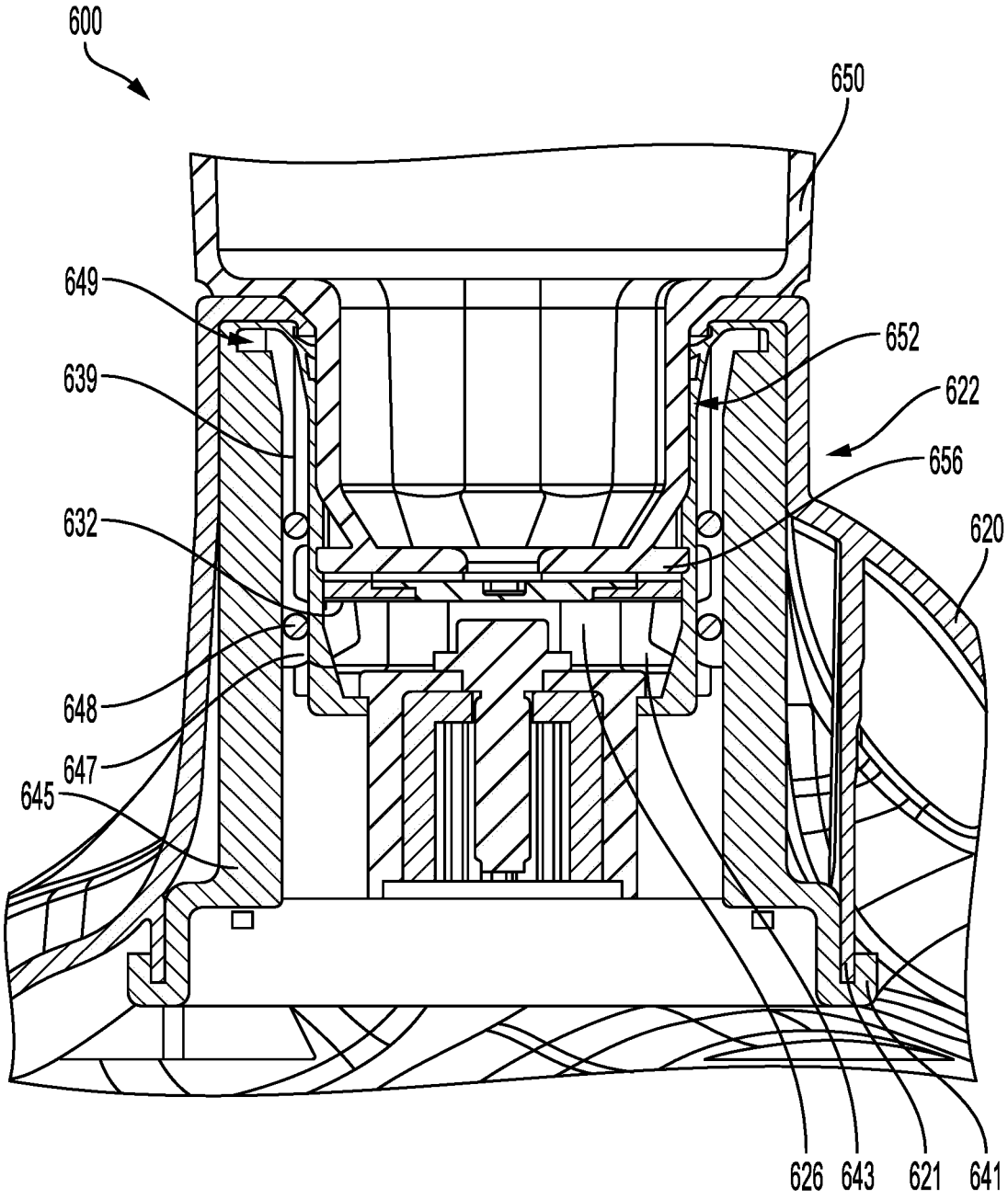
FIG. 17 is a side cross-sectional view of the agitator coupling to the impeller of FIG. 16 in a second position.

FIGS. 15-17 illustrate another example of a clothes mover 600, agitator 650, and impeller 620 for use in the laundry treating appliance 10 described herein that is similar to the clothes mover 100, agitator 150, and impeller 120 of FIG. 5 and to the clothes mover 200, agitator 250, and impeller 220 of FIG. 6, but differs in some aspects, such as the manner in which the agitator 650 is coupled with the impeller 620. Therefore, elements of the clothes mover 600, agitator 650, and impeller 620 that are similar to those of the clothes mover 100, agitator 150, impeller 120 and the clothes mover 200, agitator 250, and impeller 220 are labeled with the prefix 600.

Referring now to FIG. 15, the agitator 650 is coupled to the impeller 620 to form the clothes mover 600 using a self-seating, soft close-type connection. The agitator 650 can differ from the agitator 150 in that the agitator 650 can have a uniform diameter, as opposed to the agitator 150 that decreases in diameter moving towards the first connector 152. Additionally, or alternatively, the agitator 650 can have a vane configuration that differs from that of the agitator 150.

Referring now to FIG. 16, a self-seating mechanism is shown in an initial insertion position. The first connector 652 comprises a lower lip 656 protruding circumferentially outward from a lower edge of the first connector 652. The second connector 622 comprises a self-seating housing 645 that defines at least one cam channel 639 that extends substantially vertically along the height of the second connector 622. The cam channel 639 can further include an upper channel portion 649 that extends outwardly from the cam channel 639 at its upper extent and protrudes generally orthogonally from the cam channel 639. At a lower portion, the housing 645 includes a retaining edge or retaining lip 641 that is configured to couple with a mounting rib 621 that extends downwardly from the impeller 620 and away from the second connector 622. When the mounting rib 621 is received within the retaining lip 641, the housing 645 is retained within the impeller 620. The housing 645 further defines at least one spring mount 646.

At least one slidable cam 647, illustrated herein as a pair of slidable cams 647 is operably coupled with the housing 645. Specifically, the slidable cams 647 each define at least one guiding rib 648 that can be received within the cam channel 639 and configured such that the slidable cams 647 can be retained by and slidable within the cam channel 639. Each of the slidable cams 647 further defines a channel 632 within which the lower lip 656 of the agitator 650 can be at least partially received when the agitator 650 is coupled with the impeller 620 to form the clothes mover 600. The slidable cams 647 can be pliable elements, so as to allow deflection of the slidable cams 647 as they move from the cam channel 639 to the outwardly protruding upper channel portion 649. The second connector 622 can further comprise a coupling plate 643 that can be at least partially received within the channel 632 of the slidable cams 647 and configured to selectively couple with the agitator 650 to provide alignment and stability for the agitator 650. At least one biasing element, such as a spring (not shown) can couple each of the slidable cams 647 with the at least one spring mount 646 such that the biasing element is configured to bias, such as by pulling, the slidable cams 647 downwardly toward the spring mount 646 and into the socket 626.

FIG. 17 illustrates the self-seating mechanism in a configuration corresponding to a fully inserted position of the agitator 650, wherein the first connector 652 is fully received within the second connector 622 and within the socket 626, the lower lip 656 of the agitator 650 is at least partially received within the channel 632, and the slidable cams 647 are provided at a lowermost position corresponding to the fully inserted position.

In operation, when the agitator 650 is not coupled to the impeller 620, the self-seating mechanism occupies the initial insertion position, wherein the slidable cams 647 are provided at an uppermost position wherein at least one of the guiding ribs 648 is retained within the outwardly protruding upper channel portion 649, causing the slidable cams 647 to be deflected in such a way that the slidable cams 647 appear to be flexed upwardly and outwardly, opening up the channel 632 to allow for insertion or removal of the lower lip 656. When the slidable cams 647 are in the uppermost position, and flexed upwardly and outwardly into the upper channel portion 649, the slidable cams 647 are received at least partially within the upper channel portion 649 by an interference fit, such that the fit between the slidable cam 647, and in particular between at least one of the guiding ribs 648 and the upper channel portion 649 exerts enough frictional force so as to overcome the biasing force of the spring (not shown) pulling the slidable cam 647 downward toward the spring mount 646 and to retain the slidable cam 647 in the uppermost and flexed position.

When the self-seating mechanism is in the initial insertion position and the slidable cams 647 are in the uppermost and flexed position, the channel 632 is at least partially flexed open and oriented such that the agitator 650 can be inserted into the impeller 120 and causing the lower lip 656 to be inserted into the channel 632, and optionally also to couple with and align with the coupling plate 643. In one example, at least the weight of the agitator 650 is sufficient to cause the slidable cams 647 to move at least partially downward and out of the uppermost and flexed position by overcoming the interference fit between the slidable cam 647 and at least one guiding rib 648 with the upper channel portion 649.

When the slidable cams 647 have moved downwardly out of the uppermost and flexed position, the biasing force of the spring (not shown) is no longer overcome by the interference fit with the upper channel portion 649, allowing the slidable cams 647 to be biased or pulled downwardly along the cam channel 639 toward the spring mount 646, and in turn causing the agitator 650, and specifically the first connector 652, to be biased, drawn, or pulled downwardly into the socket 626 until slidable cams 647 are in the lowermost position and the agitator 650 has reached the fully inserted position. In this way, the user need not push the agitator 650 all the way into the fully inserted position, but can simply place or set the agitator 650 within the socket 626 and the self-seating mechanism will function to draw the agitator 650 downwardly, the rest of the way into the socket 626 and to the fully inserted position, similar to a soft-close drawer slide. This provides not only smoother movement of insertion of the agitator 650, but also can provide a more secure and stable coupling of the agitator 650 to the impeller 620 because the agitator 650 is being held down such that wobbling of the agitator 650 can be reduced.

To uncouple the agitator 650 from the impeller 620 in FIG. 17, the user can simply pull upwardly on the agitator 650 to overcome the biasing force holding the agitator 650 down. The upward pulling by the user will withdraw the agitator 650 from the impeller 620 and also move the slidable cams 647 upwardly, to be retained in the uppermost position within the upper channel portion 649, such that they are in position to receive the agitator 650 when the user should decide to re-couple the agitator 650 with the impeller 620.

FIGS. 18-21 illustrate another example of a clothes mover 700 including an impeller 720 and an agitator 750 for use in the laundry treating appliance 10 described herein that are similar to the clothes mover 100, impeller 120, and agitator 150 of FIG. 5 and to the clothes mover 200, impeller 220, and agitator 250 of FIG. 6, but differs in some aspects, such as the manner in which the agitator 750 is coupled with the impeller 720. Therefore, elements of the clothes mover 700, impeller 720, and agitator 750 that are similar to those of the clothes mover 100, impeller 120, and agitator 150 and the clothes mover 200, impeller 220, and agitator 250 are labeled with the prefix 700.

Figure 18:
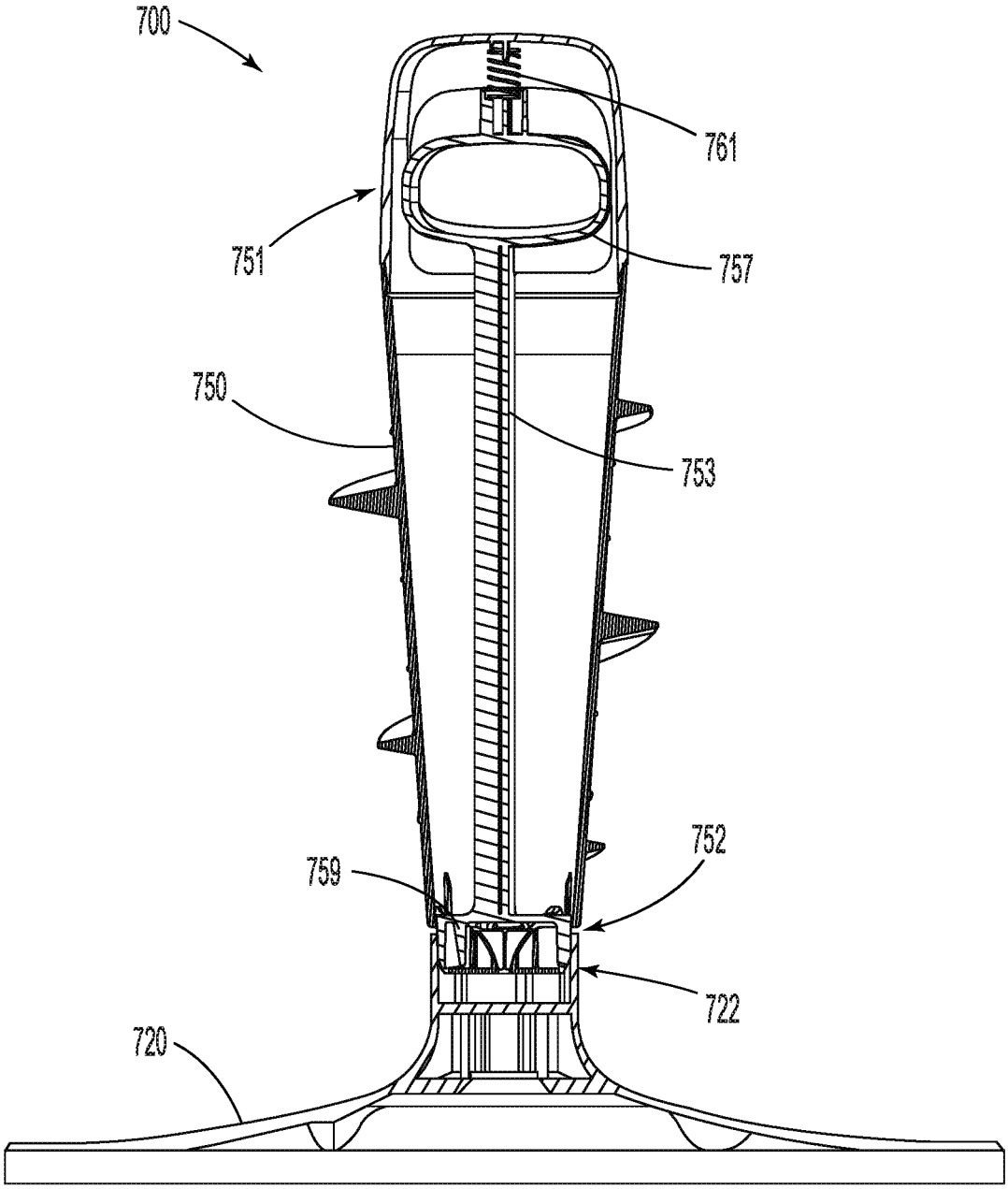
FIG. 18 is a perspective cross-sectional view of another example of an agitator coupling to an impeller for use with the clothes mover and laundry treating appliance of FIG. 1.

Referring now to FIG. 18, the agitator 750 is coupled to the impeller 720 to form the clothes mover 700 using a bayonet mount-type connection. The agitator 750 includes a grip portion, illustrated herein as a handle portion 751 at an upper end of the agitator 750. The handle portion 751 can facilitate insertion, removal, and storage of the agitator 750 by the user by giving the user a convenient handle to grip onto and to rotate the agitator 750 as needed. The agitator 750 further includes a handle pull locking post 753 provided within the interior of the agitator 750, such that the locking post 753 is nested within the agitator 750. The locking post 753 can include a handle pull portion 757 positioned such that the user can grip the handle portion 751 of the agitator 750 and the handle pull portion 757 of the locking post 753 at the same time. The locking post 753 further defines at least one pin 759 protruding downwardly from a lower end of the locking post 753. The at least one pin 759 can be thought of as forming a portion of the first connector 752. The locking post 753 can be movable within and relative to the agitator 750, for example such that the locking post 753 is vertically slidable within and relative to the agitator 750 between a lower, locking position and a raised position. A biasing element, illustrated herein as a handle pull spring 761 extends between the handle portion 751 and the handle pull portion 757 so as to bias the locking post 753 downwardly from the handle portion 751 when not compressed by the user.

Figure 19:
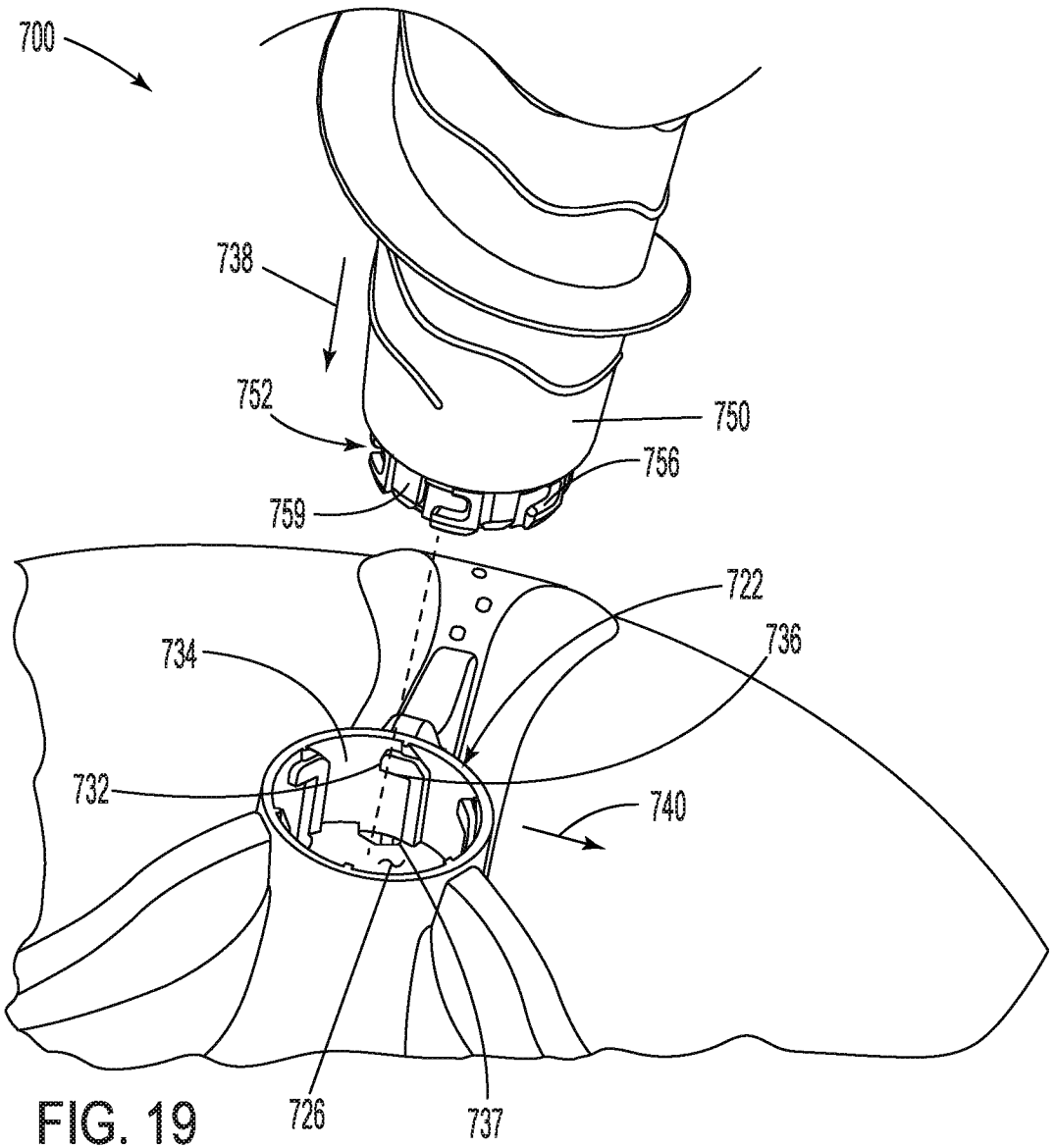
FIG. 19 is a perspective view of the agitator coupling to the impeller of FIG. 18.

FIG. 19 illustrates the second connector 722 including at least one channel 732 configured to receive at least one pin 756 carried by the first connector 752. The at least one pin 759, illustrated herein as a plurality of pins 759, can protrude downwardly from the locking post 753, and thus also from the agitator 750, adjacent the at least one pin 756. In one example, the pins 759 and the pins 756 can be provided in an alternating manner, such that the pins 759 are received between the pins 756. The second connector 722 can further define at least one locking opening 737, which can be provided in a bottom wall of the second connector 722. The second connector 722 optionally includes a biasing element, such as at least one spring (not shown), which can be the same as the spring 228 of FIG. 6 and operating in a manner similar to that described above with respect to the first and second connectors 252, 222 of FIG. 6, within the socket 726 which is compressed within the socket 726 when the agitator 750 is coupled with the impeller 720, as illustrated in FIG. 18.

Figure 20:
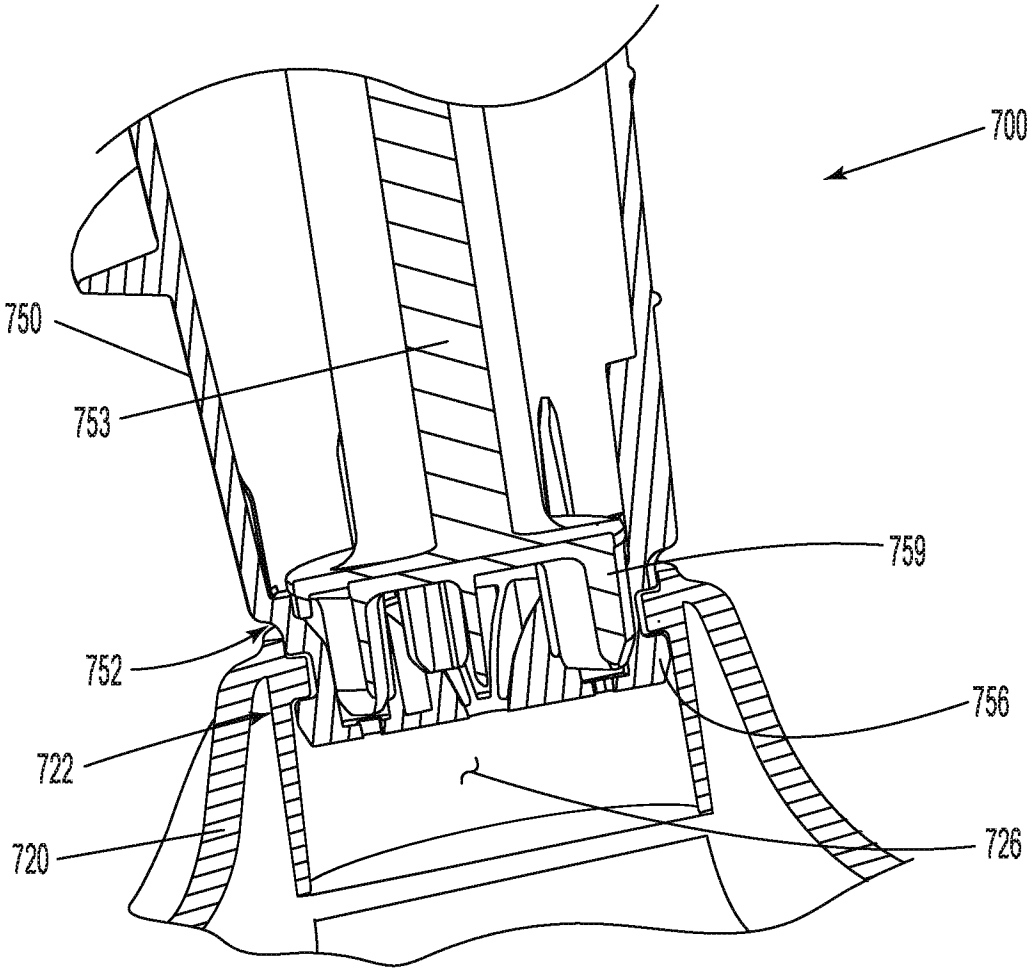
FIG. 20 is a cross-sectional view of the agitator coupling to the impeller of FIG. 18 in a first position.

To assemble the clothes mover 700, the agitator 750 is aligned with the impeller 720 such that the at least one pin 756 is aligned with at least one opening 734 of the channels 732. It is contemplated that the user can grip the agitator 750 by the handle portion 751 during insertion of the agitator 750 into the impeller 720. Further, the user can also grip the handle pull portion 757 of the locking post 753 at the same time, compressing the handle pull spring 761 and holding the locking post 753 in the raised position. The agitator 750 is moved toward the impeller 720, as illustrated by arrow 738, to insert the first connector 752 into the second connector 722. As the first connector 752 is inserted into the second connector 722, the pin 756 travels into the channel 732. The locking post 753 can be maintained in the raised position by the grip of the user against the handle pull portion 757 and the handle portion 751. The agitator 750 is then rotated, as illustrated by arrow 740, to move the pin 756 into a lock portion 736 of the channel 732, as illustrated in FIG. 20. In one example, the at least one locking opening 737 can be positioned beneath the lock portion 736 of the channel 732. Further, the first and second connectors 752, 722 can be positioned and sized such that the locking post 753 must be held in the raised position to prevent the pins 759 from protruding downwardly beyond the pins 756 and in order for the agitator 750 to be rotated as illustrated by arrow 740.

In FIG. 20, the agitator 750 is coupled with the impeller 720, with the pins 756 engaging the lock portion 736 of the channel 732. The locking post 753 is still provided in the raised position, such that the pins 759 do not exceed downwardly beyond the pins 756. When the agitator 750 is coupled with the impeller 720, the spring (not shown), or other biasing element, biases the agitator 750 away from the impeller 720, facilitating maintaining the pin 756 in the lock portion 736. The spring bias (not shown) applies a force that presses the agitator 750, and thus the pin 756, upward, which presses the pin 756 upwardly against the wall forming the lock portion 736. Biasing the pin 756 against the wall of the lock portion 736 can inhibit unintended rotation of the agitator 750 relative to the impeller 720 during a cycle of operation into a position in which the pin 756 is aligned with the channel opening 734, which could result in unintended uncoupling of the agitator 750 from the impeller 720.

Figure 21:
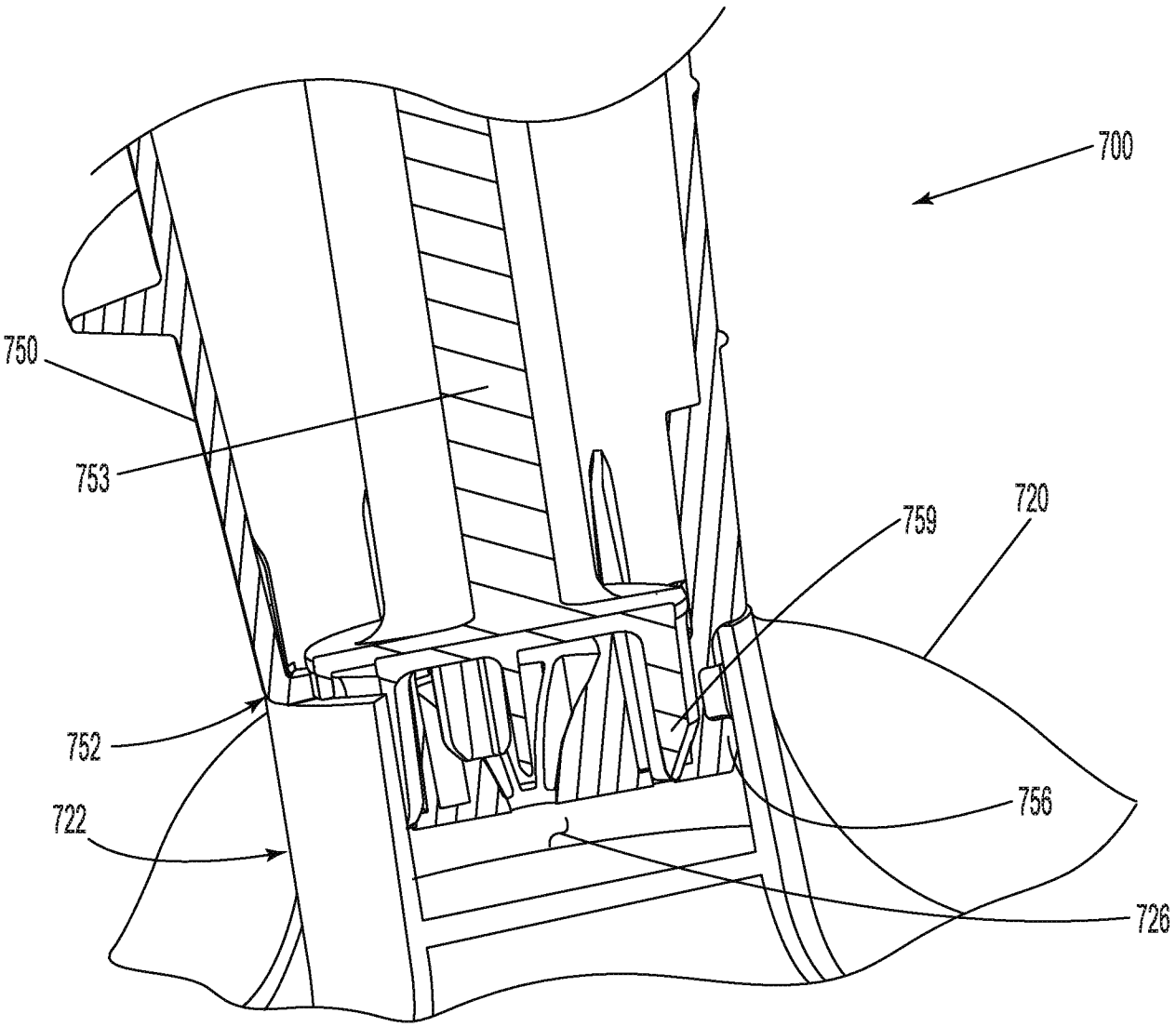
FIG. 21 is a cross-sectional view of the agitator coupling to the impeller of FIG. 20 in a second position.

Referring now to FIG. 21, and in order to further inhibit unintended rotation of the agitator 750 relative to the impeller 720 during a cycle of operation, once the agitator 750 has been rotated to move the pins 756 into the lock portion 736, the pins 759 of the locking post 753 overlie and are aligned with the locking openings 737. The user can release the handle pull portion 757 and the handle portion 751, allowing the handle pull spring 761 to bias the locking post 753 downwardly. As the handle pull spring 761 biases the locking post 753 downwardly, the pins 759 are moved downwardly to be inserted into and received within the locking openings 737. When the pins 759 are received within the locking openings 737, unintended rotation of the agitator 750 relative to the impeller 720 during a cycle of operation is inhibited. Further, the engagement between the pins 756 and the lock portion 736 prevents unintended vertical movement of the agitator 750 relative to the impeller 720.

To uncouple the agitator 750 from the impeller 720, the user can again grip the agitator 750 by the handle portion 751 and can also grip the handle pull portion 757 of the locking post 753 and compress the handle pull spring 761 to hold the locking post 753 in the raised position, withdrawing the pins 759 from the locking openings 737, to permit rotational movement of the agitator 750. The agitator 750 can then be rotated in the opposite direction of arrow 740 of FIG. 19 until the pins 756 are no longer aligned with the lock portion 736 and are instead aligned with the at least one opening 734 of the channels 732. When the pins 756 are aligned with the at least one opening 734, the agitator 750 can be withdrawn in the opposite direction of arrow 738 of FIG. 19.

Figure 22:
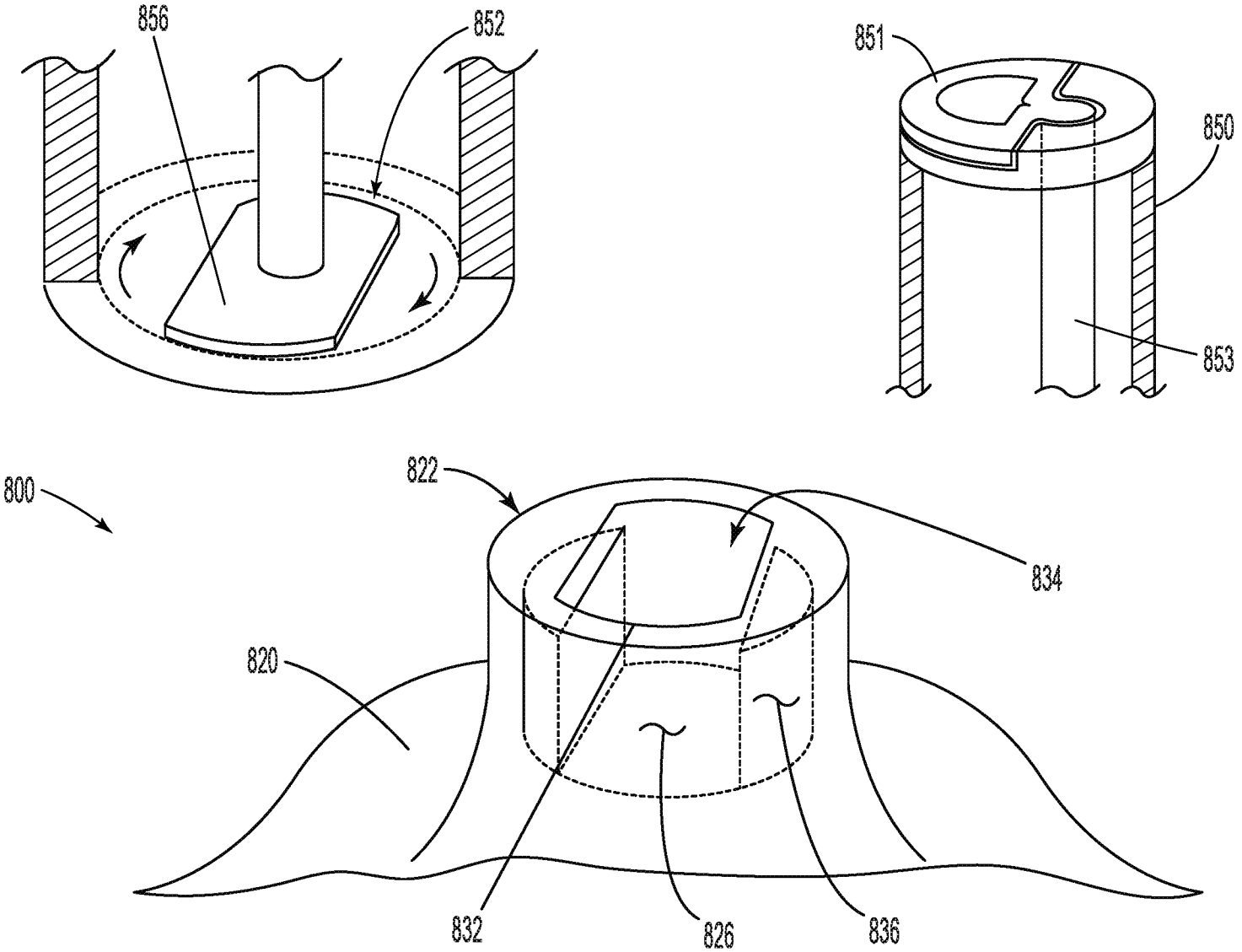
FIG. 22 is a schematic perspective view of another example of an agitator coupling to an impeller for use with the clothes mover and laundry treating appliance of FIG. 1.

FIG. 22 illustrates another example of a clothes mover 800 including an impeller 820 and an agitator 850 for use in the laundry treating appliance 10 described herein that are similar to the clothes mover 100, impeller 120, and agitator 150 of FIG. 5 and to the clothes mover 200, impeller 220, and agitator 250 of FIG. 6, but differs in some aspects, such as the manner in which the agitator 850 is coupled with the impeller 820. Therefore, elements of the clothes mover 800, impeller 820, and agitator 850 that are similar to those of the clothes mover 100, impeller 120, and agitator 150 and the clothes mover 200, impeller 220, and agitator 250 are labeled with the prefix 800.

The agitator 850 is coupled to the impeller 820 to form the clothes mover 800 using a bayonet mount-type connection. The second connector 822 includes at least one channel 832 configured to receive at least one retaining element 856, illustrated herein as a rotatable and non-circular bottom plate of the agitator 850, carried by the first connector 852. The second connector 822 optionally includes a biasing element, such as at least one spring (not shown), which can be the same as the spring 228 of FIG. 6 and operating in a manner similar to that described above with respect to the first and second connectors 252, 222 of FIG. 6, within the socket 826 which is compressed within the socket 826 when the agitator 850 is coupled with the impeller 820.

To assemble the clothes mover 800, the agitator 850 is aligned with the impeller 820 such that the retaining element 856 is aligned with an opening 834 of the channel 832. The agitator 850 is moved toward the impeller 820 to insert the first connector 852 into the second connector 822. As the first connector 852 is inserted into the second connector 822, the retaining element 856 travels to an end of the channel 832. Rather than rotating the entire agitator 850, the agitator 850 can comprise a handle portion 851 at an upper end of the agitator 850. In one example, the handle portion 851 can be foldable or pivotable relative to the agitator 850 such that the handle portion 851 can be at least partially received within and flush with the agitator 850 in a storage position and can be pivoted upward to protrude upwardly from the agitator 850 in a use position, as well as being rotatable relative to the agitator 850 in order to rotate the first connector 852. By way of further non-limiting example, the handle portion 851 can be provided as a D-ring latch, such as those that can be seen on a toolbox or a boat hatch latch. The handle portion 851 can be operably coupled with the retaining element 856 by a shaft 853 that extends within the agitator 850 and along the vertical height of the agitator 850. Thus, the handle portion 851 is then rotated to move the retaining element 856 into a lock portion 836 of the channel 832.

When the agitator 850 is coupled with the impeller 820, the spring (not shown), or other biasing element, biases the agitator 850 away from the impeller 820, facilitating maintaining the retaining element 856 in the lock portion 836. The spring bias (not shown) applies a force that presses the agitator 850, and thus the retaining element 856, upward, which presses the retaining element 856 upwardly to be received within the lock portion 836 and against the cavity wall forming the lock portion 836. Biasing the retaining element 856 against the cavity wall of the lock portion 836, such that the retaining element 856 is received within the cavity forming the lock portion 836, can inhibit unintended rotation of the agitator 850 relative to the impeller 820 during a cycle of operation into a position in which the retaining element 856 is aligned with the channel opening 834, which could result in unintended uncoupling of the agitator 850 from the impeller 820.

To uncouple the agitator 850 from the impeller 820, the handle portion 851 can again be rotated, in the direction opposite than before, to align the retaining element 856 with the channel opening 834. When the retaining element 856 is aligned with the channel opening 834, the agitator 850 can be withdrawn in an upward direction. Because the spring (not shown) is compressed when the agitator 850 is coupled with the impeller 820, the spring (not shown) provides a biasing force that presses the agitator 850 away from the impeller 820, which can facilitate withdrawing and uncoupling of the agitator 850. In another aspect of the disclosure, the spring is not present. Alternatively, the spring (not shown) can be carried by the agitator 850. The impeller 820 can be provided with a cover similar to any of those described with respect to the impellers 120, 220 of FIGS. 5 and 9. Either of the impeller 820 or the agitator 850, or both, can be provided with a locking mechanism.

Figure 23:
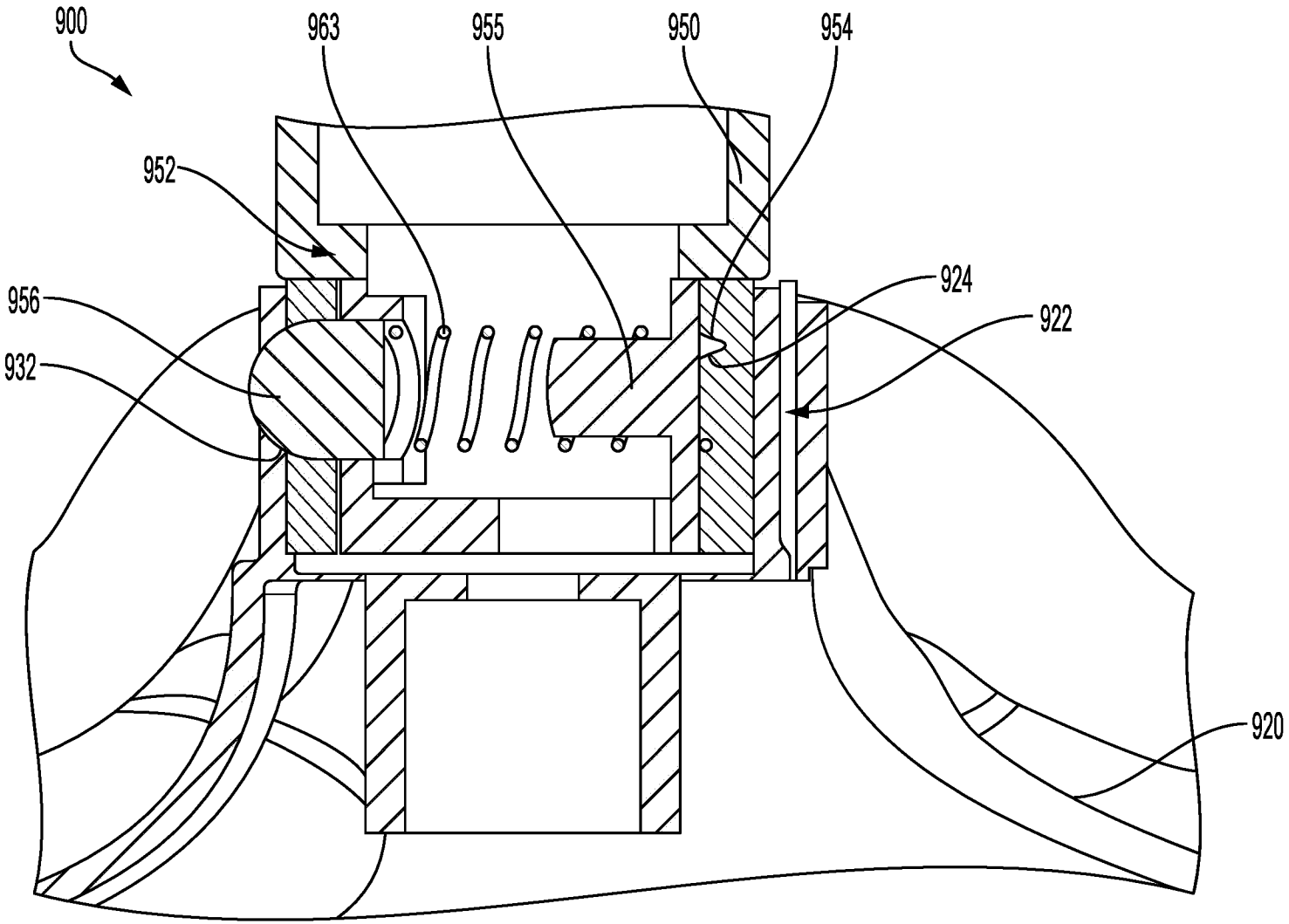
FIG. 23 is a side cross-sectional view of another example of an agitator coupling to an impeller for use with the clothes mover and laundry treating appliance of FIG. 1.

FIG. 23 illustrates another example of a clothes mover 900 including an impeller 920 and an agitator 950 for use in the laundry treating appliance 10 described herein, and that is similar to the clothes mover 100, impeller 120, and the agitator 150 of FIG. 5, but differs in some aspects, such as the manner in which the impeller 920 is coupled with the agitator 950. Therefore, elements of the clothes mover 900, impeller 920, and the agitator 950 that are similar to those of the clothes mover 100, impeller 120, and the agitator 150 are labeled with the prefix 900.

The agitator 950 is coupled to the impeller 920 to form the clothes mover 900 using a threadable connection very similar to that of the clothes mover 100 of FIG. 5, but additionally including a detent 956, illustrated herein as a ball or a rounded detent 956, to further inhibit both unintended rotation of the agitator 950 relative to the impeller 920 during a cycle of operation, and also to inhibit unintended axial or lateral displacement, such as upward or vertical movement of the agitator 950 relative to the impeller 920 during a cycle of operation, improving stability of the clothes mover 900. The first connector 952 further comprises the rounded detent 956 that protrudes radially outward from the first connector 952. A biasing element, illustrated herein as a spring 963 can extend between the rounded detent 956 and a spring mount 955 to bias the rounded detent 956 radially outward. The second connector 922 can further include an opening 932 within which the rounded detent 956 can be received and can protrude radially outwardly through. The second connector 922 optionally includes a biasing element, such as at least one spring (not shown), which can be the same as the spring 228 of FIG. 6 and operating in a manner similar to that described above with respect to the first and second connectors 252, 222 of FIG. 6, within the socket 926 which is compressed within the socket 926 when the agitator 950 is coupled with the impeller 920.

To assemble the clothes mover 900, the agitator 950 is aligned with the impeller 920 and is moved toward the impeller 920 to insert the first connector 952 into the second connector 922. As the first connector 952 is threaded onto the second connector 922, the first connector 952 travels into the socket 926. The movement of the first connector 952 into the socket 926 depresses the rounded detent 956 inwardly against the spring 963 until the rounded detent 956 comes into alignment with the opening 932, and then is biased outwardly through the opening 932 to further retain the first connector 952 within the second connector 922.

To uncouple the agitator 950 from the impeller 920, the user can manually depress the rounded detent 956 radially inwardly so that it is no longer received within the opening 932, allowing the first connector 952 to then be unthreaded and withdrawn from the socket 926. The impeller 920 can be provided with a cover similar to any of those described with respect to the impellers 120, 220 of FIGS. 5 and 9. Either of the impeller 920 or the agitator 950, or both, can be provided with a locking mechanism.

Figure 24:
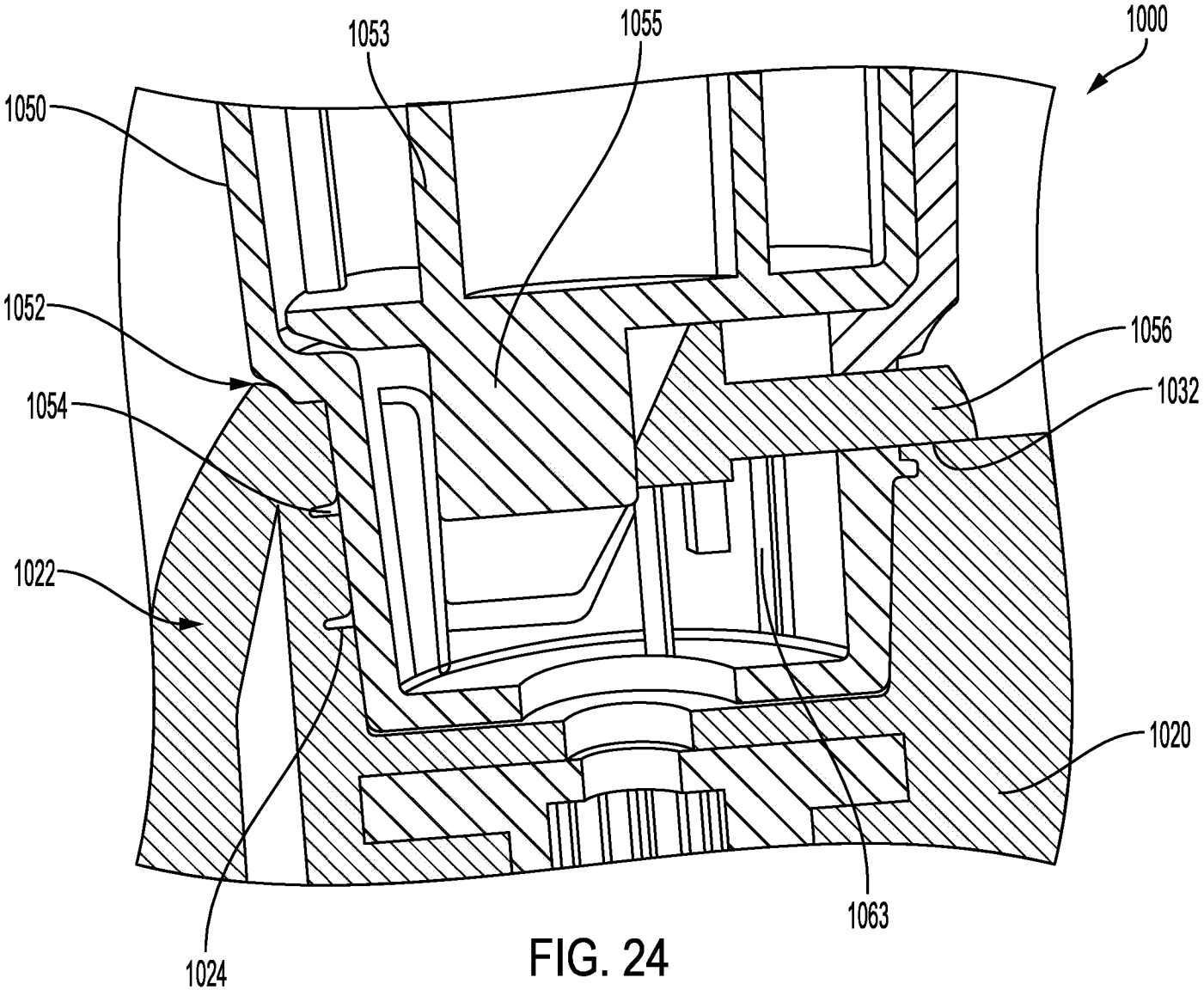
FIG. 24 is a side cross-sectional view of another example of an agitator coupling to an impeller for use with the clothes mover and laundry treating appliance of FIG. 1.

FIG. 24 illustrates another example of a clothes mover 1000 including an impeller 1020 and an agitator 1050 for use in the laundry treating appliance 10 described herein that is similar to the impeller 120 and the agitator 150 of FIG. 5 and to the impeller 920 and the agitator 950 of FIG. 23, but differs in some aspects, such as the manner in which the agitator 1050 is coupled with the impeller 1020. Therefore, elements of the clothes mover 1000, agitator 1050, and impeller 1020 that are similar to those of the clothes mover 100, agitator 150, and impeller 120 are labeled with the prefix 1000.

The agitator 1050 is coupled to the impeller 1020 to form the clothes mover 1000 using a threadable connection very similar to that of the clothes mover 100 of FIG. 5, but additionally including a spring-loaded pin 1056 to further inhibit both unintended rotation of the agitator 1050 relative to the impeller 1020 during a cycle of operation, and also to inhibit unintended lateral displacement, such as upward or vertical movement of the agitator 1050 relative to the impeller 1020 during a cycle of operation, improving stability of the clothes mover 1000. The first connector 1052 further comprises the spring-loaded pin 1056 that can protrude radially outward from the first connector 1052. A biasing element, illustrated herein as a spring 1063 can extend between the first connector 1052 and the pin 1056 to bias the pin 1056 radially inwardly.

The agitator 1050 can further include a locking ramp 1055 provided within the agitator 1050 and operably coupled via a shaft 1053 with an actuator on the agitator 1050. The locking ramp 1055, and thus also the shaft 1053, can be movable within and relative to the agitator 1050 between a lower, locking position and a raised position. The actuator can be any suitable mechanism that results in downward movement of the locking ramp 1055 relative to the pin 1056, such as, for example, a push-button at an upper end of the agitator 1050. When the locking ramp 1055 is moved into the lower, locking position, the locking ramp 1055 bears against a corresponding ramped surface of the pin 1056, biasing the pin 1056 radially outward to overcome the force of the spring 1063 and to protrude radially outwardly from the first connector 1052. In one non-limiting example, the actuator to cause the selective downward movement of the locking ramp 1055 into the lower, locking position can be a push-push mechanism similar to a clickable pen. The second connector 1022 can further include an opening 1032 within which the pin 1056 can be received and can protrude radially outwardly through.

To assemble the clothes mover 1000, the agitator 1050 is aligned with the impeller 1020 and is moved toward the impeller 1020 to insert the first connector 1052 into the second connector 1022. As the first connector 1052 is threaded into the second connector 1022, the first connector 1052 travels into the socket 1026. As the locking ramp 1055 is not actuated into the lower, locking position, and thus the pin 1056 does not protrude outward from the first connector 1052, the first connector 1052 can be threaded all the way into the second connector 1022. Once the first connector 1052 is fully received within the second connector 1022, the actuator can be depressed as desired by the user to cause downward movement of the locking ramp 1055, which in turn causes radially outward movement of the pin 1056 to protrude outwardly from the first connector 1052 and then through the opening 1032 to further retain the first connector 1052 within the second connector 1022.

To uncouple the agitator 1050 from the impeller 1020, the user can again manually depress or otherwise deactivate the actuator, such as by pulling the actuator upward into an un-depressed position, which moves the locking ramp 1055 upwardly such that it no longer displaces and outwardly biases the pin 1056. Instead, the pin 1056 can then be biased into the interior of the first connector 1052 by the spring 1063, so that the pin 1056 is no longer retained by the opening 1032, allowing the first connector 1052 to then be unthreaded and withdrawn from the socket 1026. The impeller 1020 can be provided with a cover similar to any of those described with respect to the impellers 120, 220 of FIGS. 5 and 9. Either of the impeller 1020 or the agitator 1050, or both, can be provided with a locking mechanism.

Figure 25:
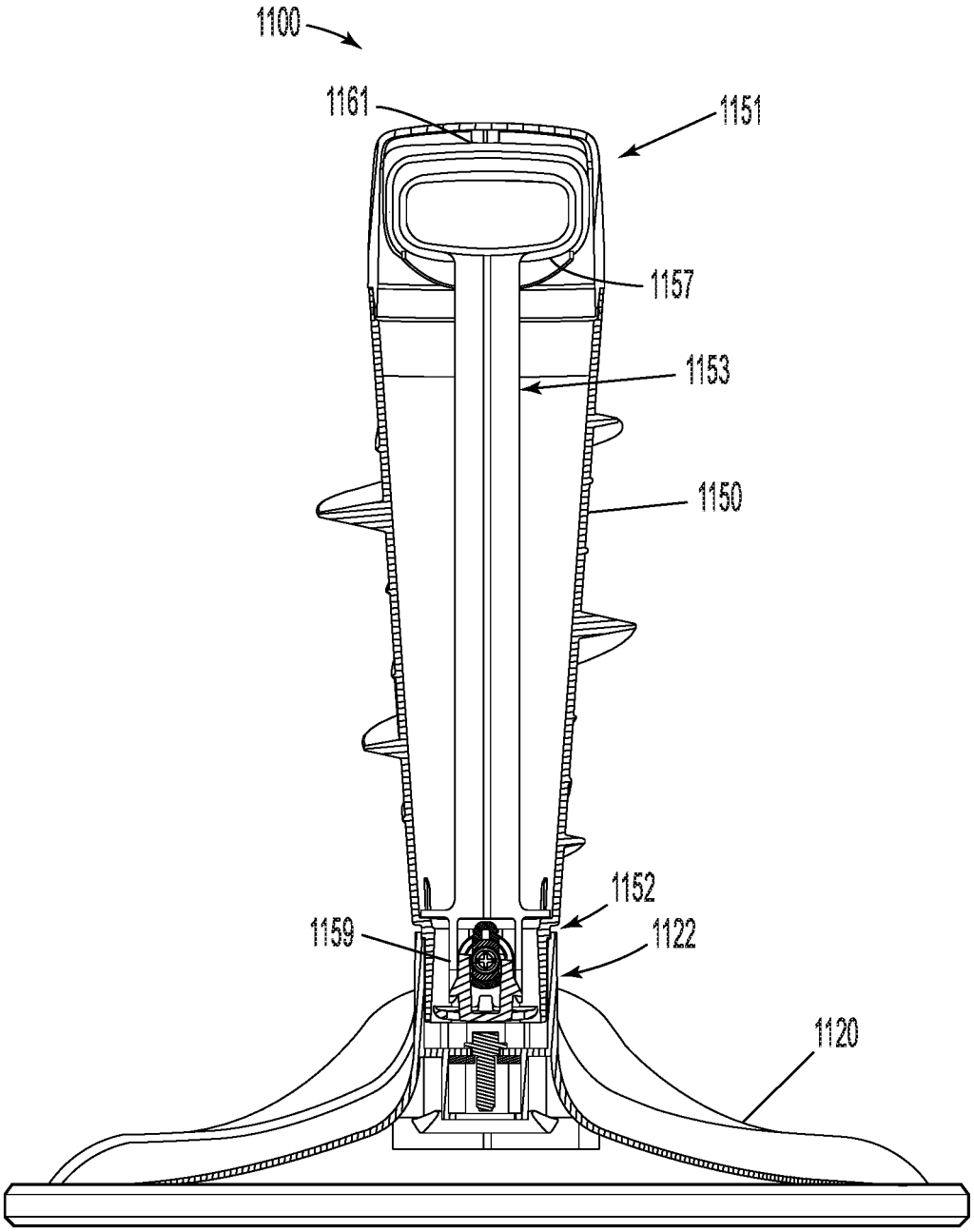
FIG. 25 is a side cross-sectional view of another example of an agitator coupling to an impeller for use with the clothes mover and laundry treating appliance of FIG. 1.
Figure 26:
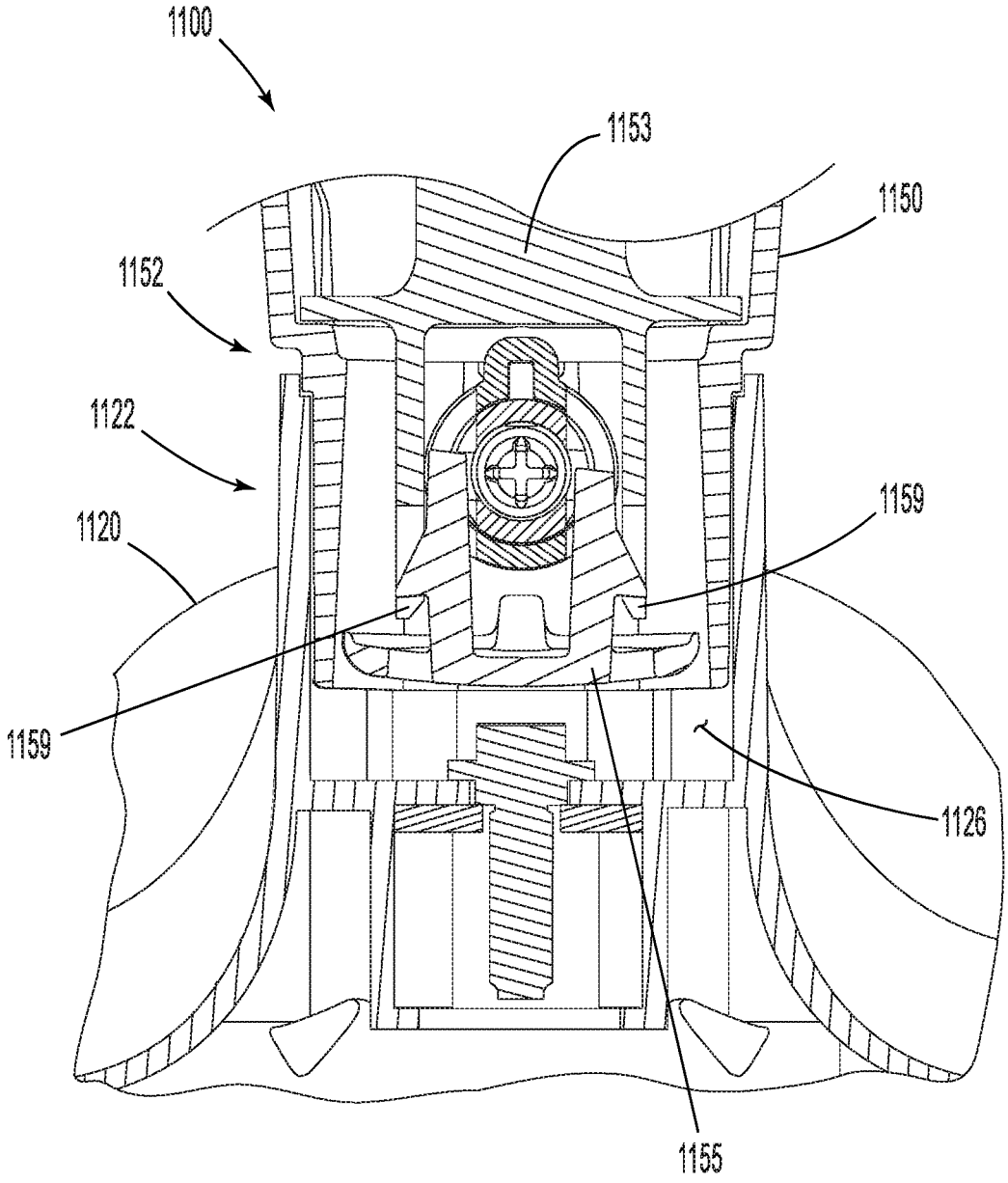
FIG. 26 is an enlarged side cross-sectional view of a portion of the agitator coupling to the impeller of FIG. 25.
Figure 27:
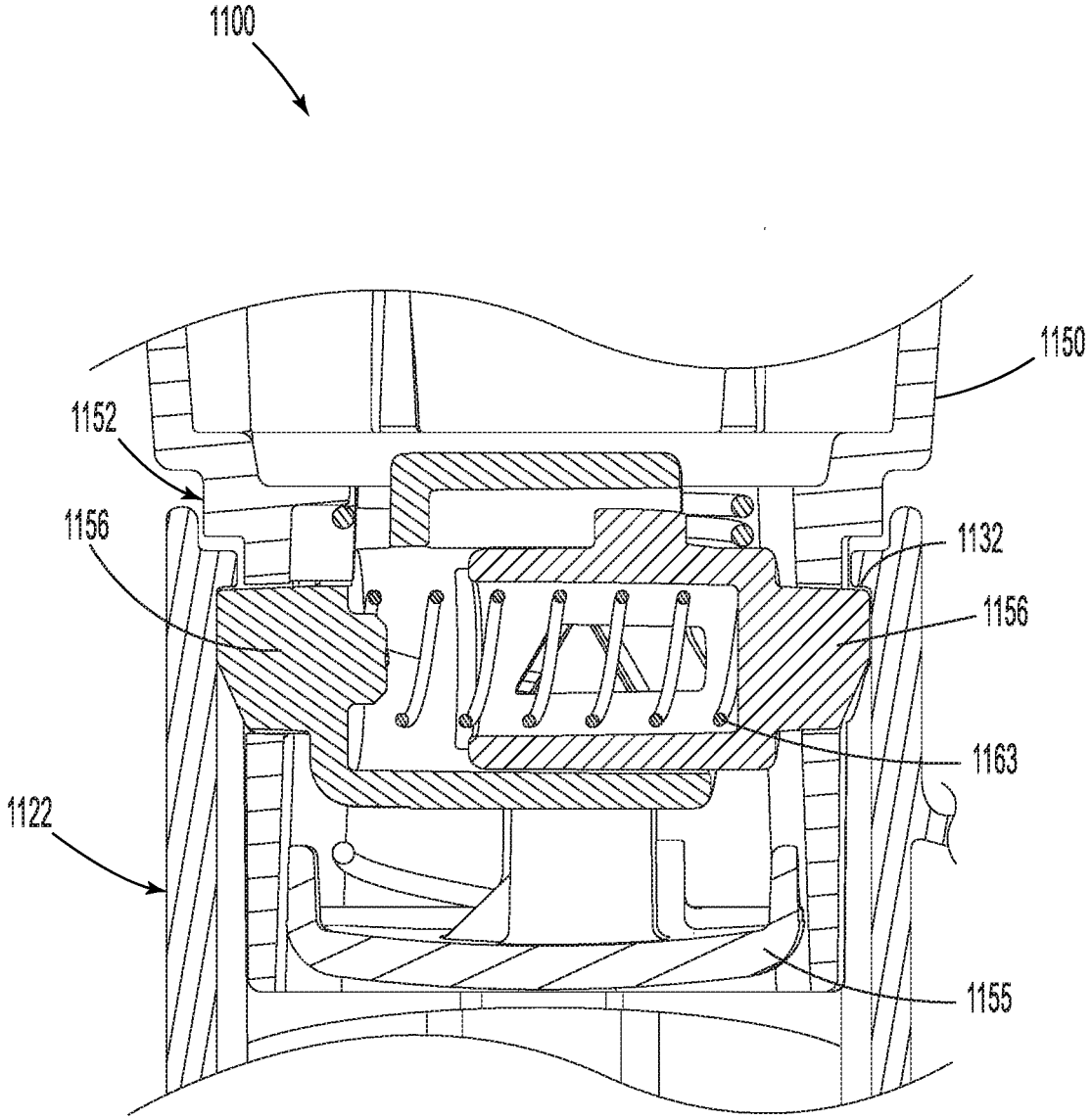
FIG. 27 is an enlarged side cross-sectional view of a portion of the agitator coupling to the impeller of FIG. 25.

FIGS. 25-27 illustrate another example of a clothes mover 1100 including an impeller 1120 and an agitator 1150 for use in the laundry treating appliance 10 described herein that are similar to the clothes mover 100, impeller 120, and agitator 150 of FIG. 5, to the clothes mover 200, impeller 220, and agitator 250 of FIG. 6, and to the clothes mover 700, impeller 720, and agitator 750 of FIG. 18, but differ in some aspects, such as the manner in which the agitator 1150 is coupled with the impeller 1120. Therefore, elements of the clothes mover 1100, impeller 1120, and agitator 1150 that are similar to those of the clothes mover 100, impeller 120, and agitator 150, the clothes mover 200, impeller 220, and agitator 250, and the clothes mover 700, impeller 720, and agitator 750 are labeled with the prefix 1100.

Referring now to FIG. 25, the agitator 1150 is coupled to the impeller 1120 to form the clothes mover 1100 using a spring-biased engagement connection. The agitator 1150 includes a grip portion, illustrated herein as a handle portion 1151 at an upper end of the agitator 1150. The handle portion 1151 can facilitate insertion, removal, and storage of the agitator 1150 by the user by giving the user a convenient handle to grip onto and to rotate the agitator 1150 as needed. The agitator 1150 further includes a handle pull locking post 1153 provided within the interior of the agitator 1150, such that the locking post 1153 is nested within the agitator 1150. The locking post 1153 can include a handle pull portion 1157 positioned such that the user can grip the handle portion 1151 of the agitator 1150 and the handle pull portion 1157 of the locking post 1153 at the same time. The locking post 1153 can be movable within and relative to the agitator 1150, for example such that the locking post 1153 is vertically slidable within and relative to the agitator 1150 between a lower, locking position and a raised position. A biasing element, illustrated herein as a handle pull spring 1161 extends between the handle portion 1151 and the handle pull portion 1157 so as to bias the locking post 1153 downwardly from the handle portion 1151 when not compressed by the user.

Referring now to FIG. 26, the locking post 1153 further defines at least one retaining rib 1159 protruding downwardly from a lower end of the locking post 1153. The at least one retaining rib 1159 can be thought of as forming a portion of the first connector 1152. The first connector 1152 further includes a biasing cap 1155 which can be retained between and operably coupled within the retaining ribs 1159. The second connector 1122 optionally includes a biasing element, such as at least one spring (not shown), which can be the same as the spring 228 of FIG. 6 and operating in a manner similar to that described above with respect to the first and second connectors 252, 222 of FIG. 6, within the socket 1126 which is compressed within the socket 1126 when the agitator 1150 is coupled with the impeller 1120, as illustrated in FIG. 25.

FIG. 27 illustrates that the first connector 1152 further includes a pair of spring-loaded detents 1156 that are biased outwardly and in opposite direction from one another by a spring 1163 that extends between the two detents 1156. The biasing cap 1155 is further operably coupled with the pair of spring-loaded detents 1156. The second connector 1122 includes a retaining opening 1132 configured to retain the pair of spring-loaded detents 1156 carried by the first connector 1152.

To assemble the clothes mover 1100, the agitator 1150 is aligned with the impeller 1120. The agitator 1150 is moved toward the impeller 1120 to insert the first connector 1152 into the second connector 1122. As the first connector 1152 is inserted into the second connector 1122, the pair of spring-loaded detents 1156 come into contact with, and can be inwardly compressed by, contact with the second connector 1122, and specifically with the retaining opening 1132. The movement of the first connector 1152 into the socket 1126 depresses the pair of spring-loaded detents 1156 inwardly against the spring 1163 until the pair of spring-loaded detents 1156 has moved past the retaining opening 1132 and then can be at least partially biased radially outwardly, past the diameter of the retaining opening 1132, such that the retaining opening 1132 prevents upward movement of the pair of spring-loaded detents 1156 to retain the first connector 1152 within the second connector 1122.

The agitator 1150 is coupled with the impeller 1120, with the pair of spring-loaded detents 1156 engaging the retaining opening 1132. When the agitator 1150 is coupled with the impeller 1120, the spring (not shown), or other biasing element, biases the agitator 1150 away from the impeller 1120. The spring bias (not shown) applies a force that presses the agitator 1150, and thus the pair of spring-biased detents 1156, upward, which presses the pair of spring-biased detents 1156 upwardly against the wall forming the retaining opening 1132. Biasing the pair of spring-biased detents 1156 against the wall of the retaining opening 1132 can inhibit unintended rotation of the agitator 1150 relative to the impeller 1120 during a cycle of operation.

To uncouple the agitator 1150 from the impeller 1120, the user can grip the agitator 1150 by the handle portion 1151 and can also grip the handle pull portion 1157 of the locking post 1153 at the same time, compressing the handle pull spring 1161 and holding the locking post 1153 in the raised position. By pulling the handle pull portion 1157 to compress the handle pull spring 1161 and raise the locking post 1153 into the raised position, the retaining ribs 1159 are also moved upwardly, thus also pulling upwardly on the biasing cap 1155. By pulling upwardly on the biasing cap 1155, the biasing cap 1155 is brought to move upwardly adjacent to and to bear against the pair of spring-loaded detents 1156. Specifically, the outer edge or edges of the biasing cap 1155 can bear against the pair of spring-loaded detents 1156, causing the pair of spring-loaded detents 1156 to be biased radially inwardly by translational movement, overcoming the spring 1163, releasing the pair of spring-loaded detents 1156 from engagement with the retaining opening 1132 and allowing the agitator 1150 to be withdrawn from the impeller 1120.

Figure 28:
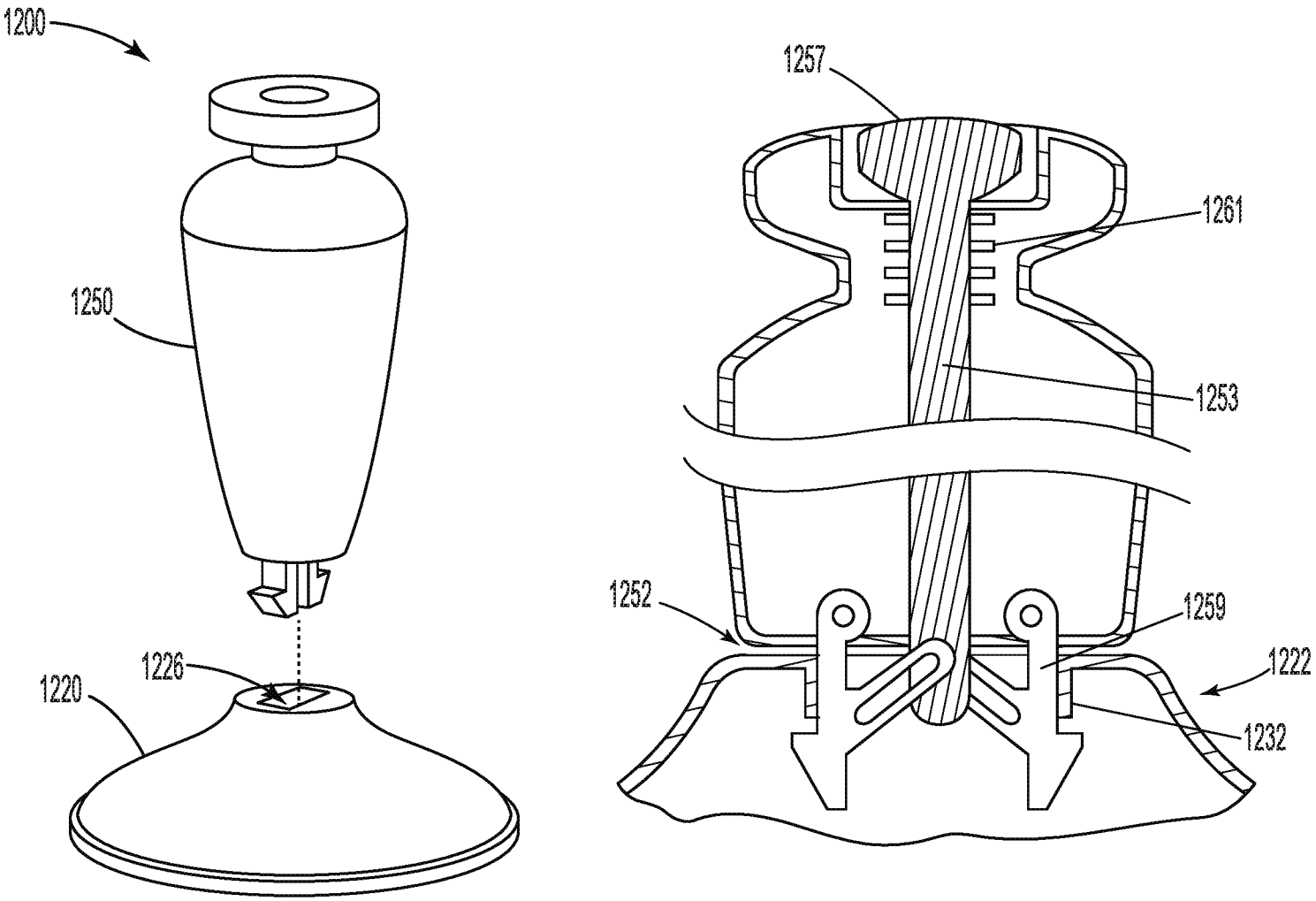
FIG. 28 is a schematic perspective view of another example of an agitator coupling to an impeller for use with the clothes mover and laundry treating appliance of FIG. 1.

FIG. 28 illustrates another example of a clothes mover 1200 including an impeller 1220 and an agitator 1250 for use in the laundry treating appliance 10 described herein that are similar to the clothes mover 100, impeller 120, and agitator 150 of FIG. 5 and to the clothes mover 200, impeller 220, and agitator 250 of FIG. 6, but differ in some aspects, such as the manner in which the agitator 1250 is coupled with the impeller 1220. Therefore, elements of the clothes mover 1200, impeller 1220, and agitator 1250 that are similar to those of the clothes mover 100, impeller 120, and agitator 150 and the clothes mover 200, impeller 220, and agitator 250 are labeled with the prefix 1200.

The agitator 1250 is coupled to the impeller 1220 to form the clothes mover 1200 using a locking latch connection mechanism. The second connector 1222 includes at least one channel 1232, which can be provided as a retaining rib, configured to engage with and receive a portion of at least one locking latch 1259 carried by the first connector 1252. The second connector 1222 optionally includes a biasing element, such as at least one spring (not shown), which can be the same as the spring 228 of FIG. 6 and operating in a manner similar to that described above with respect to the first and second connectors 252, 222 of FIG. 6, within the socket 1226 which is compressed within the socket 1226 when the agitator 1250 is coupled with the impeller 1220.

The agitator 1250 can include a locking latch actuator shaft 1253 having a lock button 1257 provided at an upper end of the actuator shaft 1253 and also at the upper end of the agitator 1250. An actuator spring 1261 is provided about a portion of the actuator shaft 1253 adjacent the lock button 1257 for providing or forming a part of an actuating mechanism. The actuator shaft 1253 is further operably coupled with the locking latches 1259 such that the locking latches 1259 are movable relative to the actuator shaft 1253, for example, for pivotal movement relative to the actuator shaft 1253. In one example, the locking latches 1259 are biased radially outwardly from the actuator shaft 1253. By way of further non-limiting example, the actuator shaft 1253 can be configured to translate axial or vertical movement (i.e., depression) of the actuator 1253 and the lock button 1257 to radial movement of the locking latches 1259 to extend and to be biased radially outward and engage with the channel 1232 to retain the agitator 1250 within the impeller 1220. For example, the lock button 1257 can function as a push button that can be pushed downwardly or raised upwardly, or the lock button 1257 can function like a clickable pen such that successive pushes of the lock button 1257 can alternately or selectively release the locking latches 1259 from engagement with the channel 1232 or bias the locking latches 1259 towards engagement with the channel 1232.

To assemble the clothes mover 1200, the agitator 1250 is aligned with the impeller 1220 and is moved toward the impeller 1220 to insert the first connector 1252 into the second connector 1222. When the first connector 1252 has traveled into the socket 1226, the lock button 1257 can be depressed as desired by the user to cause radially outward movement of the locking latches 1259 to engage with the channel 1232 and to lock or retain the first connector 1252 within the second connector 1222. To uncouple the agitator 1250 from the impeller 1220, the user can again manually depress or otherwise deactivate the lock button 1257, such as by pulling the lock button 1257 upward into an undepressed position, such that the actuator shaft 1253 no longer causes the locking latches 1259 to be outwardly biased and to couple with the second connector 1222, allowing the first connector 1252 to be withdrawn from the socket 1226. The impeller 1220 can be provided with a cover similar to any of those described with respect to the impellers 120, 220 of FIGS. 5 and 9. Either of the impeller 1220 or the agitator 1250, or both, can be provided with a locking mechanism.

Figure 29:
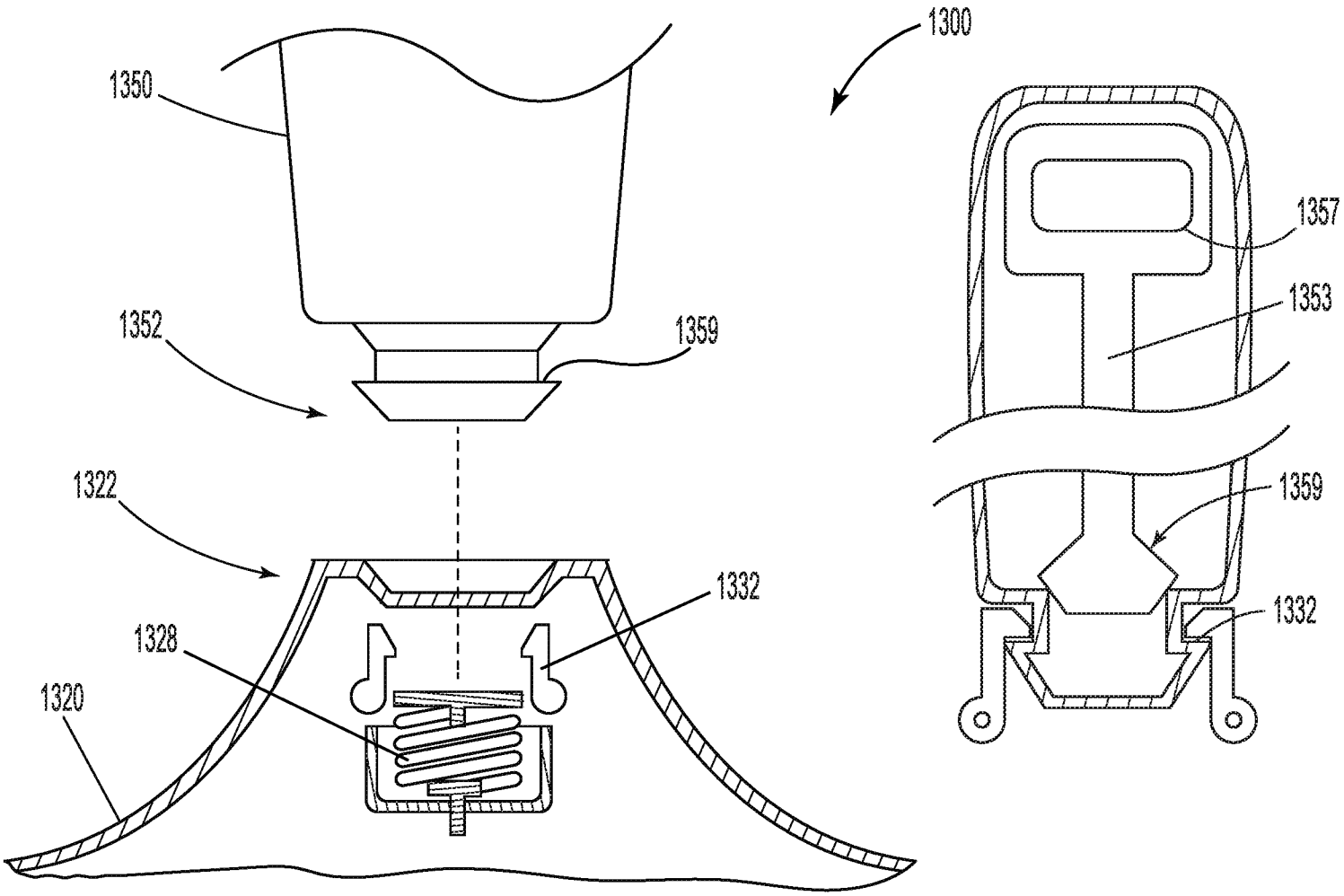
FIG. 29 is a schematic cross-sectional view of another example of an agitator coupling to an impeller for use with the clothes mover and laundry treating appliance of FIG. 1.

FIG. 29 illustrates another example of a clothes mover 1300 including an impeller 1320 and an agitator 1350 for use in the laundry treating appliance 10 described herein that are similar to the clothes mover 100, impeller 120, and agitator 150 of FIG. 5 and to the clothes mover 200, impeller 220, and agitator 250 of FIG. 6, but differs in some aspects, such as the manner in which the agitator 1350 is coupled with the impeller 1320. Therefore, elements of the clothes mover 1300, impeller 1320, and agitator 1350 that are similar to those of the clothes mover 100, impeller 120, and agitator 150 and the clothes mover 200, impeller 220, and agitator 250 are labeled with the prefix 1300.

The agitator 1350 is coupled to the impeller 1320 to form the clothes mover 1300 using a locking latch mechanism connection. The first connector 1352 includes at least one retaining rib 1359 configured to engage with and selectively be retained by at least one locking latch 1332 carried by the second connector 1322. The second connector 1322 optionally includes a biasing element, such as at least one spring 1328, which can be the same as or similar to the spring 228 of FIG. 6 and operating in a manner similar to that described above with respect to the first and second connectors 252, 222 of FIG. 6, within the socket 1326 which is compressed within the socket 1326 when the agitator 1350 is coupled with the impeller 1320.

The agitator 1350 can include a disengagement actuator shaft 1353 having a grip or handle portion 1357 at an upper end of the actuator shaft 1353 and agitator 1350. The actuator shaft 1353 can further be operably coupled to the retaining rib 1359. The locking latches 1332 are spring-loaded and biased to engage with the retaining rib 1359 when the agitator 1350 is inserted.

To assemble the clothes mover 1300, the agitator 1350 is aligned with the impeller 1320 and is moved toward the impeller 1320 to insert the first connector 1352 into the second connector 1322. When the first connector 1352 has traveled into the socket 1326, the locking latches 1332 are biased, for example, spring-loaded by the spring 1328, to engage with the retaining rib 1359 to retain the retaining rib 1359 between the locking latches 1332.

To uncouple the agitator 1350 from the impeller 1320, the disengagement actuator shaft 1353 can act as an axial disengagement trigger mechanism such that when the user applies upward force to the handle 1357, the actuator shaft 1353 can move upwardly with sufficient force to "kick off" or to bias the locking latches 1332 out of engagement with the retaining rib 1359 and allowing the first connector 1352 to be withdrawn from the socket 1326. Alternately, a push button can be provided with the handle 1357, such that depressing the push button functions as the disengagement trigger, rather than applying upward force to the handle 1357. The impeller 1320 can be provided with a cover similar to any of those described with respect to the impellers 120, 220 of FIGS. 5 and 9. Either of the impeller 1320 or the agitator 1350, or both, can be provided with a locking mechanism.

FIGS. 30-34 illustrate another example of a clothes mover 1400 including an impeller 1420 and an agitator 1450 for use in the laundry treating appliance 10 described herein that are similar to the clothes mover 100, impeller 120, and agitator 150 of FIG. 5, to the clothes mover 200, impeller 220, and agitator 250 of FIG. 6, and to the clothes mover 700, impeller 720, and agitator 750 of FIG. 18, but differ in some aspects, such as the manner in which the impeller 1420 is coupled with the agitator 1450. Therefore, elements of the clothes mover 1400, impeller 1420, and agitator 1450 that are similar to those of the clothes mover 100, impeller 120, and agitator 150, the clothes mover 200, impeller 220, and agitator 250, and the clothes mover 700, impeller 720, and agitator 750 are labeled with the prefix 1400.

Figure 30:
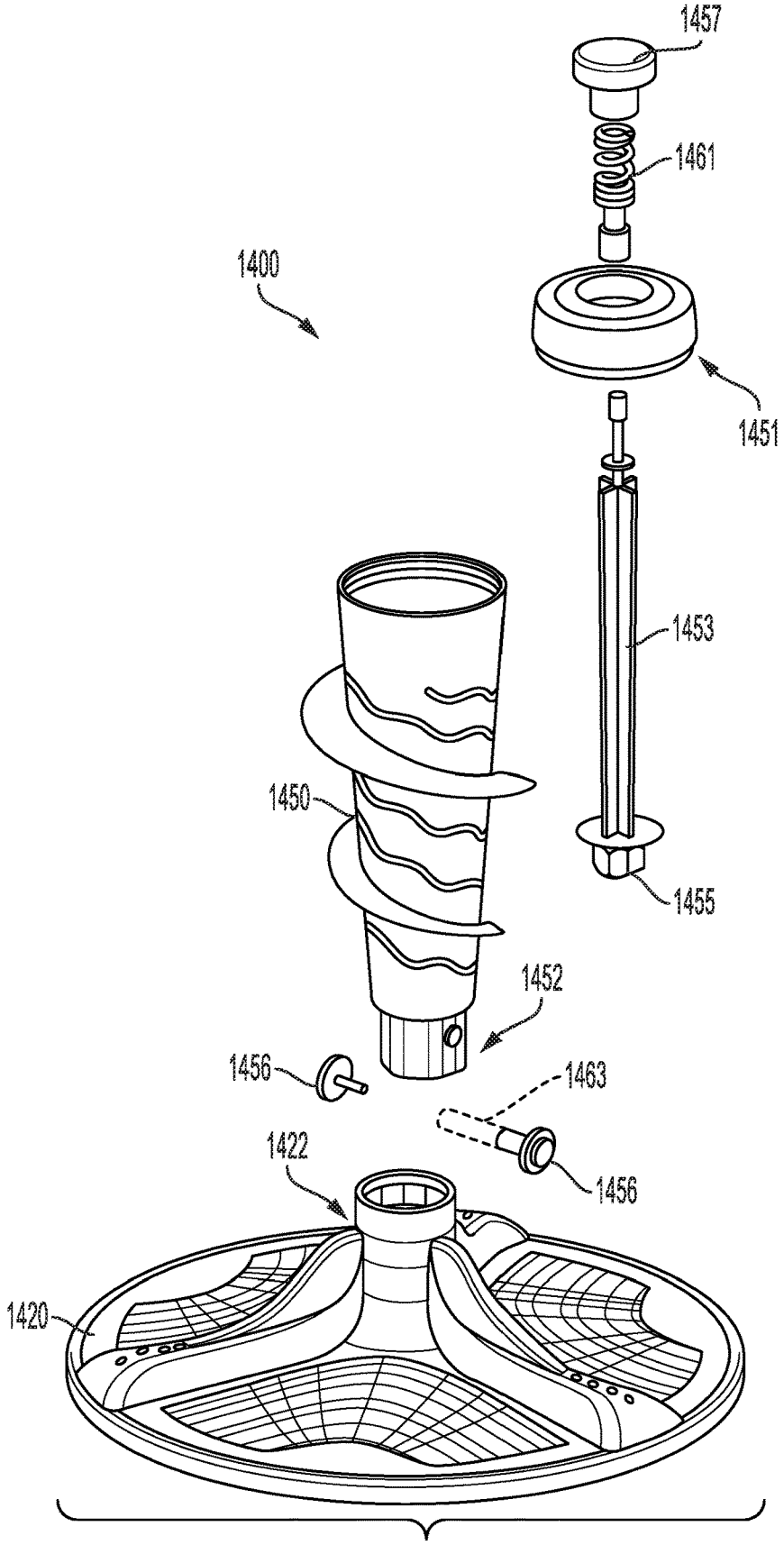
FIG. 30 is an exploded perspective view of another example of an agitator coupling to an impeller for use with the clothes mover and laundry treating appliance of FIG. 1.

Referring now to FIG. 30, the agitator 1450 is coupled to the impeller 1420 to form the clothes mover 1400 using a spring-biased engagement connection. The agitator 1450 includes a top portion, illustrated herein as a cap portion 1451 at an upper end of the agitator 1450. The cap portion 1451 can facilitate insertion, removal, and storage of the agitator 1450 by the user by providing control of the attachment mechanisms of the agitator 1450. The agitator 1450 further includes a locking post 1453 provided within the interior of the agitator 1450, such that the locking post 1453 is nested within the agitator 1450. The locking post 1453 can be coupled with an actuator 1457 that can be provided as part of the cap portion 1451. The locking post 1453 can be movable within and relative to the agitator 1450, for example such that the locking post 1453 is vertically slidable within and relative to the agitator 1450 between a lower, locking position and a raised position. At least one biasing element, illustrated herein as an actuator spring 1461 extends between the locking post 1453 and the actuator 1457 so as to bias the locking post 1453 downwardly from the cap portion 1451 and into the lower, locked position when selected by the user.

The locking post 1453 further defines at least one locking ramp 1455 protruding downwardly from a lower end of the locking post 1453. The at least one locking ramp 1455 can be thought of as forming a portion of the first connector 1452. The first connector 1452 further includes a pair of spring-loaded detents 1456 that are biased outwardly and in opposite direction from one another by a spring 1463 that extends between the two detents 1456. The second connector 1422 optionally includes a biasing element, such as at least one spring (not shown), which can be the same as the spring 228 of FIG. 6 and operating in a manner similar to that described above with respect to the first and second connectors 252, 222 of FIG. 6, within the socket 1426 which is compressed within the socket 1426 when the agitator 1450 is coupled with the impeller 1420, as illustrated in FIG. 31.

Figure 31:
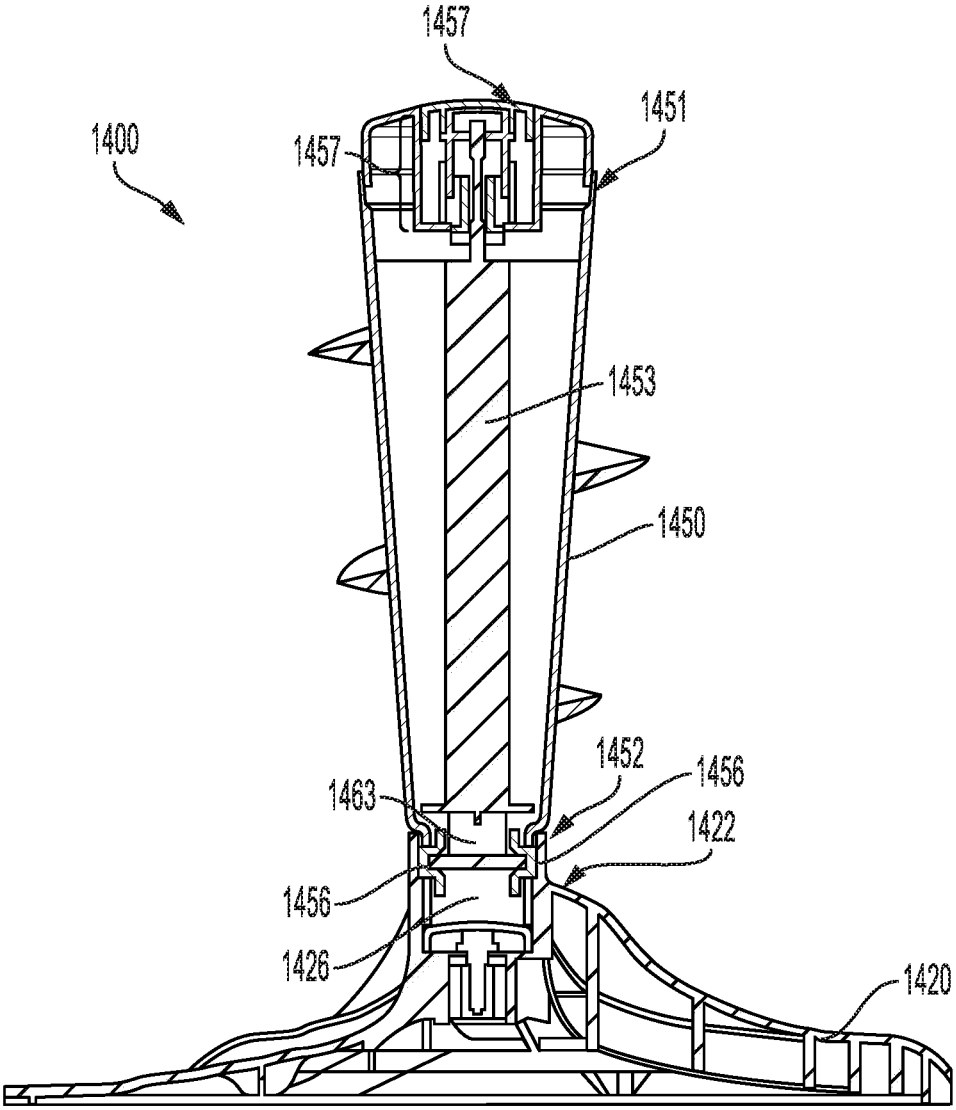
FIG. 31 is a side cross-sectional view of the agitator coupling to the impeller of FIG. 30.

Referring now to FIG. 31, the actuator 1457 can be provided as a push-push actuator 1457 that functions similarly to a clickable pen. All of the components of the push-push mechanism, or other suitable mechanism, can be thought of as collectively forming the actuator 1457, the actuator 1457 operably coupled with the locking post 1453. Further, the locking post 1453 is further operably coupled with the first connector 1452, specifically via the locking ramp 1455, which is operably coupled with the pair of spring-loaded detents 1456.

Figure 32:
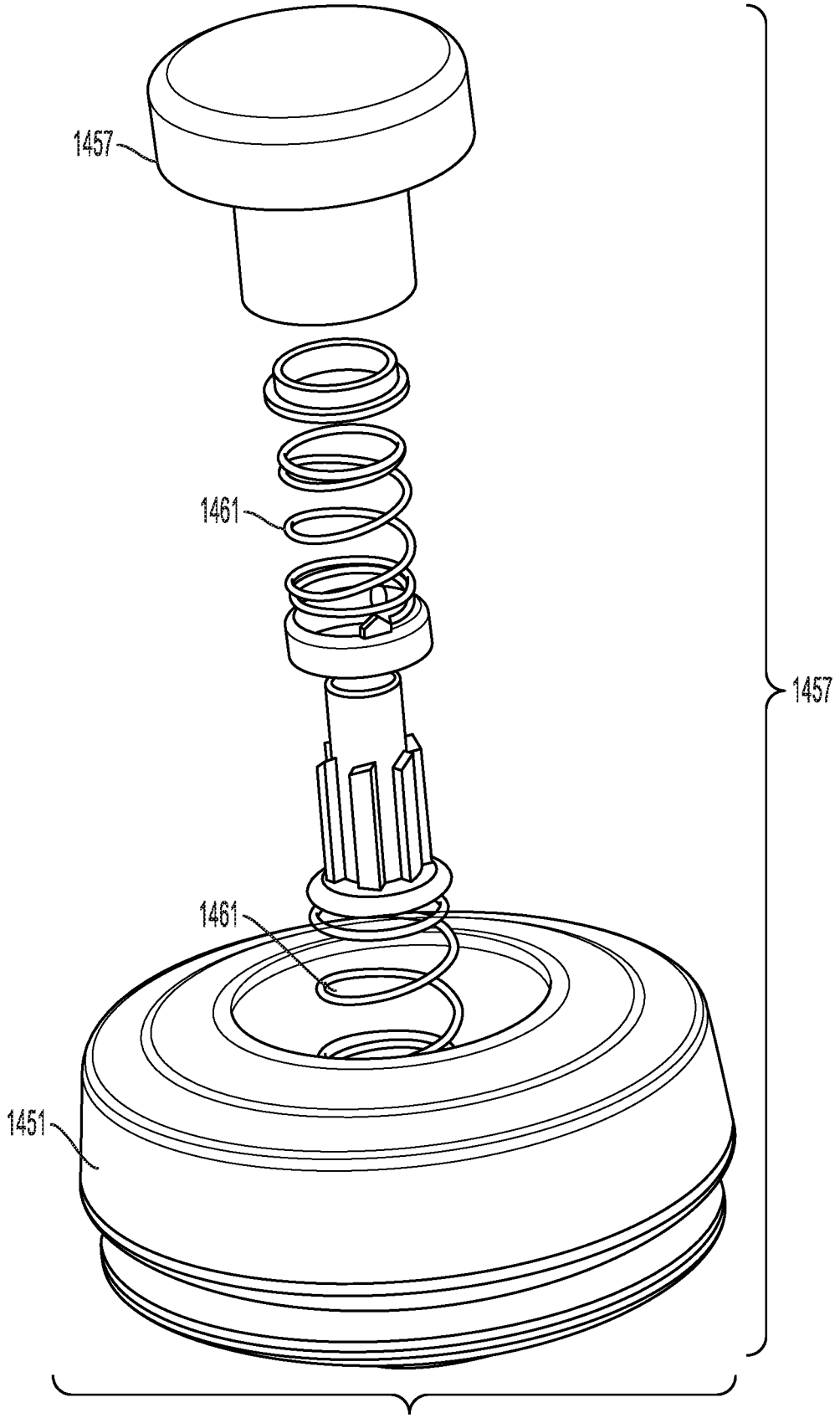
FIG. 32 is an exploded perspective view of a portion of the agitator coupling to the impeller of FIG. 30.

FIG. 32 illustrates the components, such as the cap portion 1451, the at least one actuator spring 1461, and the button, or actuator 1457, can also be thought of as collectively forming the actuator mechanism or the actuator 1457, which can be provided as a push-push mechanism.

Figure 33:
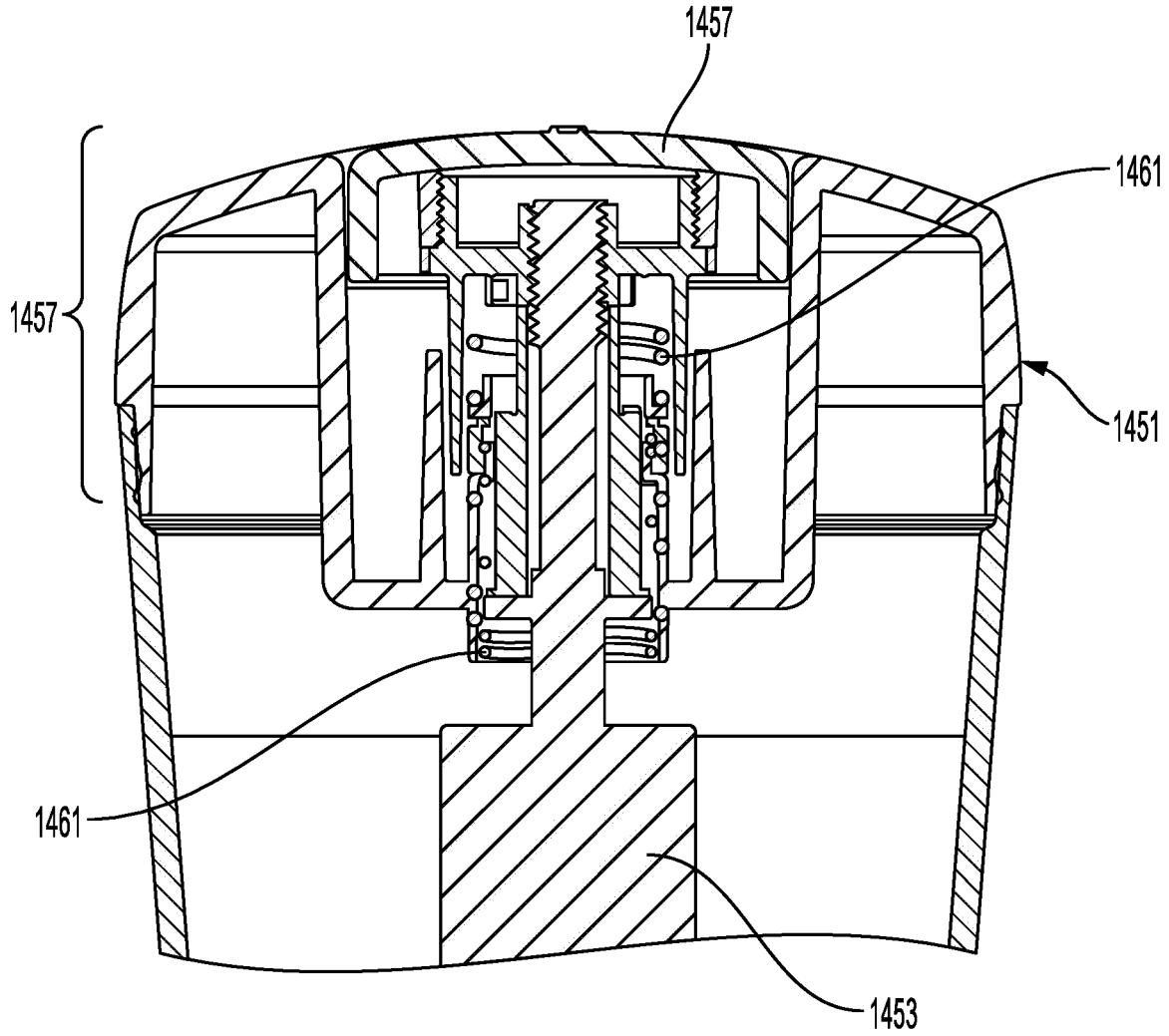
FIG. 33 is an enlarged side cross-sectional view of a portion of the agitator coupling to the impeller of FIG. 31.

FIG. 33 illustrates the components of the actuator 1457 as described above with respect to FIG. 32, but in their assembled form and operably coupled with the locking post 1453.

Figure 34:
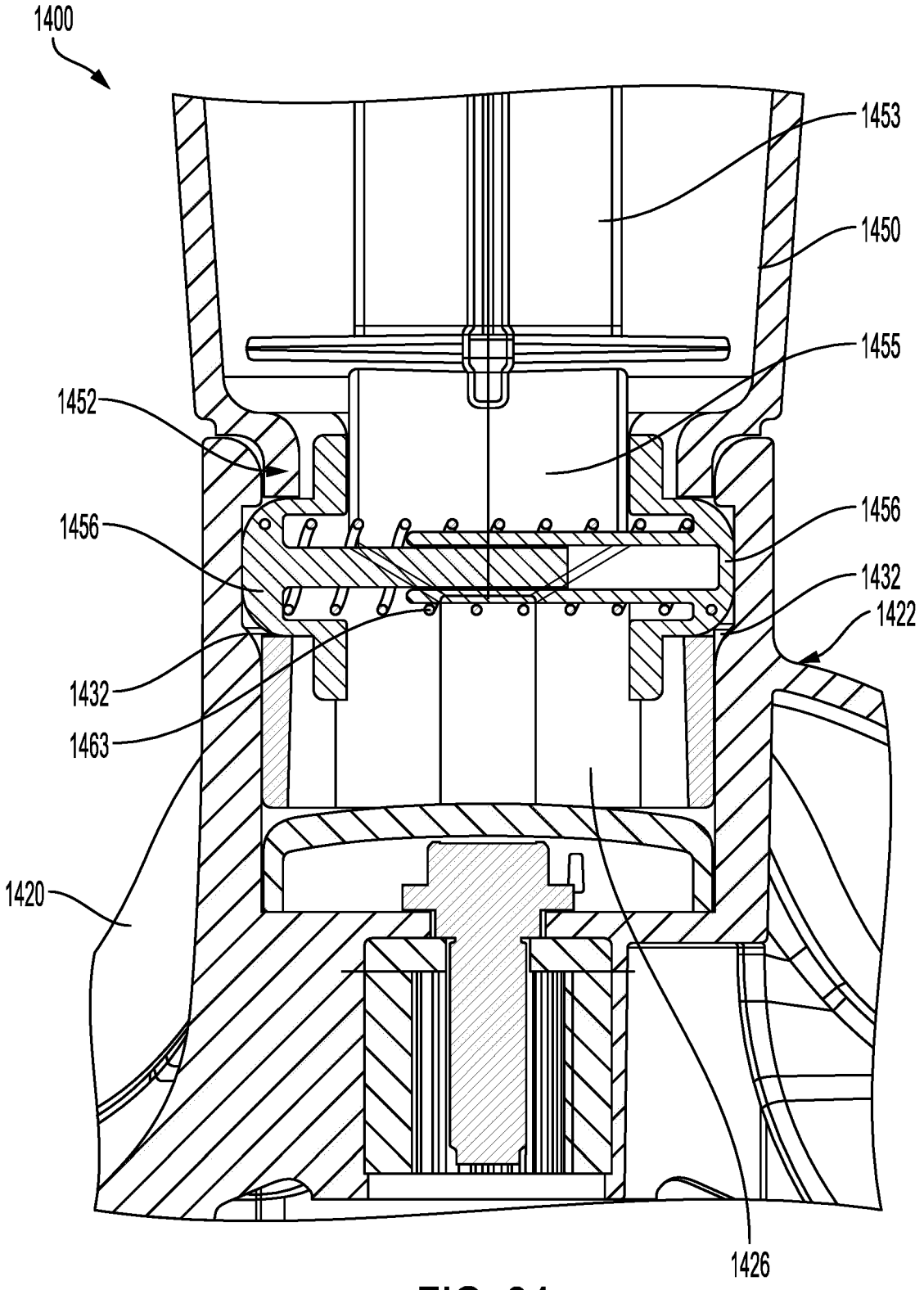
FIG. 34 is an enlarged side cross-sectional view of a portion of the agitator coupling to the impeller of FIG. 31.

Referring now to FIG. 34, the coupling of the first and second connectors 1452, 1422 can be seen, such that the spring 1463 extends between the two detents 1456 to bias them away from one another. The second connector 1422 includes a channel 1432, within which the two detents 1456 can be received, and such that the pair of spring-loaded detents 1456 are configured to be retained within the channel 1432. Further, it is contemplated that the spring 1463 can be a weak spring without sufficient force to bias the detents 1456 outwardly to be retained within the channel 1432. The locking ramp 1455 can serve to further bias the detents 1456 outwardly and to lock them in to the installed position.

To assemble the clothes mover 1400, the agitator 1450 is aligned with the impeller 1420. The actuator 1457 can be in its not actuated configuration, such that the locking post 1453 is in the raised position. The agitator 1450 is moved toward the impeller 1420 to insert the first connector 1452 into the second connector 1422. As the first connector 1452 is inserted into the second connector 1422, the pair of spring-loaded detents 1456 can come into contact with, and can be inwardly compressed by, contact with the second connector 1422, and specifically with the channel 1432. The force of contact between the detents 1456 and the second connector 1422 can be greater than the biasing force of the spring 1463, such that the spring-loaded detents 1456 are not resiliently retaining the first connector 1452 within the second connector 1422. The movement of the first connector 1452 into the socket 1426 depresses the pair of spring-loaded detents 1456 inwardly against the spring 1463 until the pair of spring-loaded detents 1456 has aligned with the channel 1432, and then can be at least partially biased radially outwardly, extending into the channel 1432, but not retained such that the force of the pair of spring-loaded detents 1456 prevents upward movement of the pair of spring-loaded detents 1456 to retain the first connector 1452 within the second connector 1422.

The agitator 1450 is coupled with the impeller 1420, with the pair of spring-loaded detents 1456 engaging the channel 1432. In order to lock the detents 1456 outwardly to resiliently retain the first connector 1452 within the second connector 1422, the actuator 1457 can be actuated by pressing downwardly on the actuator 1457. This pushes the locking post 1453, and thus also the locking ramp 1455, to move downwardly. The locking ramp 1455 comes into contact with the pair of detents 1456, and bears against the detents 1456 so as to push them apart from one another with a greater force than that provided by the spring 1463. The locking ramp 1455 will stay in the lower, locking position to resiliently bias the detents 1456 into the channel 1432 until the user again actuates the actuator 1457.

To uncouple the agitator 1450 from the impeller 1420, the user can again actuate the actuator 1457, such as by pushing down on the actuator 1457 again. The locking post 1453 is lifted from the lower, locking position to the raised position, and the locking ramp 1455 is moved out of contact with the detents 1456, allowing the force of the spring 1463 to be overcome by withdrawing the agitator 1450 from the impeller 1420. This provides for not only a convenient and easy-to-reach location for the actuator 1457, but also allows for one-handed operation and removal of the agitator 1450.

Figure 35:
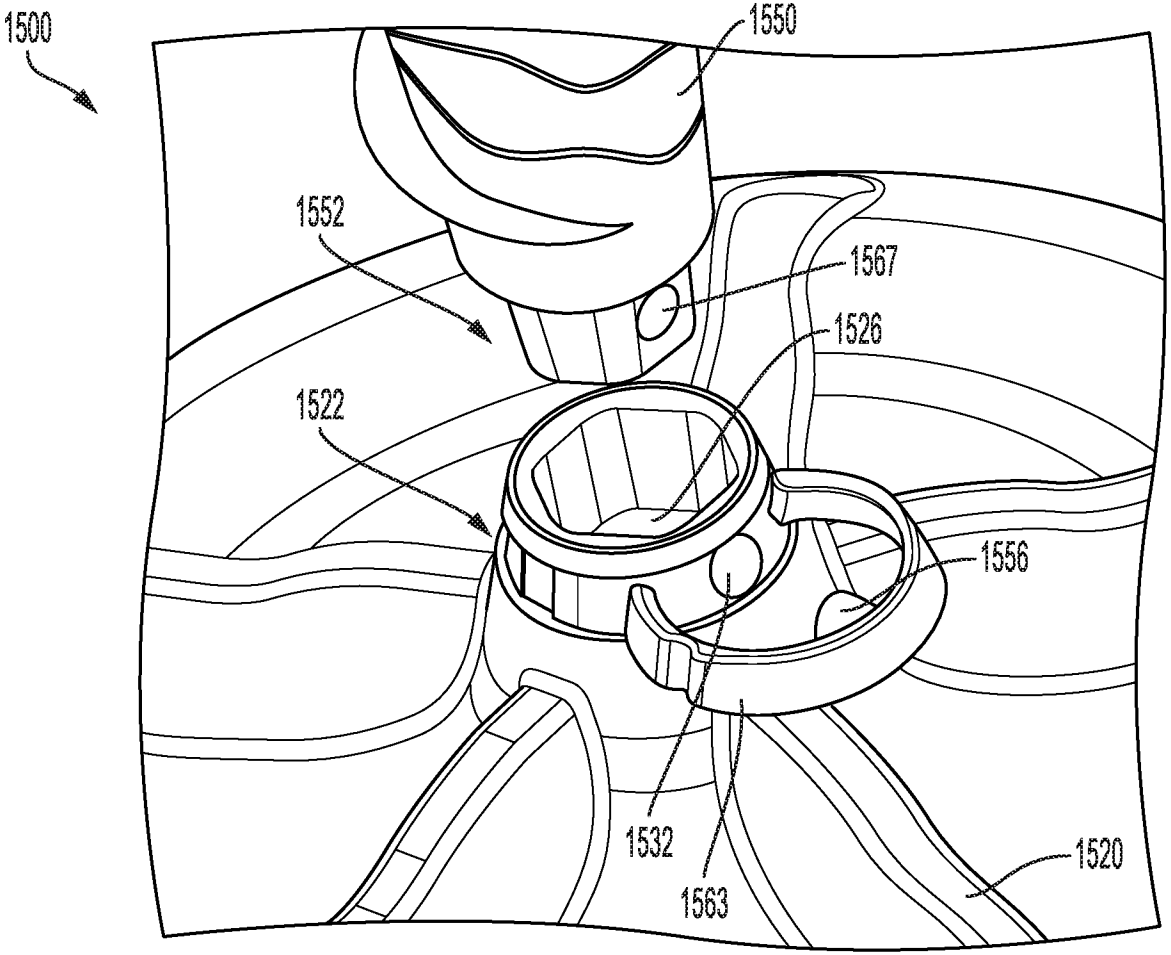
FIG. 35 is an exploded perspective view of another example of an agitator coupling to an impeller for use with the clothes mover and laundry treating appliance of FIG. 1.
Figure 36:
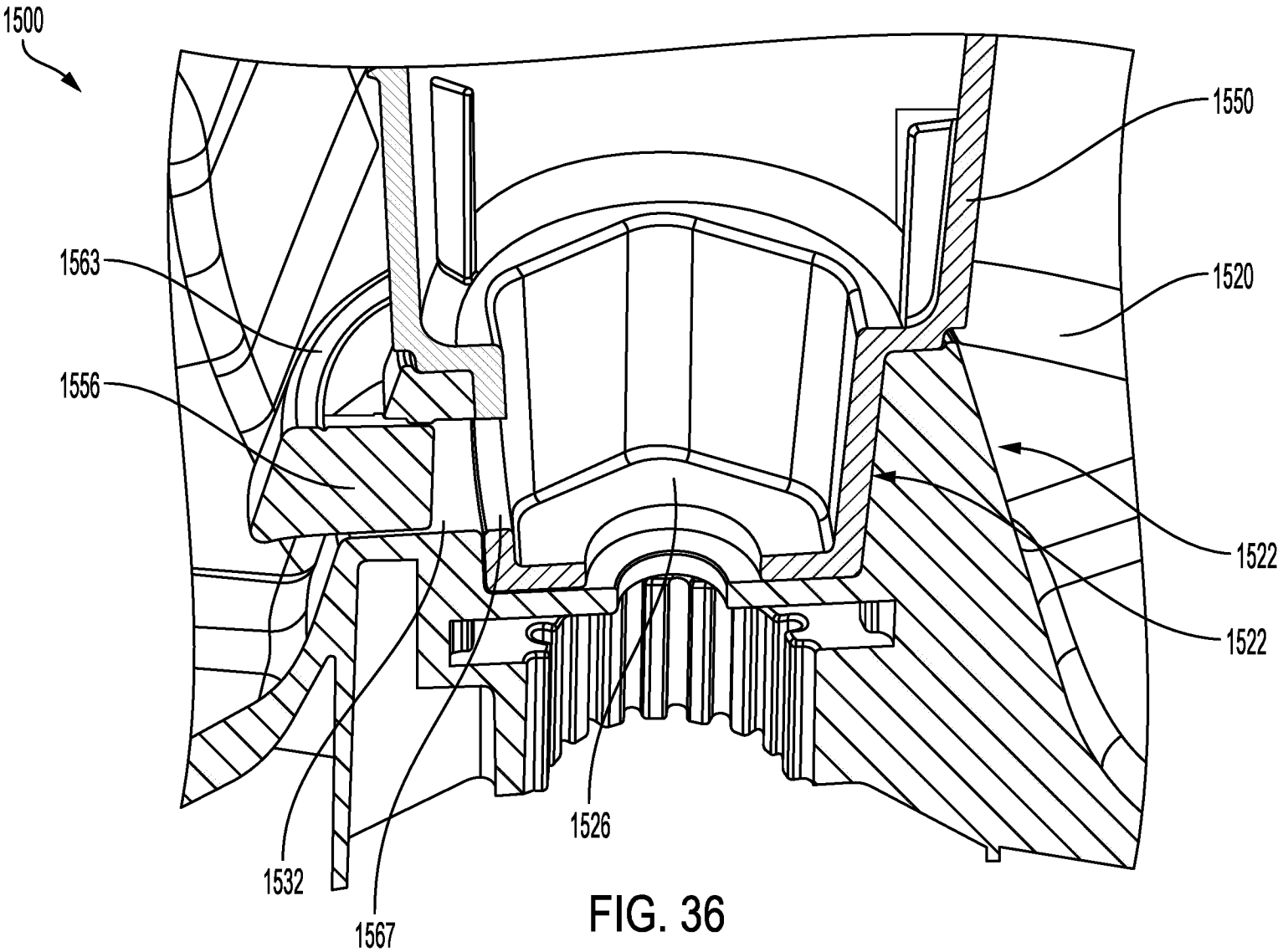
FIG. 36 is a cross-sectional view of the agitator coupling to the impeller of FIG. 35 in a first position.
Figure 37:
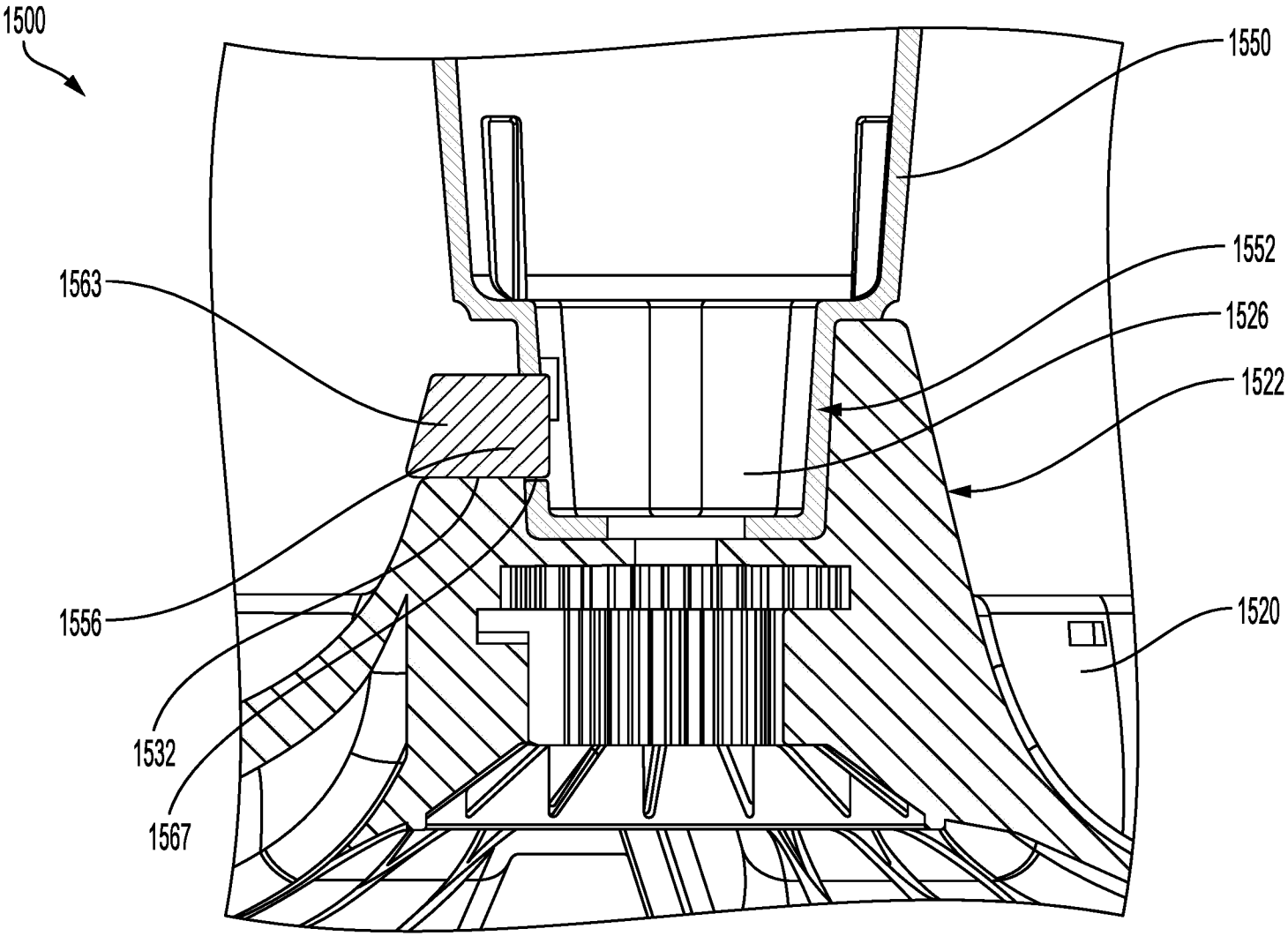
FIG. 37 is a side cross-sectional view of the agitator coupling to the impeller of FIG. 36 in a second position.

FIGS. 35-37 illustrate another example of a clothes mover 1500 including an impeller 1520 and an agitator 1550 for use in the laundry treating appliance 10 described herein that are similar to the clothes mover 100, impeller 120, and agitator 150 of FIG. 5, to the clothes mover 200, impeller 220, and agitator 250 of FIG. 6, and to the clothes mover 700, impeller 720, and agitator 750 of FIG. 18, but differ in some aspects, such as the manner in which the agitator 1550 is coupled with the impeller 1520. Therefore, elements of the clothes mover 1500, impeller 1520, and agitator 1550 that are similar to those of the clothes mover 100, impeller 120, and agitator 150, the clothes mover 200, impeller 220, and agitator 250, and the clothes mover 700, impeller 720, and agitator 750 are labeled with the prefix 1500.

Referring now to FIG. 35, the agitator 1550 is coupled to the impeller 1520 to form the clothes mover 1500 using an interference fit engagement connection. The first connector 1552 defines at least one opening 1567, while the second connector 1522 defines at least one opening 1532, that can be at least partially aligned with the opening 1567 of the first connector 1552. A locking collet 1563 can be provided to couple with both of the first and second connectors 1522, 1552. The locking collet 1563 can be any suitable locking collet 1563, non-limiting examples of which include an interference fit clamp or a C-clamp, which can be made of metal, so long as the locking collet 1563 has some degree of non-rigidity so that it can be snapped around the clothes mover 1500. Further, while the locking collet 1563 is described herein as engaging with the clothes mover 1500 through an interference fit, it will be understood that any other suitable coupling method or apparatus can be used so long as the force of attachment is sufficient such that the locking collet 1563 is removed by force from a user, and is not caused to come off from the forces of rotation of the laundry treating appliance 10. The locking collet 1563 comprises a pin 1556 configured to be received within both of the openings 1567, 1532.

Referring now to FIG. 36, to assemble the clothes mover 1500, the agitator 1550 is aligned with the impeller 1520. The agitator 1550 is moved toward the impeller 1520 to insert the first connector 1552 into the second connector 1522. As the first connector 1552 is inserted into the second connector 1522, opening 1567 of the first connector and the opening 1532 of the second connector 1522 can be aligned, then the locking collet 1563 can be coupled with the clothes mover 1500, such as by application about both the impeller 1520 and the agitator 1550, at the height level of the impeller 1520.

Referring now to FIG. 37, the locking collet 1563 is fully snapped, clipped, or clamped about the impeller 1520 and the agitator 1550 such that the pin 1556 is fully received within and protrudes through both openings 1532, 1567. Such an engagement prevents upward movement of the locking collet 1563, the agitator 1550, and the impeller 1520, as well as inhibiting unintended rotation of the agitator 1550 relative to the impeller 1520 during a cycle of operation. The locking collet 1563 can further include a suitable closure, non-limiting examples of which can include a buckle-type latch, a rotating latch such as a window latch, or a radially sliding latch, such as a sliding window latch. To uncouple the agitator 1550 from the impeller 1520, the user can grip the locking collet 1563 and pull until the locking collet 1563 is removed from the impeller 1520 and the agitator 1550, then the agitator 1550 can be withdrawn from the impeller 1520.

Figure 38:
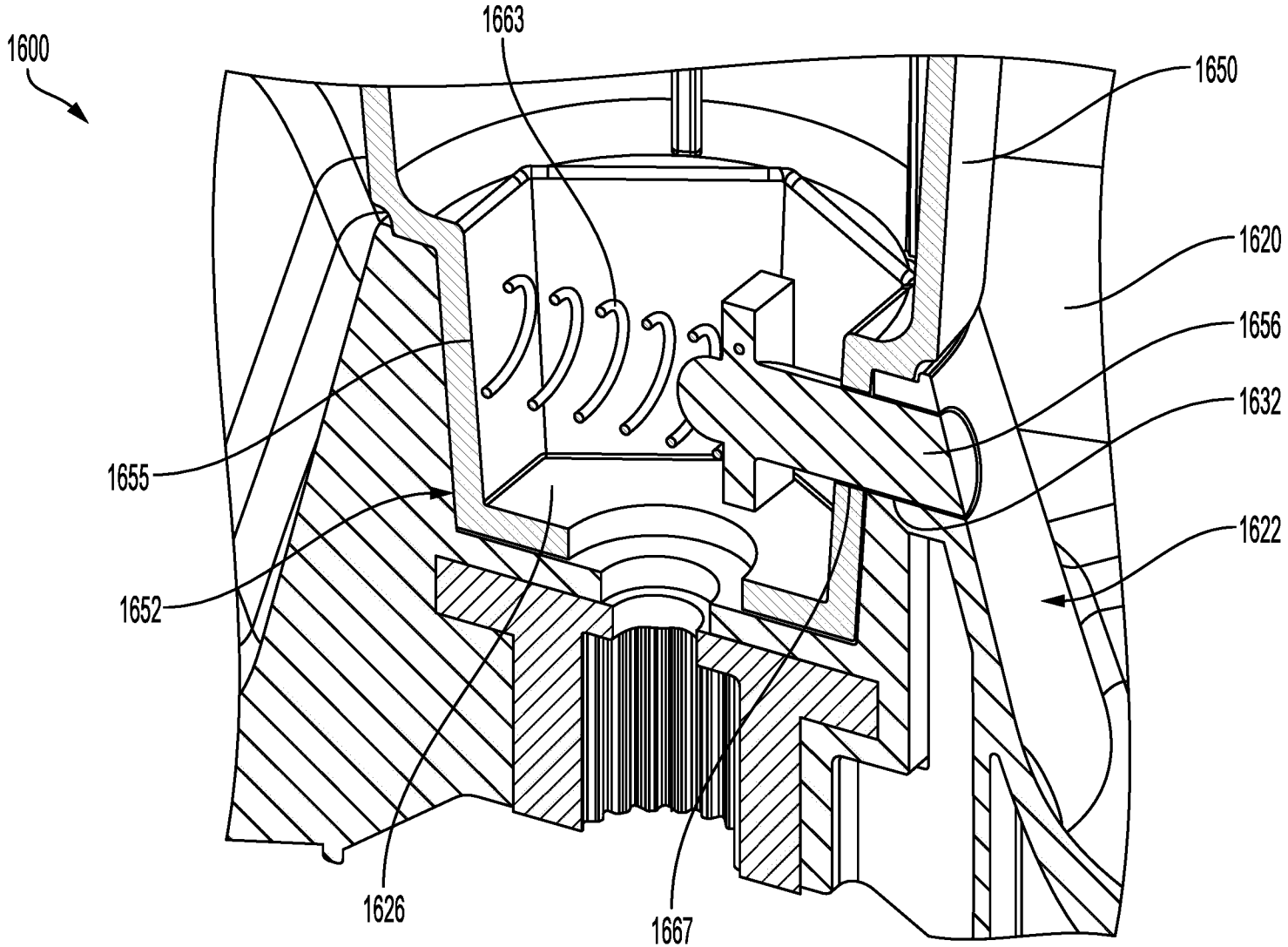
FIG. 38 is a perspective cross-sectional view of another example of an agitator coupling to an impeller for use with the clothes mover and laundry treating appliance of FIG. 1.

FIG. 38 illustrates another example of a clothes mover 1600 including an impeller 1620 and an agitator 1650 for use in the laundry treating appliance 10 described herein that are similar to the clothes mover 100, impeller 120, and agitator 150 of FIG. 5, to the clothes mover 200, impeller 220, and agitator 250 of FIG. 6, and to the clothes mover 900, impeller 920, and agitator 950 of FIG. 23, but differs in some aspects, such as the manner in which the agitator 1650 is coupled with the impeller 1620. Therefore, elements of the clothes mover 1600, impeller 1620, and agitator 1650 that are similar to those of the clothes mover 100, impeller 120, and agitator 150 and the clothes mover 200, impeller 220, and agitator 250 are labeled with the prefix 1600.

The agitator 1650 is coupled to the impeller 1620 to form the clothes mover 1600 using a spring-biased detent connection very similar to that of the clothes mover 900 of FIG. 23, but including only the detent connection, illustrated herein as a spring-biased pin 1656, and not the threadable connection. The inclusion of the pin 1656 can inhibit both unintended rotation of the agitator 1650 relative to the impeller 1620 during a cycle of operation, and also to inhibit unintended axial or lateral displacement, such as upward or vertical movement of the agitator 1650 relative to the impeller 1620 during a cycle of operation, improving stability of the clothes mover 1600.

The first connector 1652 further comprises the pin 1656 that protrudes radially outward from the first connector 1652. A biasing element, illustrated herein as a spring 1663 can extend between the pin 1656 and a spring mount 1655, illustrated herein as a wall of the first connector 1652, to bias the pin 1656 axially outward. The first connector 1652 further comprises a first connector opening 1667 through which the pin 1656 can protrude. The second connector 1622 can further include a second connector opening 1632 within which the pin 1656 can be received and can protrude radially outwardly through. The first connector opening 1667 and the second connector opening 1632 can be aligned with one another when the agitator 1650 is coupled to the impeller 1620. Actuation of the pin 1656 for coupling or decoupling of the agitator 1650 with the impeller 1620 can be achieved by any suitable method or apparatus, a variety of which are described herein, such as by manual removal or by actuation mechanisms that are provided internally of the clothes mover 1600, and whether or not the actuator is activated at the impeller 1620, at the agitator 1650, or at a handle portion 1651.

Figure 39:
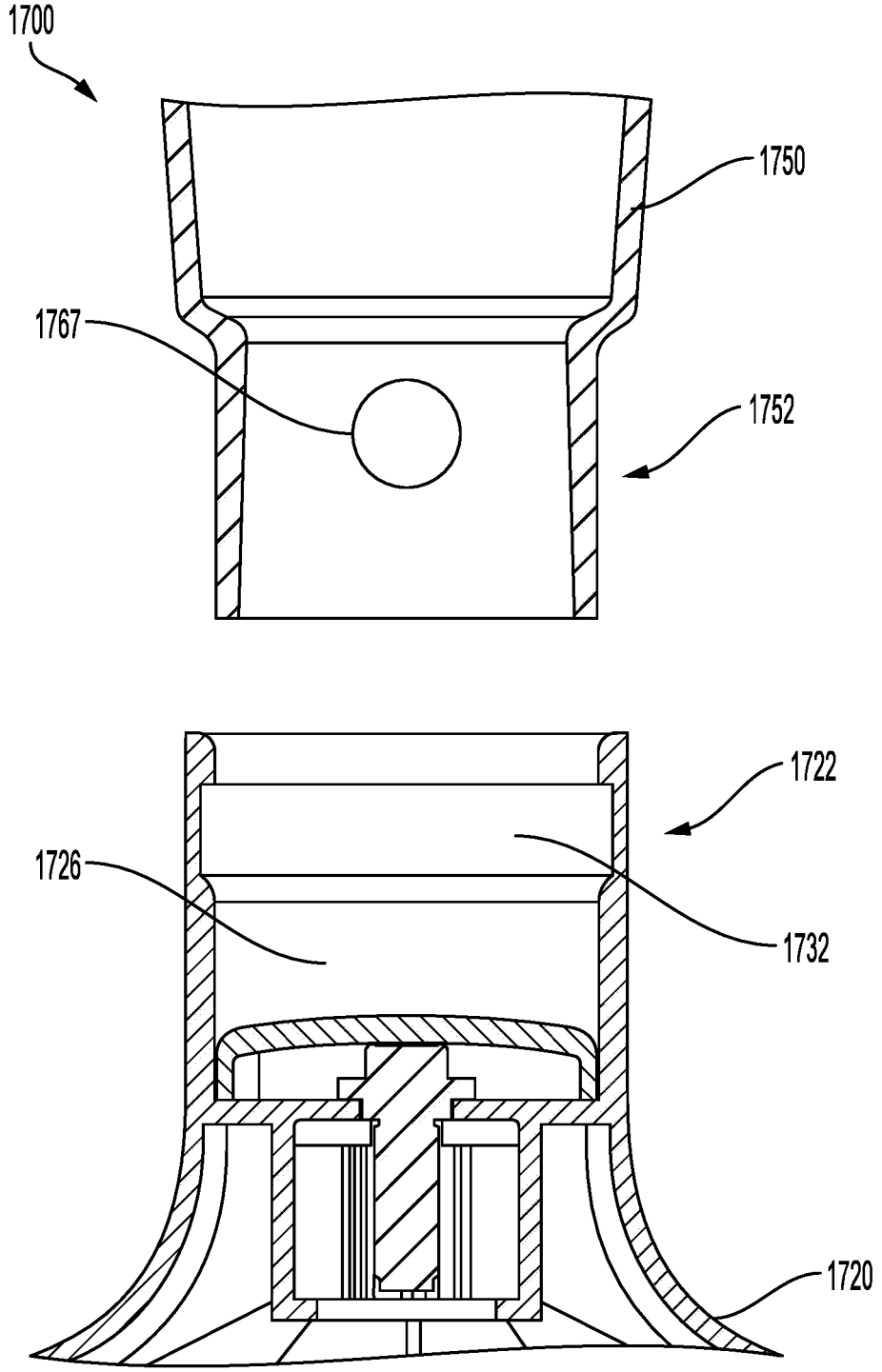
FIG. 39 is an exploded cross-sectional view of another example of an agitator coupling to an impeller for use with the clothes mover and laundry treating appliance of FIG. 1.

FIG. 39 illustrates another example of a clothes mover 1700 including an impeller 1720 and an agitator 1750 for use in the laundry treating appliance 10 described herein that are similar to the clothes mover 100, impeller 120, and agitator 150 of FIG. 5, to the clothes mover 200, impeller 220, and agitator 250 of FIG. 6, and to the clothes mover 900, impeller 920, and agitator 950 of FIG. 23, but differs in some aspects, such as the manner in which the agitator 1750 is coupled with the impeller 1720. Therefore, elements of the clothes mover 1700, impeller 1720, and agitator 1750 that are similar to those of the clothes mover 100, impeller 120, and agitator 150 and the clothes mover 200, impeller 220, and agitator 250 are labeled with the prefix 1700.

The agitator 1750 is coupled to the impeller 1720 to form the clothes mover 1700 using a detent connection similar to that of the clothes mover 900 of FIG. 23, but including only a detent connection, and not the threadable connection. The inclusion of such a detent connection can inhibit both unintended rotation of the agitator 1750 relative to the impeller 1720 during a cycle of operation, and also to inhibit unintended axial or lateral displacement, such as upward or vertical movement of the agitator 1750 relative to the impeller 1720 during a cycle of operation, improving stability of the clothes mover 1700, as well as to ensure that the impeller 1720 and the agitator 1750 are locked together so that they will rotate together and that only a direct upwards force can remove the agitator 1750 from the impeller 1720.

The first connector 1752 further comprises a first connector opening 1767 through which a snap-in pin (not shown) can protrude. The second connector 1722 can further include a channel 1732 within which the snap-in pin (not shown) can be received and can protrude into and bear against after protruding radially outwardly through the opening 1767. The first connector opening 1767 and the channel 1732 can be at least partially aligned with one another when the agitator 1750 is coupled to the impeller 1720. Actuation of the snap-in pin (not shown) for coupling or decoupling of the agitator 1750 with the impeller 1720 can be achieved by any suitable method or apparatus, a variety of which are described herein, such as by manual removal or by actuation mechanisms that are provided internally of the clothes mover 1700, and whether or not the actuator is activated at the impeller 1720, at the agitator 1750, or at a handle portion 1751.

Turning now to a discussion of other examples of attachment and alignment features that can be used with a variety of the exemplary clothes movers described herein, any of the disclosed attachment and alignment concepts can be used with any of the disclosed clothes movers for a great deal of flexibility and customizability.

Figure 40:
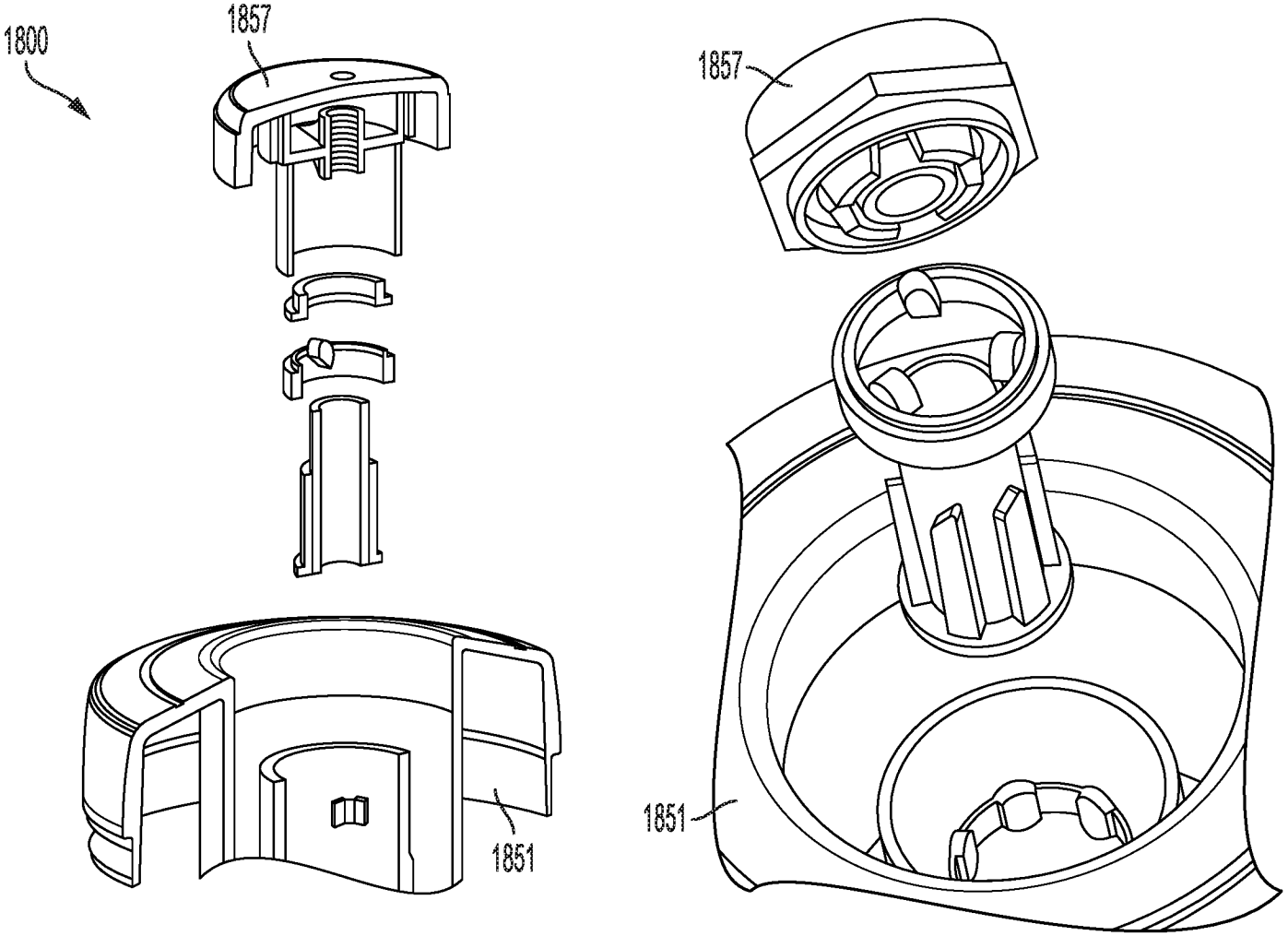
FIG. 40 is an exploded perspective view of an example of an actuator for use with the clothes mover and laundry treating appliance of FIG. 1.

FIG. 40 illustrates another example of a push-push actuator mechanism 1800 similar to the actuator 1457 as illustrated in FIG. 32 and FIG. 33 that can be provided with an actuator 1857 and within a variety of cap portions 1851, and can function like a clickable pen, such that a first click can lock the agitator 1850 in place, while a second click can unlock the agitator 1850.

Figure 41:
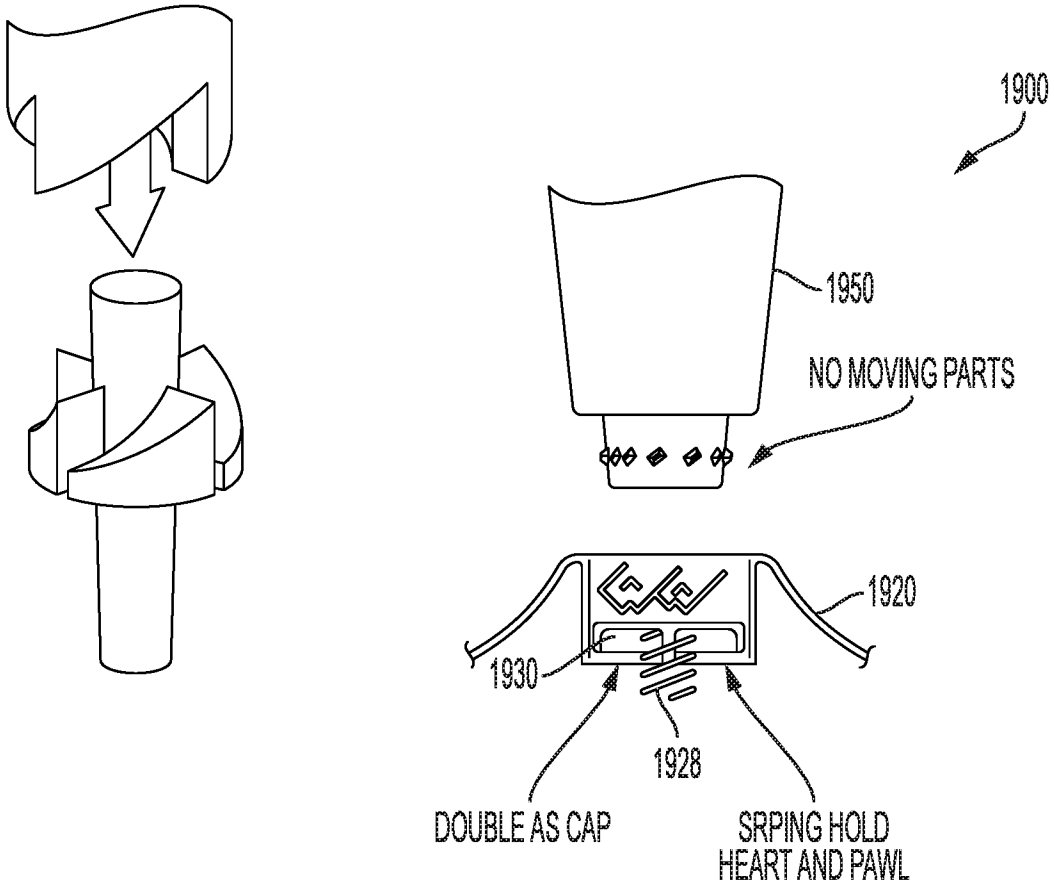
FIG. 41 is a schematic perspective view of another example of an agitator coupling to an impeller for use with the clothes mover and laundry treating appliance of FIG. 1.

FIG. 41 illustrates yet another example of a push-push actuator mechanism 1900 similar to the actuator 1457 as illustrated in FIGS. 32-33 and similar to the actuator mechanism 1800 of FIG. 40 and functioning like a clickable pen, as described previously, but wherein the push-push actuator mechanism 1900 is provided with the impeller 1920, rather than the agitator 1950. For example, such a mechanism 1900 can be provided so as to include no moving parts, such as by employing a spring-held heart and pawl that can also function as a spring-loaded cover 1930 biased by a spring 1928.

Figure 42:
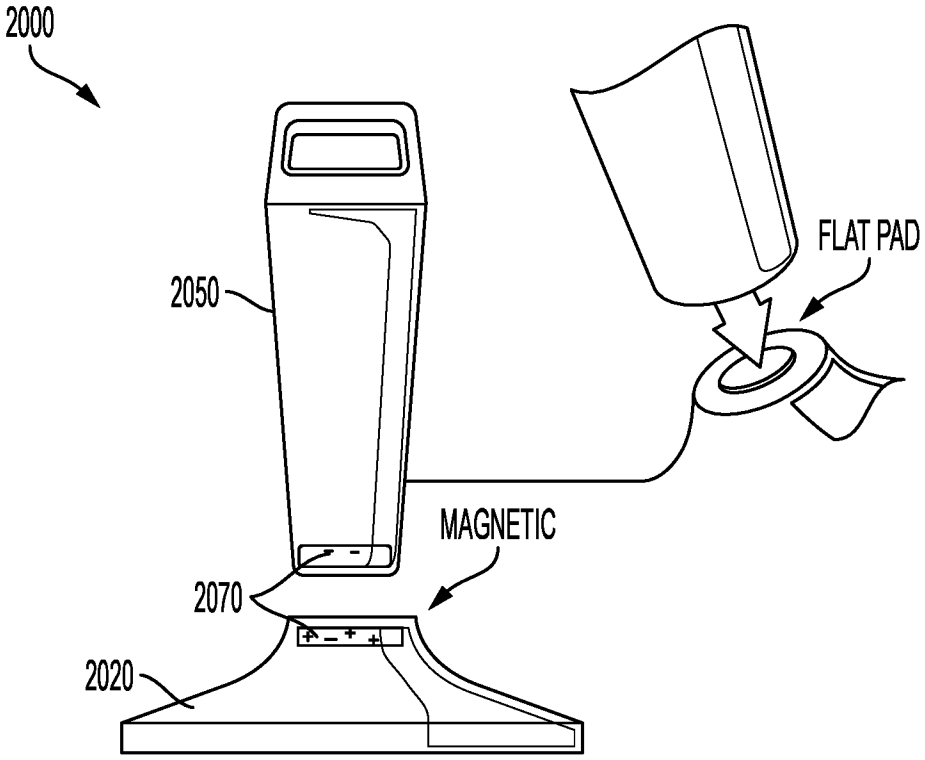
FIG. 42 is a perspective view of another example of an agitator coupling to an impeller for use with the clothes mover and laundry treating appliance of FIG. 1.

FIG. 42 illustrates an example of a magnetic coupling mechanism 2000 wherein the impeller 2020 and the agitator 2050 can include magnets 2070 so as to be magnetically coupled to one another when the impeller 2020 and the agitator 2050 are properly rotationally aligned. In another example, a magnetic latch similar to those used for pool fence locks can be used, such that magnetic pull is only created when the component has been turned or rotated to a specific degree, or, for example, when a magnet 2070 is moved downwardly into a predetermined location, the magnetic force will pull a rod, such as a metal rod, into a lock location, such as by drawing the rod horizontally into the lock location. Such movements could be axial or rotational movements.

Figure 43:
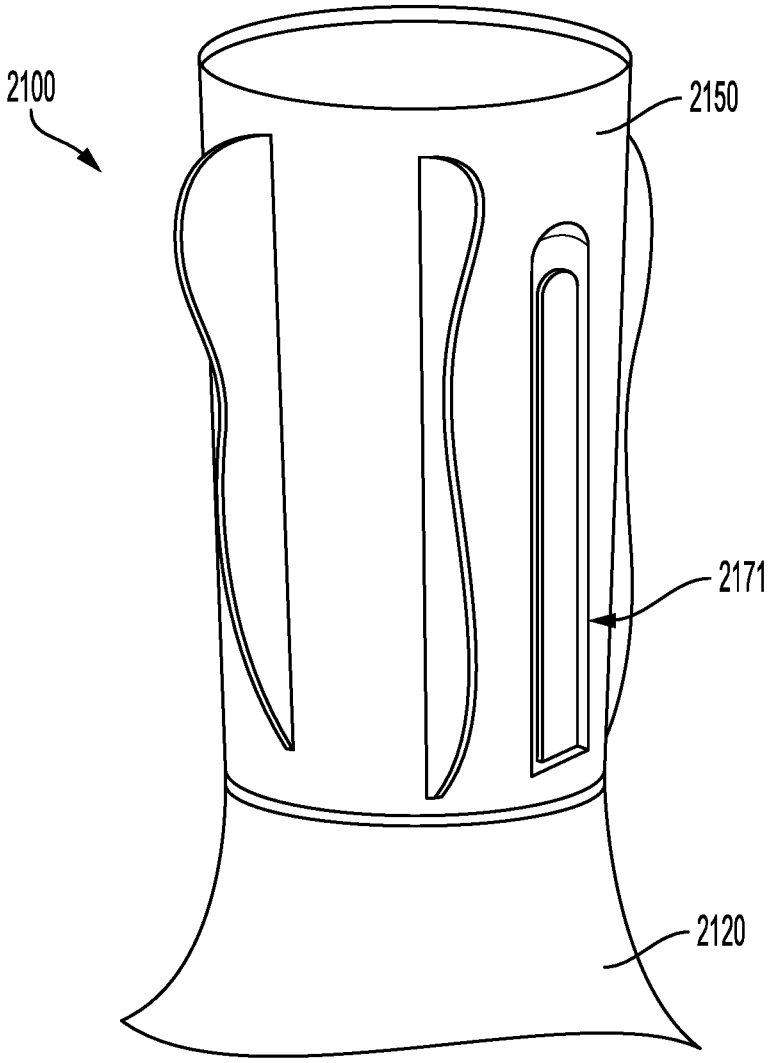
FIG. 43 is a schematic perspective view of another example of an agitator coupling to an impeller for use with the clothes mover and laundry treating appliance of FIG. 1.

FIG. 43 illustrates an example clothes mover 2100 including an impeller 2120 and an agitator 2150 wherein the coupling mechanism is provided on a side of the agitator 2150 and is provided as a pivot lever lock 2171 that is pivotable relative to the agitator 2150 to selectively couple the agitator 2150 to the impeller 2120.

Figure 44:
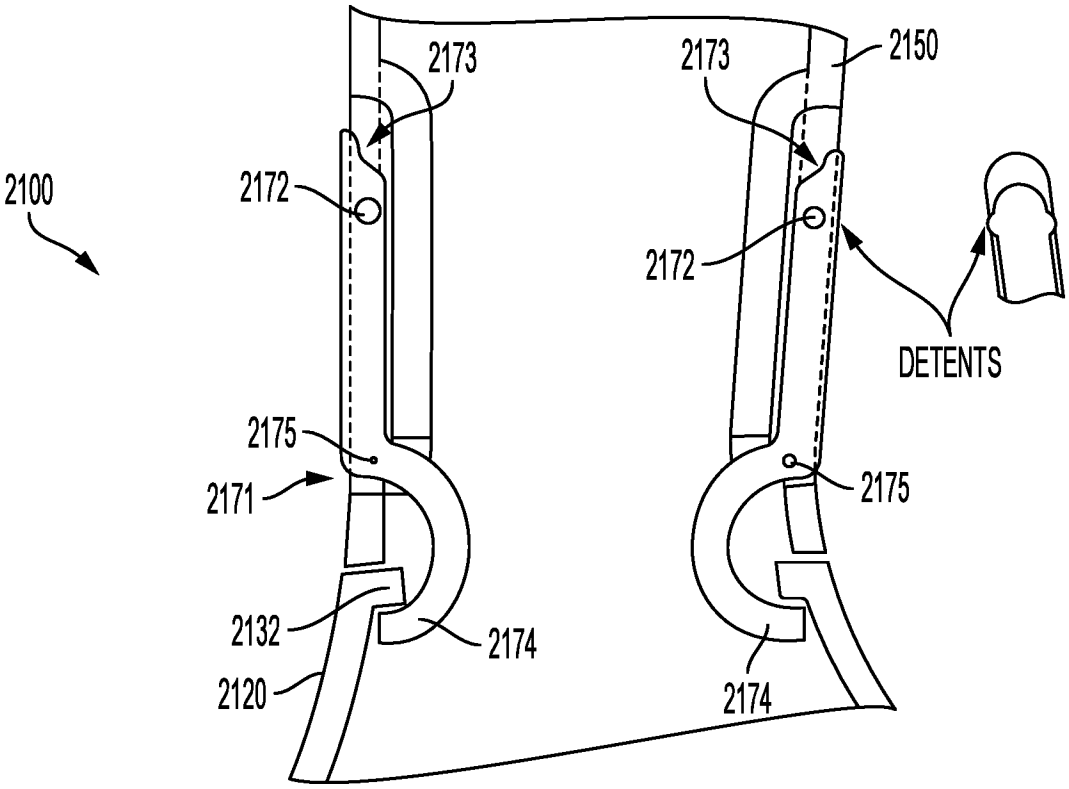
FIG. 44 is a side cross-sectional view of the agitator coupling to the impeller of FIG. 43.

FIG. 44 shows the clothes mover 2100 in cross-section. The impeller 2120 comprises a retaining rib 2132. The agitator 2150 can be provided adjacent to and rest on top of the retaining rib 2132. The pivot lever lock 2171 is pivotably coupled to the agitator 2150 about a pivot axis 2175, the pivot lever lock 2171 further comprising a finger grip portion 2173 on one side of the pivot axis 2175, and a retaining channel 2174 defined by the pivot lever lock 2171 opposite the finger grip portion 2173 about the pivot axis 2175. The retaining channel 2174 is configured to resiliently couple with the impeller 2120 via the retaining rib 2132. The pivot lever lock 2171 can further comprise at least one detent 2172 that can retain the pivot lever lock 2171 in the locked position, such as by a snap fit or an interference fit.

Figure 45:
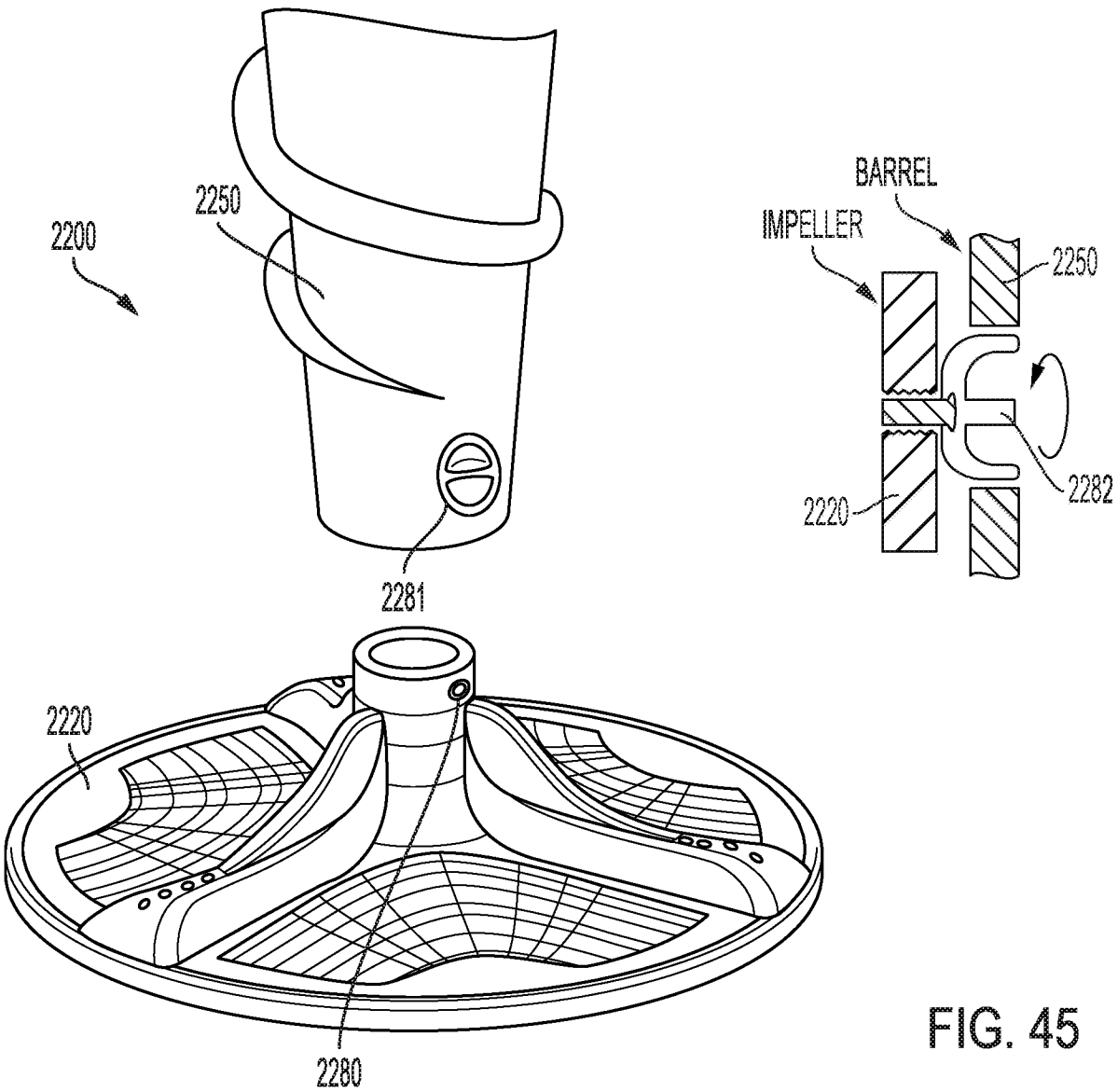
FIG. 45 is a schematic perspective view of another example of an agitator coupling to an impeller for use with the clothes mover and laundry treating appliance of FIG. 1.

FIG. 45 illustrates an example of a clothes mover 2200 including an impeller 2220 and an agitator 2250 coupled by a retaining screw 2282. The impeller 2220 can include a threaded fastener opening 2280. The agitator 2250 can be sized to fit around and to at least partially surround the impeller 2220 such that the threaded fastener opening 2280 is received within a knob opening 2281 defined by the agitator 2250. When the threaded fastener opening 2280 is received within the agitator 2250 and at least partially aligned with the knob opening 2281, the retaining screw 2282, illustrated herein as having a knob, can be threadably coupled into the threaded fastener opening 2280, with the knob portion of the retaining screw 2282 received within the knob opening 2281. The retaining screw 2282 can be, by way of non-limiting example, a retaining screw 2282 such as for a flagpole or an outdoor umbrella, having the knob which can be hand-turned by the user.

Figure 46:
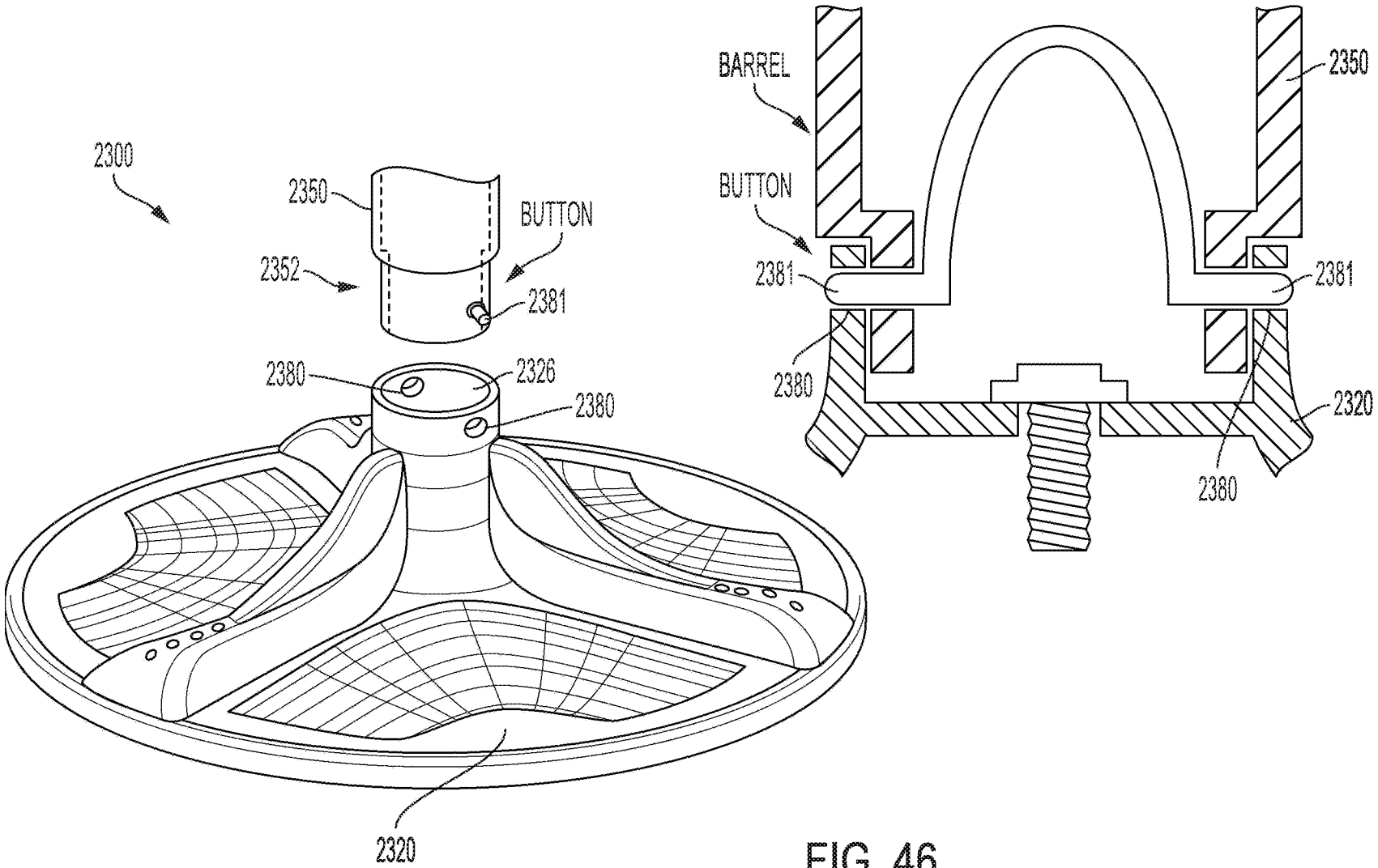
FIG. 46 is a schematic perspective and cross-sectional view of another example of an agitator coupling to an impeller for use with the clothes mover and laundry treating appliance of FIG. 1.

FIG. 46 illustrates an example of a clothes mover 2300 including an impeller 2320 and an agitator 2350 coupled by at least one spring-loaded depressible pin 2381. The impeller 2320 can define at least one pin opening 2380. The agitator 2350 can have a first connector 2352 sized to be at least partially received within the socket 2326 of the impeller 2320. At least one spring-loaded depressible pin 2381 is provided with and protrudes radially outwardly from the first connector 2352. To assemble the clothes mover 2300, the user can depress the at least one depressible pin 2381 as the agitator 2350 is inserted into the socket 2326. The depressible pin 2381 can once again be biased outwards once the depressible pin 2381 comes into alignment with the pin opening 2380, such that the depressible pin 2381 is then received within and resiliently retained by the pin opening 2380.

Figure 47:
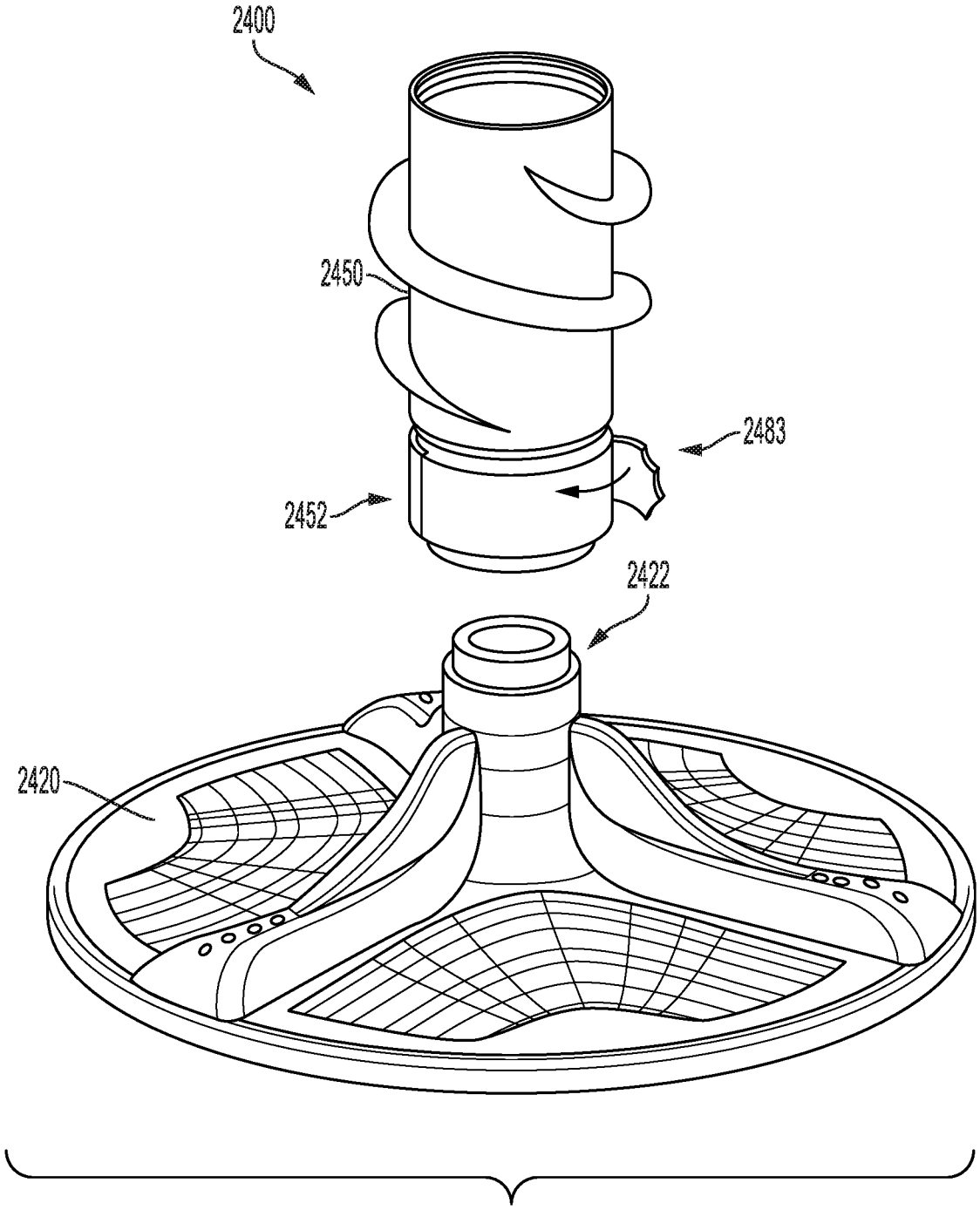
FIG. 47 is a perspective view of another example of an agitator coupling to an impeller for use with the clothes mover and laundry treating appliance of FIG. 1.

FIG. 47 illustrates an example of a clothes mover 2400 including an impeller 2420 and an agitator 2450 coupled by at least one lever lock 2483. A first connector 2452 can comprise at least one lever lock 2483 and can be sized such that a second connector 2422 of the impeller 2420 can be at least partially received within the first connector 2452. The lever lock 2483 is pivotable or rotatable relative to the agitator 2450. When the second connector 2422 is received within the first connector 2452, the lever lock 2483 can be pivoted into a locked position to be retained on the impeller 2420 at least partially by an interference fit or a pressure fit. The lever lock 2483 can be provided as, by way of non-limiting example, a lever cam lock such as those used for extendable camera tripods or portable easels.

Figure 48:
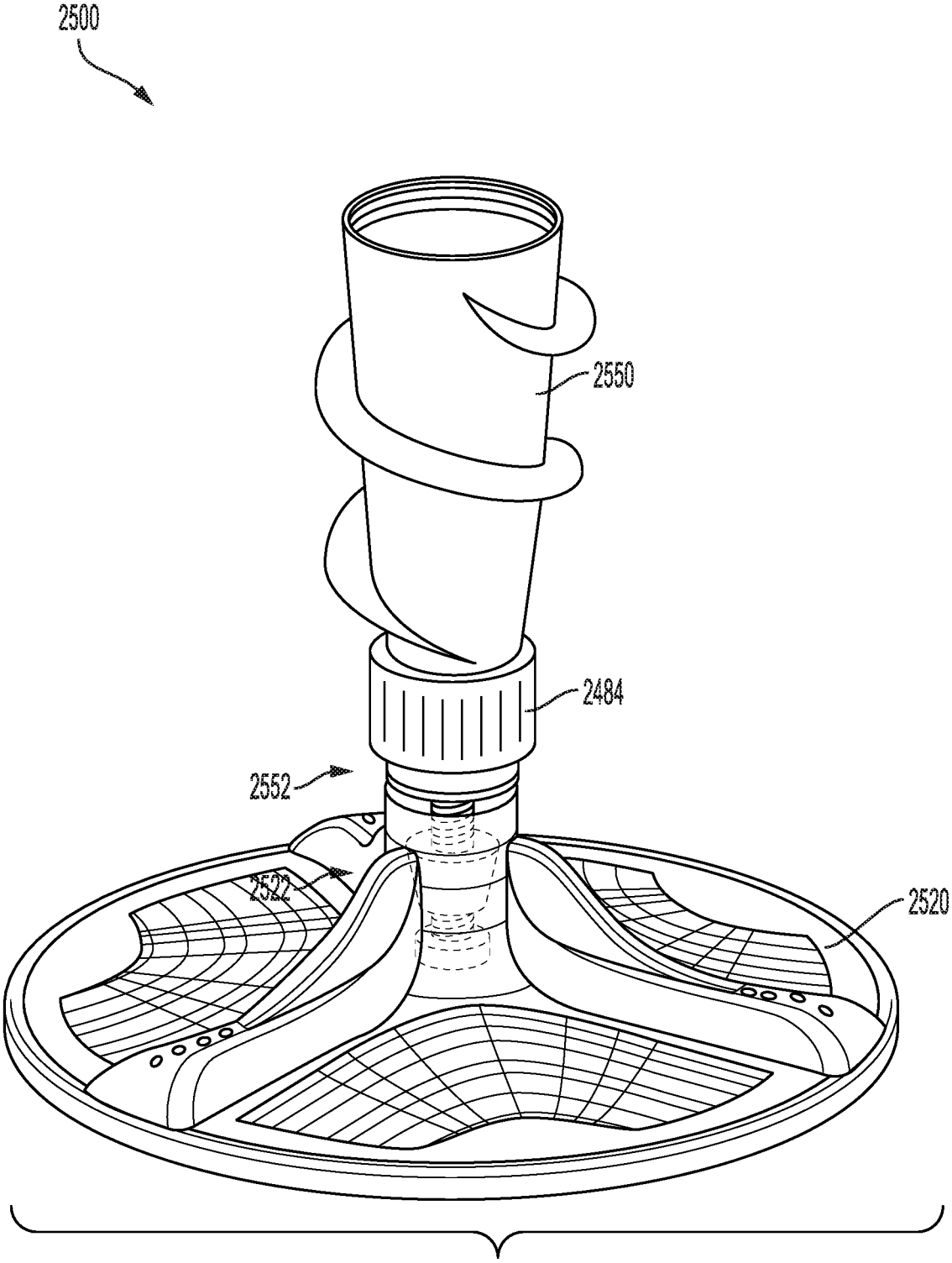
FIG. 48 is a perspective view of another example of an agitator coupling to an impeller for use with the clothes mover and laundry treating appliance of FIG. 1.

FIG. 48 illustrates an example of a clothes mover 2500 including an impeller 2520 and an agitator 2550 coupled by at least one twist lock 2484. A first connector 2552 can be sized such that it can be at least partially received within a second connector 2522 provided on the impeller 2520. The agitator 2550 further comprises the at least one twist lock 2484. In one example, the at least one twist lock 2484 can be a type of twist lock 2484 that can be used for telescoping ice scrapers, utility shop lights, or camera tripods. Such a twist lock 2484 can be multi-rotational or can have a fixed angle of rotation, non-limiting examples of which can include a quarter of a rotation.

Figure 49:
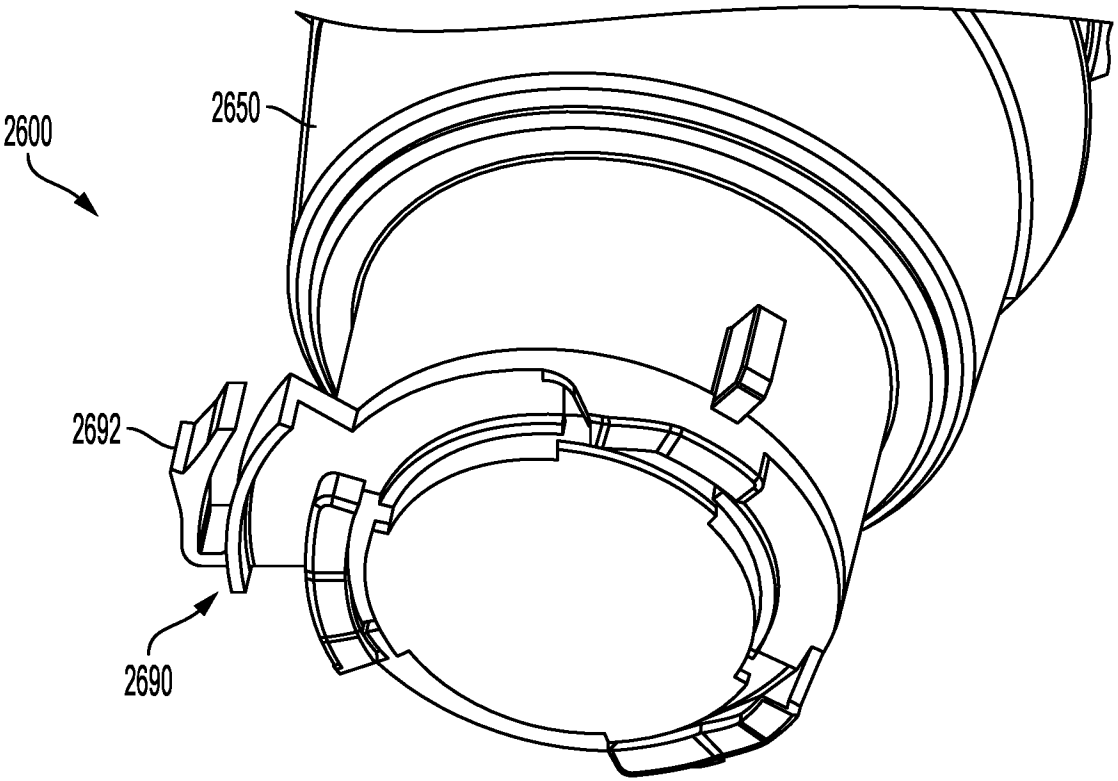
FIG. 49 is a bottom perspective view of another example of an agitator for coupling to an impeller for use with the clothes mover and laundry treating appliance of FIG. 1.
Figure 50:
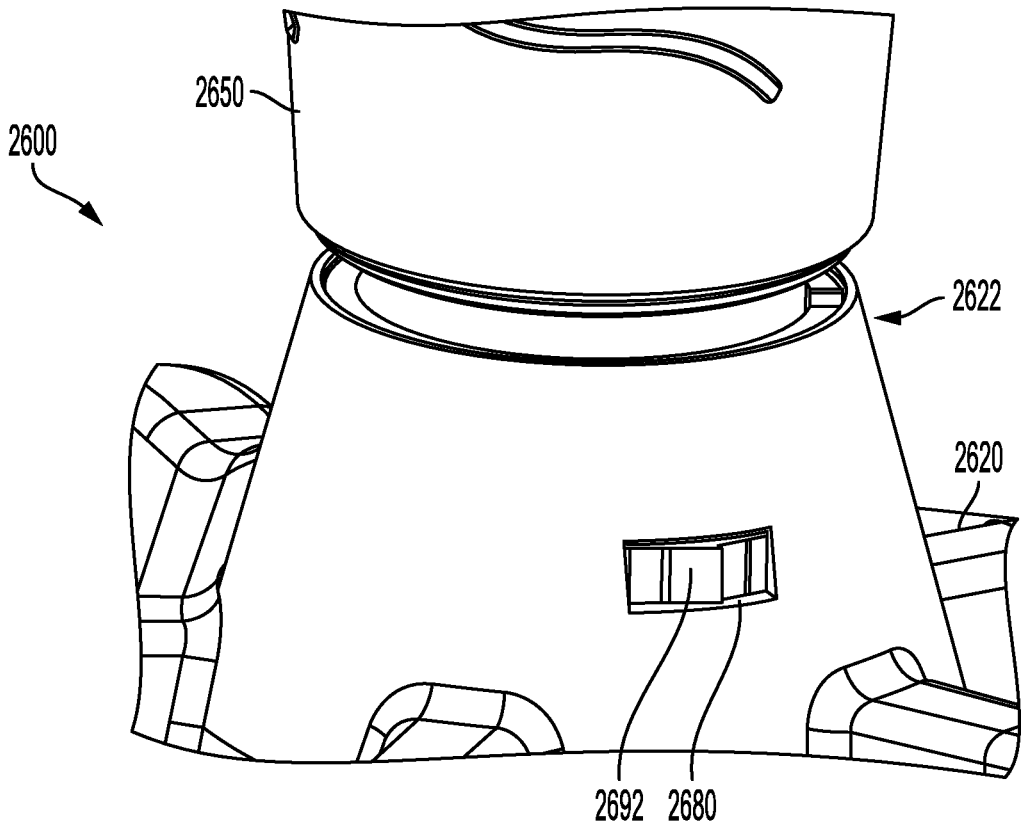
FIG. 50 is a perspective view of the agitator coupling to an impeller of FIG. 49.
Figure 51:
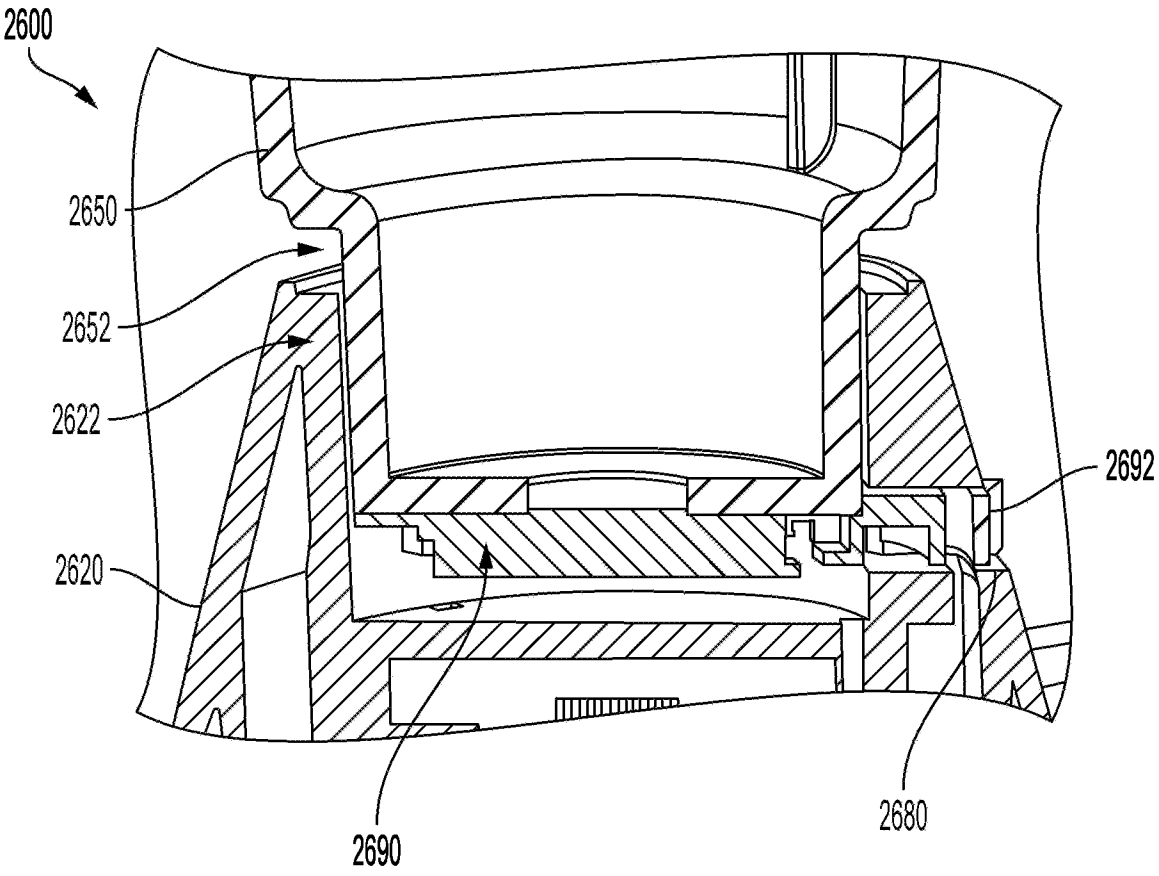
FIG. 51 is a cross-sectional view of the agitator coupling to the impeller of FIG. 49.

FIGS. 49-51 illustrate an example of a clothes mover 2600 including an impeller 2620 and an agitator 2650 coupled by at least one locking collar 2690.

In FIG. 49, the agitator 2650 is coupled with the locking collar 2690. The locking collar 2690 further comprises at least one detent 2692. The locking collar 2690 can be, by way of non-limiting example, a locking collar 2690 such as would be used for a garbage disposal or a pump motor attachment.

In FIG. 50, the agitator 2650 and the locking collar 2690 are each at least partially received within the impeller 2620. The impeller 2620 defines a detent opening 2680 within which the detent 2692 can be received so as to prevent or inhibit undesired rotation or axial or lateral movement between the agitator 2650 and the impeller 2620.

In FIG. 51, the coupling of the agitator 2650 and the impeller 2620 is shown in cross-section to illustrate the coupling of the locking collar 2690 to the agitator 2650, as well as to more clearly show the position of the detent 2692 as it is received within the detent opening 2680.

Figure 52:
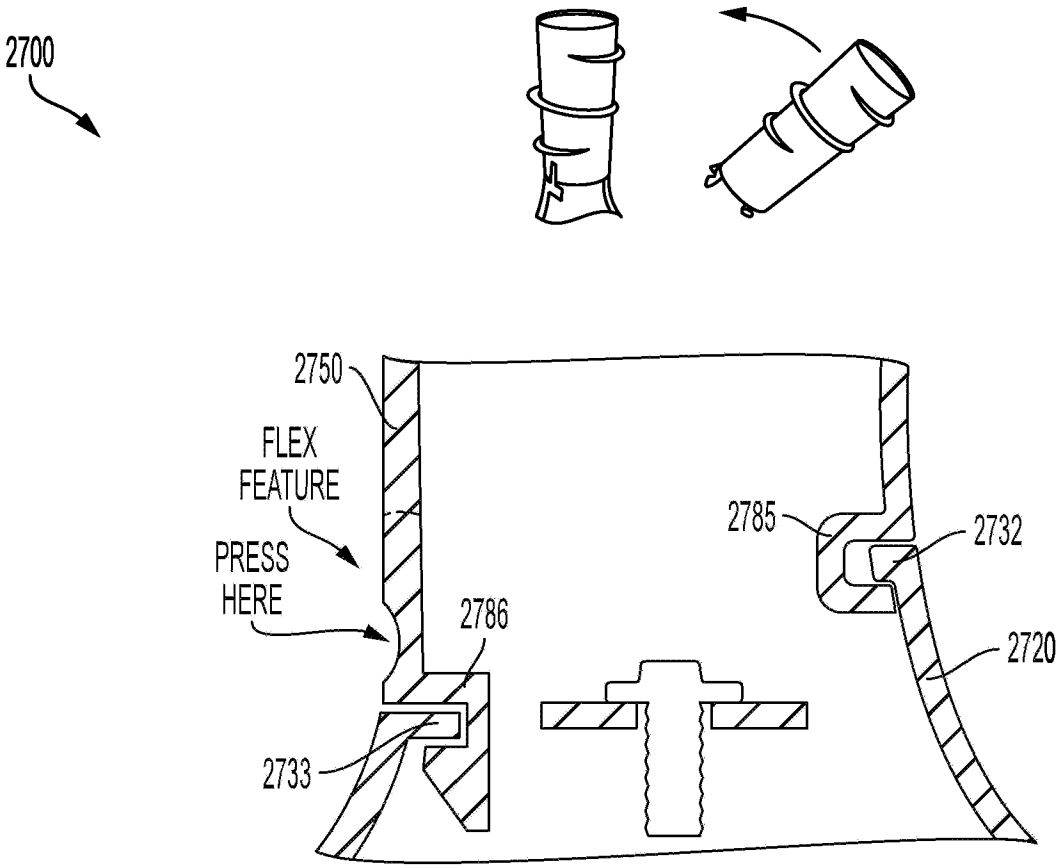
FIG. 52 is a schematic cross-sectional view of another example of an agitator coupling to an impeller for use with the clothes mover and laundry treating appliance of FIG. 1.

FIG. 52 illustrates an example of a clothes mover 2700 including an impeller 2720 and an agitator 2750 coupled by at least one pivoting attachment mechanism. The impeller 2720 defines a first raised retaining rib 2732 and a second lower retaining rib 2733. The agitator 2750 comprises a first hook channel 2785 configured to receive the first raised retaining rib 2732 and a second snap channel 2786 configured to receive the second lower retaining rib 2733. In one example, the hook channel 2785 can be positioned in place and receiving the first raised retaining rib 2732 while the agitator 2750 is at least partially tilted. Then, the agitator 2750 can be pivoted or rotated back to the upright position, allowing the snap channel 2786 to snap over the lower retaining rib 2733 as the agitator 2750 pivots.

Figure 53:
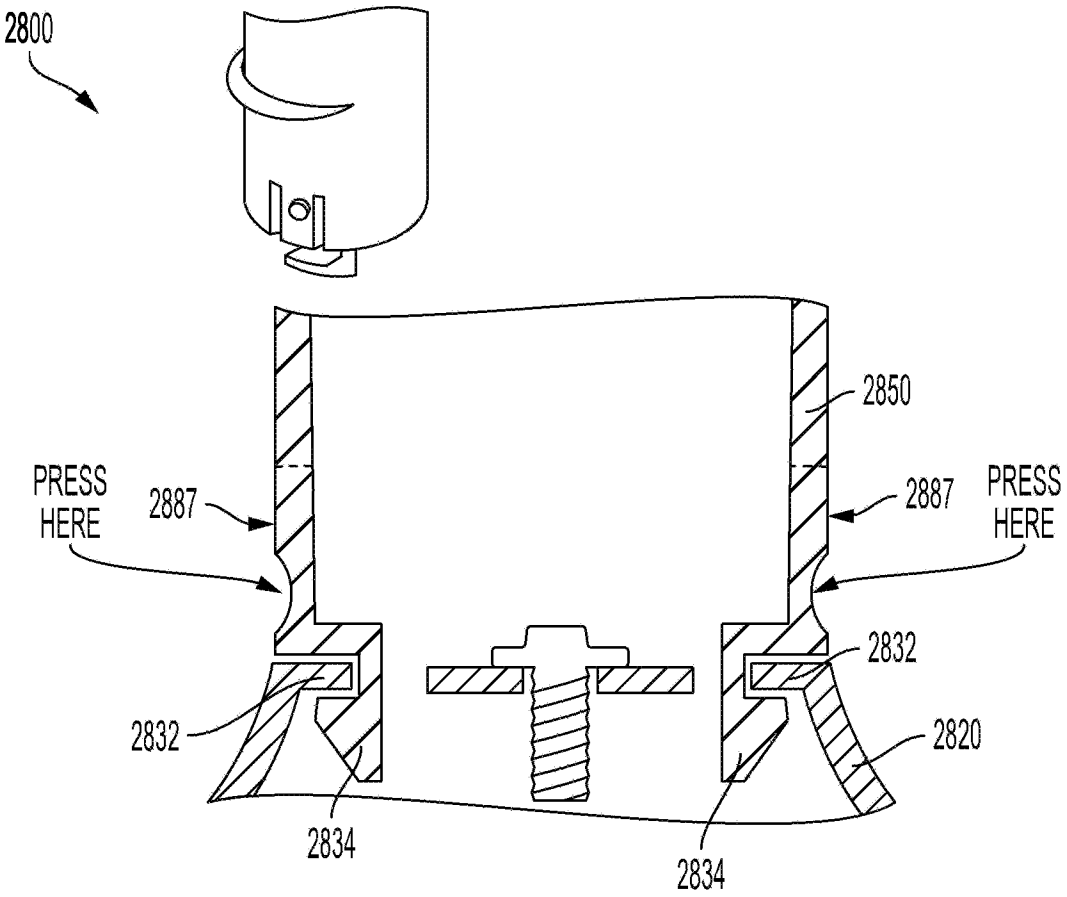
FIG. 53 is a schematic cross-sectional view of another example of an agitator coupling to an impeller for use with the clothes mover and laundry treating appliance of FIG. 1.

FIG. 53 illustrates an example of a clothes mover 2800 including an impeller 2820 and an agitator 2850 coupled by at least one snap-down attachment mechanism. The impeller 2820 defines at least one retaining rib 2832. The agitator 2850 includes at least one non-rigid lower end 2887 defining at least one snap channel 2834 configured to receive the retaining rib 2832. In one example, the agitator 2850 can be coupled to the impeller 2820 by moving the agitator 2850 straight downward into the impeller 2820, causing the snap channels 2834 to be deflected and to flex inwardly, then to return radially outwardly once the snap channel 2834 has snapped around the retaining rib 2832. Optionally, the non-rigid lower ends 2887 can include grips for the user to place their fingers to squeeze the non-rigid lower ends 2887 inwardly to make the snap fit connection.

Figure 54:
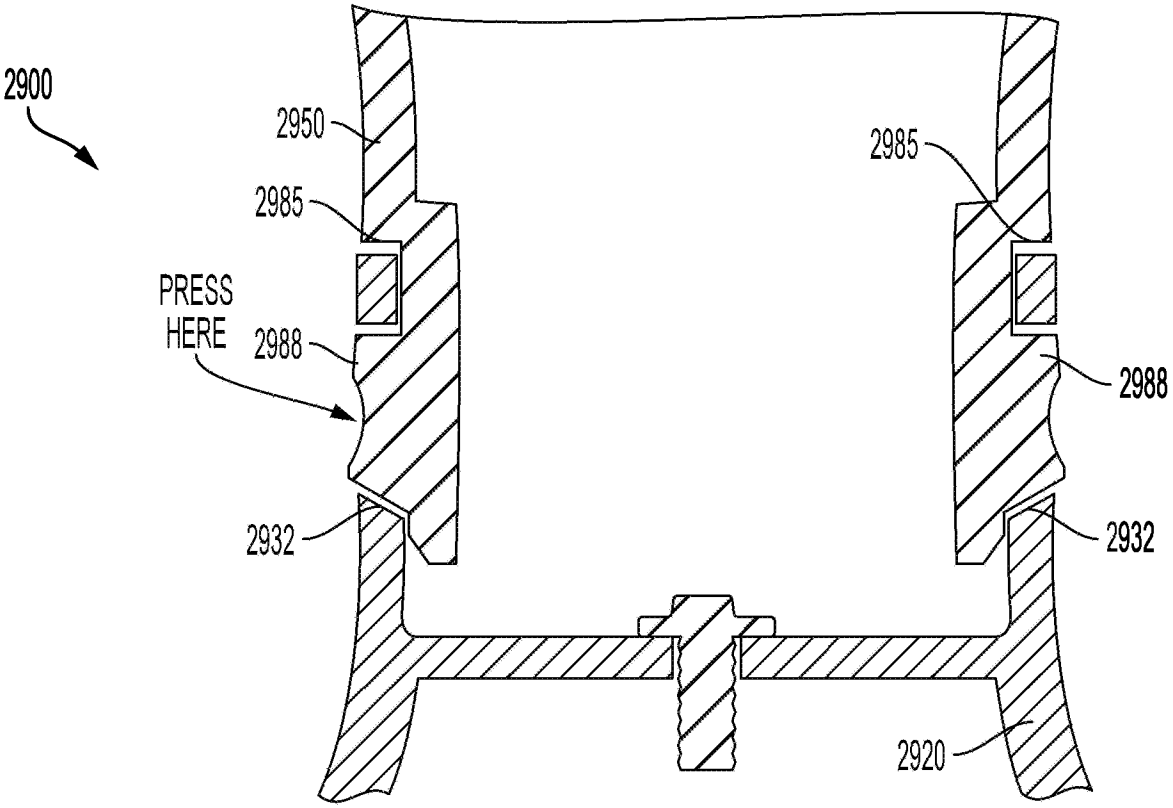
FIG. 54 is a schematic cross-sectional view of another example of an agitator coupling to an impeller for use with the clothes mover and laundry treating appliance of FIG. 1.

FIG. 54 illustrates an example of a clothes mover 2900 including an impeller 2920 and an agitator 2950 coupled by at least one depressible button attachment mechanism. The impeller 2920 defines at least one button opening 2932. The agitator 2950 defines at its lower ends at least one depressible button 2988 with an adjacent impeller receiving channel 2985. When the user wishes to assembly the agitator 2950 to the impeller 2920 to form the clothes mover 2900, the user can inwardly deflect the depressible buttons 2988 with their fingers, then insert the agitator 2950 into the impeller 2920 such that the depressible buttons 2988 can snap back outwardly once the depressible buttons come into alignment with the button openings 2932.

Figure 55:
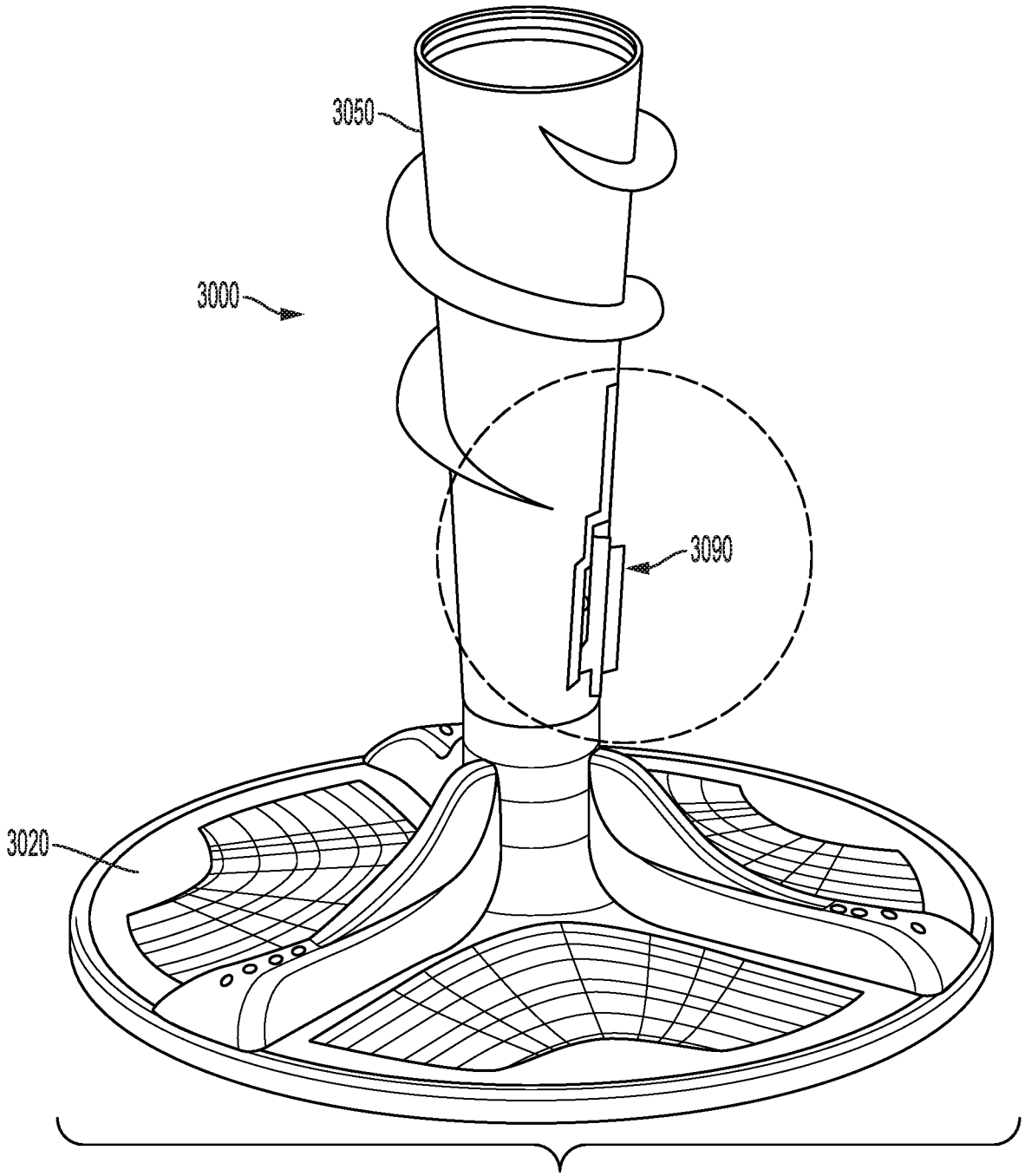
FIG. 55 is a perspective view of another example of an agitator coupling to an impeller for use with the clothes mover and laundry treating appliance of FIG. 1.
Figure 56:
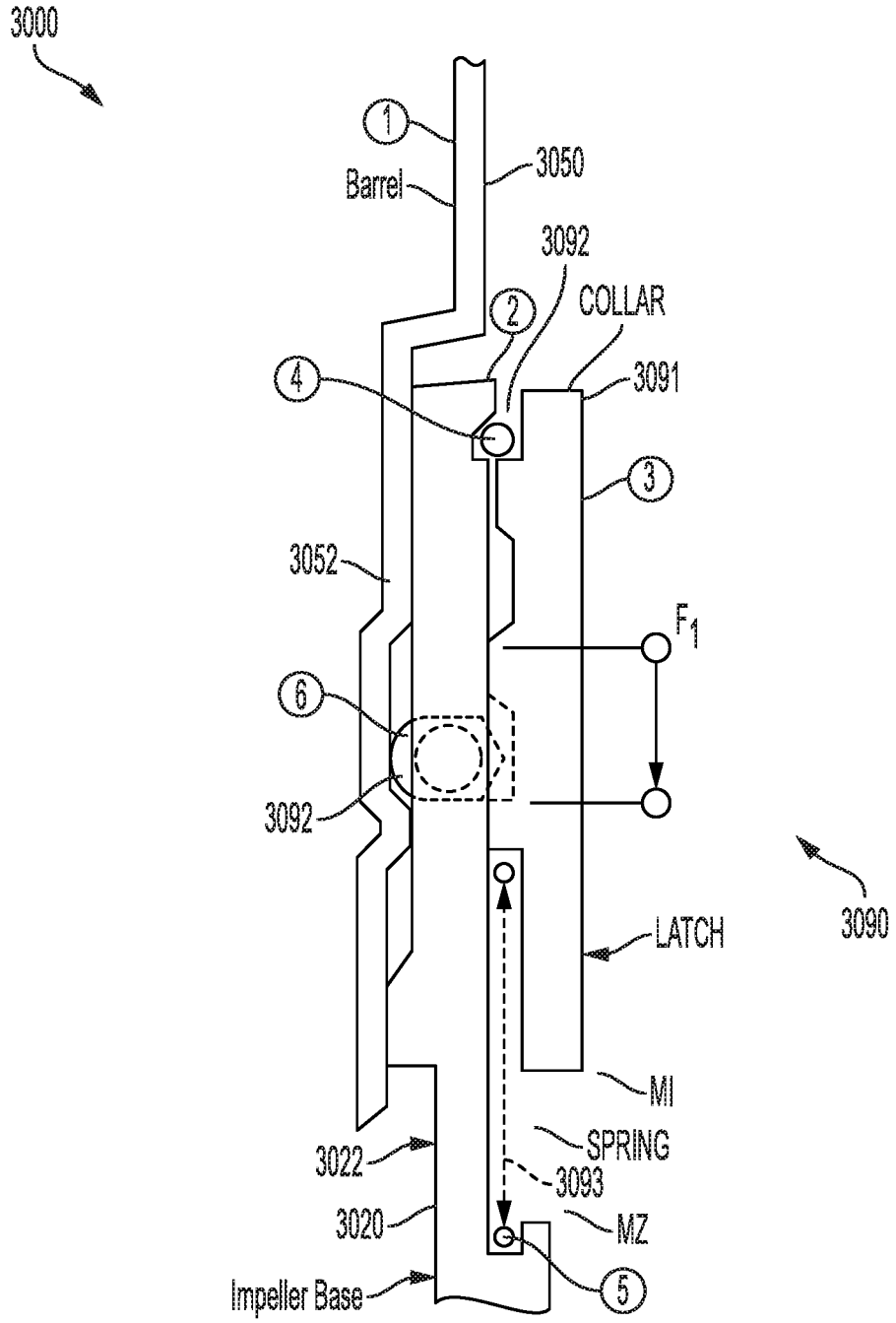
FIG. 56 is a perspective cross-sectional view of the agitator coupling to the impeller of FIG. 55.

FIGS. 55-56 illustrate an example of a clothes mover 3000 including an impeller 3020 and an agitator 3050 coupled by at least one locking sleeve 3090.

Referring now to FIG. 56, when the first connector 3052 is received within the second connector 3022 to couple the agitator 3050 to the impeller 3020, the locking sleeve 3090 can at least partially surround the agitator 3050, and can further include at least an outer collar portion 3091. The locking sleeve 3090 can further comprise at least a spring 3093 and at least one ball 3092 received within the collar portion 3091. The locking sleeve 3090 can be provided in a manner similar to that used for quick disconnects for air hose couplings.

Figure 57:
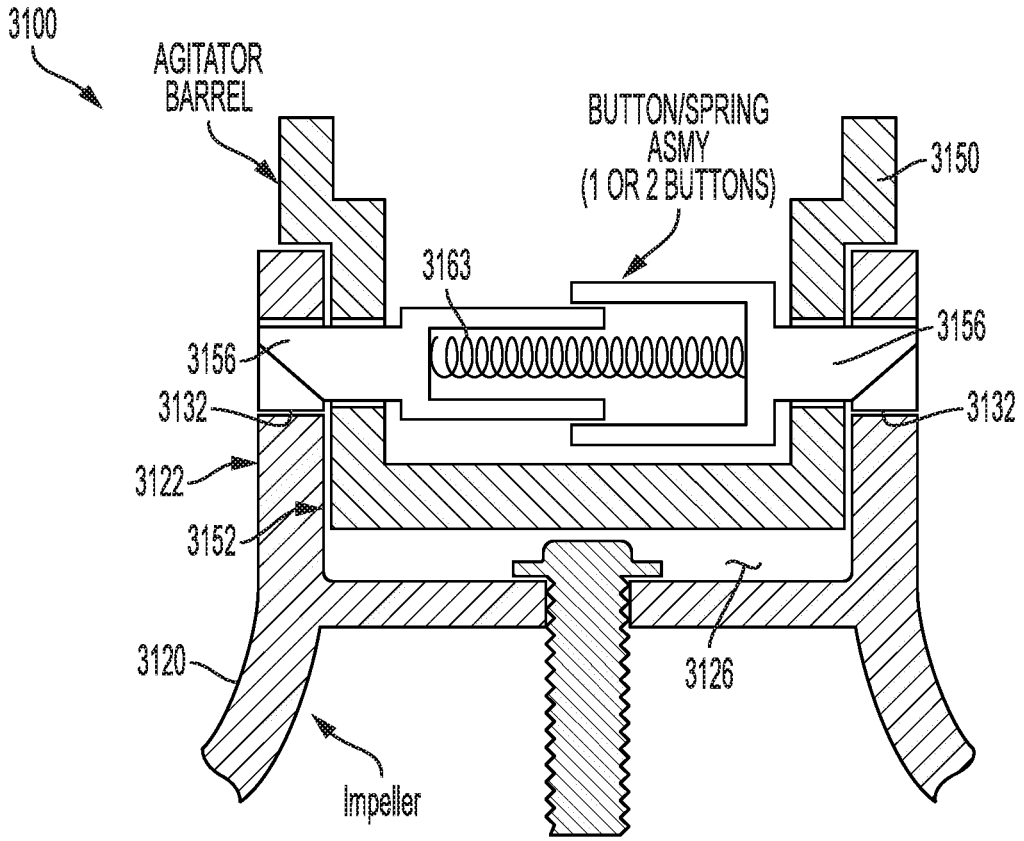
FIG. 57 is a schematic cross-sectional view of another example of an agitator coupling to an impeller for use with the clothes mover and laundry treating appliance of FIG. 1.

FIG. 57 illustrates an example of a clothes mover 3100 including an impeller 3120 and an agitator 3150 coupled by at least one spring-biased detent connection comprising a pair of spring-loaded detents 3156 that are biased axially outwardly and in opposite direction from one another by a spring 3163 that extends between the two detents 3156. A first connector 3152 includes the pair of spring-loaded detents 3156 and the spring 3163 therebetween, the detents 3156 protruding axially outwardly from the first connector 3152. A second connector 3122 defines a pair of openings 3132 within which the detents 3156 can be received when the agitator 3150 is received within a socket 3126 of the impeller 3120.

To assemble the clothes mover 3100, the agitator 3150 can be provided downwardly into the socket 3126 such that the movement of the first connector 3152 into the second connector 3122 depresses the pair of spring-loaded detents 3156 inwardly against the spring 3163 until the pair of spring-loaded detents 3156 has aligned with the openings 3132. When the detents 3156 come into alignment with the openings 3132, the spring 3163 again biases the detents 3156 outwardly such that they extend into and are received within the openings 3132. To decouple the agitator 3150 from the impeller 3120, the user can manually depress the detents 3156 until the agitator 3150 can be upwardly withdrawn from the socket 3126.

Figure 58:
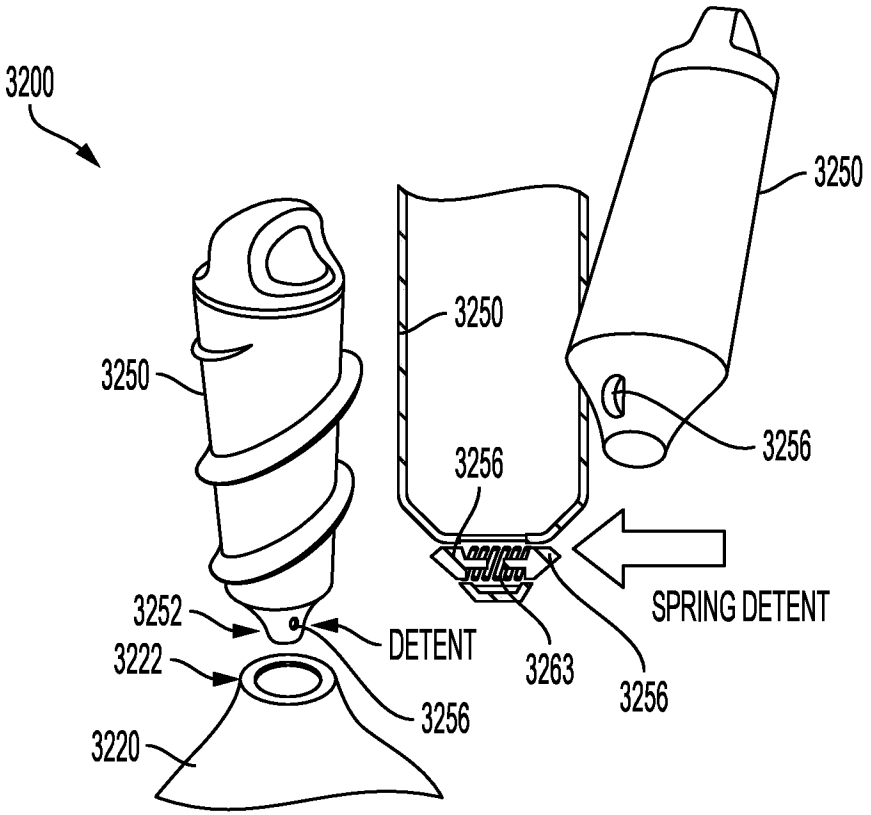
FIG. 58 is a perspective view of another example of an agitator coupling to an impeller for use with the clothes mover and laundry treating appliance of FIG. 1.

FIG. 58 illustrates examples of clothes movers 3200 including an impeller 3220 and at least one agitator 3250 having the spring-biased detent connection as described in FIG. 57, but with varying aesthetic designs. The clothes movers 3200 and agitators 3250 are very similar to the clothes mover 3100 and agitator 3150 of FIG. 57 and differ only in aesthetic detail. Therefore, elements of the clothes mover 3200 that are similar to those of the clothes mover 3100 are labeled with the prefix 3200.

Figure 59:
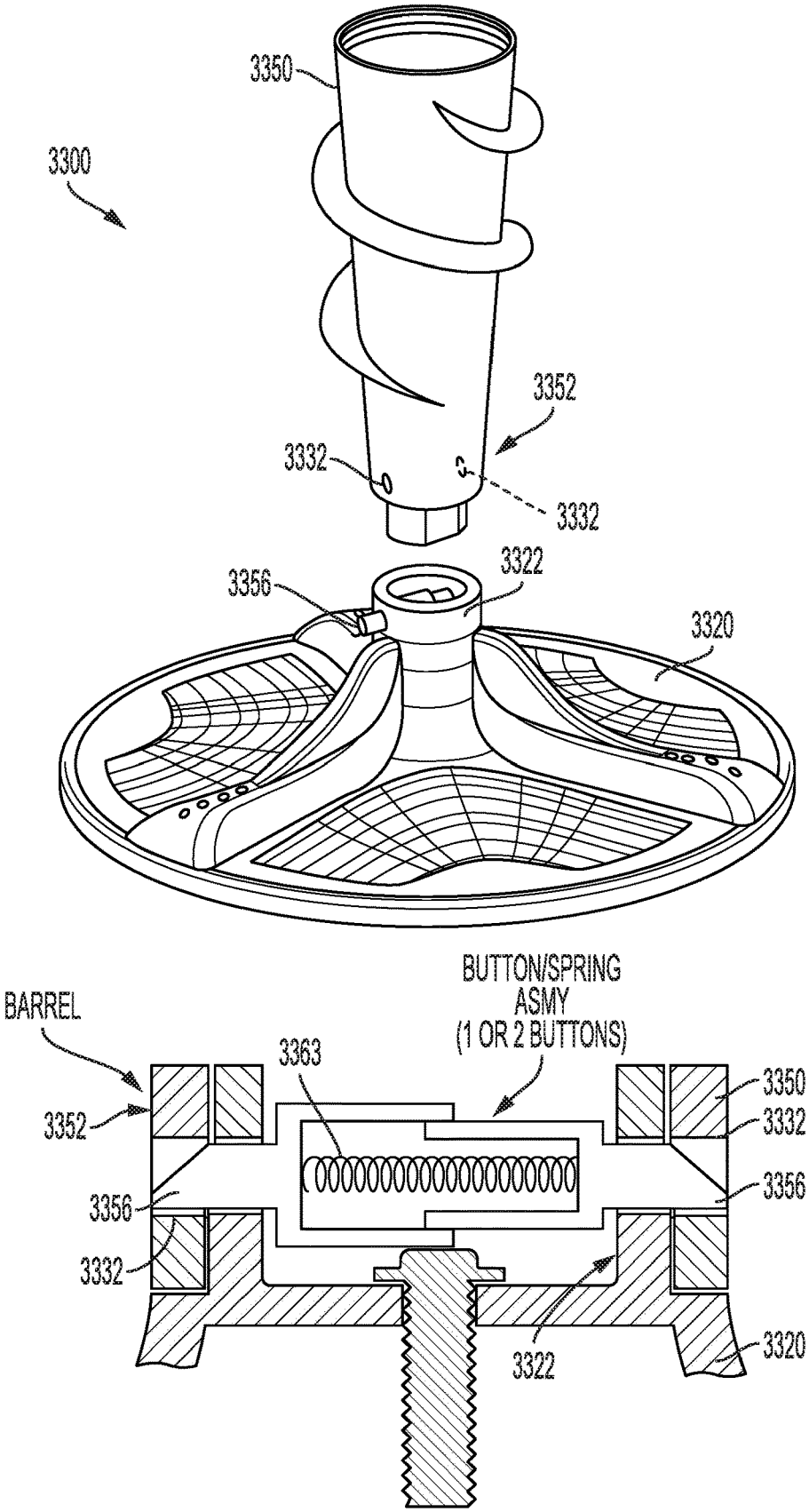
FIG. 59 is a schematic perspective and cross-sectional view of another example of an agitator coupling to an impeller for use with the clothes mover and laundry treating appliance of FIG. 1.

FIG. 59 illustrates an example of a clothes mover 3300 including an impeller 3320 and an agitator 3350 coupled by at least one spring-biased detent connection comprising a pair of spring-loaded detents 3356 that are biased radially outwardly and in opposite direction from one another by a spring 3363 that extends between the two detents 3356. A second connector 3322 includes the pair of spring-loaded detents 3356 and the spring 3363 therebetween, the detents 3356 protruding radially outwardly from the second connector 3322. A first connector 3352 defines a pair of openings 3332 within which the detents 3356 can be received when the second connector 3322 is received within the first connector 3352.

To assemble the clothes mover 3300, the agitator 3350 can be provided downwardly around the second connector 3322 such that the movement of the first connector 3352 downwardly over the second connector 3322 depresses the pair of spring-loaded detents 3356 inwardly against the spring 3363 until the pair of spring-loaded detents 3356 has aligned with the openings 3332. When the detents 3356 come into alignment with the openings 3332, the spring 3363 again biases the detents 3356 outwardly such that they extend into and are received within the openings 3332. To decouple the agitator 3350 from the impeller 3320, the user can manually depress the detents 3356 until the agitator 3350 can be upwardly withdrawn from around the second connector 3322.

Figure 60:
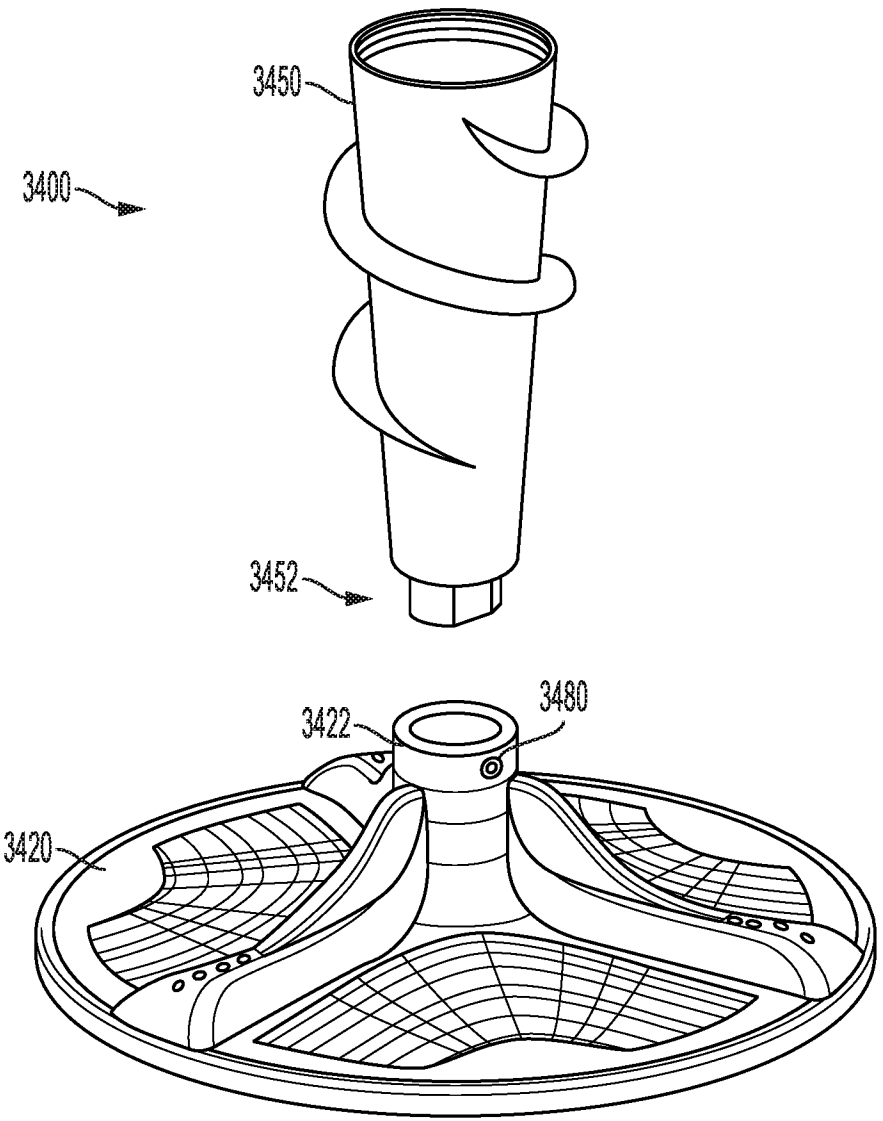
FIG. 60 is a schematic perspective and cross-sectional view of another example of an agitator coupling to an impeller for use with the clothes mover and laundry treating appliance of FIG. 1.
Figure 60:
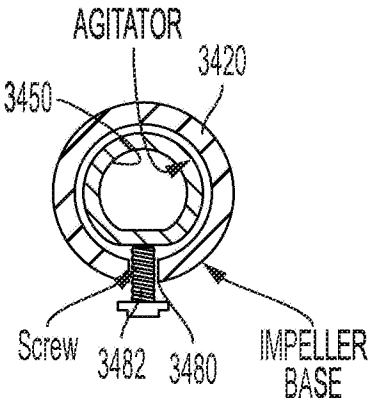

FIG. 60 illustrates an example of a clothes mover 3400 including an impeller 3420 and an agitator 3450 coupled by a retaining screw 3482. The impeller 3420 includes a threaded fastener opening 3480. The first connector 3452 is sized to fit within the impeller 3420 such that the threaded fastener opening 3480 abuts the first connector 3452. When the agitator 3450 is received within the impeller 3420, the retaining screw 3482 can be threadably coupled into the threaded fastener opening 3480, with the help of a tool as the retaining screw 3482 has no hand-turnable knob. The retaining screw 3482 can be, by way of non-limiting example, a retaining screw 3482 such as for a flagpole or an outdoor umbrella.

Figure 61:
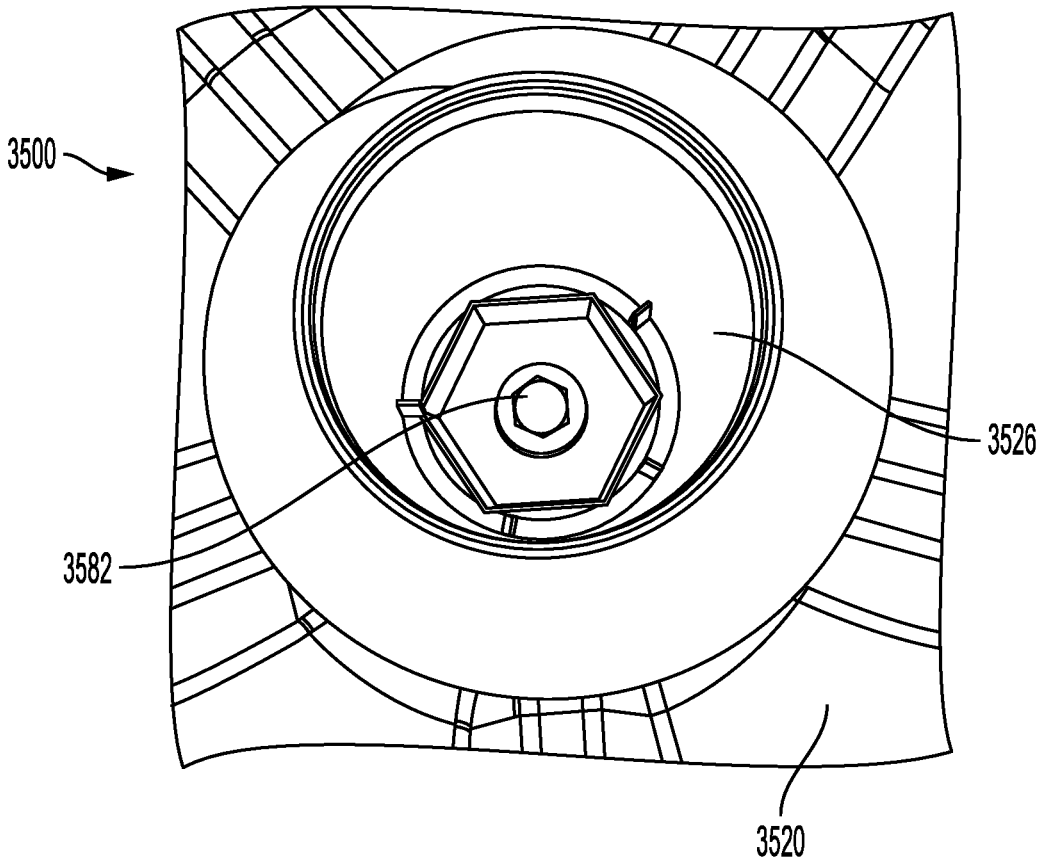
FIG. 61 is a perspective view of another example of an impeller for coupling to an agitator for use with the clothes mover and laundry treating appliance of FIG. 1.

FIG. 61 illustrates an example of a clothes mover 3500 comprising at least an impeller 3520 defining a socket 3526, within which an assembly bolt 3582 is installed. In some cases it is necessary to remove this assembly bolt 3582 before a removable agitator 3550 can be attached. However, this can require specialized tools, such as a long-handled ratchet wrench.

Figure 62:
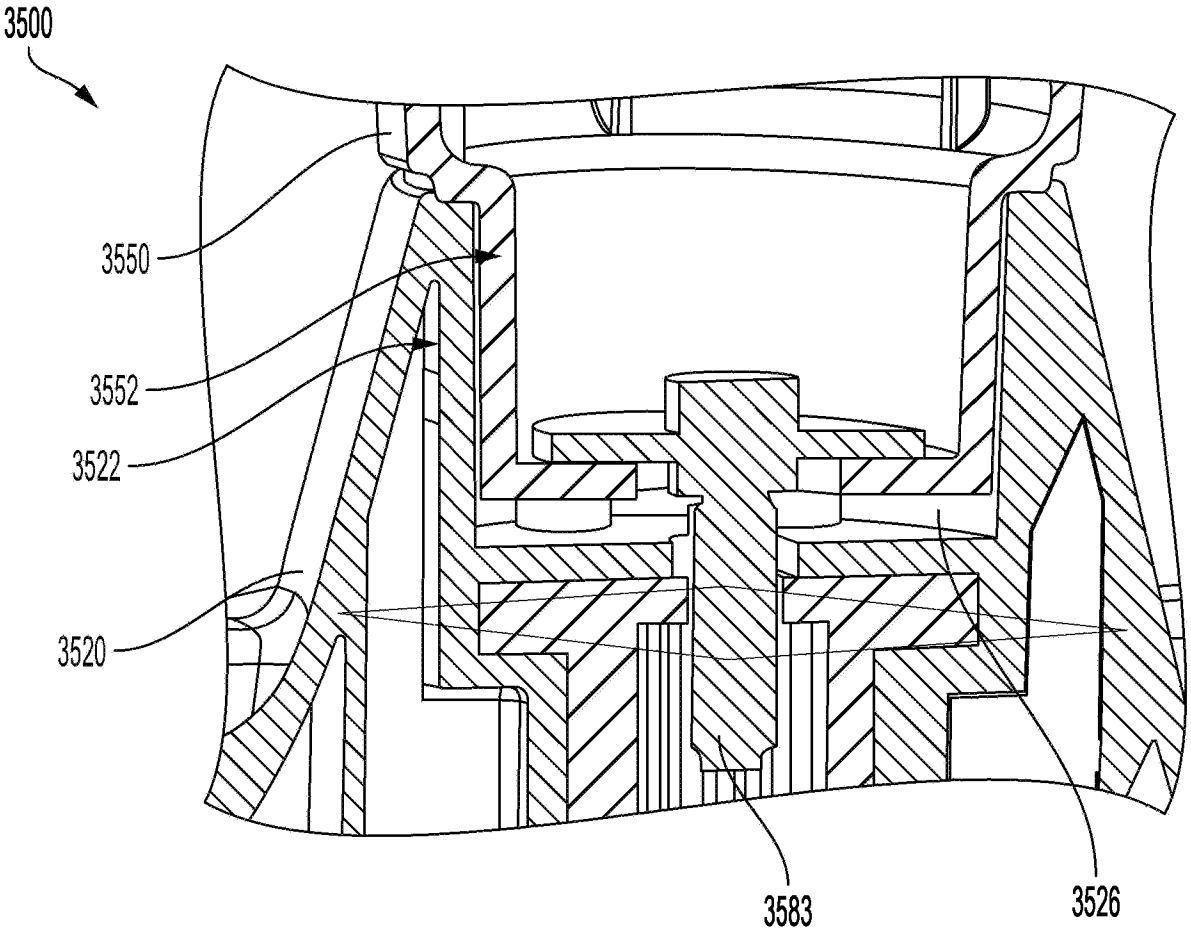
FIG. 62 is a cross-sectional view of another example of an agitator coupling to an impeller for use with the clothes mover and laundry treating appliance of FIG. 1.

Referring now to FIG. 62, when the assembly bolt 3582 of FIG. 61 has been removed, an agitator 3550 comprising a coupling bolt 3583 can be coupled with the impeller 3520 in the place of the assembly bolt 3582. In order for optimal operation to occur, the agitator 3550 should be fixed relative to the coupling bolt 3583 such that there is no relative rotation between the coupling bolt 3583 and the agitator 3550. In one example, the coupling bolt 3583 can be molded within the agitator 3550.

Figure 63:
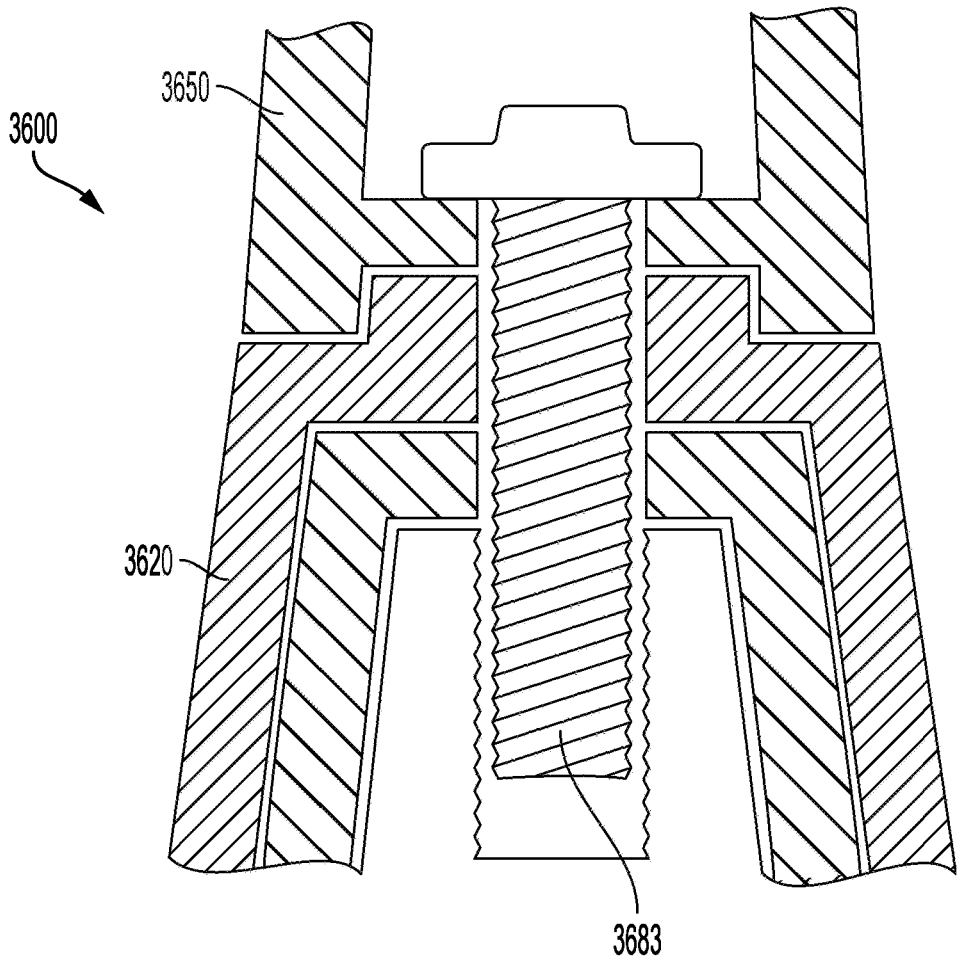
FIG. 63 is a schematic cross-sectional view of another example of an agitator coupling to an impeller for use with the clothes mover and laundry treating appliance of FIG. 1.

FIG. 63 illustrates a clothes mover 3600 including an impeller 3620 and an agitator 3650, with the female agitator 3650 coupled to the male impeller 3620 by a coupling bolt 3683. Thus, any of the attachment concepts or mechanisms described herein can be used with either a male agitator and a female socket of the impeller, or with a female agitator and a male socket of the impeller.

Figure 64:
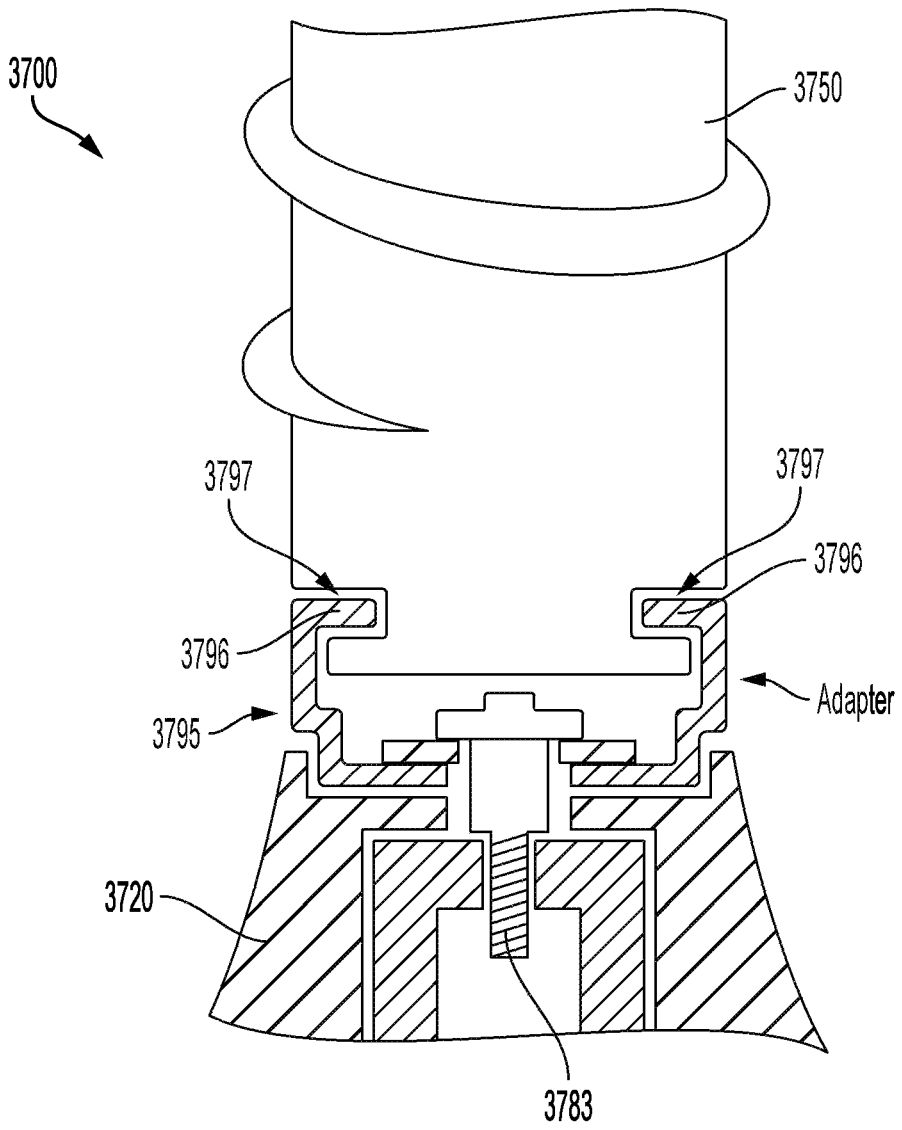
FIG. 64 is a schematic cross-sectional view of another example of an agitator coupling to an impeller for use with the clothes mover and laundry treating appliance of FIG. 1.

FIG. 64 illustrates a clothes mover 3700 including an impeller 3720 and an agitator 3750, with an adapter 3795 provided between the impeller 3720 and the agitator 3750. Any of the concepts disclosed herein can be implemented with the adapter 3795 in order to provide added flexibility such that the concepts disclosed herein can be used even with impellers 3720 or agitators 3750 that may not be designed to couple together. In one example, the adapter 3795 couples to the impeller 3720 via a coupling bolt 3783. The adapter 3795 further comprises at least one retaining rib 3796. The agitator 3750 can include at least one channel 3797 within which the retaining rib 3796 can be received so as to couple the agitator 3750 to the impeller 3720. The adapter 3795 can be attached in any suitable way, non-limiting examples of which include the use of fasteners, the use of glue or adhesives, by welding, vibration welding, ultrasonic welding, spin welding, or other mechanical and/or chemical bonding means.

Figure 65:
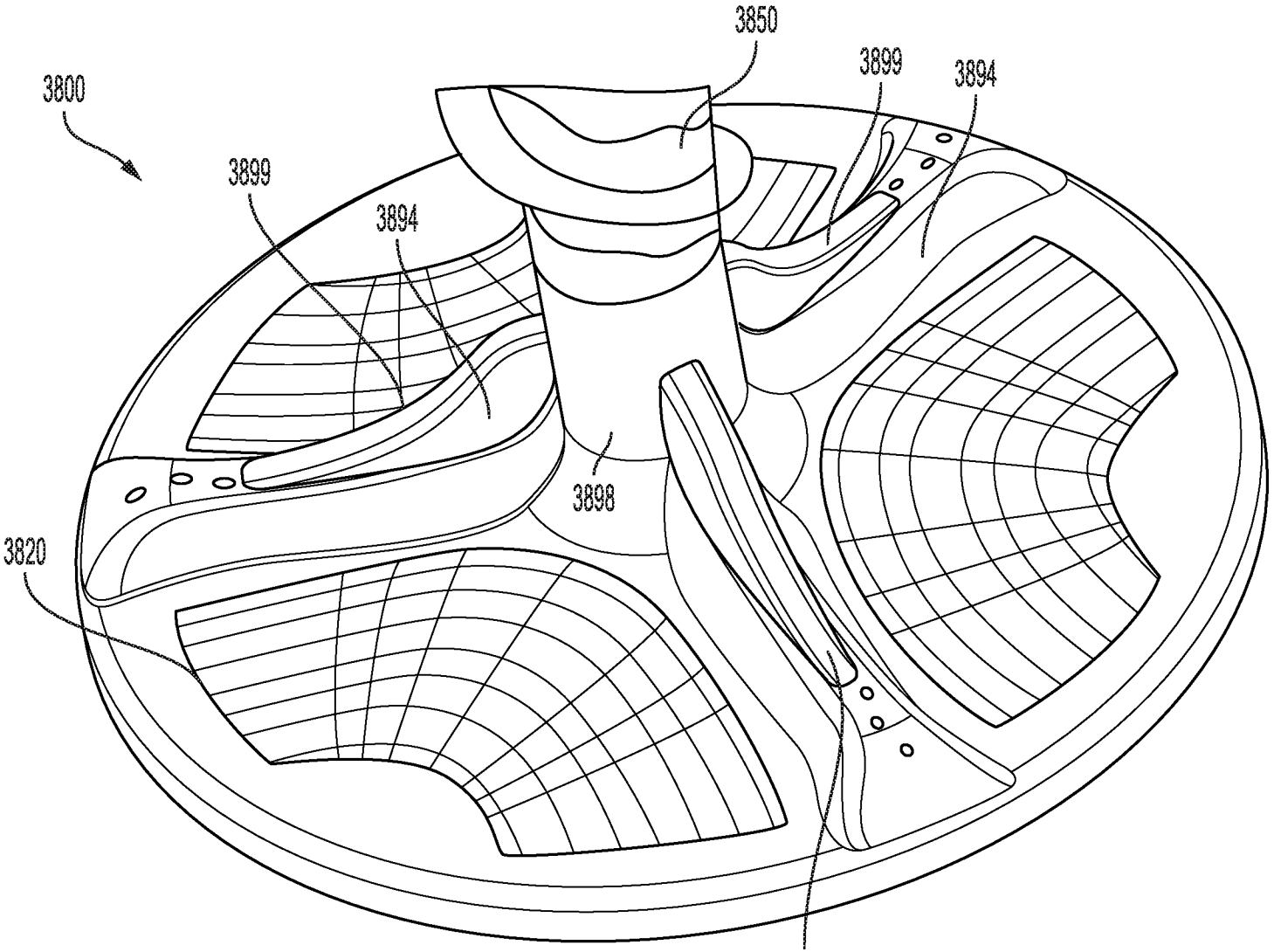
FIG. 65 is a perspective view of another example of an impeller coupling to an agitator for use with the clothes mover and laundry treating appliance of FIG. 1 and including an outrigger.

FIG. 65 illustrates a clothes mover 3800 including an impeller 3820 and an agitator 3850, and further including an outrigger assembly 3898. The outrigger assembly 3898 can be provided between the impeller 3820 and the agitator 3850 and can couple to both the impeller 3820 and the agitator 3850. The outrigger assembly 3898 can at least partially surround or couple to the impeller 3820, and in particular to the area of the second connector 3822. In one example, the outrigger assembly 3898 can be non-removable, though it will be understood that the outrigger can be permanently attached to or can be a part of the agitator 3850. In addition, the outrigger assembly 3898 can be provided with any of the aspects of the present disclosure.

The outrigger assembly 3898 comprises at least one individual outrigger 3899 that can extend at least partially along and couple to a vane 3894 defined by the impeller 3820. In one example, the outrigger 3899 can clip to the vane 3894 to provide a locking feature between the outrigger assembly 3898 and the impeller 3820. The outrigger assembly 3898 is configured to provide additional support to the agitator 3850, improving the robustness of the agitator 3850 to forces in the wash bath and also to reduce the amount of wobble of the agitator 3850 to improve spinning performance and user perception. The coupling of individual outriggers 3899 to at least one individual vanes 3894 can serve to retain the outriggers 3899, as well as to offer additional support by providing more contact points, and to leverage the outriggers 3899 to displace the moment of the agitator 3850.

Figure 66:
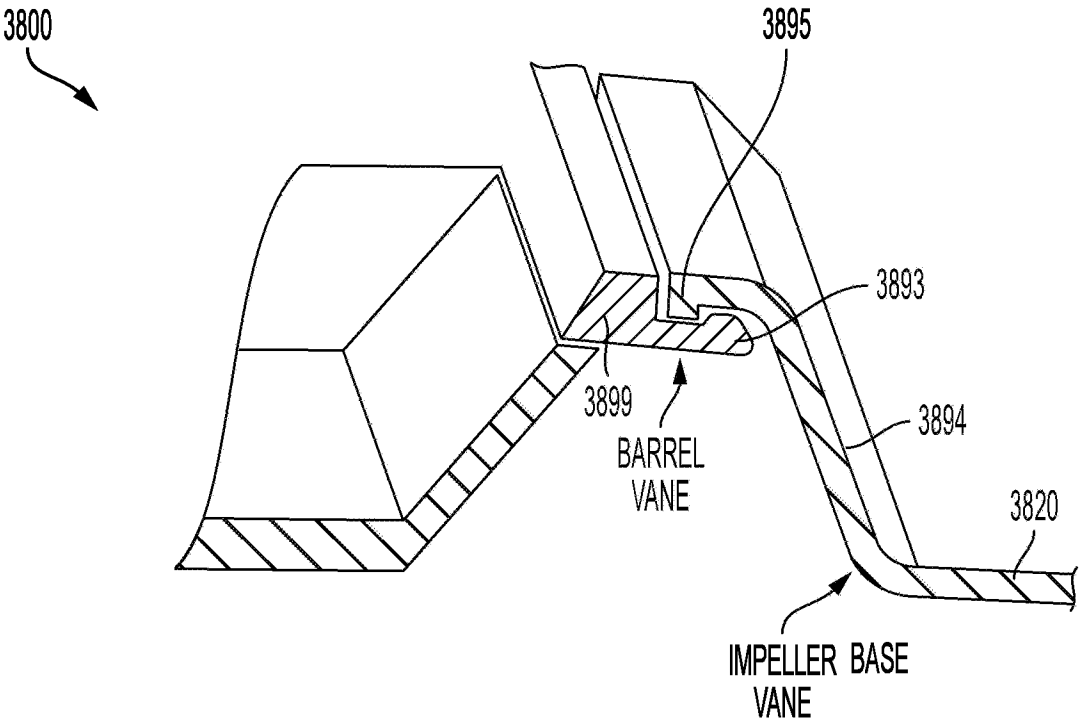
FIG. 66 is a schematic cross-sectional view of a portion of the outrigger of FIG. 65.

FIG. 66 illustrates a schematic view of the coupling between the vane 3894 and the outrigger 3899 of FIG. 65. The vane 3894 can define at least one rib 3895, which can be configured to resiliently retain the outrigger 3899. Further, the outrigger 3899 can include at least one protrusion 3893 that can be complementary to the rib 3895 of the outrigger 3899 for even more robust coupling.

Figure 67:
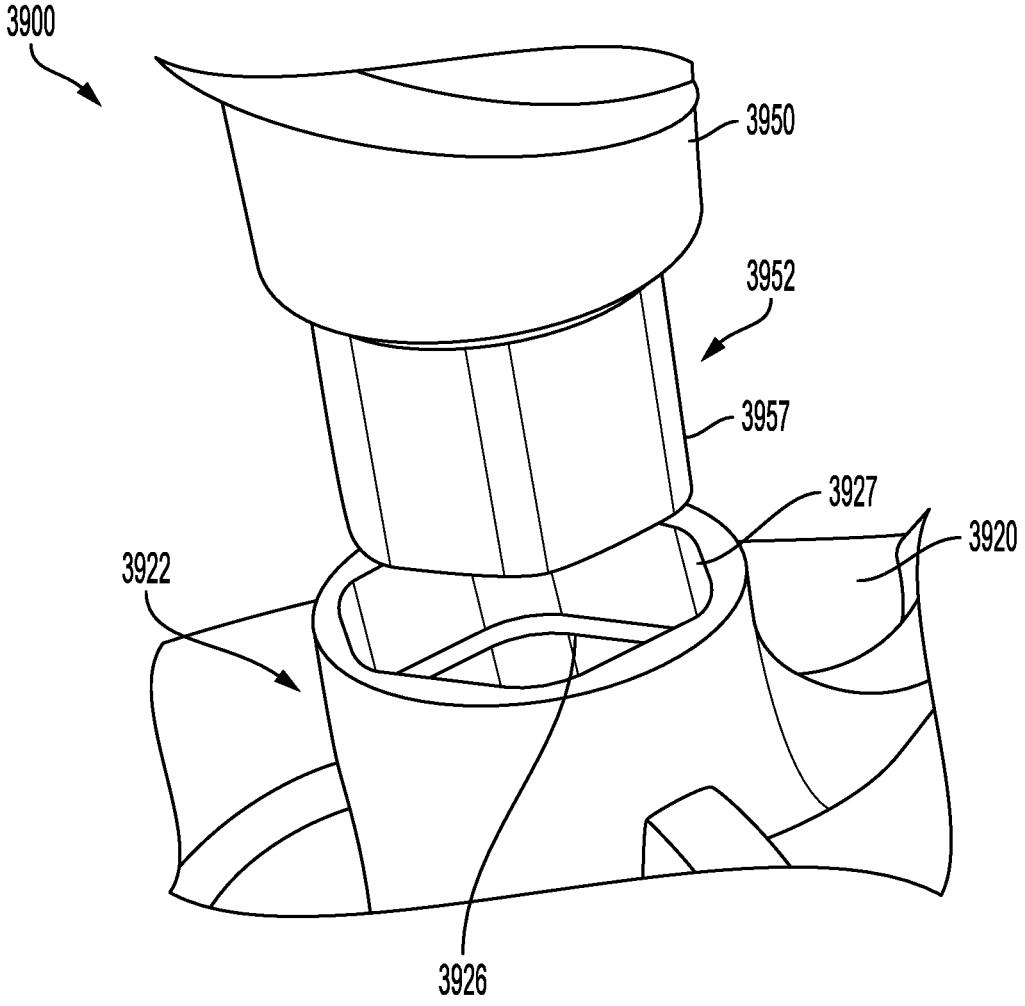
FIG. 67 is a perspective view of another example of an impeller coupling to an agitator for use with the clothes mover and laundry treating appliance of FIG. 1.

FIG. 67 illustrates a clothes mover 3900 including an impeller 3920 and an agitator 3950, and further comprising at least one alignment structure between the first connector 3952 and the second connector 3922. The agitator 3950 and the impeller 3920, and more specifically the first connector 3952 and the second connector 3922 can include at least one complementary shape, profile, surface, feature, etc. so as to facilitate easy alignment of the agitator 3950 with the impeller 3920 and easy insertion of the agitator 3950 into the socket 3926 during coupling. In this example, both the first and second connectors 3952, 3922 have a shape that is complementary to one another about the entire peripheries. However, it will be understood that the complementary profile need not extend about the entire periphery. For example, if the first connector 3952 had only one surface 3957, such as one flat surface, that was complementary to one other surface 3927 of the second connector 3922, the alignment benefit can still be realized. Further, while the first and second connectors 3952, 3922 are illustrated herein as having complementary hexagonal shape profiles, it will be understood that any desired shape can be used, non-limiting examples of which include, square, rectangular, star-shaped, triangular, sawtoothed, zig-zagged, wavey, round, oval, elliptical, etc.

Figure 68:
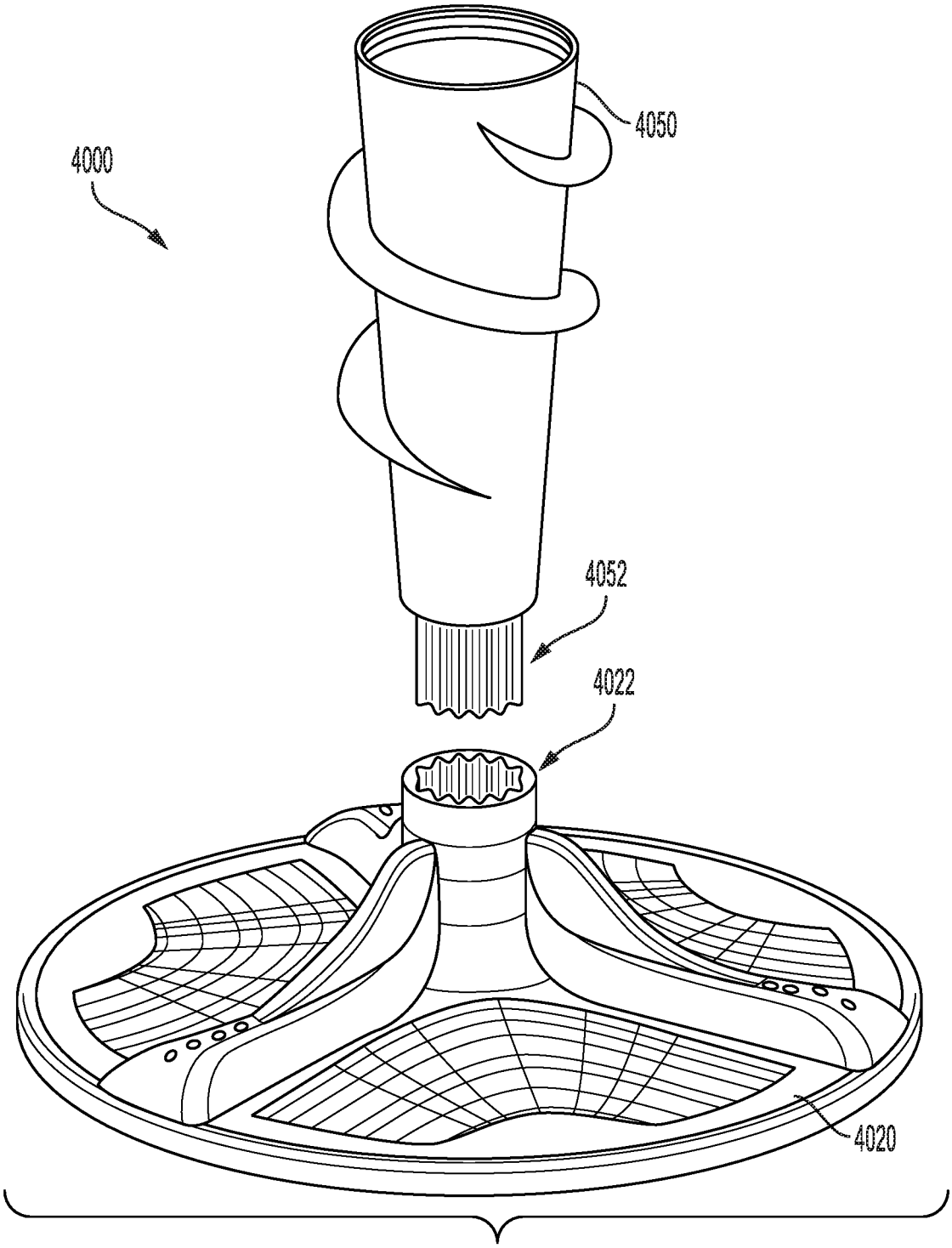
FIG. 68 is a schematic perspective view of another example of an impeller coupling to an agitator for use with the clothes mover and laundry treating appliance of FIG. 1.

FIG. 68 illustrates a clothes mover 4000 including an impeller 4020 and an agitator 4050, and further comprising an example of at least one alignment structure that is provided such as to be complementary between the first connector 4052 and the second connector 4022. In this example, the alignment structure comprises a set of splines, illustrated herein as having the appearance of toothed splines, defined by each of the first connector 4052 and the second connector 4022 and configured to mesh with one another.

Figure 69:
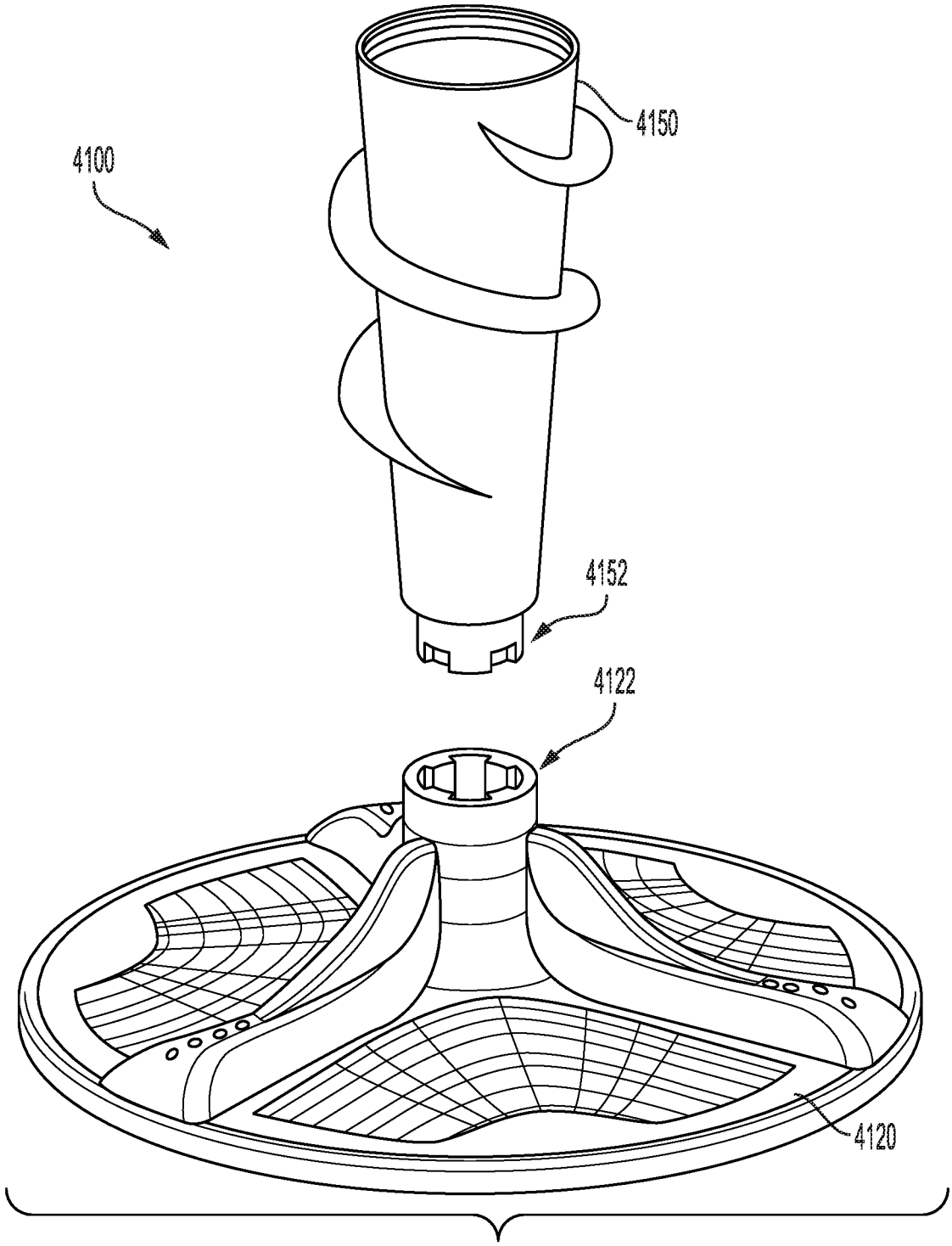
FIG. 69 is a schematic perspective view of another example of an impeller coupling to an agitator for use with the clothes mover and laundry treating appliance of FIG. 1.

FIG. 69 illustrates a clothes mover 4100 including an impeller 4120 and an agitator 4150, and further comprising an example of at least one alignment structure that is provided such as to be complementary between the first connector 4152 and the second connector 4122. In this example, the alignment structure comprises a set of splines, illustrated herein as having the appearance of uniform block splines, defined by each of the first connector 4152 and the second connector 4122 and configured to mesh with one another.

Figure 70:
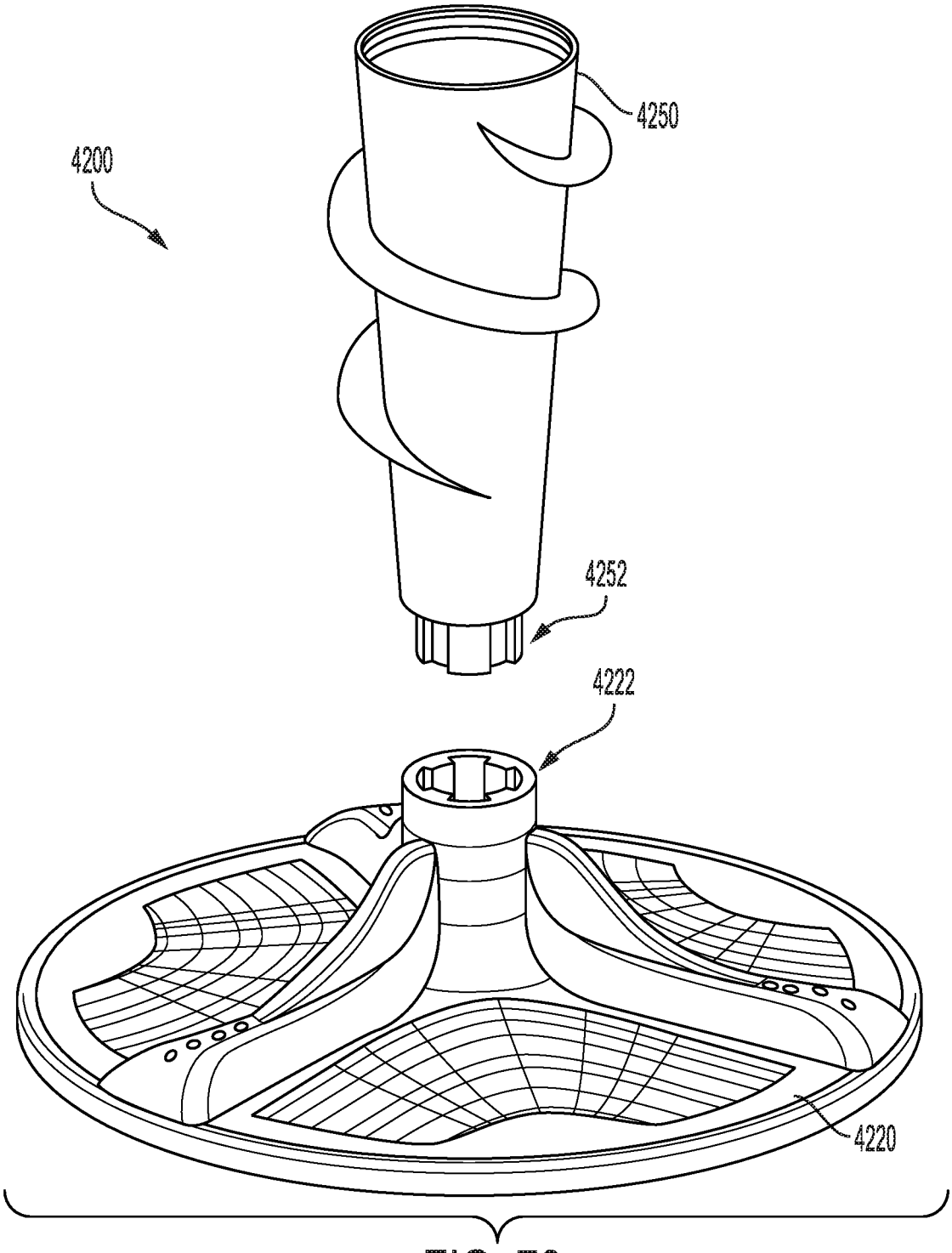
FIG. 70 is a schematic perspective view of another example of an impeller coupling to an agitator for use with the clothes mover and laundry treating appliance of FIG. 1.

FIG. 70 illustrates a clothes mover 4200 including an impeller 4220 and an agitator 4250, and further comprising an example of at least one alignment structure that is provided such as to be complementary between the first connector 4252 and the second connector 4222. In this example, the alignment structure comprises a set of splines, illustrated herein as having the appearance of flared or elongated block splines, defined by each of the first connector 4252 and the second connector 4222 and configured to mesh with one another.

Figure 71:
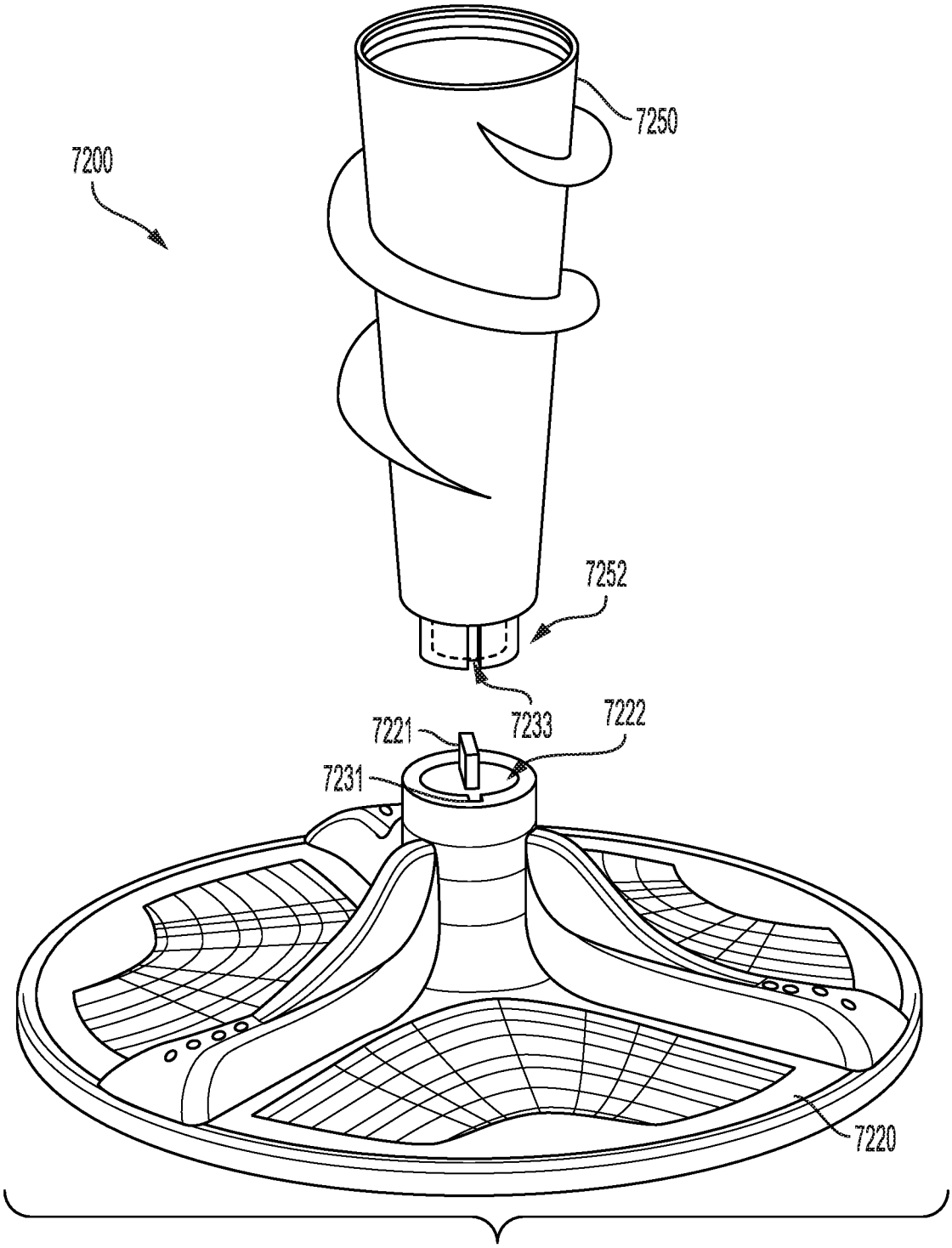
FIG. 71 is a schematic perspective view of another example of an impeller coupling to an agitator for use with the clothes mover and laundry treating appliance of FIG. 1.

FIG. 71 illustrates a clothes mover 7200 including an impeller 7220 and an agitator 7250, and further comprising an example of at least one alignment structure that is provided such as to be complementary between the first connector 7252 and the second connector 7222. In this example, the alignment structure comprises a block-shaped key 7221, receivable within a recess 7231 defined by the second connector 7222, and further receivable within a second recess 7233 defined by the first connector 7252 such that both the first and second connectors 7222, 7252 can be aligned with the key 7221, and thus with each other, at the same time, and configured to mesh with one another.

Figure 72:
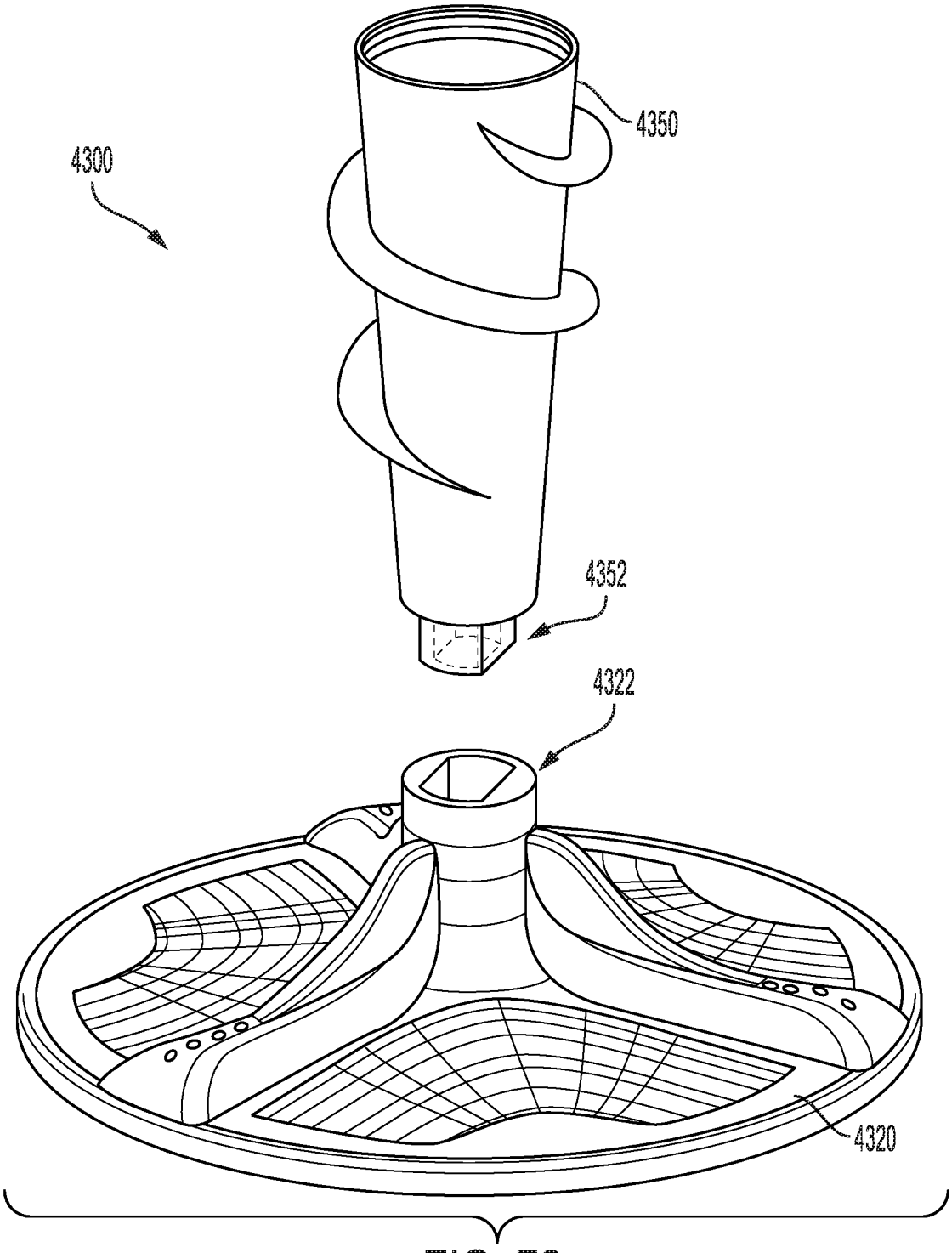
FIG. 72 is a schematic perspective view of another example of an impeller coupling to an agitator for use with the clothes mover and laundry treating appliance of FIG. 1.

FIG. 72 illustrates a clothes mover 4300 including an impeller 4320 and an agitator 4350, and further comprising an example of at least one alignment structure that is provided such as to be complementary between the first connector 4352 and the second connector 4322. In this example, the alignment structure comprises a shape, illustrated herein as having the appearance of a square-cornered oval or a back-to-back D shape, defined by each of the first connector 4352 and the second connector 4322 and configured to mesh with one another.

Figure 73:
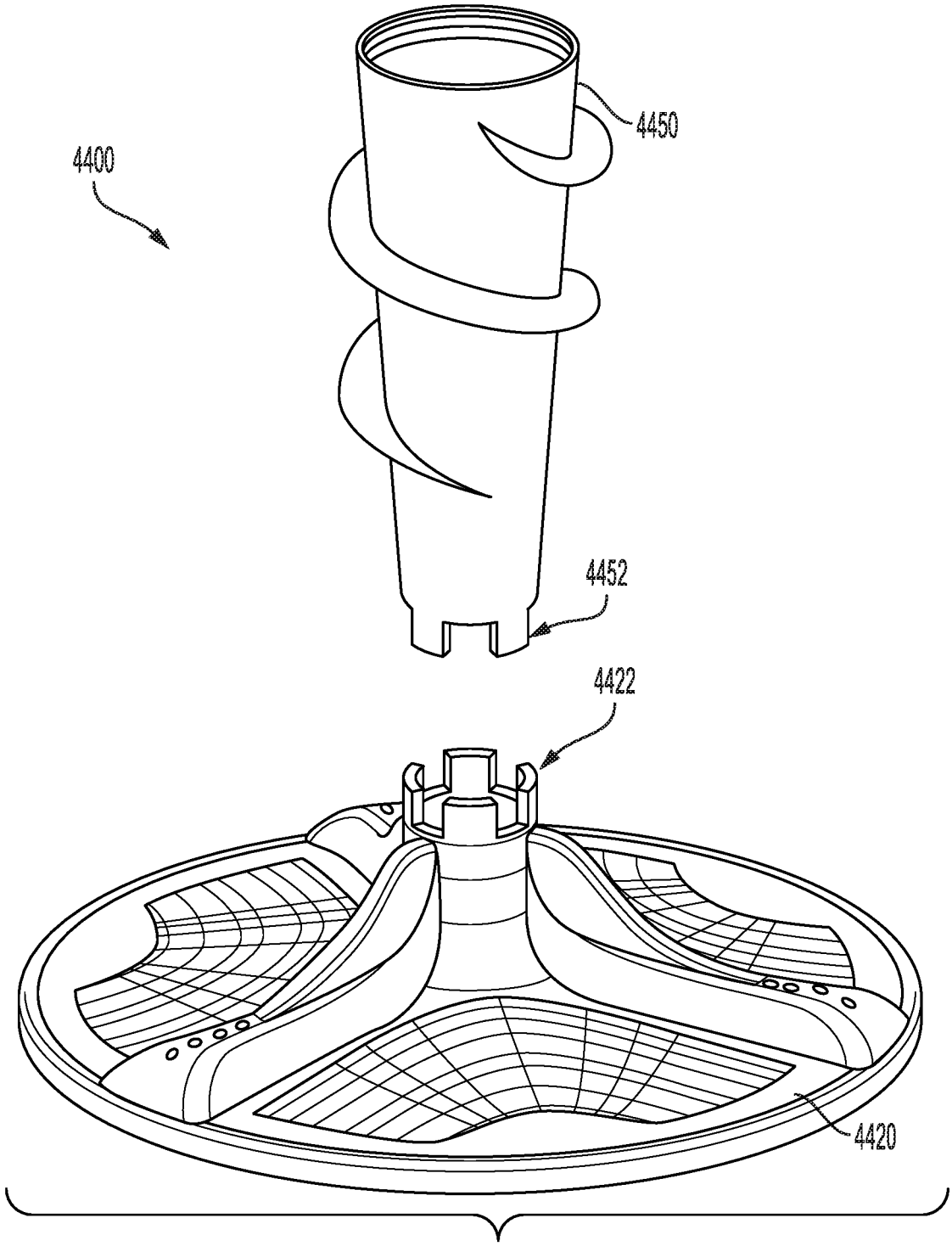
FIG. 73 is a schematic perspective view of another example of an impeller coupling to an agitator for use with the clothes mover and laundry treating appliance of FIG. 1.

FIG. 73 illustrates a clothes mover 4400 including an impeller 4420 and an agitator 4450, and further comprising an example of at least one alignment structure that is provided such as to be complementary between the first connector 4452 and the second connector 4422. In this example, the alignment structure comprises a set of castled structures or blocks, defined by each of the first connector 4452 and the second connector 4422 and configured to mesh with one another.

Figure 74:
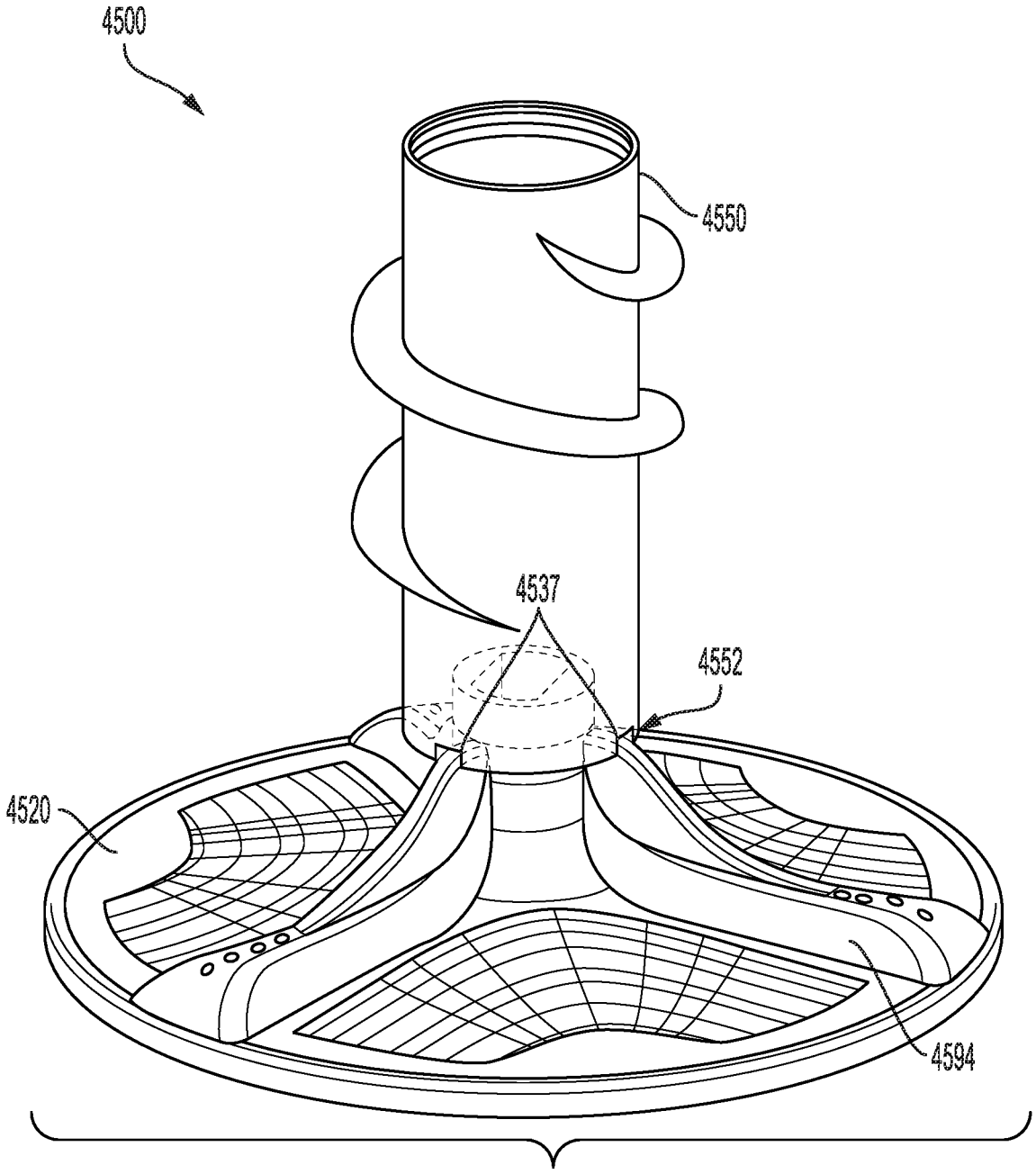
FIG. 74 is a schematic perspective view of another example of an impeller coupling to an agitator for use with the clothes mover and laundry treating appliance of FIG. 1.

FIG. 74 illustrates a clothes mover 4500 including an impeller 4520 and an agitator 4550, and further comprising an example of at least one alignment structure that is provided such as to be complementary between the agitator 4550 and the impeller 4520. In this example, the alignment structure comprises a set of cut-outs 4537, defined by a lower edge of the agitator 4550 and configured to mesh with vanes 4594 on the impeller 4520, such that the vanes 4594 are received within the cut-outs 4537.

Figure 75:
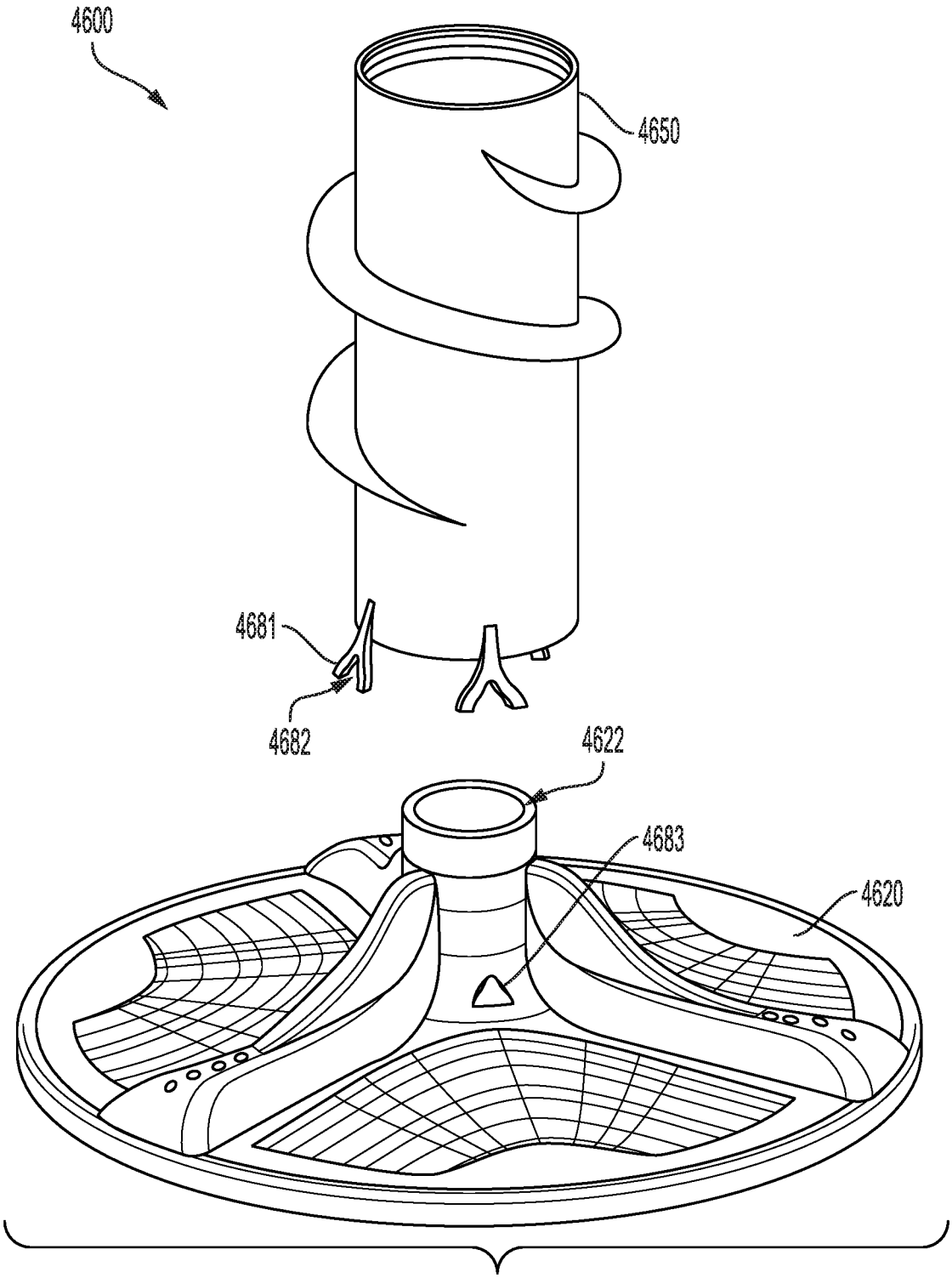
FIG. 75 is a schematic perspective view of another example of an impeller coupling to an agitator for use with the clothes mover and laundry treating appliance of FIG. 1.

FIG. 75 illustrates a clothes mover 4600 including an impeller 4620 and an agitator 4650, and further comprising an example of at least one alignment structure that is provided such as to be complementary between the agitator 4650 and the impeller 4620. In this example, the alignment structure comprises a set of retaining structures 4681, each retaining structure 4681 defining a receiving opening, illustrated herein as an open end 4682, coupled to and extending from a lower edge of the agitator 4650 and configured to cooperate with nubs or protrusions 4683 on the impeller 4620, such that the protrusions 4683 are received within the open ends 4682 of the retaining structures 4681.

Figure 76:
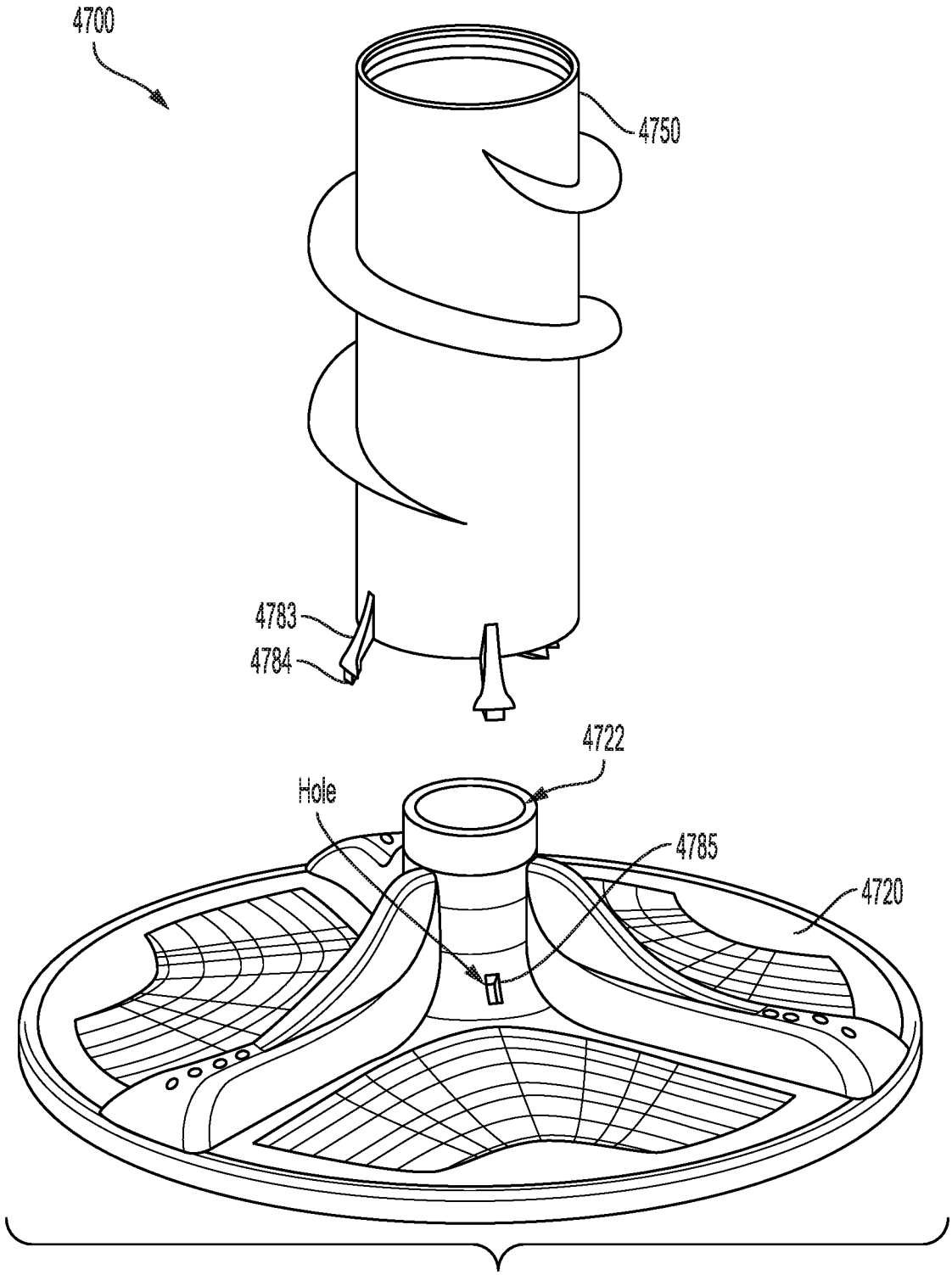
FIG. 76 is a schematic perspective view of another example of an impeller coupling to an agitator for use with the clothes mover and laundry treating appliance of FIG. 1.

FIG. 76 illustrates a clothes mover 4700 including an impeller 4720 and an agitator 4750, and further comprising an example of at least one alignment structure that is provided such as to be complementary between the agitator 4750 and the impeller 4720. In this example, the alignment structure comprises a set of coupling structures 4783, each coupling structure 4783 including a lug 4784 protruding downwardly from the coupling structure 4783, the coupling structures 4783 coupled to and extending from a lower edge of the agitator 4750 and configured to cooperate with recesses 4785 on the impeller 4720, such that the lugs 4784 are received within the recesses 4785 of the impeller 4720.

Figure 77:
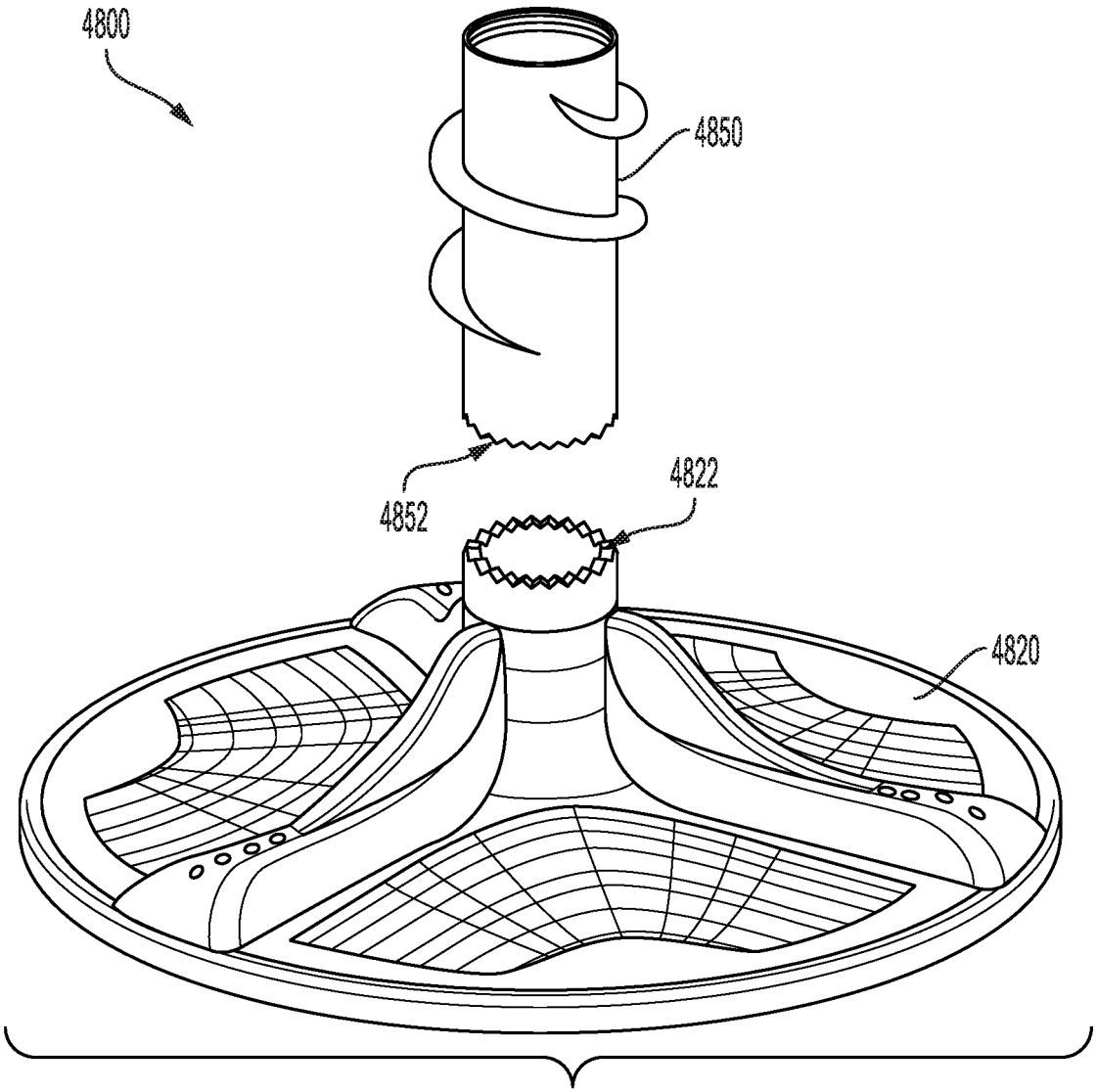
FIG. 77 is a schematic perspective view of another example of an impeller coupling to an agitator for use with the clothes mover and laundry treating appliance of FIG. 1.

FIG. 77 illustrates a clothes mover 4800 including an impeller 4820 and an agitator 4850, and further comprising an example of at least one alignment structure that is provided such as to be complementary between the first connector 4852 and the second connector 4822. In this example, the alignment structure comprises a set of teeth, illustrated herein as having the appearance of a sawtoothed pattern, defined by each of the first connector 4852 and the second connector 4822 and configured to mesh with one another.

Figure 78:
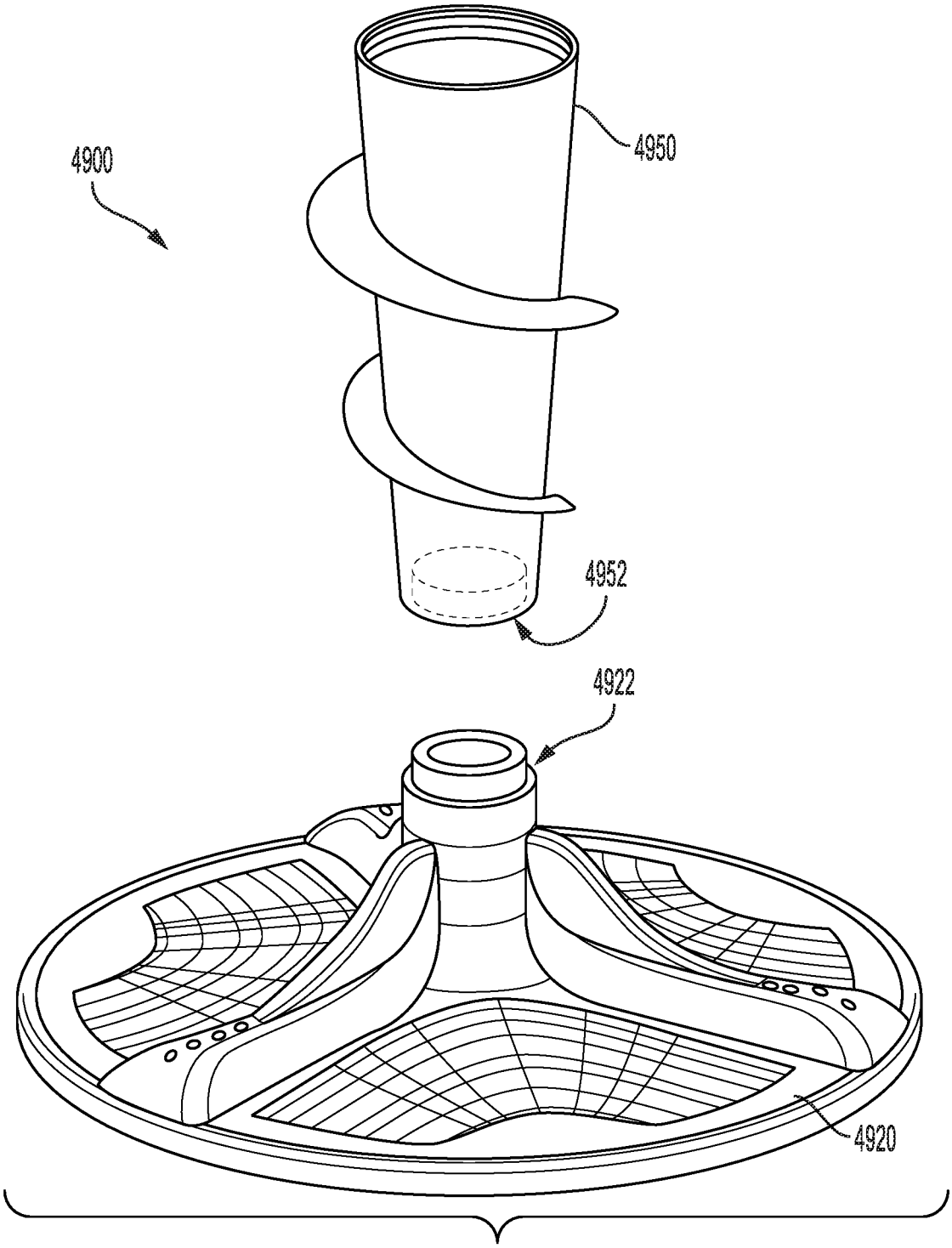
FIG. 78 is a schematic perspective view of another example of an impeller coupling to an agitator for use with the clothes mover and laundry treating appliance of FIG. 1.

FIG. 78 illustrates a clothes mover 4900 including an impeller 4920 and an agitator 4950, and further comprising an example of at least one alignment structure that is provided such as to be complementary between the first connector 4952 and the second connector 4922. In this example, the alignment structure comprises a shape, illustrated herein as having the appearance of a raised circle or a raised o-shape, defined by each of the first connector 4952 and the second connector 4922 and configured to mesh with one another.

As described above, there are many examples of attachment and alignment features that can be used with a variety of the exemplary clothes movers described herein for a great deal of flexibility and customizability. That a specific attachment, actuation, or alignment structure or approach was not discussed in detail does not mean that it does not fall within the scope of the present disclosure. Attachment mechanisms, actuators, and alignment structures from a variety of pursuits can be relevant and useful for the present disclosure. By way of non-limiting example, some general mechanisms or approaches that could be used that may or may not have been discussed in detail herein include: direct actuation, indirect actuation, the use of input from the user to the user interface regarding the configuration of the clothes mover, the inclusion of a battery with a water-tight quick disconnect, the use of magnet and a solenoid, the use of magnetic attachment on its own or in combination with another approach, a toggle lock mechanism, standard bolt action, the use of molley action, actuation by a straight downward push, actuation by a push and twist or a pull and twist combination mechanism, the use of a safety lock, the use of a lever that can either always lock or always unlock, a ball shifter, a 90 degree worm drive, a shower hook lever, releasing by a vertical position and locking by a horizontal position, and the leveraging of handle recesses at a top edge of an agitator.

In another aspect, it can be an inconvenience for the user if the user removes the agitator as desired, but then has no convenient place to set or store the agitator until it is desired for use again. Thus, it can improve the user experience if laundry treating appliances also include considerations as to storage of the agitator when it is removed. There are a wide variety of potential solutions for this aspect, as well, many of which involve storing the agitator still somehow associated with the laundry treating appliance 10. The agitator can include or be coupled with a magnet by which it can be magnetically attached to the cabinet 14 of the laundry treating appliance 10, either by standing upright on top of the laundry treating appliance 10 or being attached to a side of the cabinet 14. The laundry treating appliance 10 could also be modified to include a receptacle somewhere, such as within the cabinet 14 or the console, within which the agitator could be placed to be stored out of sight. Further yet, the agitator could be stored on a different laundry treating appliance, such as the adjacent clothes dryer, where it could be, for example, nested within or behind the door of the dryer.

Even in the case that the agitator is not able to be stored in cooperation with the laundry treating appliance 10 itself, many options are available. A case for receiving the agitator can be provided, such as an accessory box or briefcase. The agitator could be somehow suspended from or coupled to the drain hose port. The agitator could be hung from some kind of hanger or hook assembly, such as to be hung from a towel bar, a closet hanging bar, a utility tub, or over a door, in the same way that a wreath hanger would function. Even when the agitator does not include a handle for easy hanging, some sort of adapter can be provided to couple a hook to the agitator, such as by snapping the agitator into a hook assembly that can then be hung from a variety of places. The outer edge of the vanes on the agitator can be provided with flattened portions or facets, which could make it possible that the user could simply set the agitator down on a surface, such as a countertop, or on top of the appliance, and not have to worry about it rolling away due to the specifically selected edge geometry to prevent rolling.

Another advantage of the aspects described herein is that providing a laundry treating appliance 10 with customizability yields even more customizable options due to combinability of different features to make new combinations. Another aspect which provides customizability to the laundry treating appliance 10 is that the clothes movers can include a wide variety of additional options, features, or utilities that can be coupled with the agitator kits. It will be understood that while the present disclosure may more often refer to a removable agitator, any of these customizability options, including these additional options, features, or utilities, can be provided in the laundry treating appliance 10 regardless of whether or not the agitator is removable or permanently fixed.

Figure 79:
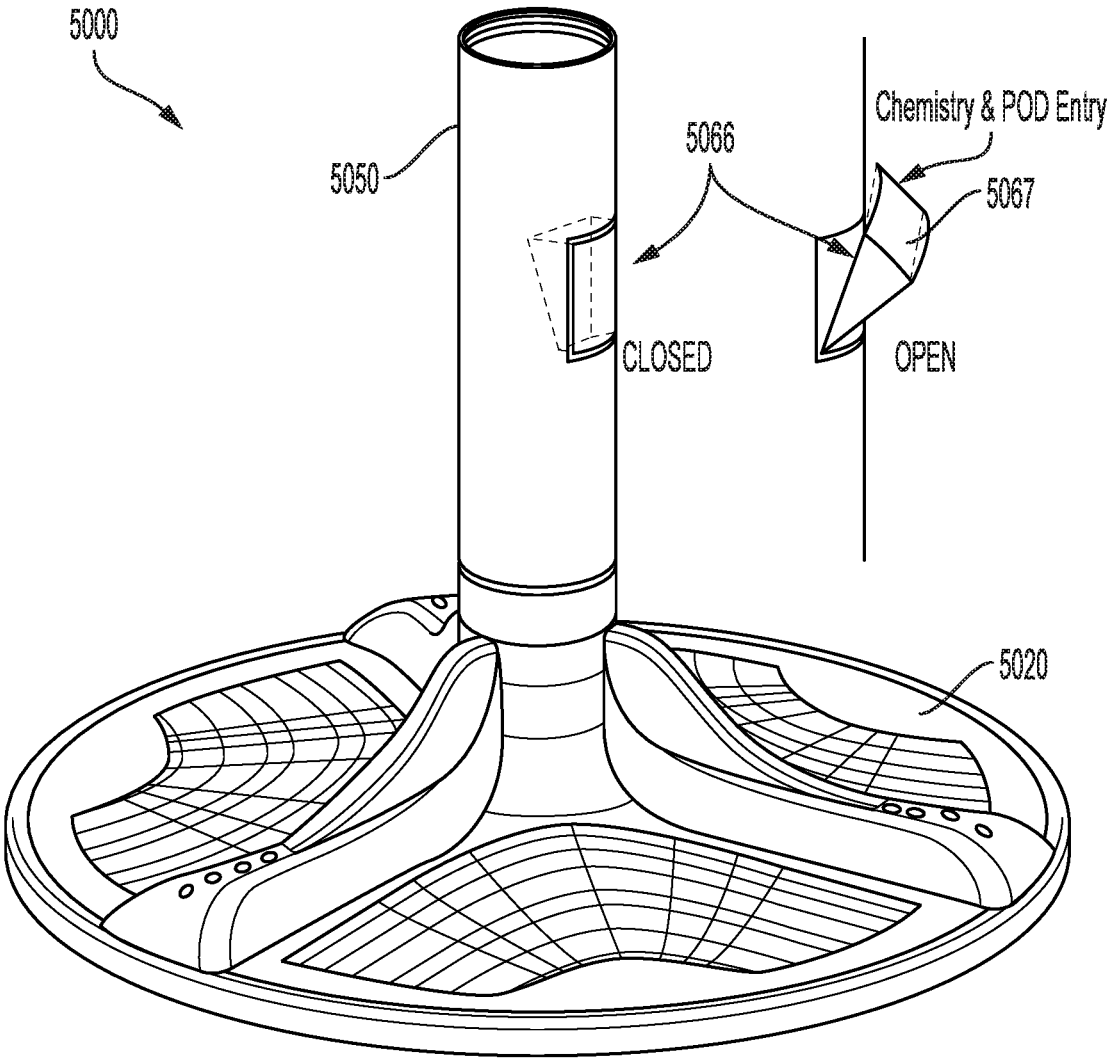
FIG. 79 is a schematic perspective view of another example of an impeller coupling to an agitator for use with the clothes mover and laundry treating appliance of FIG. 1.

FIG. 79 illustrates a clothes mover 5000 including an impeller 5020 and an agitator 5050, and further comprising an example of at least one additional utility feature that can be included with the clothes mover 5000. In this example, the clothes mover 5000 can include a treating chemistry dispenser 5066, and more specifically a treating chemistry dispenser 5066 that can also be configured to receive pod doses of treating chemistries. The treating chemistry dispenser 5066 is shown in a closed condition on the left and in an opened condition on the right, exposing an interior 5067 wherein the treating chemistry can be deposited.

Figure 80:
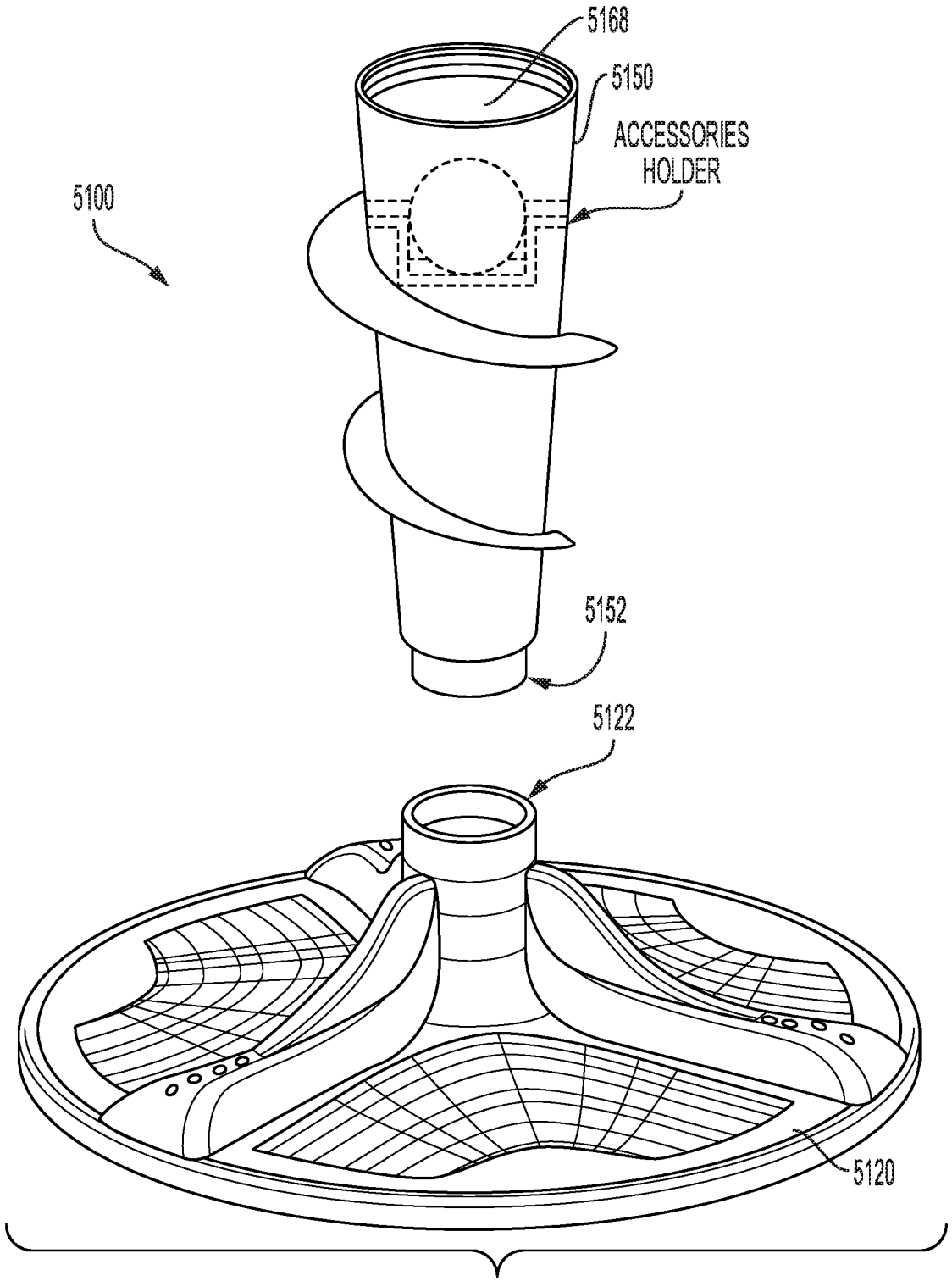
FIG. 80 is a schematic perspective view of another example of an impeller coupling to an agitator for use with the clothes mover and laundry treating appliance of FIG. 1.

FIG. 80 illustrates a clothes mover 5100 including an impeller 5120 and an agitator 5150, and further comprising an example of at least one additional utility feature that can be included with the clothes mover 5100. In this example, the clothes mover 5100 can include an interior 5168 of the agitator 5150 that is configured to function as an accessories holder 5168 for storing items within the laundry treating appliance 10, non-limiting examples of which can include laundry agitation balls, fabric softener dispensers, such as dispensing balls, and dryer balls.

Figure 81:
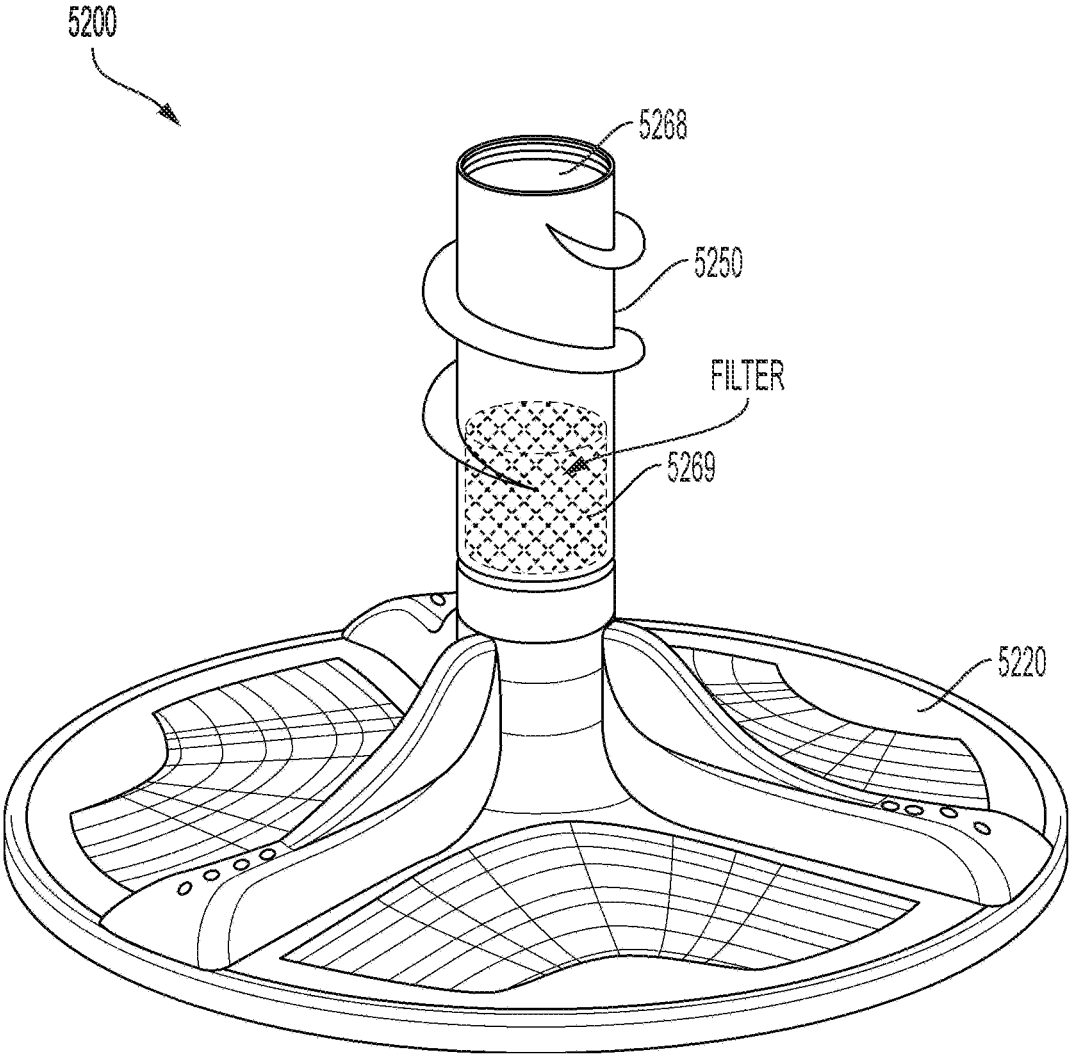
FIG. 81 is a schematic perspective view of another example of an impeller coupling to an agitator for use with the clothes mover and laundry treating appliance of FIG. 1.

FIG. 81 illustrates a clothes mover 5200 including an impeller 5220 and an agitator 5250, and further comprising an example of at least one additional utility feature that can be included with the clothes mover 5200. In this example, the clothes mover 5200 can include an interior 5268 of the agitator 5250 that is configured to receive and to function as a filter 5269, such as for lint. While the filter 5269 is illustrated herein as being provided within the interior of the agitator 5250, it will be understood that the lint filter 5269 could be at other locations and still be associated with the agitator 5250, examples of which include at a top cap of the agitator 5250, or on an outer surface of the agitator 5250. In addition, it is contemplated that the lint filter 5269 can have a pumping mechanism, dedicated or otherwise, coupled with it.

Figure 82:
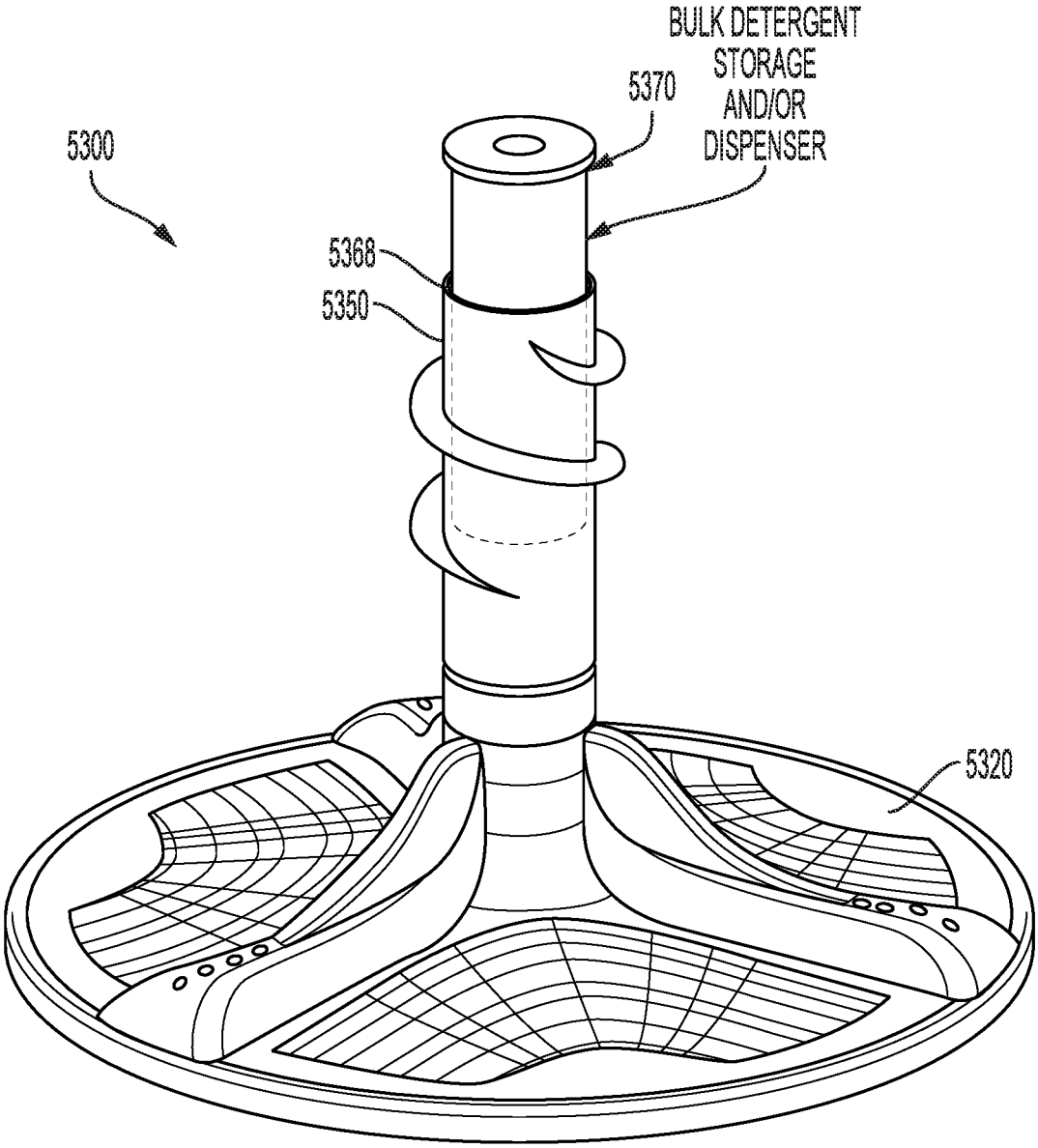
FIG. 82 is a schematic perspective view of another example of an impeller coupling to an agitator for use with the clothes mover and laundry treating appliance of FIG. 1.

FIG. 82 illustrates a clothes mover 5300 including an impeller 5320 and an agitator 5350, and further comprising an example of at least one additional utility feature that can be included with the clothes mover 5300. In this example, the clothes mover 5300 can include an interior 5368 of the agitator 5350 that is configured to receive a bulk detergent reservoir 5370, which can function as a bulk detergent storage reservoir 5370 or bulk dispensing reservoir 5370.

Figure 83:
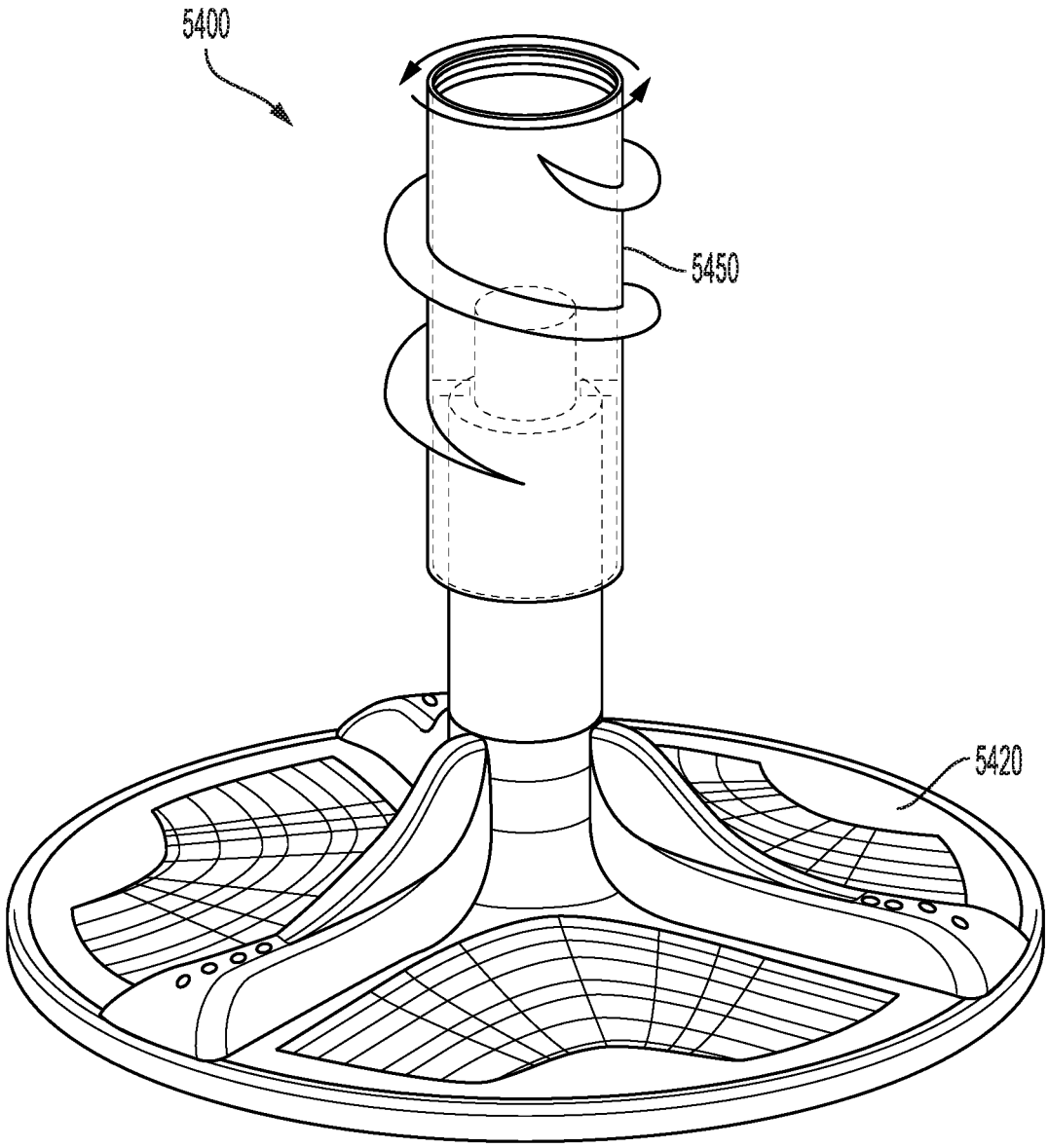
FIG. 83 is a schematic perspective view of another example of an impeller coupling to an agitator for use with the clothes mover and laundry treating appliance of FIG. 1.

FIG. 83 illustrates a clothes mover 5400 including an impeller 5420 and an agitator 5450, and further comprising an example of at least one additional utility feature that can be included with the clothes mover 5400. In this example, the clothes mover 5400 can include a modified agitator 5450 having a specific structure and that is configured to function as a one-directional rotational agitator 5450.

Figure 84:
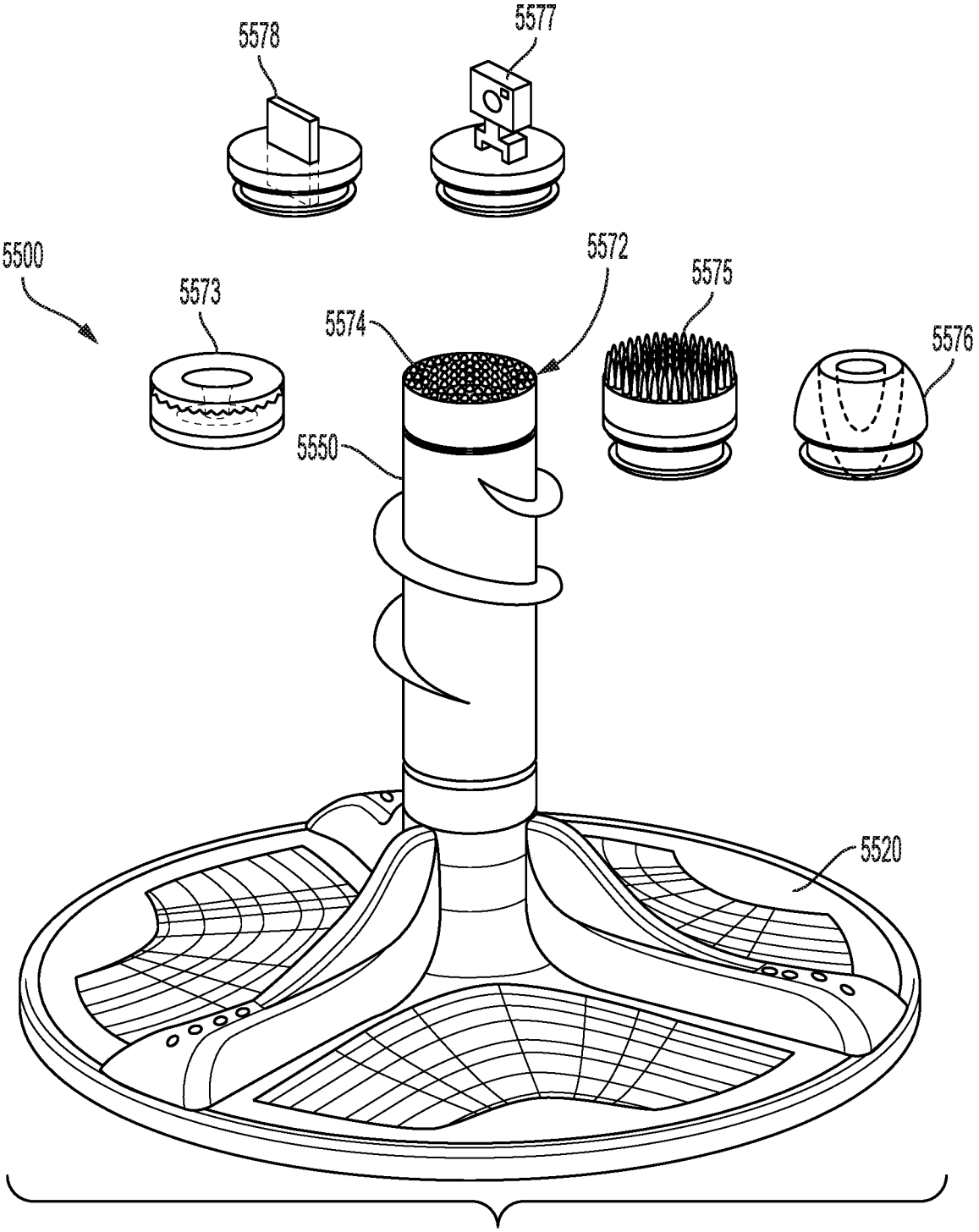
FIG. 84 is a schematic perspective view of another example of an impeller coupling to an agitator for use with the clothes mover and laundry treating appliance of FIG. 1.

FIG. 84 illustrates a clothes mover 5500 including an impeller 5520 and an agitator 5550, and further comprising an example of at least one additional utility feature that can be included with the clothes mover 5500. In this example, the clothes mover 5500 can include an agitator cap 5572 that is configured to function as an accessories holder for receiving a variety of different accessories or add-on features. For example, the agitator cap 5572 can receive a pre-treatment detergent dispenser 5573, a scrubber 5574 defining a scrubbing surface for soiled laundry items, a bristled scrubber 5575 for heavy-duty laundry items, another cleaning agent dispenser 5576, such as a centrifugal fabric softener dispenser, a smartphone dock 5578, or a camera mount 5577 for a camera or other video monitoring device. In the case of the smartphone dock 5578 or the camera mount 5577, the devices can, in one example, be WiFi-, Bluetooth-, or other-electronically connected. In addition, the devices can be used for sensors. In the case that sensors are used, they may likely be WiFi-communicating sensors. For example, the user may wish to video monitor the inside of the laundry machine to see if there is, perhaps, an off-balance load generating within the treating chamber 32 by viewing the treating chamber 32 using a camera or a GoPro. Another example would be to use the phone to check the temperature within the laundry treating appliance 10 by using the thermal imaging feature.

Figure 85:
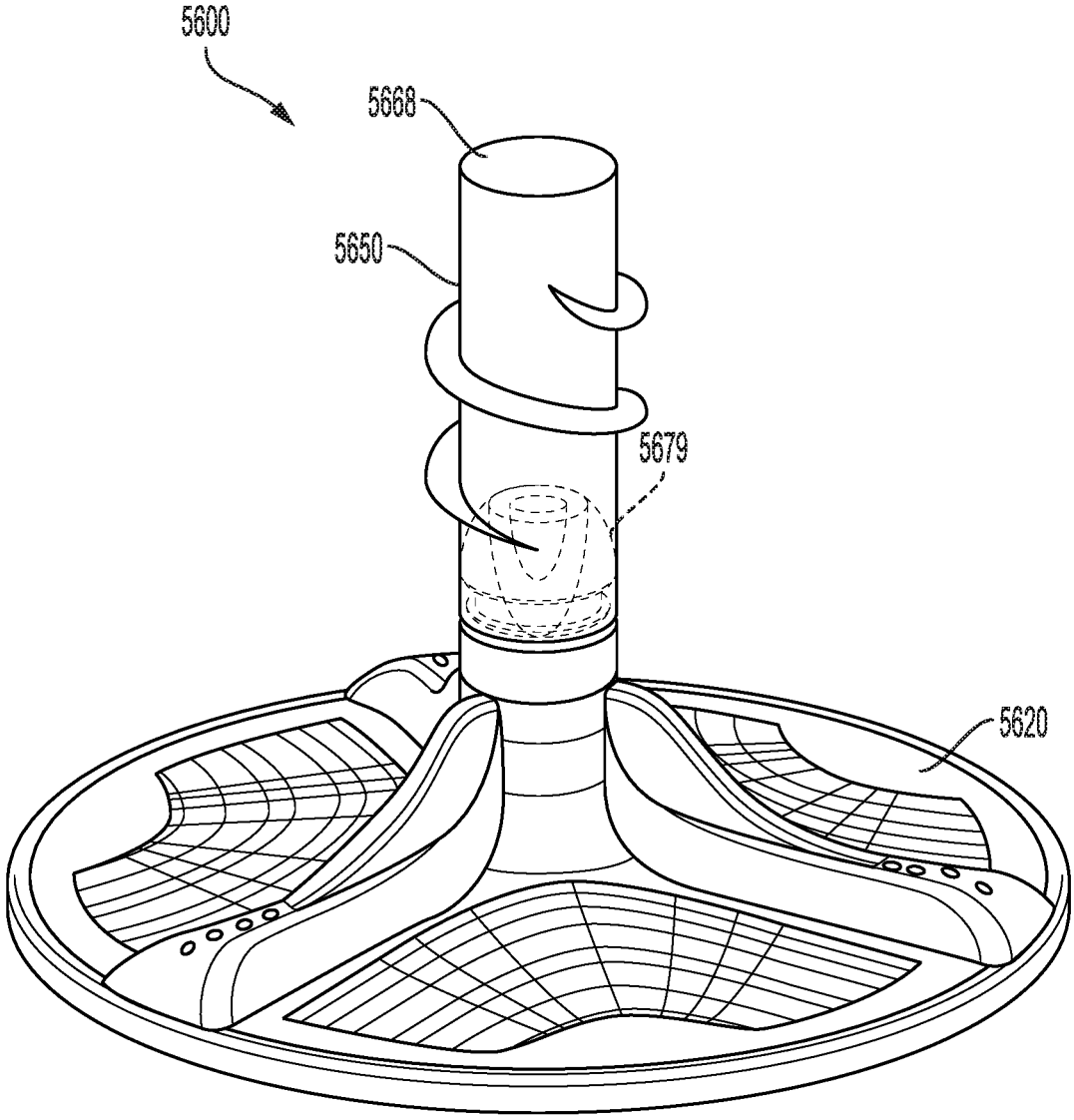
FIG. 85 is a schematic perspective view of another example of an impeller coupling to an agitator for use with the clothes mover and laundry treating appliance of FIG. 1.

FIG. 85 illustrates a clothes mover 5600 including an impeller 5620 and an agitator 5650, and further comprising an example of at least one additional utility feature that can be included with the clothes mover 5600. In this example, the clothes mover 5600 can include an interior 5668 of the agitator 5650 that is configured to receive a cleaning agents or treating chemistry dispenser 5679 within the interior 5668 of the agitator 5650. In one example, the treating chemistry dispenser 5679 can be a centrifugal fabric softener dispenser 5679.

Figure 86:
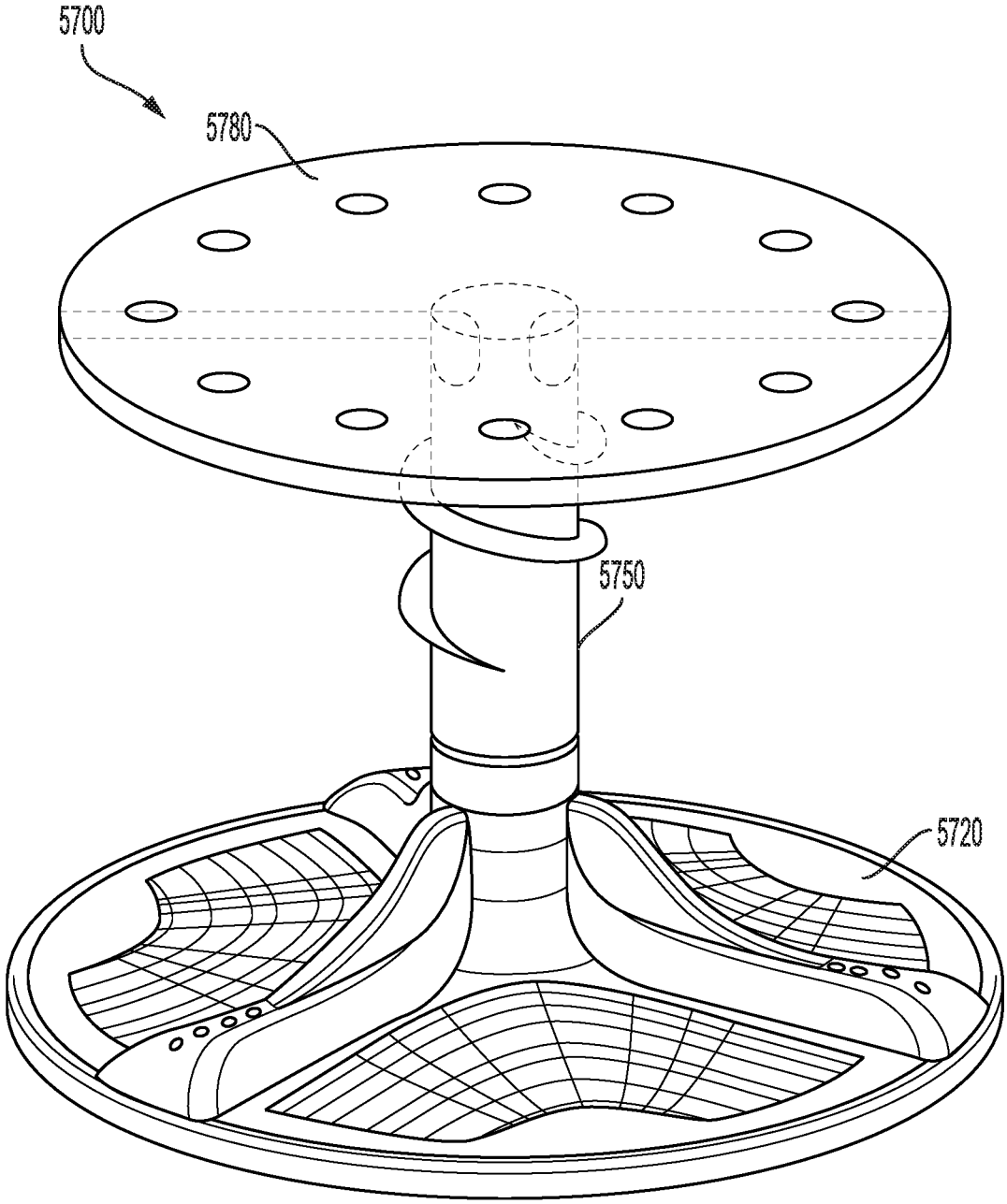
FIG. 86 is a schematic perspective view of another example of an impeller coupling to an agitator for use with the clothes mover and laundry treating appliance of FIG. 1.

FIG. 86 illustrates a clothes mover 5700 including an impeller 5720 and an agitator 5750, and further comprising an example of at least one additional utility feature that can be included with the clothes mover 5700. In this example, the clothes mover 5700 can include a modified agitator 5750 having a specific structure and that is configured to be coupled with or to include or be integral with a steam platform 5780. The steam platform 5780 can be used for steam cleaning, dry cleaning, etc. In this example, the steam platform 5780 is positioned at the top of the agitator 5750, like a table top.

Figure 87:
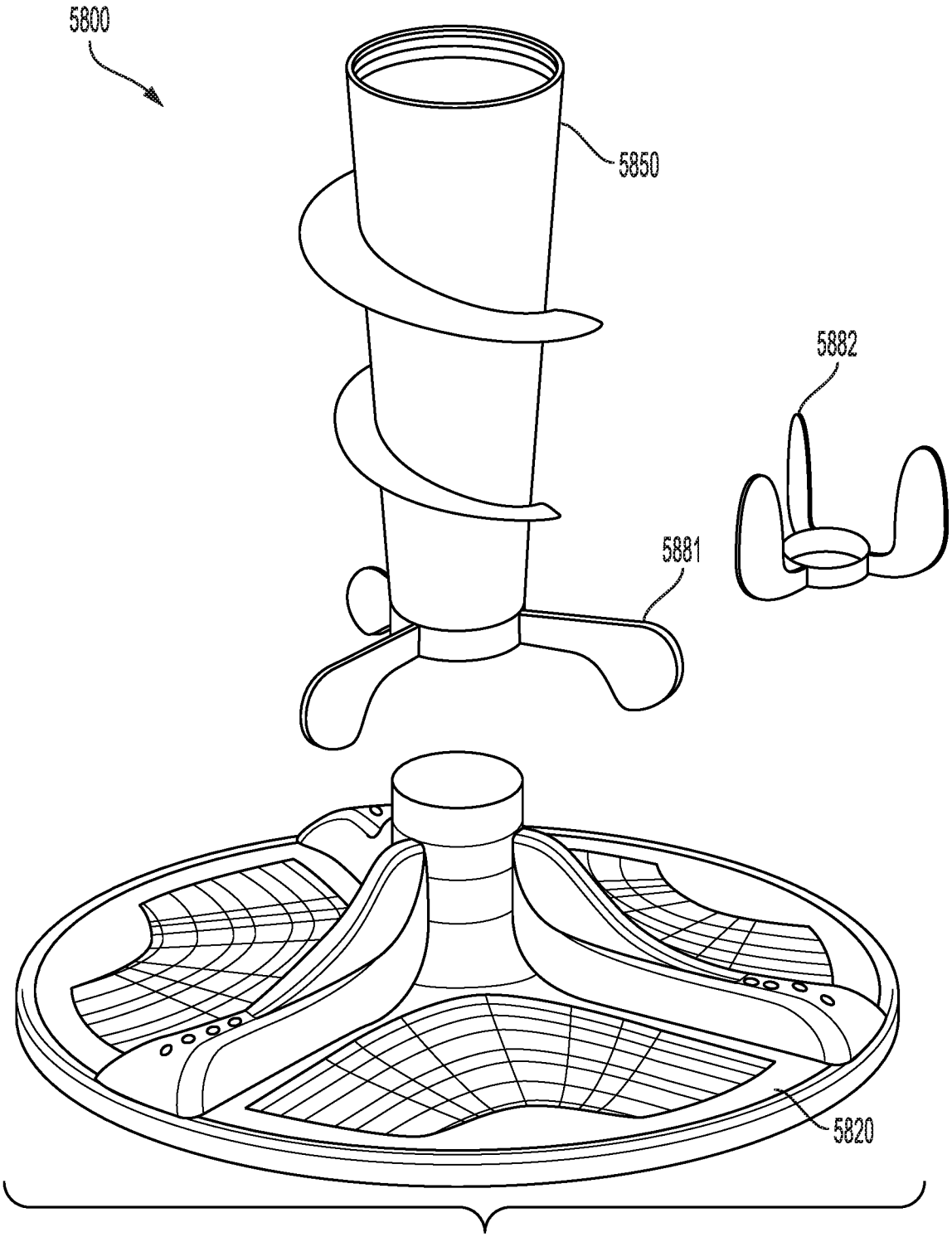
FIG. 87 is a schematic perspective view of another example of an impeller coupling to an agitator for use with the clothes mover and laundry treating appliance of FIG. 1.

FIG. 87 illustrates a clothes mover 5800 including an impeller 5820 and an agitator 5850, and further comprising an example of at least one additional utility feature that can be included with the clothes mover 5800. In this example, the clothes mover 5800 can include a modified agitator 5850 having a specific structure that is configured to receive additional attachments 5881, 5882 with interchangeable features. The attachments 5881, 5882, described herein as ring attachments 5581, 5582, can be provided between the impeller 5820 and the agitator 5850 when they are included. In a further example, the different attachments 5881, 5882 with their different interchangeable features can be provided in different configurations or for different purposes.

Figure 88:
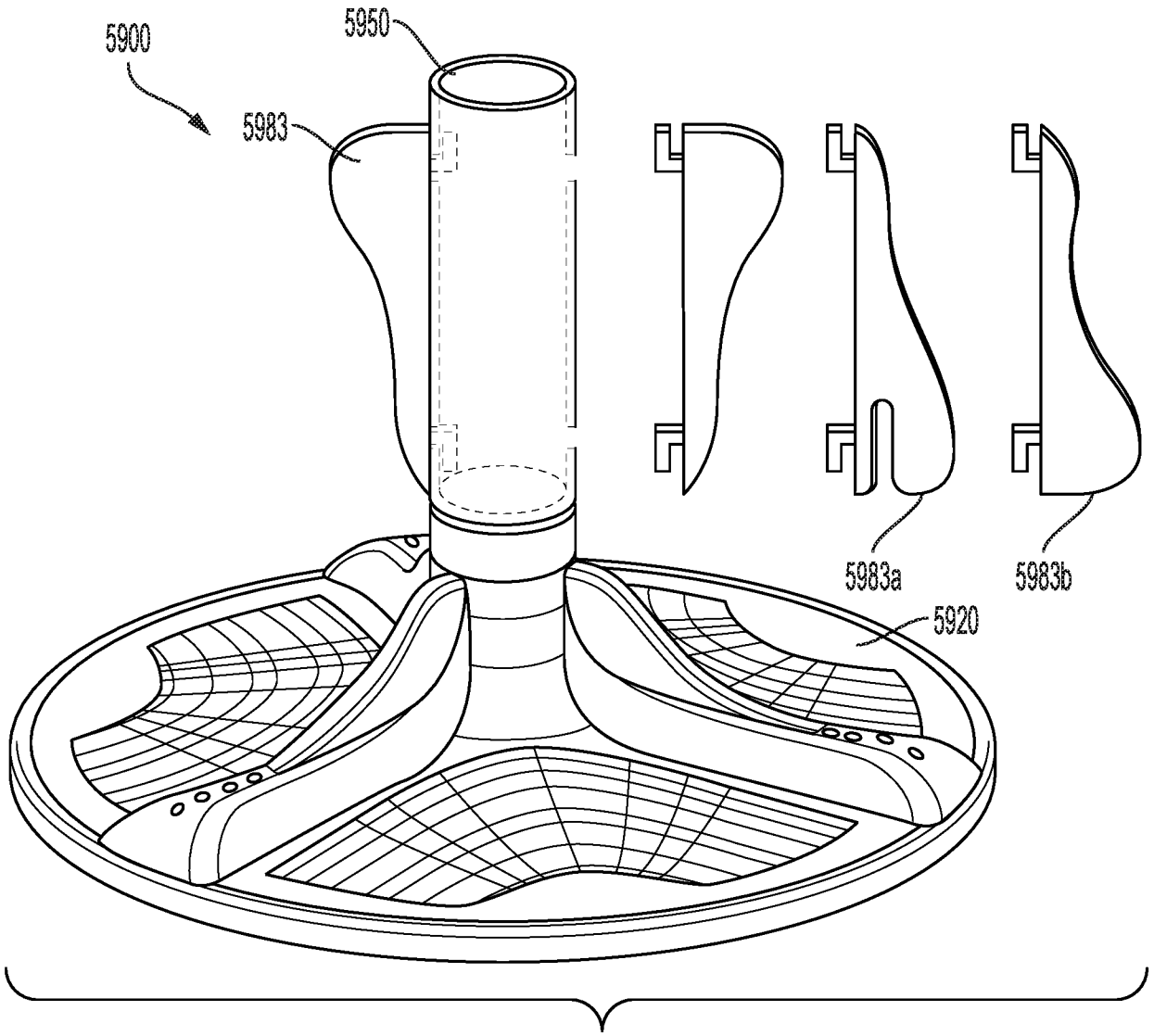
FIG. 88 is a schematic perspective view of another example of an impeller coupling to an agitator for use with the clothes mover and laundry treating appliance of FIG. 1.

FIG. 88 illustrates a clothes mover 5900 including an impeller 5920 and an agitator 5950, and further comprising an example of at least one additional utility feature that can be included with the clothes mover 5900. In this example, the clothes mover 5900 can include a modified agitator 5950 having a specific structure and that is configured to function as a customizable agitator 5950 including at least one set of interchangeable vanes 5983, 5983*a*, 5983*b*. In one example, there can be a set of primary or main vanes 5983 that are most useful for traditional laundry loads. However, sometimes different circumstances cause the needs for laundry treatment to be different, and so alternate sets of vanes 5983*a*, 5983*b* can be included for flexibility to whatever extent is desired by the user.

Figure 89:
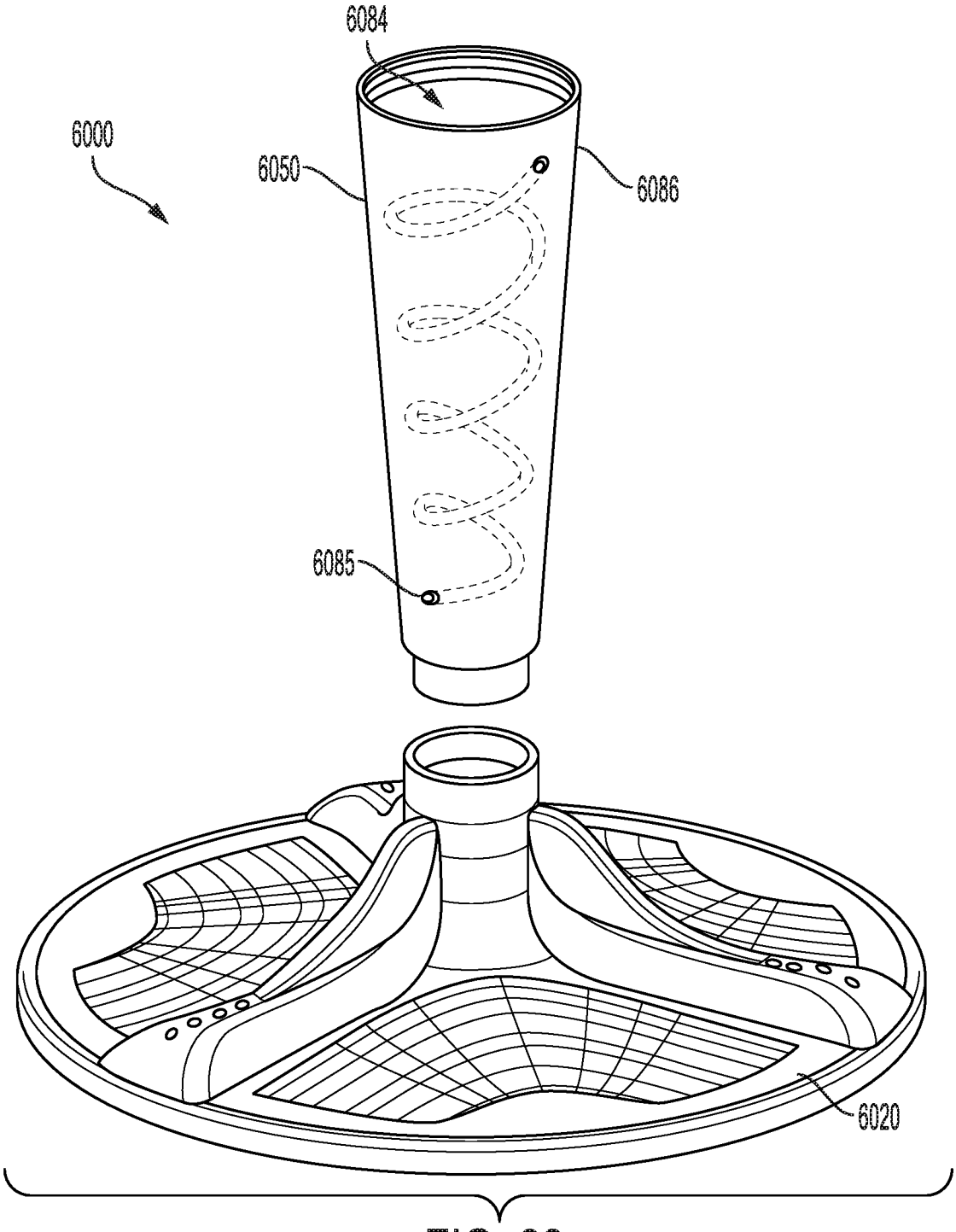
FIG. 89 is a schematic perspective view of another example of an impeller coupling to an agitator for use with the clothes mover and laundry treating appliance of FIG. 1.

FIG. 89 illustrates a clothes mover 6000 including an impeller 6020 and an agitator 6050, and further comprising an example of at least one additional utility feature that can be included with the clothes mover 6000. In this example, the clothes mover 6000 can include a modified agitator 6050 having a specific structure and that is configured to function as a liquid pumping or liquid supply tower 6084. The liquid supply tower 6084 can include a liquid inlet 6085 at a lower portion of the agitator 6050 and a liquid outlet 6086 at an upper portion of the agitator 6050. In one example, the liquid flow path within the liquid supply tower 6084 can be provided in a spiral pattern. Providing liquid to the treating chamber 32 from an upper portion of the agitator 6050 can help to improve even distribution of liquid within the laundry treating appliance 10, as well.

Figure 90:
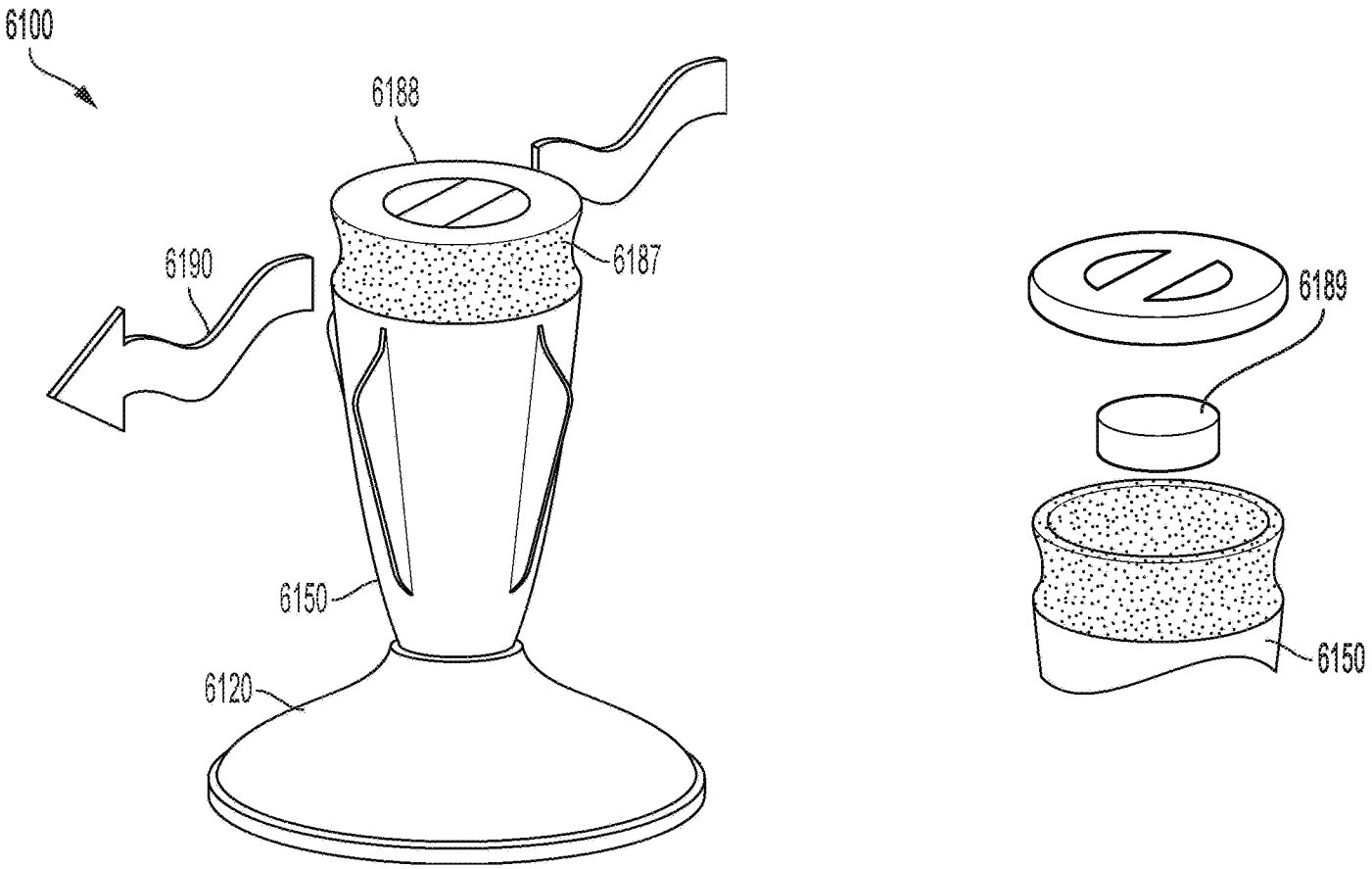
FIG. 90 is a schematic perspective view of another example of an impeller coupling to an agitator for use with the clothes mover and laundry treating appliance of FIG. 1.

FIG. 90 illustrates a clothes mover 6100 including an impeller 6120 and an agitator 6150, and further comprising an example of at least one additional utility feature that can be included with the clothes mover 6100. In this example, the clothes mover 6100 can include an agitator top 6187 that includes an agitator cover 6188 and is configured to receive an odor eliminator 6189 and to function as an odor eliminating device by allowing air flow through the odor eliminator portion 6189 along the flow path as illustrated by the arrows 6190.

Figure 91:
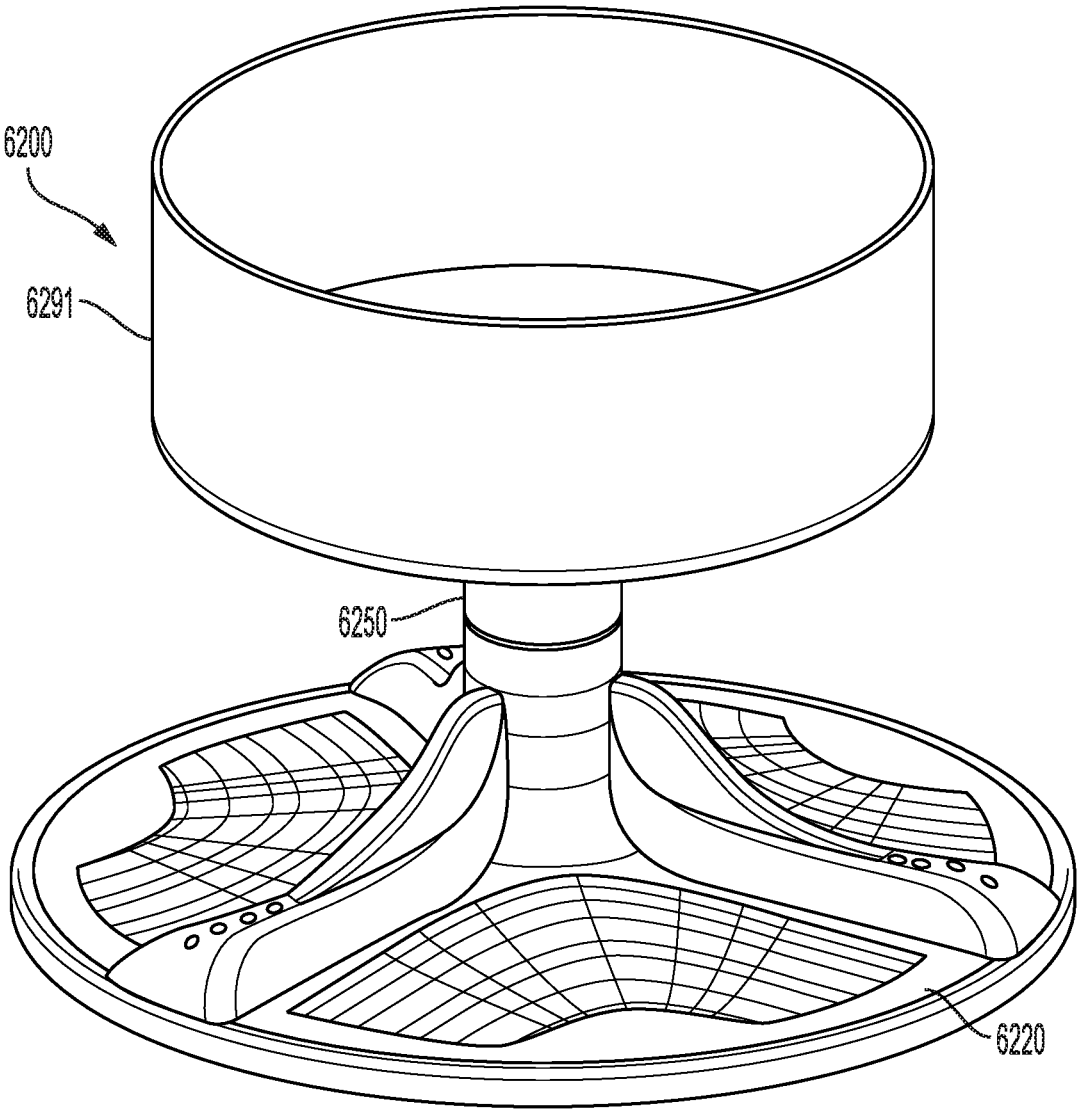
FIG. 91 is a schematic perspective view of another example of an impeller coupling to an agitator for use with the clothes mover and laundry treating appliance of FIG. 1.

FIG. 91 illustrates a clothes mover 6200 including an impeller 6220 and an agitator 6250, and further comprising an example of at least one additional utility feature that can be included with the clothes mover 6200. In this example, the clothes mover 6200 can include a modified agitator 6250 having a specific structure and that is configured to be coupled with or to include or be integral with a second separate basket 6291 for implementing its own laundry treating cycles of operation, and optionally completely independently of the main treating chamber 32.

Figure 92:
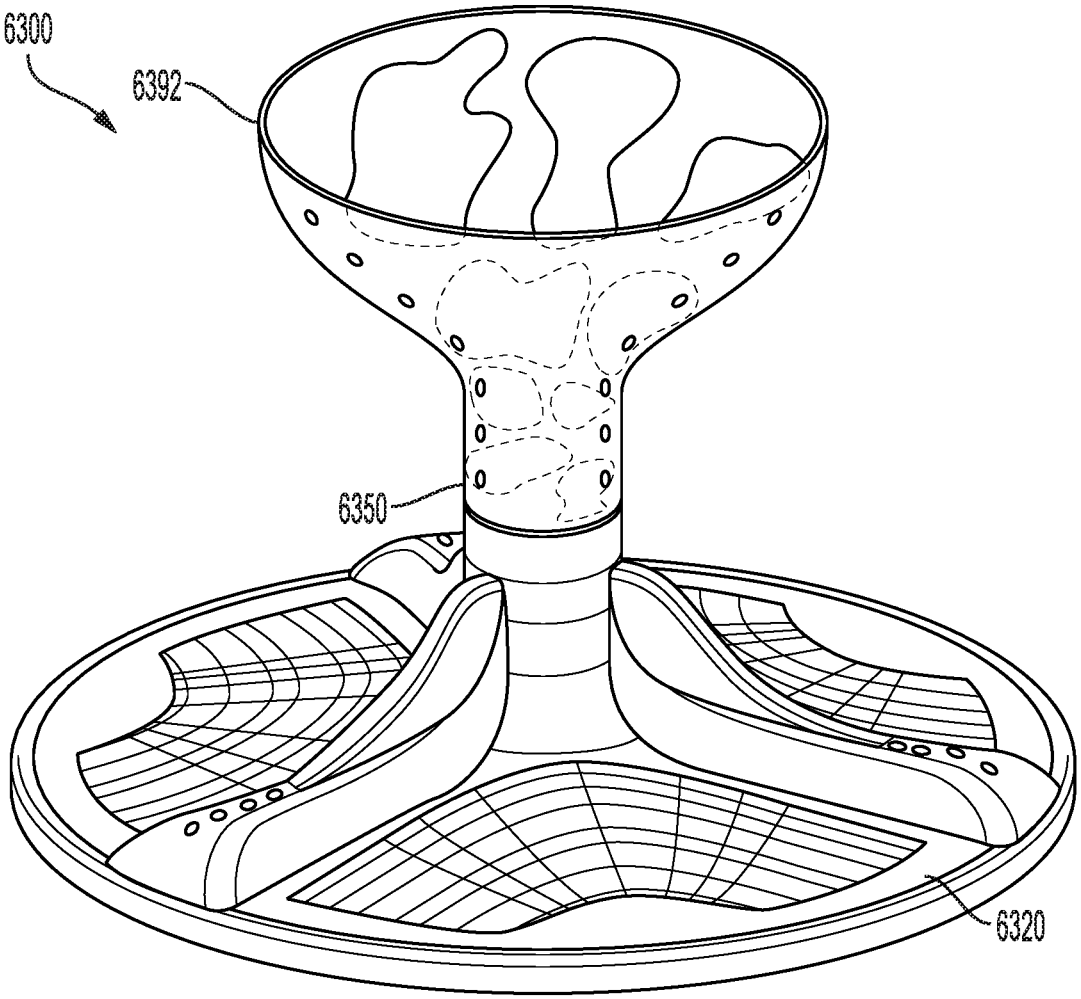
FIG. 92 is a schematic perspective view of another example of an impeller coupling to an agitator for use with the clothes mover and laundry treating appliance of FIG. 1.

FIG. 92 illustrates a clothes mover 6300 including an impeller 6320 and an agitator 6350, and further comprising an example of at least one additional utility feature that can be included with the clothes mover 6300. In this example, the clothes mover 6300 can include a modified agitator 6350 having a specific structure and that is configured to be coupled with or to include or be integral with a second separate basket 6392 for implementing its own laundry treating cycles of operation, and optionally completely independently of the main treating chamber 32. The second separate basket 6392 can have a structure that is very porous, and so the second separate basket 6392 can either function as its own wash zone, or it can be operated using a different water and a different cycle, or it can be operated using all the same water and cycle between the two baskets 30, 6392. Utilization of a second separate basket for treating laundry items can be operated in a manner similar to that disclosed in U.S. Patent Pub. No. 20190062978 to Czarnecki, filed Aug. 22, 2017, entitled "Laundry Treating System and Kit for Use with a Laundry Treating Appliance," which is herein incorporated by reference in its entirety.

Figure 93:
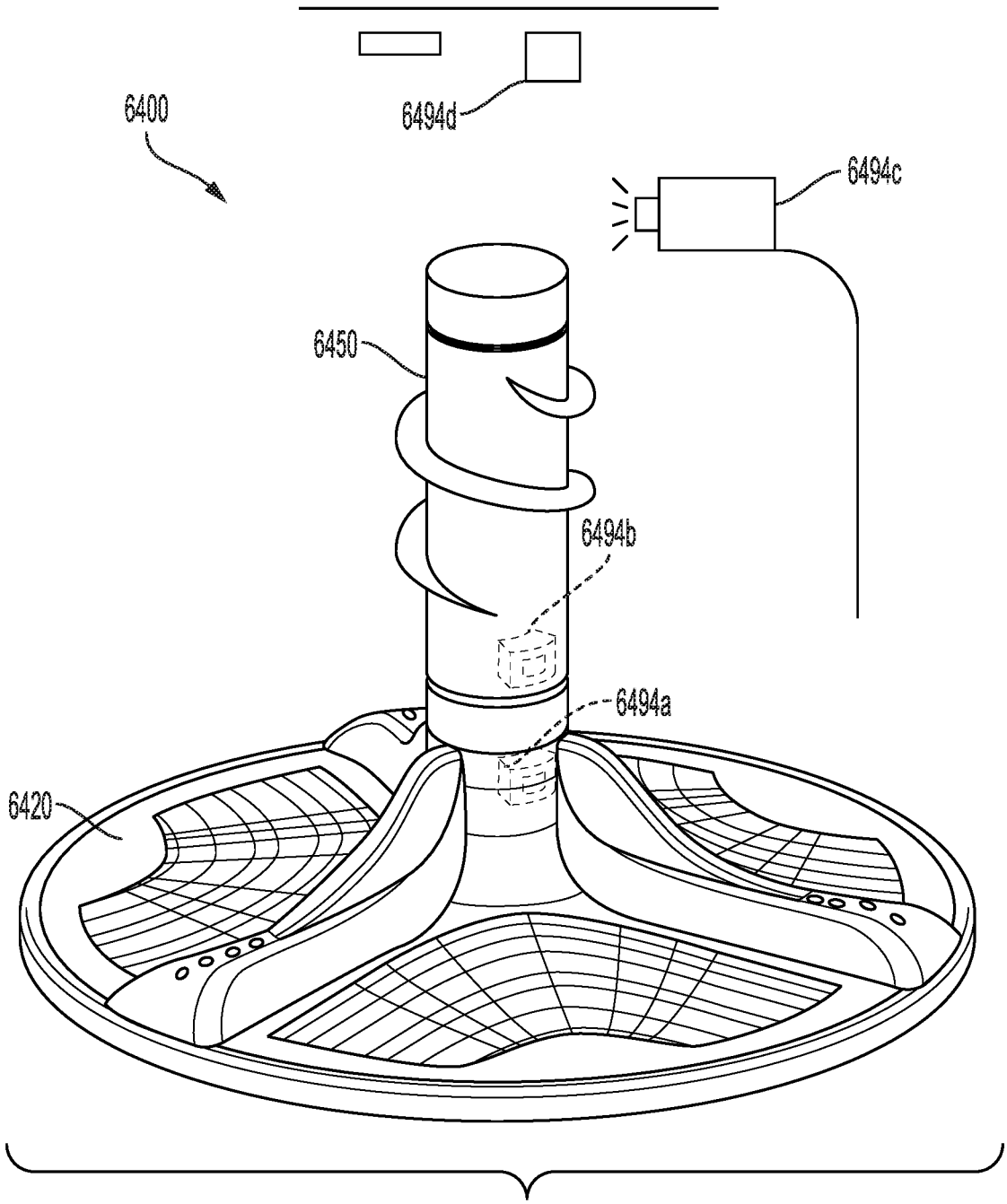
FIG. 93 is a schematic perspective view of another example of an impeller coupling to an agitator for use with the clothes mover and laundry treating appliance of FIG. 1.

FIG. 93 illustrates a clothes mover 6400 including an impeller 6420 and an agitator 6450, and further comprising an example of at least one additional utility feature that can be included with the clothes mover 6400. In this example, the clothes mover 6400 can include at least one additional sensor 6494. Further, the clothes mover 6400 and the laundry treating appliance 10 as a whole can include several additional sensors, such as a first sensor 6494*a* provided below the agitator 6450, a second sensor 6494*b* provided within the agitator 6450, a sensor, smartphone, camera, video camera, or other sensor, illustrated herein as a third sensor 6494*c*, provided outside of the agitator 6450, and a fourth sensor 6494*d* provided on an underside of the lid 28 to view down into the treating chamber 32.

Figure 94:
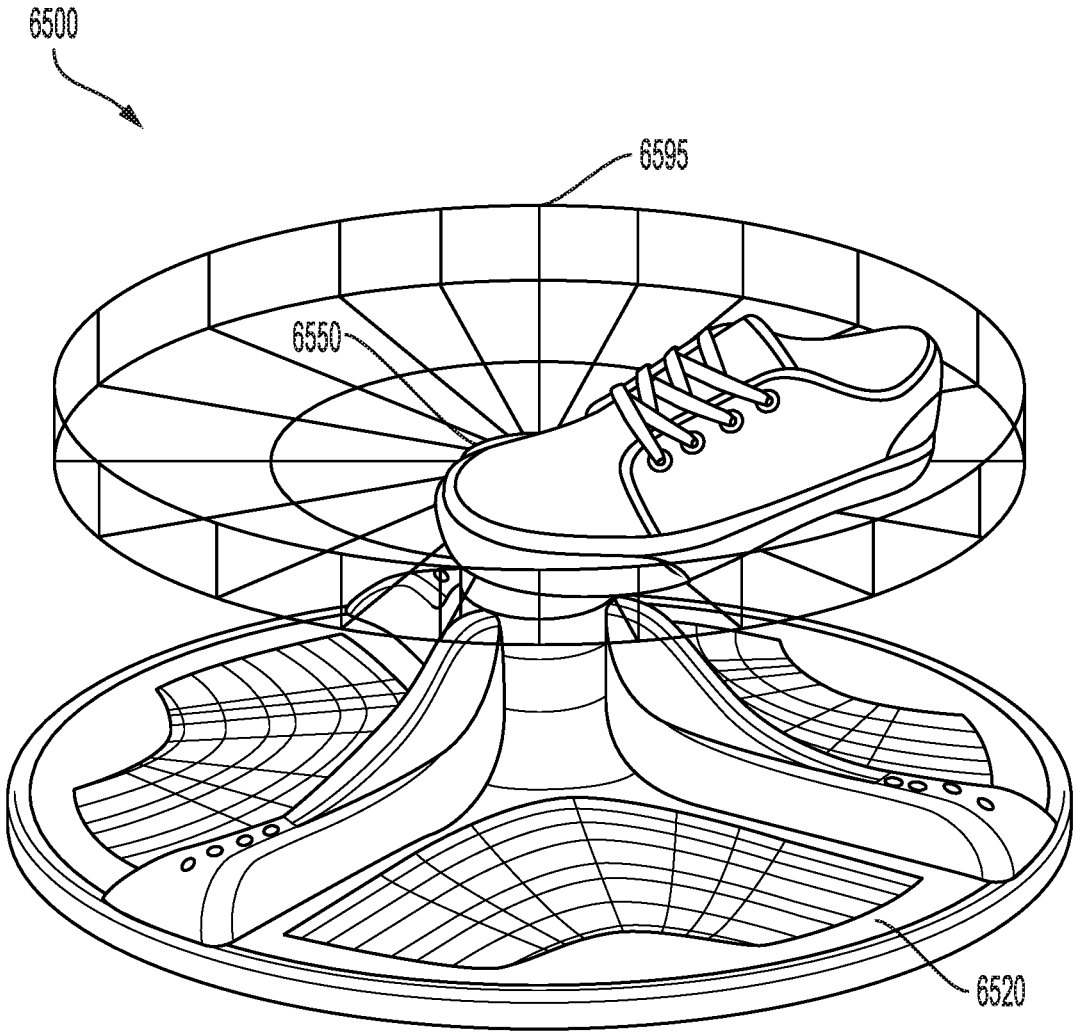
FIG. 94 is a schematic perspective view of another example of an impeller coupling to an agitator for use with the clothes mover and laundry treating appliance of FIG. 1.

FIG. 94 illustrates a clothes mover 6500 including an impeller 6520 and an agitator 6550, and further comprising an example of at least one additional utility feature that can be included with the clothes mover 6500. In this example, the clothes mover 6500 can include a modified agitator 6550 having a specific structure and that is configured to be coupled with or to include or be integral with a second separate basket 6595, that is specifically configured to support shoes to be washed. The basket 6595 can be a wire basket 6595, a plastic basket 6595, or any type of basket 6595. for supporting shoes to be washed within the treating chamber 32.

Figure 95:
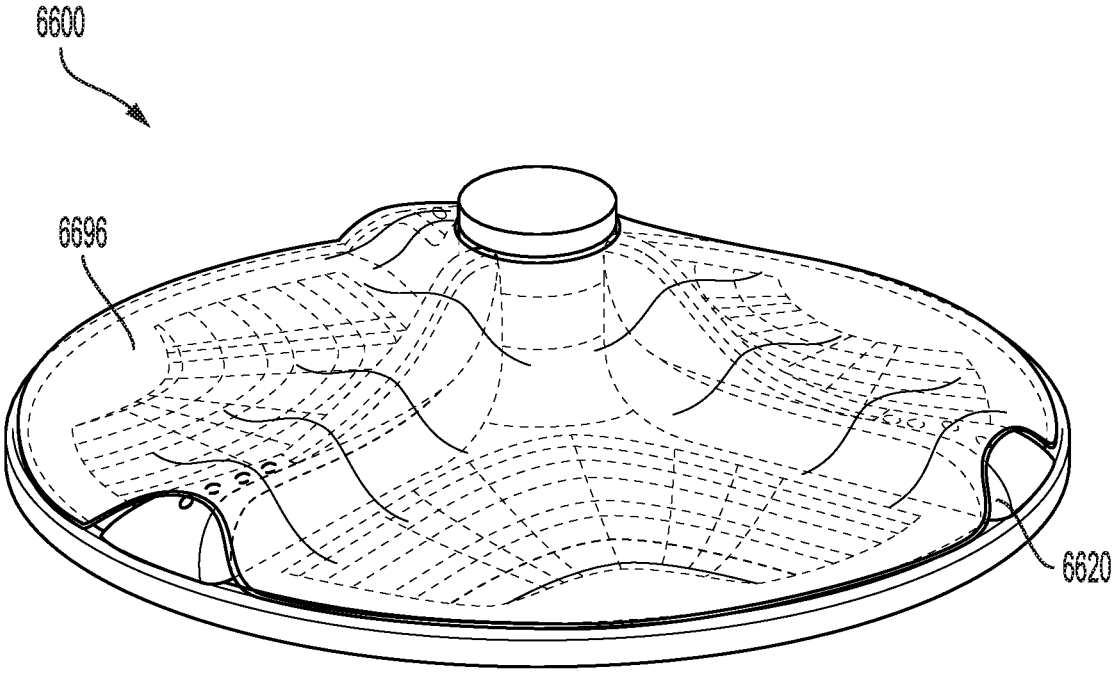
FIG. 95 is a schematic perspective view of another example of an impeller for coupling to an agitator for use with the clothes mover and laundry treating appliance of FIG. 1.

FIG. 95 illustrates a clothes mover 6600 including at least an impeller 6620, and further comprising an example of at least one additional utility feature that can be included with the clothes mover 6600. In this example, the clothes mover 6600 can include a smoothing plate 6696 that can be coupled to the impeller 6620 to overlie the impeller 6620 and to soften the mechanical action imparted by the vanes, such as for the purpose of washing delicate laundry items.

Figure 96:
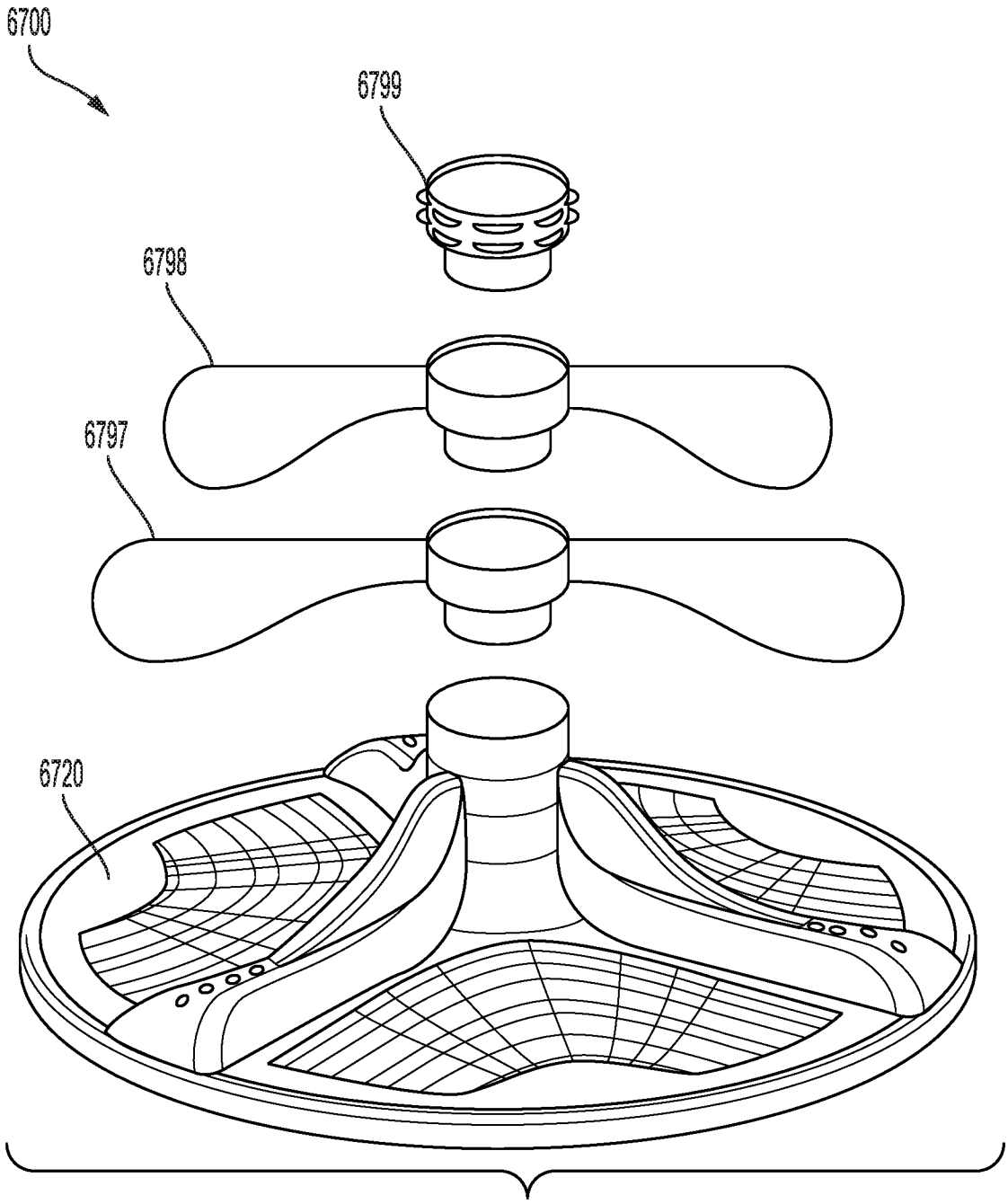
FIG. 96 is a schematic perspective view of another example of an impeller coupling to an agitator for use with the clothes mover and laundry treating appliance of FIG. 1.

FIG. 96 illustrates a clothes mover 6700 including an impeller 6720 and an agitator 6750, and further comprising an example of at least one additional utility feature that can be included with the clothes mover 6700. In this example, the clothes mover 6700 can include a modified agitator 6750 having a specific structure and that is configured to function as a customizable agitator including at least one set of interchangeable vanes 6797, 6798, 6799, which are illustrated herein as stackable interchangeable agitator 6750 sections. In one example, there can be a set of primary or main vanes 5983 that are most useful for traditional laundry loads. However, sometimes different circumstances cause the needs for laundry treatment to be different, and so alternate sets of vanes 6797, 6798, 6799 can be included for flexibility to whatever extent is desired by the user.

Figure 97:
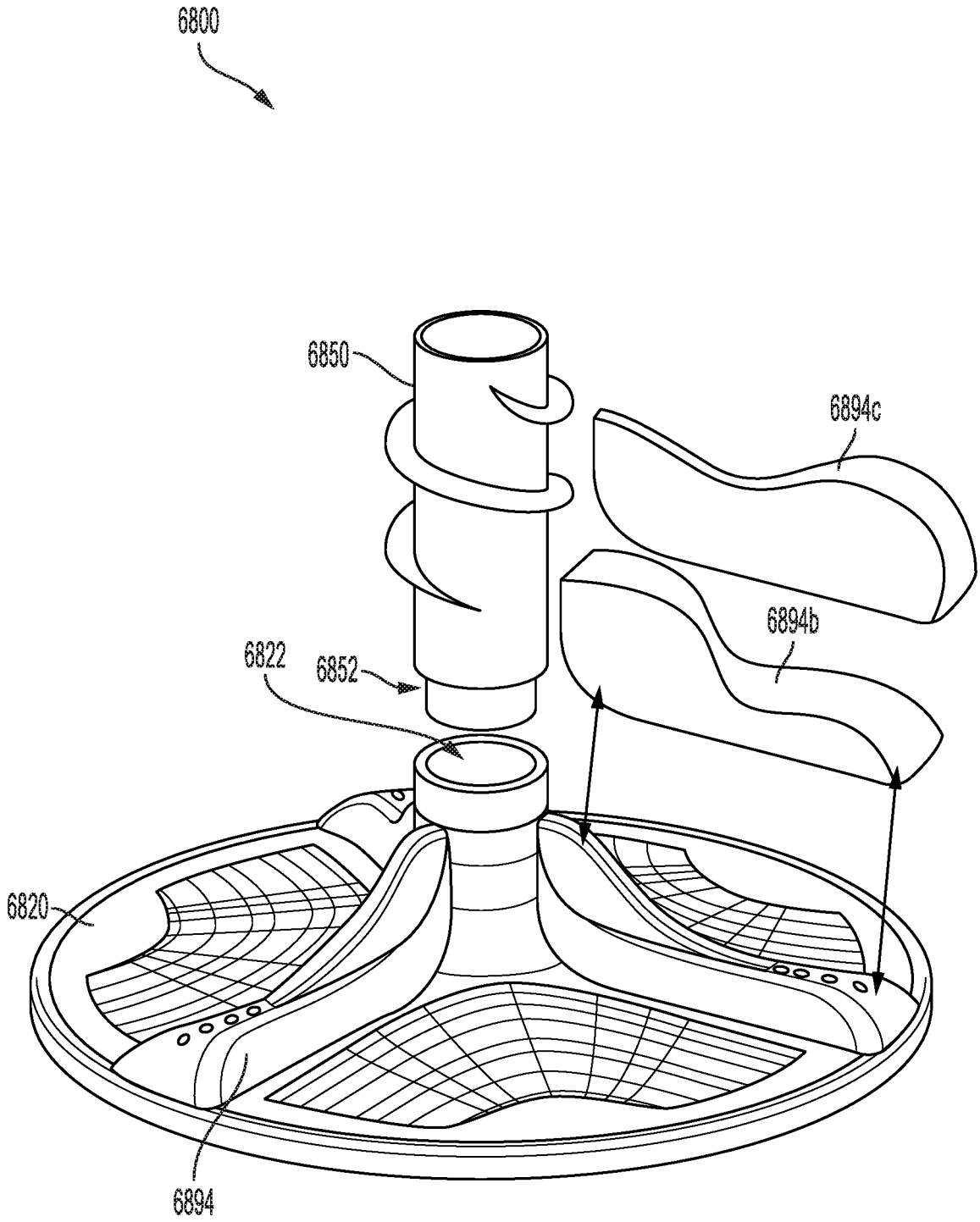
FIG. 97 is a schematic perspective view of another example of an impeller coupling to an agitator for use with the clothes mover and laundry treating appliance of FIG. 1.

FIG. 97 illustrates a clothes mover 6800 including an impeller 6820 and an agitator 6850, and further comprising an example of at least one additional utility feature that can be included with the clothes mover 6800. In this example, the clothes mover 6800 can include the agitator 6850, as well as a modified impeller 6820 having a specific structure and that is configured to function as a customizable impeller 6820 including at least one set of interchangeable vanes 6894, 6894*b*, 6894*c*. In one example, there can be a set of primary or main vanes 6894 that are most useful or the most common for traditional laundry loads. However, sometimes different circumstances cause the needs for laundry treatment to be different, and so alternate sets of vanes 6894*b*, 6894*c* can be included for flexibility to whatever extent is desired by the user.

Figure 98:
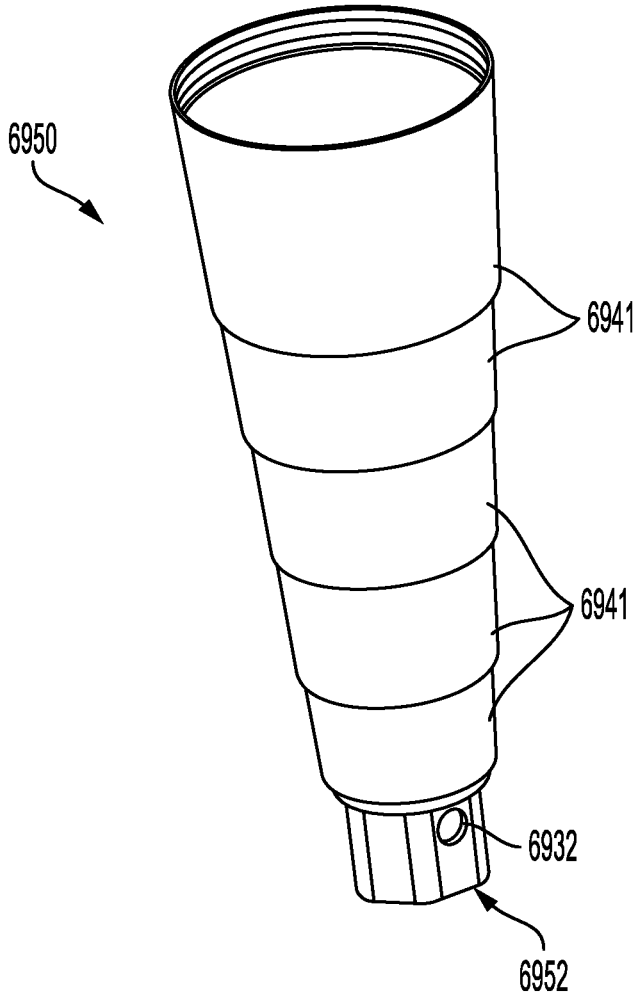
FIG. 98 is a perspective view of another example of an agitator for use with the clothes mover and laundry treating appliance of FIG. 1.
Figure 99:
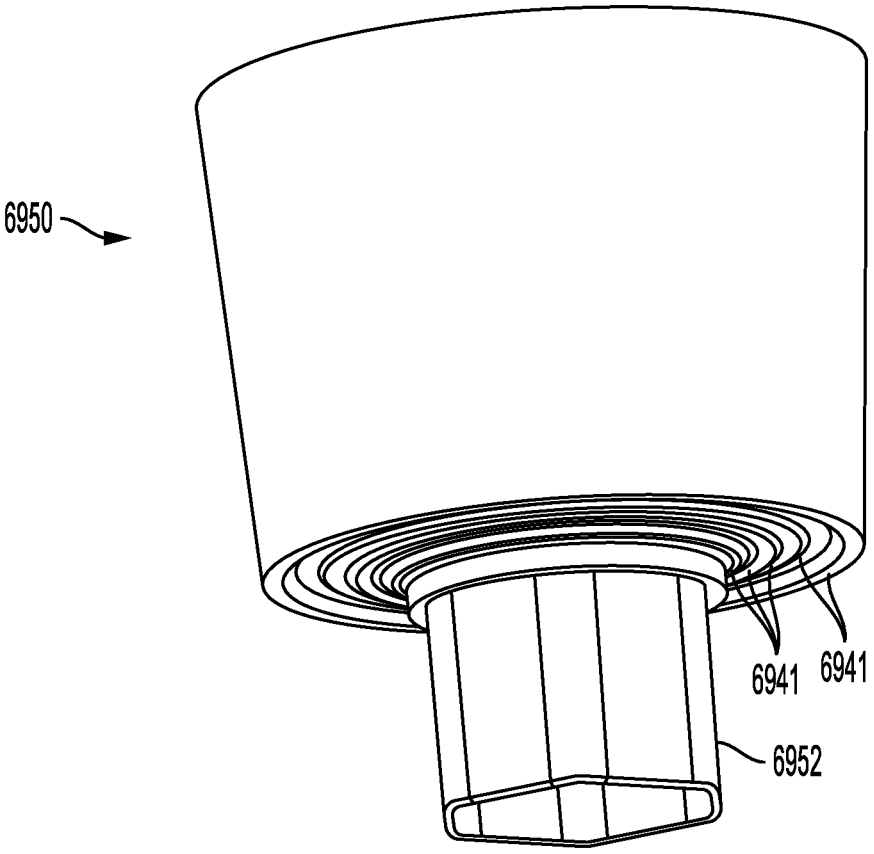
FIG. 99 is a bottom perspective view of the agitator of FIG. 98 in a collapsed position.
Figure 100:
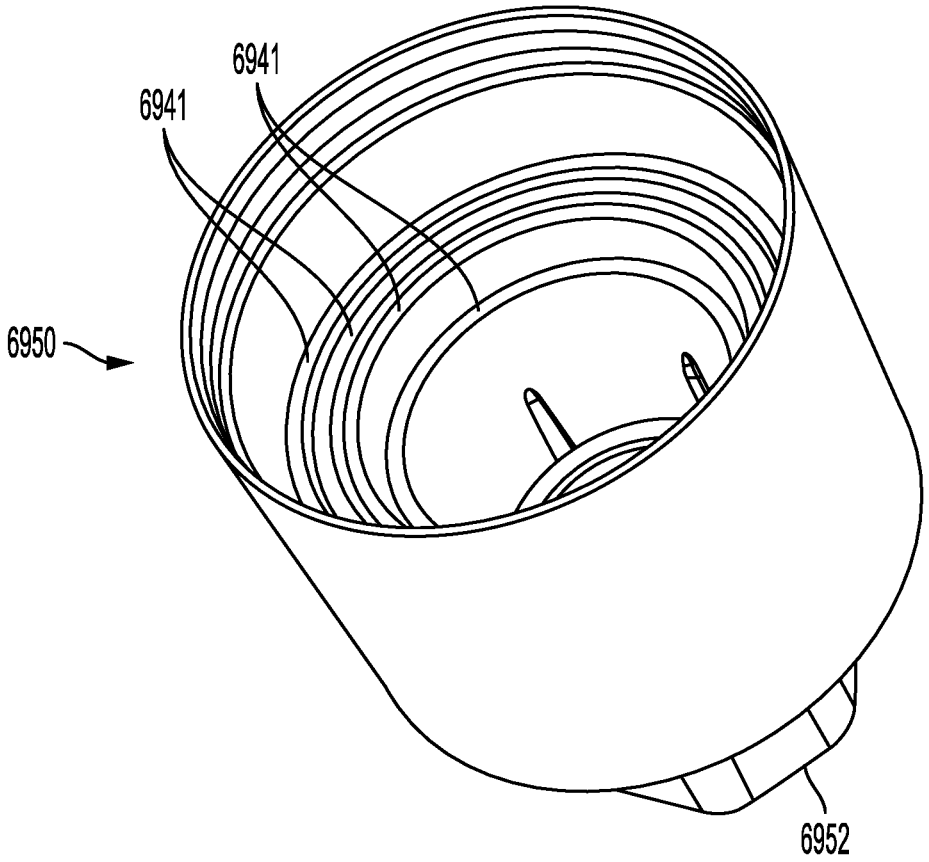
FIG. 100 is a top perspective view of the agitator of FIG. 99.

FIGS. 98-100 illustrate another example of an agitator 6950 that can be used within the laundry treating appliance 10, and which is illustrated herein as a telescoping agitator 6950. The attachment and alignment mechanisms may remain substantially the same, such as by the inclusion of the first connector for coupling with an impeller, as well as the openings 6932 for biasing elements, etc. The agitator 6950 can be a selectively telescoping agitator 6950, in that it can be locked either in a fully extended position, or it can be locked in a fully collapsed position. For example, the agitator 6950 can be selectively locked in either the extended or the collapsed position by any suitable locking mechanism, non-limiting examples of which include the use of a pin or by rotating the agitator 6950, for example, a ¼ twist, in order to lock it in place.

As illustrated in FIG. 98, the telescoping agitator 6950 comprises multiple agitator sections 6941, each extending to a greater height and a greater width than the one below it. In one example, it is contemplated that, while the telescoping agitator 6950 can be moved between the extended position as shown and a collapsed position (FIGS. 99-100), it may not be completely removable from the laundry treating appliance 10.

FIG. 99 shows the agitator 6950 in the collapsed position and from a bottom angle. It can be seen that in the fully collapsed position as shown, the lower edges of the different agitator sections are substantially even with one another, such that the collapsed position for the agitator 6950 is fairly compact.

Referring now to FIG. 100, it can be seen that the top edges of all the agitator sections 6941 are not flush with one another. While the agitator 6950 has been described herein in terms of the extended position or the collapsed position, it will also be understood that there can be more than the two discrete positions. In one example, it is possible that the agitator 6950 can be locked in at any desired position or location based upon the preference of the user.

Figure 101:
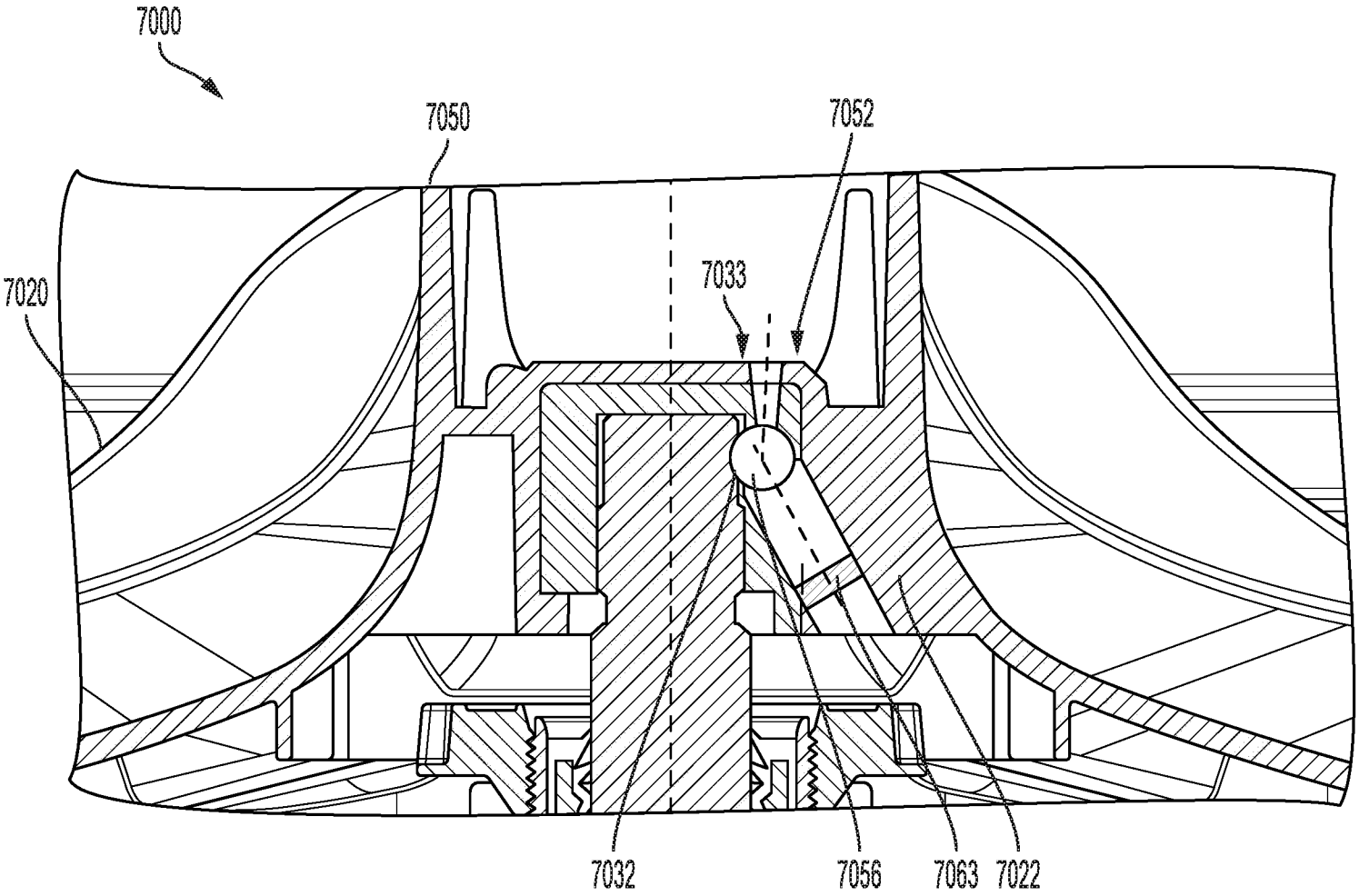
FIG. 101 is a side cross-sectional view of another example of an agitator coupling to an impeller for use with the clothes mover and laundry treating appliance of FIG. 1.

FIG. 101 illustrates another example of a clothes mover 7000 including an impeller 7020 and an agitator 7050 for use in the laundry treating appliance 10 described herein, and that is similar to the clothes mover 100, impeller 120, and the agitator 150 of FIG. 5, to the clothes mover 200, impeller 220, and agitator 250 of FIG. 6, and to the clothes mover 900, impeller 920, and agitator 950 of FIG. 23, but differs in some aspects, such as the manner in which the impeller 7020 is coupled with the agitator 7050. Therefore, elements of the clothes mover 7000, impeller 7020, and the agitator 7050 that are similar to those of the clothes mover 100, impeller 120, and the agitator 150, the clothes mover 200, impeller 220, and agitator 250, and the clothes mover 900, impeller 920, and agitator 950 are labeled with the prefix 7000.

The agitator 7050 is coupled to the impeller 7020 to form the clothes mover 7000 using a spring-biased engagement connection that can include a detent 7056, illustrated herein as a ball or a rounded detent 7056, to inhibit both unintended rotation of the agitator 7050 relative to the impeller 7020 during a cycle of operation, and also to inhibit unintended axial or lateral displacement, such as upward or vertical movement of the agitator 7050 relative to the impeller 7020 during a cycle of operation, improving stability of the clothes mover 7000. The first connector 7052 can comprise the rounded detent 7056 that protrudes radially inward from the first connector 7052. A biasing element 7063, which can be a spring or any other suitable biasing element, can be biased against the rounded detent 7056 to bias the rounded detent 7056 radially inward. The second connector 7022 can further include an opening 7032, which can be an opening 7032, a groove, an indentation, etc., within which the rounded detent 7056 can be received and can protrude radially inwardly into.

To assemble the clothes mover 7000, the agitator 7050 is aligned with the impeller 7020 and is moved toward the impeller 7020 to insert the first connector 7052 into the second connector 7022. As the first connector 7052 is moved into the second connector 7022, the first connector 7052 travels into the socket 7026. The movement of the first connector 7052 into the socket 7026 depresses the rounded detent 7056 outwardly against the biasing element 7063 until the rounded detent 7056 comes into alignment with the opening 7032, and then is biased inwardly into the opening 7032 to further retain the first connector 7052 within the second connector 7022.

To uncouple the agitator 7050 from the impeller 7020, the agitator 7050 can further comprise a release opening 7033 through which the user can depress the rounded detent 7056 downwardly and radially outwardly so that it is no longer received within the opening 7032, allowing the first connector 7052 to then be withdrawn from the socket 7026. The depression of the rounded detent 7056 through the release opening 7033 can be actuated via a release tool or additional element, which can be separate from or incorporated with either the agitator 7050 or the impeller 7020, in order to be moved through the release opening 7033 and depress the rounded detent 7056 to allow release of the agitator 7050 from the impeller 7020. The impeller 7020 can be provided with a cover similar to any of those described with respect to the impellers 120, 220 of FIGS. 5 and 9. Either of the impeller 7020 or the agitator 7050, or both, can be provided with a locking mechanism.

The aspects of the present disclosure described herein set forth a laundry treating appliance that provides flexibility and customizability to the user by allowing the user to select between at least two configurations for the clothes mover based on a user preference or based upon characteristics of the laundry load. This flexibility allows the user to have the capability of removing the agitator, for example in order to wash larger bulky laundry loads or items such as blankets or comforters, without sacrificing the ability to also be able to use the agitator when desired for other types of laundry loads. Another benefit provided is that, even when the user does not desire to remove the agitator for a cycle of operation, if it were to occur that laundry items became tangled with or around the agitator, such as can be common with laundry items that may contain thin straps, drawstrings, or the like, the agitator can be easily removed in order to untangle the laundry items without causing damage to the laundry items by trying to remove them from the agitator in place within the basket and also without requiring the user to try to reach into the bottom of the basket to untangle them while the agitator is still coupled with the impeller.

In addition, beyond the removability of the agitator itself, the present disclosure sets forth a large variety of options for designs for the agitator, including attachment, alignment, and actuation concepts for the coupling of the agitator to the impeller, a variety of methods for storing the agitator when it's not in use, and for detecting the presence or absence of the agitator and/or the configuration of the treating chamber.

To the extent not already described, the different features and structures of the various aspects can be used in combination with each other as desired. That one feature may not be illustrated in all of the aspects of the disclosure is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While the aspects of the present disclosure have been specifically described in connection with certain specific details thereof, it is to be understood that this is by way of illustration and not of limitation. Reasonable variation and modification are possible within the scope of the forgoing disclosure and drawings without departing from the spirit of the present disclosure, which is defined in the appended claims. Hence, specific dimensions and other physical characteristics relating to the aspects of the present disclosure are not to be considered as limiting, unless expressly stated otherwise.

What is claimed is:

1. An agitator configured to be removably mounted to an impeller mount as a clothes mover, the agitator comprising:

a post having a first end and an opposing second end;

a connector disposed at the first end of the post, the connector being configured to removably attach to a corresponding connector of the impeller mount;

a handle disposed at the second end of the post for manipulating the agitator; and a lock, controllable towards the second end of the post, configured to be adjusted between a locked position in which the agitator is secured to the impeller mount and an unlocked position allowing movement of the agitator with respect to the impeller mount, the lock including a pull portion positioned to facilitate gripping of both the handle and the pull portion, such that the pull portion is configured to be compressible towards the handle to transition the lock from the locked position into the unlocked position.

2. The agitator of claim 1, further comprising a biasing element configured to bias the lock into the locked position.

3. The agitator of claim 1, wherein the lock defines at least one locking pin, such that when in the locked position, the at least one locking pin protrudes from the agitator to inhibit movement of the agitator within the impeller mount, and when in the unlocked position, the at least one locking pin is raised to allow for movement of the agitator within the impeller mount.

4. The agitator of claim 1, wherein the lock extends from the second end of the post toward the connector at the first end of the post.

5. An agitator configured to be removably mounted to an impeller mount as a clothes mover, the agitator comprising:

a handle portion;

a locking element slidable between a locked position securing the agitator to the impeller mount and an unlocked position allowing movement of the agitator with respect to the impeller mount; and a biasing element configured to bias the locking element into the locked position, wherein the locking element includes a pull portion positioned to facilitate gripping of both the handle portion and the pull portion, such that the pull portion is configured to be compressible against the biasing element towards the handle portion to slide the locking element from the locked position into the unlocked position.

6. The agitator of claim 5, wherein the locking element defines at least one locking pin, such that when in the locked position, the at least one locking pin protrudes radially outward from the agitator to inhibit movement of the agitator within the impeller mount, and when in the unlocked position, the at least one locking pin is withdrawn to allow for movement of the agitator within the impeller mount.

7. The agitator of claim 5, wherein the locking element defines at least one locking pin, such that when in the locked position, the at least one locking pin protrudes downward from a lower end of the locking element to inhibit movement of the agitator within the impeller mount, and when in the unlocked position, the at least one locking pin is raised to allow for movement of the agitator within the impeller mount.

8. The agitator of claim 7, wherein the agitator is configured to mount to the impeller mount using a bayonet mount connection.

9. The agitator of claim 8, wherein the agitator includes at least one agitator pin configured to be received into at least one respective channel of the impeller mount, such that in the unlocked position, the at least one locking pin is raised to allow for insertion and rotation of the agitator within the impeller mount, and in the locked position, the at least one locking pin is lowered into the at least one respective channel to prevent rotation of the agitator with respect to the impeller mount.

10. A removable agitator system for a customizable laundry treating appliance, comprising:

a base of the appliance having a first connector; and an agitator configured to act as a clothes mover when coupled to the base, the agitator including a second connector configured to form a coupling with the first connector; and a lock, at least partially integrated with the agitator, having a first state providing for capture and release of the first and second connectors, and a second state preventing removal of the second connector of the agitator from the first connector of the base;

wherein the agitator comprises:

a handle portion;

a handle pull locking element, slidable between a lower, locked position away from the handle portion and a raised, unlocked position towards the handle portion;

a biasing element configured to bias the locking element downward from the handle portion into the lower, locked position; and at least one locking pin configured to be received into the at least one channel, such that in the raised, unlocked position, the at least one locking pin is moved away to allow for insertion and rotation of the first connector into the second connector, and in the lower, locked position the at least one locking pin is lowered into the second connector to prevent rotation of the agitator with respect to the base.

11. The system of claim 10, wherein the base is an impeller configured to operate as a low-profile clothes mover independent of attachment of the agitator.

12. A removable agitator system for a customizable laundry treating appliance, comprising:

aligning means, including first connecting means disposed at a first end of an agitator for removably associating the agitator with a second connecting means of an impeller mount;

holding means disposed at a second end of the agitator opposite the first end; securing means configured to be adjusted between a locked position in which the agitator is secured to the impeller mount and an unlocked position allowing movement of the agitator with respect to the impeller mount; and controlling means, towards the second end of the agitator, positioned to facilitate gripping of both the holding means and the controlling means, such that the controlling means is configured to be compressible towards the holding means to transition the securing means from the locked position into the unlocked position.

13. The agitator of claim 12, further comprising biasing means for biasing the securing means into the locked position.

* * * * *